US007766727B2

(12) United States Patent
Mandel et al.

(10) Patent No.: US 7,766,727 B2
(45) **Date of Patent: *Aug. 3, 2010**

(54) TRIBOLOGICAL SURFACE AND LAPPING METHOD AND SYSTEM THEREFOR

(75) Inventors: Kostia Mandel, Netanya (IL); Boris Shamshidov, Or Kaiva (IL); Bela Shteinvas, Ashkelon (IL); Semyon Melamed, Haifa (IL); Sergei Stefanidin, Haifa (IL)

(73) Assignee: Fricso Ltd, Tirat Hacarmel (IL)

( * ) Notice: Subject to any disclaimer, the term of this patent is extended or adjusted under 35 U.S.C. 154(b) by 0 days.

This patent is subject to a terminal disclaimer.

(21) Appl. No.: 11/972,014

(22) Filed: Jan. 10, 2008

(65) Prior Publication Data

US 2008/0227372 A1 Sep. 18, 2008

Related U.S. Application Data

(60) Provisional application No. 60/879,586, filed on Jan. 10, 2007.

(51) Int. Cl.
*B24B 7/00* (2006.01)

(52) U.S. Cl. ..... 451/164; 451/446; 29/898.1; 29/898.14

(58) Field of Classification Search ..... 451/164, 451/446; 427/198; 29/898.1, 898.14
See application file for complete search history.

(56) References Cited

U.S. PATENT DOCUMENTS

| | | | | |
|---|---|---|---|---|
| 3,961,104 | A * | 6/1976 | Tanner | 427/198 |
| 7,134,939 | B2 * | 11/2006 | Shamshidov et al. | 451/36 |
| 2005/0054276 | A1 * | 3/2005 | Shamshidov et al. | 451/36 |
| 2007/0123152 | A1 * | 5/2007 | Shteinvas et al. | 451/11 |
| 2008/0166214 | A1 * | 7/2008 | Mandel et al. | 414/787 |
| 2008/0166950 | A1 * | 7/2008 | Mandel et al. | 451/36 |
| 2008/0166955 | A1 * | 7/2008 | Mandel et al. | 451/164 |

* cited by examiner

*Primary Examiner*—Maurina Rachuba
(74) *Attorney, Agent, or Firm*—Mark M. Friedman

(57) ABSTRACT

A tribological system including: a tribological workpiece having a working surface adapted for moving relative to a counter-surface in a presence of a lubricant, in a load-bearing environment, the working surface for disposing generally opposite the counter-surface, the working surface having: (i) a metal surface layer; (ii) a plurality of organic particles incorporated in the metal surface layer, and (iii) a plurality of inorganic particles incorporated in the working surface, the inorganic particles having a Mohs hardness of at least 8.

25 Claims, 49 Drawing Sheets

FIGURE 2A PRIOR ART
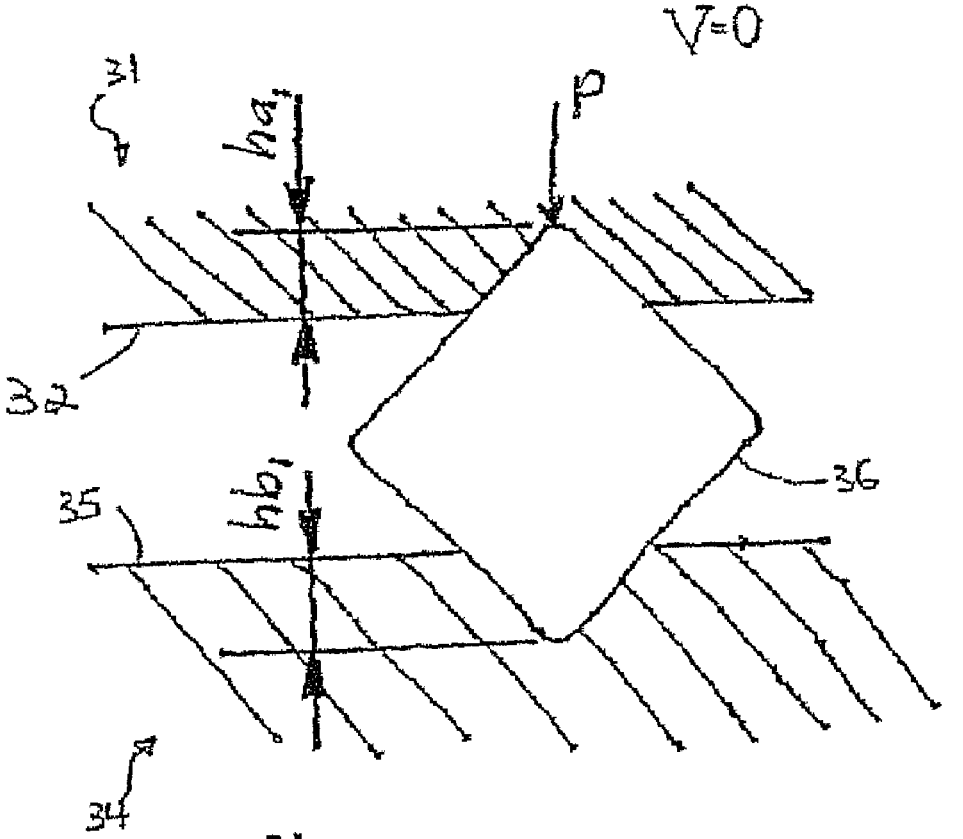
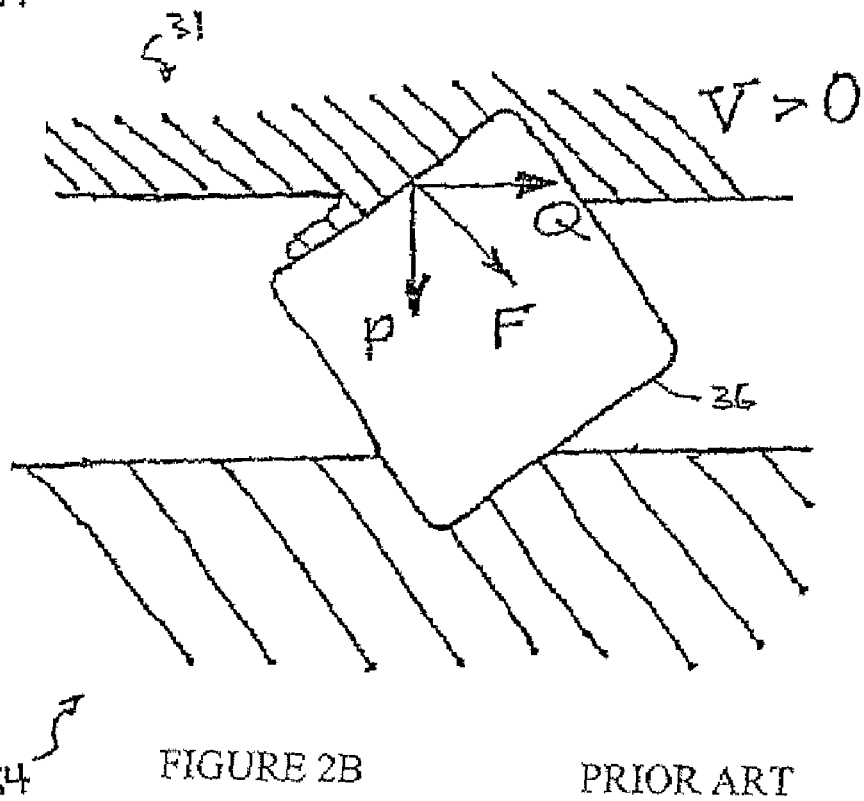
FIGURE 2B PRIOR ART

FIGURE 5
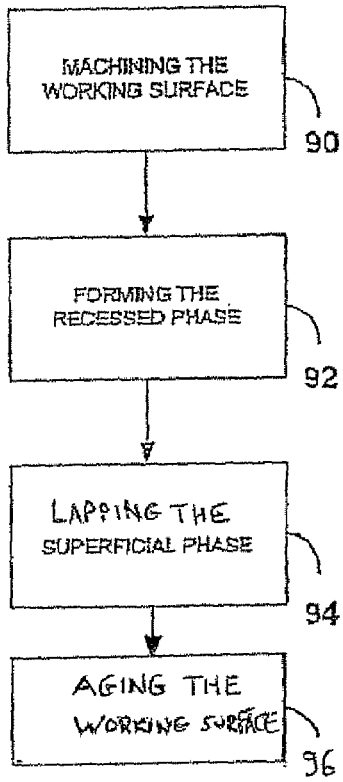
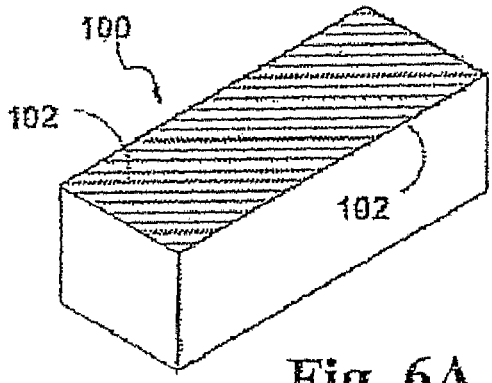
Fig. 6A
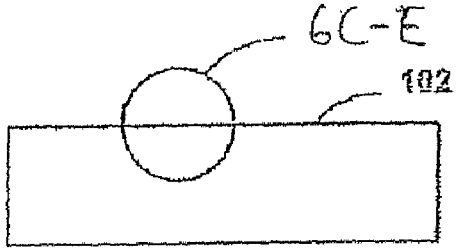
Fig. 6B

FIG. 8C(i)
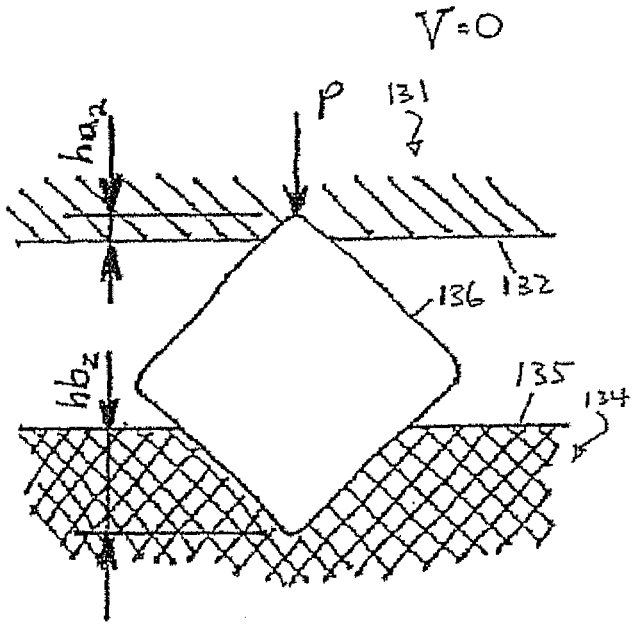
FIG. 8C(ii)
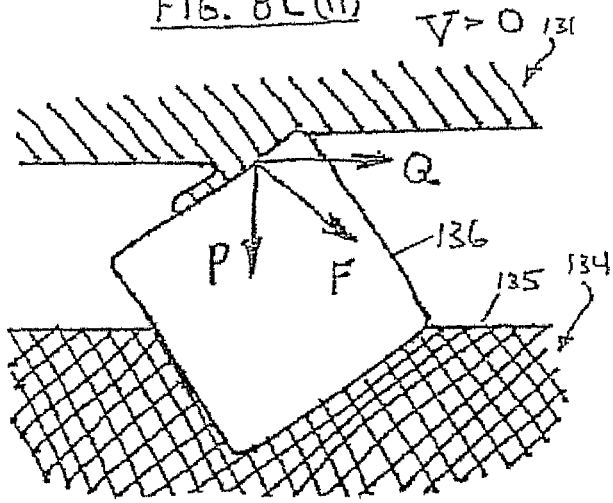
FIG. 8C(iii)
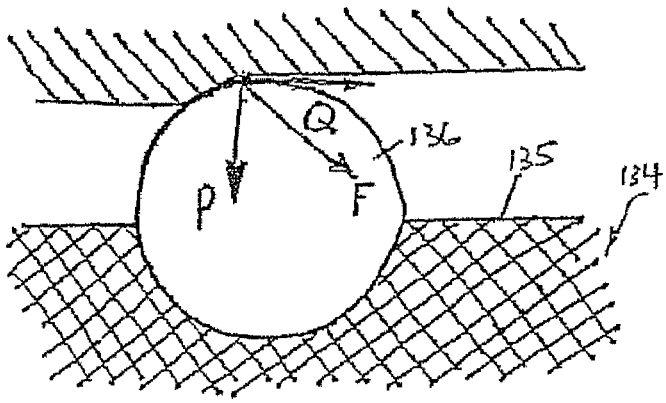

FIGURE 9J
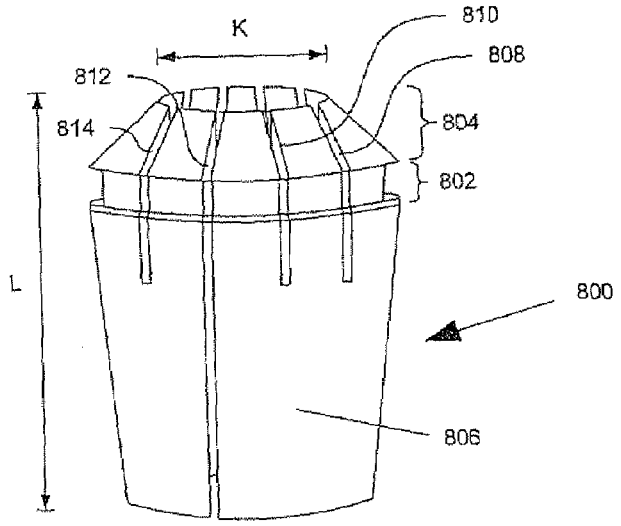
FIGURE 9K
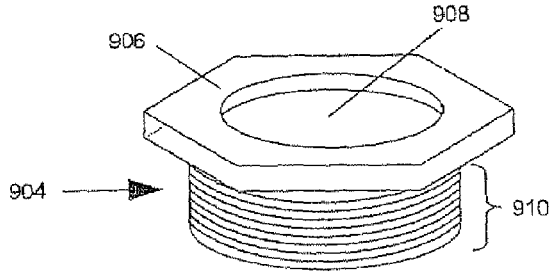
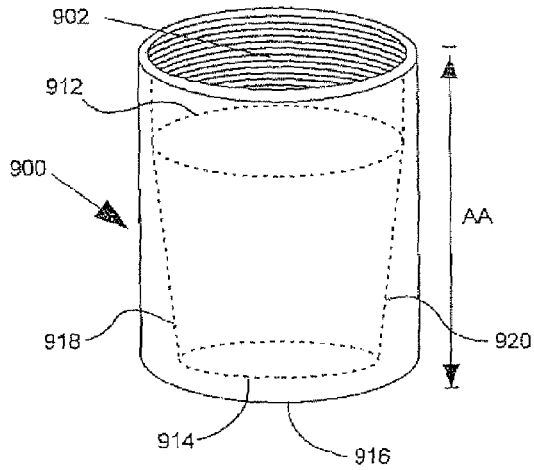
FIGURE 9L
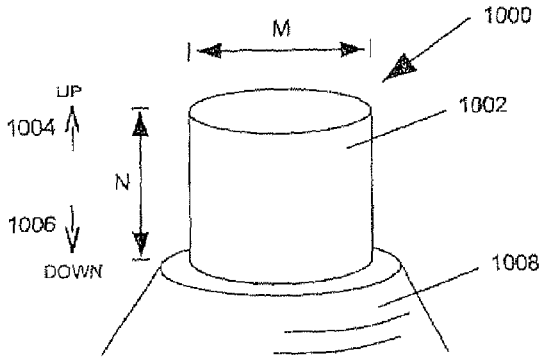

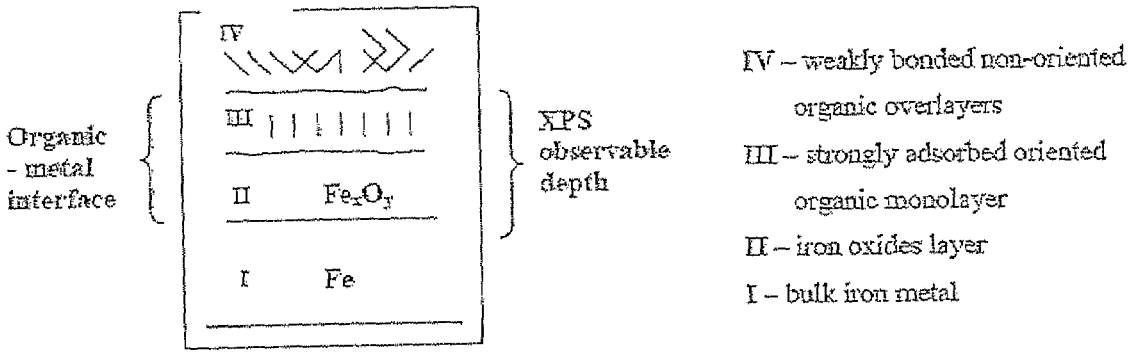
PRIOR ART FIGURE 13
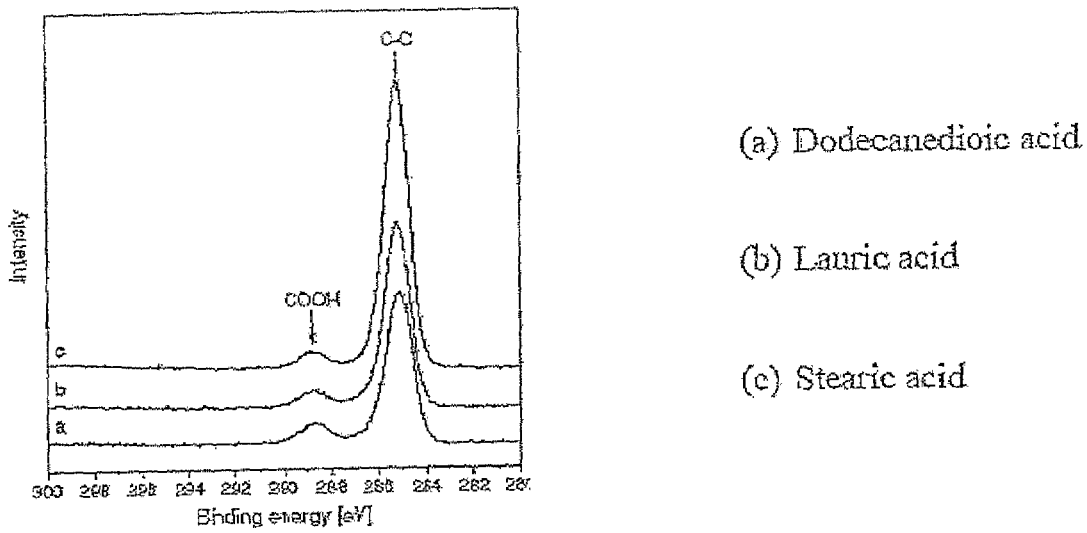
PRIOR ART FIGURE 15

TRIBOLOGICAL SURFACE AND LAPPING METHOD AND SYSTEM THEREFOR

This application draws priority from U.S. Provisional Patent Application Ser. No. 60/879,586, filed Jan. 10, 2007.

FIELD AND BACKGROUND OF THE INVENTION

The present invention relates to improved metal tribological surfaces, and to lapping methods and systems for producing such surfaces.

In order to reduce friction and wear in mechanically interacting surfaces, a lubricant is introduced to the zone of interaction. As depicted schematically in FIG. 1A, under ideal lubricating conditions, the lubricant film 20 between opposing surfaces 32 and 34, moving at a relative velocity V, forms an intact layer which permits the moving surfaces to interact with the lubricant. Under such conditions, no contact between surfaces 32 and 34 occurs at all, and the lubricant layer is said to carry a load P that exists between the opposing surfaces. If the supply of lubricant is insufficient, a redaction in the effectively of the lubrication ensues, which allows surface-to-surface interactions to occur.

As shown schematically in FIG. 1B, below a certain level of lubricant supply, the distance between opposing, relatively moving surfaces 32 and 34 diminishes because of load P, such that surface asperities, i.e., peaks of surface material protruding from the surfaces, may interact. Thus, for example, an asperity 36 of surface 34 can physically contact and interact with an asperity 38 of surface 32. In an extreme condition, the asperities of surfaces 32 and 34 carry all of the load existing between the interacting surfaces. In this condition, often referred to as boundary lubrication, the lubricant is ineffective and the friction and wear are high.

Grinding and lapping are conventional methods of improving surface roughness and for producing working surfaces for, inter alia, various tribological applications. FIGS. 2A and 2B schematically illustrate a working surface being conditioned in a conventional lapping process. In FIG. 2A, a working surface 32 of a workpiece 31 faces a contact surface 35 of lapping tool 34. An abrasive paste containing abrasive particles, of which is illustrated a typical abrasive particle 36, is disposed between working surface 32 and contact surface 35. Contact surface 35 of lapping tool 34 is made of a material having a lower hardness with respect to working surface 32. The composition and size distribution of the abrasive particles are selected so as to readily wear down working surface 32 according to plan, such as reducing surface roughness so as to achieve a pre-determined finish.

A load is exerted in a substantially normal direction to surfaces 32 and 35, causing abrasive particle 36 to penetrate working surface 32 and contact surface 35, and resulting in a pressure P being exerted on a section of abrasive particle 36 that is embedded in working surface 32. The penetration depth of abrasive particle 36 into working surface 32 is designated by $h_{a1}$; the penetration depth of abrasive particle 36 into contact surface 35 is designated by $h_{b1}$. Generally, abrasive particle 36 penetrates into lapping tool 34 to a greater extent than the penetration into workpiece 31, such that $h_{b1} >> h_{a1}$.

In FIG. 2B, workpiece 31 and lapping tool 34 are made to move in a relative velocity V. The pressure P, and relative velocity V of workpiece 31 and lapping tool 34, are of a magnitude such that abrasive particle 36, acting like a knife, gouges out a chip of surface material from workpiece 31.

At low relative velocities, abrasive particle 36 is substantially stationary. Typically, however, and as shown in FIG. 2B, relative velocity V is selected such that a corresponding shear force Q is large. Because the material of lapping tool 34 that is in contact with abrasive particle 36 is substantially unyielding (i.e., of low elasticity) with respect to the particles in the abrasive paste, these particles are usually ground up quite quickly, such that the abrasive paste must be replenished frequently.

In the known art, grinding, lapping, polishing and cutting are carried out on materials such as metals, ceramics, glass, plastic, wood and the like, using bonded abrasives such as grinding wheels, coated abrasives, loose abrasives and abrasive cutting tools. Abrasive particles, the cutting tools of the abrasive process, are naturally occurring or synthetic materials which are generally much harder than the materials which they cut. The most commonly used abrasives in bonded, coated and loose abrasive applications are garnet, alpha alumina, silicon carbide, boron carbide, cubic boron nitride, and diamond. The relative hardness of the materials can be seen from Table 1:

TABLE 1

| Material | Knoop Hardness Number |
|---|---|
| garnet | 1360 |
| alpha-alumina | 2100 |
| silicon carbide | 2480 |
| boron carbide | 2750 |
| cubic boron nitride | 4500 |
| diamond (monocrystalline) | 7000 |

The choice of abrasive is normally dictated by economics, finish desired, and the material being abraded. The above-provided list of abrasive materials is in order of increasing hardness, but is also, coincidentally, in order of increasing cost, with garnet being the least expensive abrasive material and diamond the most expensive.

Generally, a soft abrasive is selected to abrade a soft material and a hard abrasive to abrade harder types of materials in view of the cost of the various abrasive materials. There are, of course, exceptions such as very gummy materials where the harder materials actually cut more efficiently. Furthermore, the harder the abrasive grain, the more material it will remove per unit volume or weight of abrasive. Super-abrasive materials include diamond and cubic boron nitride, both of which are used in a wide variety of applications.

Conventional lapping methods and systems generally have several distinct deficiencies, including:

- The contact surface of the lapping tool is eventually consumed by the abrasive material, requiring replacement. In some typical applications, the contact surface of the lapping tool is replaced after approximately 50 workpieces have been processed.
- The lapping processing must generally be performed in several discrete lapping stages, each stage using an abrasive paste having different physical properties.
- Sensitivity to the properties of the abrasive paste, including paste formulation, hardness of the abrasive particles, and particle size distribution (PSD) of the abrasive particles.
- Sensitivity to various processing parameters in the lapping process.

Various improvements to these conventional lapping methods and systems have been disclosed in U.S. Pat. No. 7,134, 939 to Shamshidov et al., and in U.S. Patent Publication No. 2007/0123152 to Shteinvas et al., both of which applications are assigned to Fricso, Ltd.

These advancements notwithstanding, there is a recognized need for, and it would be highly advantageous to have workpieces and tribological systems having metal working surfaces that exhibit improved tribological properties. It would be of further advantage to have a lapping method and system that overcome various deficiencies of the known lapping technologies, and that produce such improved metal working surfaces.

SUMMARY OF THE INVENTION

According to the teachings of the present invention there is provided a tribological system including: a tribological workpiece having a working surface adapted to move relative to a counter-surface in a presence of a lubricant, in a load-bearing environment, the working surface adapted to be disposed generally opposite the counter-surface, the working surface having: (i) a metal surface layer; (ii) a plurality of organic particles incorporated in the metal surface layer, and (iii) a plurality of inorganic particles incorporated in the working surface, the inorganic particles having a Mohs hardness of at least 8.

According to another aspect of the present invention there is provided a tribological system including: a tribological workpiece having a working surface adapted to move relative to a counter-surface in a presence of a lubricant, in a load-bearing environment, the working surface adapted to be disposed generally opposite the counter-surface, the working surface having: (i) a metal surface layer; (ii) a plurality of organic particles incorporated in the metal surface layer, and (iii) a plurality of inorganic particles incorporated in the working surface, the inorganic particles having a Mohs hardness of at least 8, wherein a combined coverage density of the organic particles and the inorganic particles on the working surface is at least 1%.

According to yet another aspect of the present invention there is provided a tribological system including: a tribological workpiece having a working surface adapted to move relative to a counter-surface in a presence of a lubricant, in a load-bearing environment, the working surface adapted to be disposed generally opposite the counter-surface, the working surface having: (i) a metal surface layer; (ii) a plurality of organic particles intimately bonded to the metal surface layer, and (iii) a plurality of inorganic particles incorporated in the working surface, the inorganic particles having a Mohs hardness of at least 8, wherein the inorganic particles have a population density of at least 10,000 particles per square millimeter.

According to further features in the described preferred embodiments, the inorganic particles are selected from the group of abrasive particles consisting of corundum, alumina, silicon carbide, and boron carbide.

According to further features in the described preferred embodiments, the inorganic particles include alumina particles.

According to further features in the described preferred embodiments, the alumina particles include fused alumina particles.

According to further features in the described preferred embodiments, the working surface is a steel.

According to further features in the described preferred embodiments, the metal working surface has a Rockwell C hardness of at least 20.

According to further features in the described preferred embodiments, the metal working surface has a Rockwell C hardness of at least 50.

According to further features in the described preferred embodiments, the inorganic particles have a population density of at least 10,000 particles per square millimeter.

According to further features in the described preferred embodiments, the inorganic particles have a population density of at least 50,000 particles per square millimeter.

According to further features in the described preferred embodiments, the organic particles are intimately bonded to the metal surface layer.

According to further features in the described preferred embodiments, the organic particles are sufficiently bonded to the metal surface layer so as to remain incorporated in the metal surface layer after subjection to a vacuum of $10^{-10}$ torr for five minutes.

According to further features in the described preferred embodiments, at least a portion of the inorganic particles are incorporated in the organic particles.

According to further features in the described preferred embodiments, at least a portion of the organic particles form a nanolayer on the working surface.

According to further features in the described preferred embodiments, at least a portion of the inorganic particles are incorporated in the nanolayer on the working surface.

According to further features in the described preferred embodiments, at least a portion of the inorganic particles is at least partially covered by the organic particles.

According to further features in the described preferred embodiments, at least a portion of the inorganic particles is at least partially covered by the nanolayer.

According to further features in the described preferred embodiments, at least a portion of the inorganic particles is completely covered by the nanolayer.

According to further features in the described preferred embodiments, the inorganic particles have a Mohs hardness of at least 8.5.

According to further features in the described preferred embodiments, the organic particles have a coverage density of at least 0.1%.

According to further features in the described preferred embodiments, the inorganic particles have a coverage density of at least 0.1%.

According to further features in the described preferred embodiments, the organic particles have a coverage density of at least 0.1%, the inorganic particles have a coverage density of at least 0.1%, and a combined coverage density of the organic particles and the inorganic particles is at least 1%.

According to further features in the described preferred embodiments, the organic particles and the inorganic particles have a combined coverage density of at least 1%.

According to further features in the described preferred embodiments, within an area having the population density, at least 90% of the inorganic particles have a diameter of less than 1000 nanometers.

According to further features in the described preferred embodiments, at least 90% of the inorganic particles have a diameter of less than 300 nanometers.

According to further features in the described preferred embodiments, at least 50% of the inorganic particles have a diameter of less than 100 nanometers.

According to further features in the described preferred embodiments, within an area having the coverage density, at least 90% of the inorganic particles have a diameter of less than 1000 nanometers.

According to further features in the described preferred embodiments, at least 90% of the inorganic particles have a diameter of less than 300 nanometers.

According to further features in the described preferred embodiments, at least 50% of the inorganic particles have a diameter of less than 100 nanometers.

According to further features in the described preferred embodiments, the metal surface layer includes a plurality of recessed microstructures.

According to further features in the described preferred embodiments, the working surface includes at least 0.5% iron, by weight.

According to further features in the described preferred embodiments, the tribological system further includes the counter-surface, the lubricant, and at least one mechanism, associated with at least one of the working surface and the second surface, the mechanism adapted to apply a relative motion between the surfaces, and to exert a load on the surfaces.

According to further features in the described preferred embodiments, the tribological system further includes the counter-surface, the lubricant, and at least one mechanism, associated with at least one of the working surface and the second surface, the mechanism adapted to apply a relative motion between the surfaces, and to exert a load of at least 0.01 MPa on the surfaces.

According to further features in the described preferred embodiments, the tribological system further includes the counter-surface, the lubricant, and at least one mechanism, associated with at least one of the working surface and the second surface, the mechanism adapted to apply a relative motion between the surfaces, and to exert a load of at least 0.1 MPa on the surfaces.

According to further features in the described preferred embodiments, the tribological system further includes the counter-surface, the lubricant, and at least one mechanism, associated with at least one of the working surface and the second surface, the mechanism adapted to apply a relative motion between the surfaces, and to exert a load of at least 0.5 MPa on the surfaces.

According to further features in the described preferred embodiments, the average roughness (Ra) of the working surface is at least 0.012 microns.

According to further features in the described preferred embodiments, the average roughness (Ra) of the working surface is at least 0.015 microns.

According to further features in the described preferred embodiments, the average roughness (Ra) of the working surface is at least 0.02 microns.

According to further features in the described preferred embodiments, the average roughness (Ra) of the working surface is at least 0.03 microns.

According to further features in the described preferred embodiments, the plurality of inorganic particles is incorporated in a predominant phase of the working surface.

According to further features in the described preferred embodiments, the plurality of inorganic particles is incorporated in a metallic phase of the working surface.

According to further features in the described preferred embodiments, the plurality of inorganic particles is incorporated in a phase of the working surface, the phase having a Mohs hardness exceeding 2.0.

According to further features in the described preferred embodiments, the plurality of inorganic particles is incorporated in a phase of the working surface, the phase having a Mohs hardness of at least 2.5.

According to further features in the described preferred embodiments, the plurality of inorganic particles is incorporated in a phase of the working surface, the phase having a Mohs hardness of at least 3.5.

According to further features in the described preferred embodiments, the tribological workpiece is intrinsically adapted to bear a load of at least 0.01 MPa.

According to further features in the described preferred embodiments, the working surface is intrinsically adapted to bear a load of at least 0.03 MPa.

According to further features in the described preferred embodiments, the working surface is intrinsically adapted to bear a load of at least 0.08 MPa.

According to further features in the described preferred embodiments, the working surface is intrinsically adapted to bear a load of at least 0.1 MPa.

According to further features in the described preferred embodiments, the organic particles are sufficiently bonded to the metal surface layer so as to remain incorporated in the metal surface layer after subjection to a procedure including: immersing the working surface in a bath filled with ethanol, and subsequently subjecting the working surface, immersed in the ethanol, to ultrasonic treatment for at least one minute; washing the working surface in a stream of ethanol; wiping the working surface with a cloth soaked in ethanol, and subjecting the working surface to a vacuum of at least $10^{-9}$ torr for at least 5 minutes.

According to further features in the described preferred embodiments, the working surface is subjected to a vacuum of at least $10^{-10}$ torr for at least 5 minutes.

According to further features in the described preferred embodiments, the inorganic particles are sufficiently affixed to the working surface so as to remain incorporated in the metal surface layer after subjection to a procedure including: immersing the working surface in a bath filled with ethanol, and subsequently subjecting the working surface, immersed in the ethanol, to ultrasonic treatment for at least one minute; washing the working surface in a stream of ethanol; wiping the working surface with a cloth soaked in ethanol, and subjecting the working surface to a vacuum of at least $10^{-9}$ torr for at least 5 minutes.

According to further features in the described preferred embodiments, the working surface includes at least 10% iron, by weight.

According to further features in the described preferred embodiments, the tribological system is disposed in a hydraulic system.

According to further features in the described preferred embodiments, the tribological system is disposed in an internal combustion engine.

According to further features in the described preferred embodiments, the tribological system is disposed in a sliding friction application.

According to further features in the described preferred embodiments, at least 90% of the inorganic particles have a diameter of less than 1000 nanometers.

According to yet another aspect of the present invention there is provided a method of operating a tribological system including (a) providing a workpiece having a tribological working surface, the working surface including: (i) a metal surface layer; (ii) a plurality of organic particles incorporated in the metal surface layer, and (iii) a plurality of inorganic particles incorporated in the working surface, the inorganic particles having a Mohs hardness of at least 8; (b) providing a counter-surface disposed opposite the working surface; (c) disposing a lubricant between the working surface and the counter-surface; (d) providing at least one mechanism, associated with at least one of the working surface and the second surface, for applying a relative motion between the surfaces, and for exerting a load on the surfaces, the surfaces, the lubricant, and the at least one mechanism forming the tribological system; (e) exerting the load on the working surface and the counter-surface, and (f) applying a relative motion between the working surface and the counter-surface.

According to further features in the described preferred embodiments, the organic particles are intimately bonded to the metal surface layer.

According to further features in the described preferred embodiments, at least a portion of the inorganic particles is incorporated in the organic particles.

According to further features in the described preferred embodiments, at least a portion of the organic particles form a nanolayer on the working surface.

According to further features in the described preferred embodiments, at least a portion of the inorganic particles is incorporated in the nanolayer on the working surface.

According to further features in the described preferred embodiments, at least a portion of the inorganic particles is at least partially covered by the organic particles.

According to further features in the described preferred embodiments, at least a portion of the inorganic particles is at least partially covered by the nanolayer.

According to further features in the described preferred embodiments, the organic particles have a coverage density of at least 0.1%.

According to further features in the described preferred embodiments, the inorganic particles have a coverage density of at least 0.1%.

According to further features in the described preferred embodiments, the organic particles have a coverage density of at least 0.1%, the inorganic particles have a coverage density of at least 0.1%, and a combined coverage density of the organic particles and the inorganic particles is at least 1%.

According to further features in the described preferred embodiments, the organic particles and the inorganic particles have a combined coverage density of at least 1%.

According to further features in the described preferred embodiments, the population density, at least 90% of the inorganic particles have a diameter of less than 1000 nanometers.

According to further features in the described preferred embodiments, at least 90% of the inorganic particles have a diameter of less than 500 nanometers.

According to further features in the described preferred embodiments, at least 50% of the inorganic particles have a diameter of less than 100 nanometers.

According to further features in the described preferred embodiments, the coverage density, at least 90% of the inorganic particles have a diameter of less than 1000 nanometers.

According to further features in the described preferred embodiments, the plurality of inorganic particles is incorporated in a predominant phase of the working surface.

According to further features in the described preferred embodiments, the plurality of inorganic particles is incorporated in a metallic phase of the working surface.

According to further features in the described preferred embodiments, the working surface is a multiple-phase surface having at least a first phase and a second phase, wherein the first phase is a harder phase with respect to the second phase, and wherein the plurality of inorganic particles is incorporated in the first phase.

According to yet another aspect of the present invention there is provided a method of operating a tribological system including: (a) providing a workpiece having a tribological working surface, the working surface including: (i) a metal surface layer; (ii) a plurality of organic particles incorporated in the metal surface layer, and (iii) a plurality of inorganic particles incorporated in the working surface, the inorganic particles having a Mohs hardness of at least 8; (b) providing a counter-surface disposed opposite the working surface; (c) disposing a lubricant between the working surface and the counter-surface; (d) providing at least one mechanism, associated with at least one of the working surface and the second surface, for applying a relative motion between the surfaces, and for exerting a load on the surfaces, the surfaces, the lubricant, and the at least one mechanism forming the tribological system; (e) exerting the load between the working surface and the counter-surface, and (f) applying a relative motion between the working surface and the counter-surface, wherein the organic particles and the inorganic particles have a combined coverage density of at least 0.5%.

According to yet another aspect of the present invention there is provided a method of operating a tribological system including: (a) providing a workpiece having a tribological working surface, the working surface including: (i) a metal surface layer; (ii) a plurality of inorganic particles incorporated in the working surface, the inorganic particles having a Mohs hardness of at least 8; (b) providing a counter-surface disposed opposite the working surface; (c) disposing a lubricant between the working surface and the counter-surface; (d) providing at least one mechanism, associated with at least one of the working surface and the second surface, for applying a relative motion between the surfaces, and for exerting a load on the surfaces, the surfaces, the lubricant, and the at least one mechanism forming the tribological system; (e) exerting the load between the working surface and the counter-surface, and (f) applying a relative motion between the working surface and the counter-surface, wherein the inorganic particles have a population density of at least 10,000 particles per square millimeter.

According to yet another aspect of the present invention there is provided a mechanical system for lapping a workpiece having a metal working surface, the system including: (a) a workpiece having the metal working surface; (b) a lapping tool having a contact surface, the tool and the contact surface adapted wherein the contact surface is disposed generally opposite the working surface, the contact surface including an organic, polymeric material; (c) a plurality of particles, including abrasive particles, the abrasive particles freely disposed between the contact surface and the working surface, and (d) a mechanism, associated with at least one of the working surface and the contact surface, adapted to apply a relative motion between the contact surface and the metal working surface, and to exert a load on the contact surface and the working surface the contact surface for providing an at least partially elastic interaction with the plurality of abrasive particles, and wherein the contact surface and the mechanism are adapted, and the plurality of particles is selected, such that upon activation of the mechanism, the relative motion under the load effects: (i) lapping of the metal working surface, and (ii) incorporation of particles into the metal working surface.

According to further features in the described preferred embodiments, the contact surface has a Shore D hardness within a range of 40-90.

According to further features in the described preferred embodiments, the Shore D hardness is within a range of 60-90.

According to further features in the described preferred embodiments, the Shore D hardness is within a range of 65-90, and wherein the impact resistance is within a range of 4-12 $kJ/m^2$.

According to further features in the described preferred embodiments, the Shore D hardness is within a range of 68-82.

According to further features in the described preferred embodiments, the Shore D hardness is within a range of 68-82, and wherein the impact resistance is within a range of 5-8 $kJ/m^2$.

According to further features in the described preferred embodiments, the abrasive particles are freely disposed between the contact surface and the working surface.

According to further features in the described preferred embodiments, the polymeric material includes an epoxy material.

According to further features in the described preferred embodiments, the polymeric material includes polyurethane.

According to further features in the described preferred embodiments, the composition of the contact surface includes an epoxy material and polyurethane in a weight ratio of 25:75 to 90:10.

According to further features in the described preferred embodiments, the composition of the contact surface includes polyurethane in a range of 3% to 75%, by weight.

According to further features in the described preferred embodiments, the contact surface and the mechanism are further designed and configured, and the plurality of particles is selected, such that the incorporation provides an organic nanolayer intimately bonded to at least a portion of the metal working surface.

According to further features in the described preferred embodiments, the contact surface and the mechanism are further designed and configured, and the plurality of particles is selected, such that upon activation of the mechanism, the relative motion under the load effects: (iii) incorporation of a portion of the abrasive particles into the metal working surface.

According to further features in the described preferred embodiments, the contact surface and the mechanism are further designed and configured, and the plurality of particles is selected, such that upon activation of the mechanism, the relative motion under the load effects: (iii) incorporation of a portion of the abrasive particles into the organic nanolayer.

According to further features in the described preferred embodiments, the contact surface is disposed on a lapping tool.

According to further features in the described preferred embodiments, the lapping tool has a leading device associated therewith, the leading device for effecting an engagement of the lapping tool.

According to further features in the described preferred embodiments, the leading device is associated with the lapping tool so as to provide the lapping tool with at least one degree of freedom of movement with respect to the metal working surface.

According to further features in the described preferred embodiments, the lapping tool has an internal tube for delivering a working agent from an external supply to a volume between the contact surface and the working surface.

According to further features in the described preferred embodiments, the organic nanolayer has an average thickness of less than 25 nanometers.

According to further features in the described preferred embodiments, the organic nanolayer has an average thickness of less than 15 nanometers.

According to further features in the described preferred embodiments, the organic nanolayer has an average thickness of less than 10 nanometers.

According to further features in the described preferred embodiments, the metal working surface has a Rockwell C hardness of at least 20.

According to further features in the described preferred embodiments, the abrasive particles are freely disposed between the contact surface and the working surface in an abrasive paste.

According to further features in the described preferred embodiments, the pH of the abrasive paste is between 6 and 8.

According to yet another aspect of the present invention there is provided a mechanical system for lapping a metal working surface, the system including: (a) a workpiece having the metal working surface; (b) a lapping tool having a contact surface, the contact surface disposed generally opposite the working surface, the contact surface including an organic, polymeric material; (c) a plurality of particles, including abrasive particles, the abrasive particles disposed between the contact surface and the working surface, and (d) a mechanism, associated with at least one of the working surface and the contact surface, adapted to apply a relative motion between the contact surface and the metal working surface, and to exert a load on said contact surface and the working surface, said contact surface adapted to provide an at least partially elastic interaction with said plurality of abrasive particles, and wherein said contact surface and said mechanism are adapted, and said plurality of particles is selected, such that upon activation of said mechanism, said relative motion under said load effects: (i) lapping of the metal working surface, and (ii) incorporation of inorganic particles into the metal working surface, said inorganic particles having a Mohs hardness of at least 8.

According to yet another aspect of the present invention there is provided a conditioning process including: (a) providing a system including: (i) a workpiece having a metal working surface; (ii) a contact surface, disposed generally opposite the working surface, the contact surface including an organic, polymeric material and (iii) a plurality of particles, including abrasive particles, the plurality of particles disposed between the contact surface and the working surface, and (b) treating the workpiece so as to: (i) effect an at least partially elastic interaction between the contact surface and the abrasive particles such that at least a portion of the abrasive particles penetrate the working surface, and (ii) incorporate organic particles into the metal working surface, thereby producing a modified working surface, wherein the treating of the workpiece includes a lapping process including: (i) exerting a load on the contact surface and the metal working surface, and (ii) applying a relative motion between the metal working surface and the contact surface.

According to further features in the described preferred embodiments, the treating further includes aging the modified metal working surface such that the organic particles are incorporated in the metal working surface.

According to further features in the described preferred embodiments, the aging is effected in an oxygen-rich environment.

According to further features in the described preferred embodiments, the treating further includes aging the modified metal working surface such that the organic particles intimately bond to the metal working surface.

According to further features in the described preferred embodiments, the conditioning process further includes the step of: (c) producing at least one recessed microstructure in the metal working surface.

According to further features in the described preferred embodiments, the organic particles are derived from the organic material on the contact surface.

According to further features in the described preferred embodiments, the treating is effected so as to incorporate at least a portion of the abrasive particles in the working surface.

According to yet another aspect of the present invention there is provided a conditioning process including the steps of: (a) providing a system including: (i) a workpiece having a metal working surface; (ii) a contact surface, disposed generally opposite the working surface, the contact surface including an organic, polymeric material and (iii) a plurality of particles, including abrasive particles, the plurality of particles disposed between the contact surface and the working surface, and (b) treating the workpiece so as to: (i) effect an at least partially elastic interaction between the contact surface and the abrasive particles such that at least a portion of the abrasive particles penetrate the working surface, and (ii) incorporate organic particles into the metal working surface, thereby producing a modified working surface, wherein the treating of the workpiece includes a lapping process including: (i) exerting a load on the contact surface and the metal working surface, and (ii) applying a relative motion between the metal working surface and the contact surface, and wherein the treating of the workpiece further includes aging the modified metal working surface such that the organic particles are incorporated in the metal working surface.

According to further features in the described preferred embodiments, at least a portion of the organic particles is derived from the organic, polymeric material on the contact surface.

According to further features in the described preferred embodiments, the aging is performed so as to increase a ratio of polar bonds to non-polar bonds in the working surface.

According to further features in the described preferred embodiments, the workpiece is prepared substantially according to the processes disclosed herein.

According to yet another aspect of the present invention there is provided a conditioning process including: (a) providing a system including: (i) a workpiece having an initial metal working surface; (ii) a contact surface, disposed generally opposite the working surface, the contact surface including an organic, polymeric material and (iii) a plurality of particles, including abrasive particles, the plurality of particles disposed between the contact surface and the working surface, and (b) treating the workpiece so as to: (i) effect an at least partially elastic interaction between the contact surface and the abrasive particles such that at least a portion of the abrasive particles penetrate the working surface, and (ii) incorporate abrasive particles into the metal working surface, thereby producing a modified working surface, wherein the treating of the workpiece includes a lapping process including: (i) exerting a load on the contact surface and the metal working surface, and (ii) applying a relative motion between the metal working surface and the contact surface, and wherein the abrasive particles have a Mohs hardness of at least 8.

According to further features in the described preferred embodiments, the abrasive particles have an average particle size of at least 3 microns.

According to further features in the described preferred embodiments, the abrasive particles have an average particle size of at least 4 microns.

According to further features in the described preferred embodiments, the abrasive particles have an average particle size of at least 5 microns.

According to further features in the described preferred embodiments, the abrasive particles have an average particle size of at least 8 microns.

According to further features in the described preferred embodiments, the abrasive particles are disposed in an abrasive paste.

According to further features in the described preferred embodiments, the abrasive paste is an organic-based paste.

According to further features in the described preferred embodiments, the abrasive paste is a hydrophobic paste.

According to further features in the described preferred embodiments, the abrasive paste has a pH between 2 and 12.

According to further features in the described preferred embodiments, the abrasive paste has a pH between 4 and 10.

According to further features in the described preferred embodiments, the abrasive paste has a pH between 2 and 4.

According to further features in the described preferred embodiments, the abrasive paste has a pH between 4 and 6.

According to further features in the described preferred embodiments, the abrasive paste has a pH between 6 and 8.

According to further features in the described preferred embodiments, the abrasive paste has a pH between 8 and 10.

According to further features in the described preferred embodiments, the abrasive paste has a pH between 10 and 12.

According to further features in the described preferred embodiments, the contact pressure between the tool and the working surface is at least 0.01 MPa.

According to further features in the described preferred embodiments, the contact pressure between the tool and the working surface is at least 0.04 MPa.

According to further features in the described preferred embodiments, the workpiece is a metallic workpiece.

According to yet another aspect of the present invention there is provided a mechanical system for lapping a metal working surface, the system including: (a) a workpiece having the metal working surface, the working surface having a substantially cylindrical form; (b) a lapping tool having a contact surface, the contact surface disposed generally opposite the working surface, the contact surface including an organic, polymeric material; (c) a plurality of particles, including abrasive particles, the abrasive particles disposed between the contact surface and the working surface, and (d) a mechanism, associated with at least one of the working surface and the contact surface, adapted to apply a relative motion between the contact surface and the metal working surface, and to exert a load on the contact surface and the working surface, the contact surface for providing an at least partially elastic interaction with the plurality of abrasive particles, and wherein the contact surface and the mechanism are designed and configured, and the plurality of particles is selected, such that upon activation of the mechanism, the relative motion under the load effects: (i) lapping of the metal working surface, and (ii) incorporation of inorganic particles into the metal working surface, the inorganic particles having a Mohs hardness of at least 8, and wherein the working surface is disposed along an outside diameter of the substantially cylindrical form.

According to further features in the described preferred embodiments, the contact surface of the lapping tool has a concavity that at least partially conforms to the substantially cylindrical form.

According to further features in the described preferred embodiments, the workpiece includes a tribological element selected from the group of tribological elements consisting of piston pins, poppet valves, hydraulic pistons, sliding bearings, and rollers of roller bearings.

According to further features in the described preferred embodiments, the mechanical system further includes (e) a tubing system including a tube adapted to deliver a fluid working agent containing the plurality of particles to a lapping tool working space disposed between the contact surface of the lapping tool and the metal working surface.

According to further features in the described preferred embodiments, the fluid communication path fluidly connects, at a first end, to a reservoir, and at a second end, to a lapping tool working space, the path adapted to receive the working agent from the reservoir, and to deliver the working agent into the working space.

According to further features in the described preferred embodiments, the fluid communication path passes through a wall of the lapping tool.

According to further features in the described preferred embodiments, the fluid communication path is adapted to deliver the working agent into the working space via an opening in the contact surface.

According to further features in the described preferred embodiments, the contact surface envelops more than half of a circumference of the substantially cylindrical form.

According to further features in the described preferred embodiments, the lapping tool envelops more than half of a circumference of the substantially cylindrical form.

According to further features in the described preferred embodiments, the lapping tool has at least one slot running in a generally longitudinal fashion, the at least one slot adapted to impart flexibility to the lapping tool.

According to further features in the described preferred embodiments, at least a portion of the mechanism has a substantially cylindrical form, the mechanism further adapted to envelop the lapping tool and to exert the load on the metal working surface, via a wall of the lapping tool.

According to further features in the described preferred embodiments, the workpiece includes a tribological element selected from the group of tribological elements consisting of piston pins, poppet valves, hydraulic pistons, sliding bearings, and rollers of roller bearings.

According to further features in the described preferred embodiments, on the substantially cylindrical form is disposed at least one recessed surface region selected from the group consisting of grooves, depressions, cogs and prongs.

According to further features in the described preferred embodiments, the workpiece includes a rack-and-pinion steering element.

According to further features in the described preferred embodiments, the workpiece includes a trunnion.

According to further features in the described preferred embodiments, the contact surface envelops more than half of a circumference of the substantially cylindrical form, and wherein the workpiece has at least a second portion having a diameter that exceeds an inner diameter of the contact surface.

According to yet another aspect of the present invention there is provided a mechanical system for lapping a metal working surface, the system including: (a) the metal working surface, disposed on an inner surface of a workpiece, the metal working surface forming and bounding a substantially cylindrical hollow volume; (b) a lapping tool having a contact surface, the contact surface disposed generally within the hollow volume and generally opposite the working surface, the contact surface including an organic, polymeric material; (c) a plurality of particles, including abrasive particles, the abrasive particles disposed between the contact surface and the working surface, and (d) a mechanism, associated with at least one of the working surface and the contact surface, adapted to apply a relative motion between the contact surface and the metal working surface, and to exert a load on the contact surface and the working surface, the contact surface for providing an at least partially elastic interaction with the plurality of abrasive particles, and wherein the contact surface and the mechanism are designed and configured, and the plurality of particles is selected, such that upon activation of the mechanism, the relative motion under the load effects: (i) lapping of the metal working surface, and (ii) incorporation of inorganic particles into the metal working surface, the inorganic particles having a Mohs hardness of at least 8.

According to further features in the described preferred embodiments, the lapping tool has at least one slot running in a generally longitudinal fashion, the at least one slot adapted to impart flexibility to the lapping tool.

According to further features in the described preferred embodiments, at least a portion of the mechanism has a substantially cylindrical form, the mechanism further adapted to envelop an outer surface of the workpiece and to exert the load on the metal working surface and the contact surface, via the outer surface of the workpiece.

According to further features in the described preferred embodiments, the mechanical system further includes: (e) a wedge element, disposed within the lapping tool, the wedge element adapted to exert a load on the metal working surface, via an inside wall of the lapping tool.

According to further features in the described preferred embodiments, the contact surface of the lapping tool has a substantially cylindrical forms.

According to further features in the described preferred embodiments, the workpiece includes a tribological element selected from the group of tribological elements consisting of a rocker roller and an outer ring of a sliding bearing.

According to further features in the described preferred embodiments, the lapping tool is a spider having a shaft and at least two pads, each having the contact surface, and wherein the mechanism is adapted to act upon the shaft to achieve the relative motion between the contact surface and the metal working surface.

According to further features in the described preferred embodiments, the pads are adapted to at least partially retract towards the shaft.

According to further features in the described preferred embodiments, the workpiece includes a tribological element selected from the group of tribological elements consisting of a cylinder, a cylinder sleeve, and an outer ring of a sliding bearing.

According to yet another aspect of the present invention there is provided a mechanical system for lapping a metal working surface, the system including: (a) a workpiece having the metal working surface, the workpiece having a substantially conical section; (b) a lapping tool having a contact surface, the contact surface disposed generally opposite at least a portion of the working surface, the contact surface including an organic, polymeric material; (c) a plurality of particles, including abrasive particles, the abrasive particles disposed between the contact surface and the working surface, and (d) a mechanism, associated with at least one of the working surface and the contact surface, adapted to apply a relative motion between the contact surface and the metal working surface, and to exert a load on the contact surface and the working surface, the contact surface for providing an at least partially elastic interaction with the plurality of abrasive particles, and wherein the contact surface and the mechanism are designed and configured, and the plurality of particles is selected, such that upon activation of the mechanism, the relative motion under the load effects: (i) lapping of the metal working surface, and (ii) incorporation of inorganic particles into the metal working surface, the inorganic particles having a Mohs hardness of at least 8, and wherein at least a portion of the working surface is disposed along an outside diameter of the conical section.

According to further features in the described preferred embodiments, the lapping tool includes a rotating disk adapted to rotate about an axis thereof, and wherein the contact surface includes a face of the disk.

According to further features in the described preferred embodiments, the mechanism and the workpiece are adapted wherein the conical section rotates about a longitudinal axis thereof.

According to further features in the described preferred embodiments, the workpiece includes a variable-diameter pulley in a continuously variable transmission.

According to yet another aspect of the present invention there is provided a mechanical system for lapping a metal working surface, the system including: (a) a workpiece having the metal working surface, the metal working surface having a concavity; (b) a lapping tool having a contact surface disposed generally opposite at least a portion of the concavity, the contact surface including an organic, polymeric material; (c) a plurality of particles, including abrasive particles, the abrasive particles disposed between the contact surface and the working surface, and (d) a mechanism, associated with at least one of the working surface and the contact surface, adapted to apply a relative motion between the contact surface and the metal working surface, and to exert a load on the contact surface and the working surface, the contact surface for providing an at least partially elastic interaction with the plurality of abrasive particles, and wherein the contact surface and the mechanism are designed and configured, and the plurality of particles is selected, such that upon activation of the mechanism, the relative motion under the load effects: (i) lapping of the metal working surface, and (ii) incorporation of inorganic particles into the metal working surface, the inorganic particles having a Mohs hardness of at least 8.

According to further features in the described preferred embodiments, the lapping tool has a convex area on which is situated the contact surface.

According to further features in the described preferred embodiments, the mechanism is adapted to rotate the lapping tool about an axis thereof, to achieve the relative motion.

According to further features in the described preferred embodiments, the concavity is at least a portion of a surface area of a socket.

According to further features in the described preferred embodiments, the socket is a socket of an artificial ball-and-socket joint implant.

According to further features in the described preferred embodiments, the socket is a socket of a rocker arm.

According to further features in the described preferred embodiments, the lapping tool substantially has a shape of a cup, and wherein the contact surface is disposed at least on a portion of a rim of the cup.

According to further features in the described preferred embodiments, the mechanism is further adapted to effect an angle of between zero (0) and ninety (90) degrees between the contact surface and a general direction of the metal working surface, to produce a lapped, concave surface.

According to further features in the described preferred embodiments, the mechanism is adapted wherein at least one of said lapping tool and said workpiece rotates about its axis, to achieve said relative motion.

According to further features in the described preferred embodiments, the lapping tool is disposed relative to said workpiece, wherein said organic, polymeric material on said rim contacts said concavity on the metal working surface, to effect said lapping and said incorporation of said inorganic particles into the metal working surface.

According to yet another aspect of the present invention there is provided a mechanical system for lapping a metal working surface, the system including: (a) a workpiece having the metal working surface; (b) a lapping tool having a contact surface disposed generally opposite the metal working surface, the contact surface including an organic, polymeric material; (c) a plurality of particles, including abrasive particles, the abrasive particles disposed between the contact surface and the working surface, and (d) a mechanism, associated with at least one of the working surface and the contact surface, adapted to apply a relative motion between the contact surface and the metal working surface, and to exert a load on the contact surface and the working surface, the contact surface for providing an at least partially elastic interaction with the plurality of abrasive particles, and wherein the contact surface and the mechanism are designed and configured, and the plurality of particles is selected, such that upon activation of the mechanism, the relative motion under said load effects: (i) lapping of the metal working surface, and (ii) incorporation of inorganic particles into the metal working surface, said inorganic particles having a Mohs hardness of at least 8, and wherein said mechanism is further adapted to effect an angle of between zero (0) and ninety (90) degrees between said contact surface and a general direction of the metal working surface, to transform the metal working surface into a lapped, convex surface.

According to further features in the described preferred embodiments, the lapping tool substantially has a shape of a cup, and wherein said contact surface is disposed at least on a portion of a rim of the cup.

According to further features in the described preferred embodiments, the mechanism is adapted to rotate at least one of the lapping tool and the workpiece about its axis, to achieve the relative motion.

According to further features in the described preferred embodiments, the workpiece is a tappet.

According to yet another aspect of the present invention there is provided a mechanical system for lapping a metal working surface, the system including: (a) a workpiece having the metal working surface, the surface have a generally spherical form; (b) a lapping tool having a contact surface disposed generally opposite the metal working surface, the contact surface including an organic, polymeric material; (c) a plurality of particles, including abrasive particles, the abrasive particles disposed between the contact surface and the working surface, and (d) a mechanism, associated with at least one of the working surface and the contact surface, adapted to apply a relative motion between the contact surface and the metal working surface, and to exert a load on the contact surface and the working surface, the contact surface for providing an at least partially elastic interaction with the plurality of abrasive particles, and wherein the contact surface and the mechanism are designed and configured, and the plurality of particles is selected, such that upon activation of the mechanism, the relative motion under the load effects: (i) lapping of the metal working surface, and (ii) incorporation of inorganic particles into the metal working surface, the inorganic particles having a Mohs hardness of at least 8, wherein the lapping tool substantially has a shape of a cup, and wherein the contact surface is disposed at least on a portion of a rim of the cup.

According to further features in the described preferred embodiments, the mechanism is adapted to rotate at least one of the lapping tool and the workpiece about its axis, to achieve the relative motion.

According to further features in the described preferred embodiments, the mechanism is further adapted to move along the working surface of the workpiece in at least two directions.

According to further features in the described preferred embodiments, the working surface is at least a part of a working surface of a ball of an artificial ball-and-socket joint implant.

According to further features in the described preferred embodiments, the working surface is at least a part of a working surface of a ball stud in a steering system.

According to yet another aspect of the present invention there is provided a mechanical system for lapping a metal working surface, the system including: (a) a workpiece having the metal working surface, the surface have a generally spherical form; (b) a lapping tool having a contact surface disposed generally opposite the metal working surface, the contact surface including an organic, polymeric material; (c) a plurality of particles, including abrasive particles, the abrasive particles disposed between the contact surface and the working surface, and (d) a mechanism, associated with at least one of the working surface and the contact surface, adapted to apply a relative motion between the contact surface and the metal working surface, and to exert a load on the contact surface and the working surface, the contact surface for providing an at least partially elastic interaction with the plurality of abrasive particles, and wherein the contact surface and the mechanism are designed and configured, and the plurality of particles is selected, such that upon activation of the mechanism, the relative motion under the load effects: (i) lapping of the metal working surface, and (ii) incorporation of inorganic particles into the metal working surface, the inorganic particles having a Mohs hardness of at least 8, wherein the lapping tool substantially has a generally annular area flaring out towards a rim of the tool, the annular area containing at least a portion of the contact surface having the organic, polymeric material.

According to further features in the described preferred embodiments, the mechanism is adapted to rotate at least one of the lapping tool and the workpiece about its axis, to achieve the relative motion.

According to further features in the described preferred embodiments, the mechanism is further adapted to move along the working surface of the workpiece in at least two directions.

According to further features in the described preferred embodiments, the working surface is at least a part of a working surface of a ball of an artificial ball-and-socket joint implant.

BRIEF DESCRIPTION OF THE DRAWINGS

The invention is herein described, by way of example only, with reference to the accompanying drawings. With specific reference now to the drawings in detail, it is stressed that the particulars shown are by way of example and for purposes of illustrative discussion of the preferred embodiments of the present invention only, and are presented in the cause of providing what is believed to be the most useful and readily understood description of the principles and conceptual aspects of the invention. In this regard, no attempt is made to show structural details of the invention in more detail than is necessary for a fundamental understanding of the invention, the description taken with the drawings making apparent to those skilled in the art how the several forms of the invention may be embodied in practice. Throughout the drawings, like-referenced characters are used to designate like elements.

In the drawings.

FIGS. 2A and 2B schematically illustrate a working surface being conditioned in a conventional lapping process;

FIG. 5 is a flow chart of the process of conditioning a working surface in accordance with one embodiment of the inventive lapping process;

FIG. 6A is schematic view of an interacting surface of the lapping technology disclosed herein;

FIG. 6B is a schematic description of a side view of the interacting surface of FIG. 6A;

FIG. 8C(i)-(iii) are an additional cross-sectional schematic representation of a working surface being conditioned in the inventive lapping process;

FIG. 9J is an exemplary, schematic perspective view of another inventive hollow, generally cylindrical element having a contact surface according to the present invention;

FIG. 9K is an exemplary, schematic perspective view of a cylindrical assembly fitting over the hollow cylindrical element of FIG. 9J;

FIG. 9L is an exemplary, schematic perspective view of a generally cylindrical workpiece for treating with the cylindrical element and cylindrical assembly of FIGS. 9J-9K;

FIGS. 10N-P show the treatment of complex surfaces using an adaptable tool of the present invention, wherein:

FIG. 10N is an exemplary, schematic perspective view of the inventive, adaptable lapping tool;

FIG. 10O is an exemplary, schematic perspective view of a convex spherical surface of a sphere to be treated thereby, and FIG. 10P is an exemplary, schematic perspective view of a cylindrical surface of a sphere to be treated thereby;

FIG. 10Q is an exemplary view of an inventive chain-link tool for treatment of wires;

FIG. 13 is a schematic representation of a typical metal surface;

FIG. 15 shows XPS spectra of several motor oil additives;

DESCRIPTION OF THE PREFERRED EMBODIMENTS

Figure 1A:
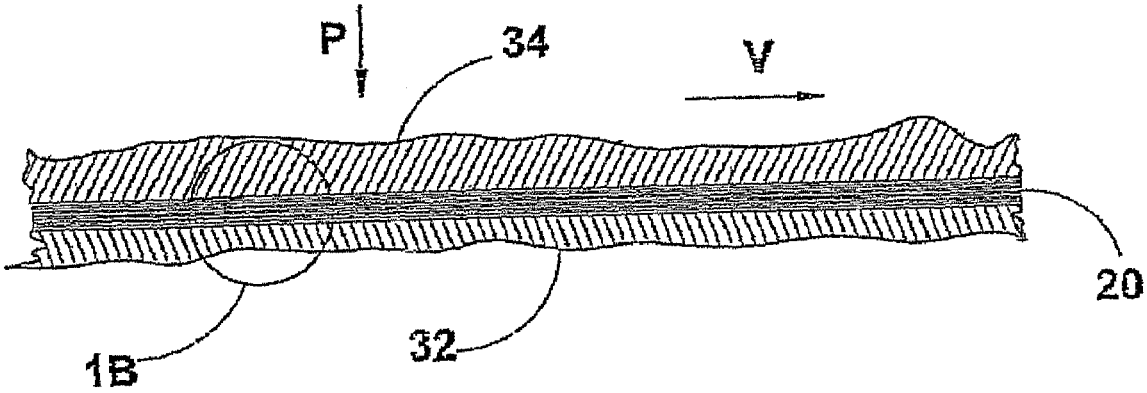
Fig. 1A PRIOR ART
FIG. 1A is a schematic description of the mechanically interacting surfaces having an interposed lubricating layer.

One aspect of the present invention relates, inter alia, to metal tribological surfaces enhanced with all organic nanolayer, and to lapping methods and systems for producing such surfaces.

The principles and operation of the present invention may be better understood with reference to the drawings and the accompanying description.

Before explaining at least one embodiment of the invention in detail, it is to be understood that the invention is not limited in its application to the details of construction and the arrangement of the components set forth in the following description or illustrated in the drawing. The invention is capable of other embodiments or of being practiced or carried out in various ways. Also, it is to be understood that the phraseology and terminology employed herein is for the purpose of description and should not be regarded as limiting.

Figure 3A:
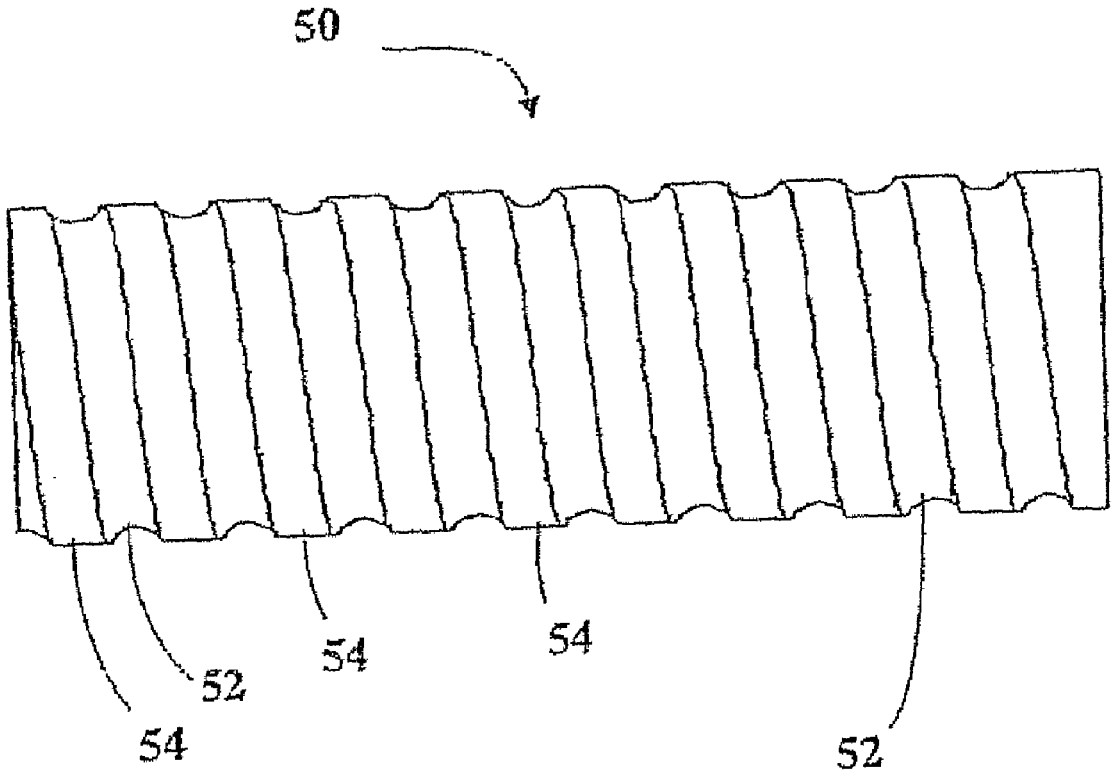
FIG. 3A is a schematic side view of a grooved cylinder in accordance with the inventive lapping process.
Figure 3B:
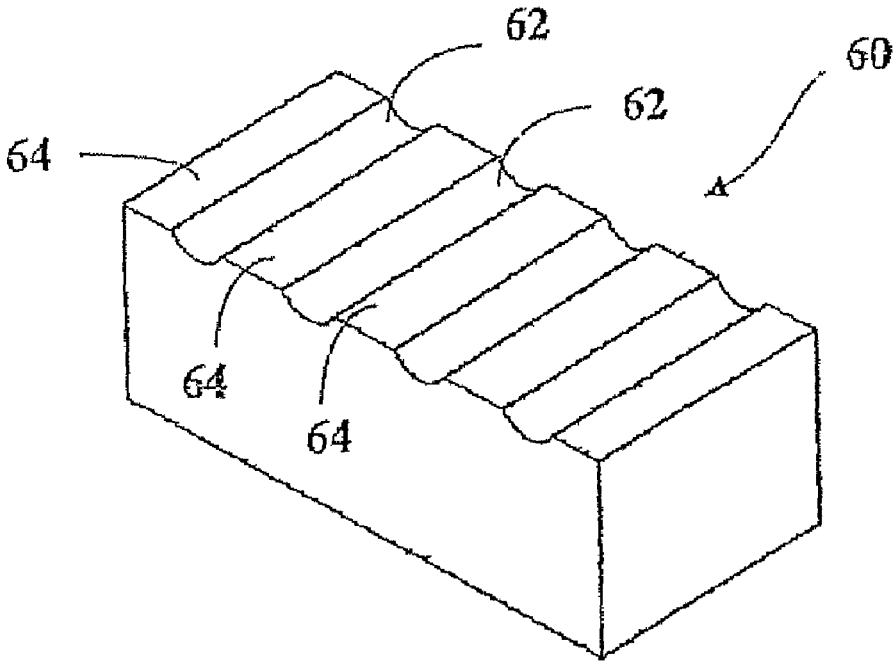
FIG. 3B is a schematic view of a metal plate, the working surface of which is grooved, in accordance with the inventive lapping process.

FIG. 3A is a schematic side view of a cylinder 50 lapped in accordance with the inventive lapping process. Cylinder 50 has one or more grooves, such as helical groove 52, engraved on the surface. Typically, such grooves have a maximum depth of about 5-30 microns, and a width of about 100-1000 microns. The remainder of the original surface is one or more plateaus, such as substantially flat regions 54. FIG. 3B is a schematic representation of a metal workpiece 60 that has been processed by the inventive lapping process described hereinbelow. The working surface includes grooves 62, and alternate, substantially flat regions 64.

Figure 4A:
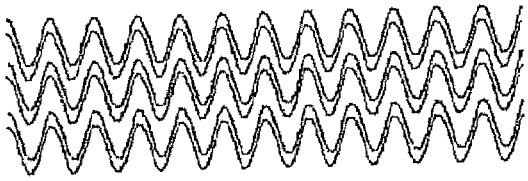
FIG. 4A is a pattern of dense sinusoidal grooving, in accordance with an embodiment of the inventive lapping process.
Figure 4C:
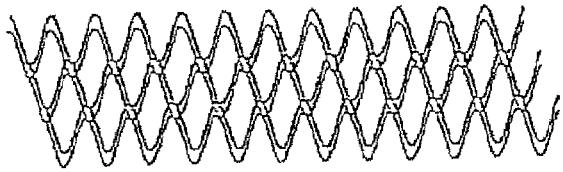
FIG. 4C is a sinusoidal pattern of grooving, containing overlapping waves, in accordance with an embodiment of the inventive lapping process.
Figure 4B:
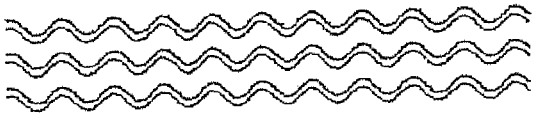
FIG. 4B is a pattern of sinusoidal grooving, in accordance with an embodiment of the inventive lapping process.
Figure 4D:
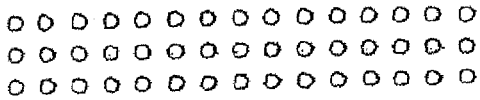
FIG. 4D is a pitted pattern of grooving in accordance with an embodiment of the inventive lapping process.

In FIGS. 4A-D are provided exemplary, schematic patterns of recessed microstructures, such as microgrooves, which are suitable for the structural aspects of embodiments of the present invention. FIGS. 4A-B show sinusoidal patterns of varying density; FIG. 4C shows a sinusoidal pattern containing overlapping sinuses, and FIG. 4D shows a pitted pattern. The diversity of optional patterns is very large, and the examples given above constitute only a representative handful.

In a preferred process for conditioning the working surface, described schematically in FIG. 5, the working surface is machined by abrading and/or lapping (step 90) so as to obtain a high degree of flatness and surface finish. In step 92, all optional recessed zone is formed, and in step 94, the superficial zone of the working surface undergoes lapping. The surface is preferably aged (step 96), as will be explained hereinbelow, to obtain the inventive working surface.

In those embodiments in which the recessed zone is desirable, the working surface may be micro-structured to obtain a plurality of recesses. This can be achieved by various methods known in the art, including mechanical cutting, laser engraving, and chemical etching. Methods for producing regular microstructures in mechanical parts is taught by M. Levitin and B. Shamshidov in "A Disc on Flat Wear Test Under Starved Lubrication", Tribotest Journal 4-2, December 1997, (4), 159, the contents of which are incorporated by reference for all purposes as if fully set forth herein.

Lapping of the superficial zone has been found to achieve a very good flatness rating, and a superior finish. The lapping technique uses a free-flowing abrasive material, as compared to grinding, which uses fixed abrasives.

Figure 6C:
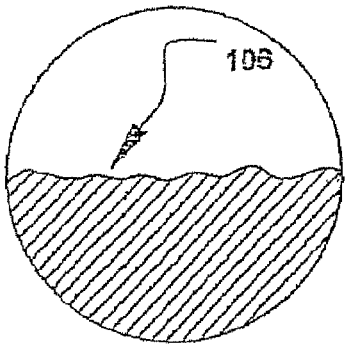
FIG. 6C is a cross-sectional schematic description of the surface of FIG. 6B.
Figure 6D:
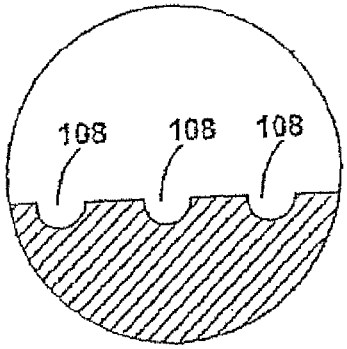
FIG. 6D is a cross-sectional schematic description of the surface of FIG. 6C, after micro-grooving.
Figure 6E:
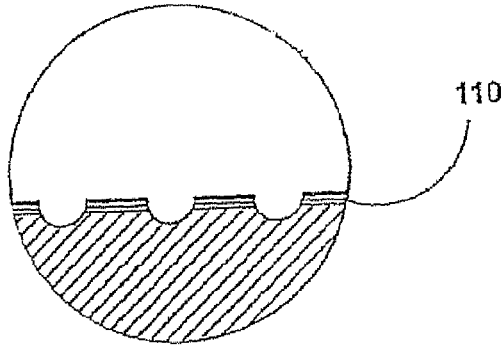
FIG. 6E is a cross-sectional schematic description of the micro-grooved surface of FIG. 6D, after undergoing the inventive lapping process.

FIG. 6A describes schematically a workpiece 100, a working surface 102 of which is to be processed in accordance with an embodiment of the invention. A schematic sectional view of the surface is shown in FIG. 6B, indicating the position of an enlarged view of the cross-section shown in FIGS. 6C-E. In FIG. 6C, a machined surface 106 is shown. In FIG. 6D, surface 106 is shown after optional microgrooves or recessed microstructures 108 have been formed. In FIG. 6E, the working surface has been leveled and transformed by the inventive lapping process. A new plastically deformed region 110, which will be discussed in greater detail hereinbelow, has formed on the superficial zone.

Figure 7B:
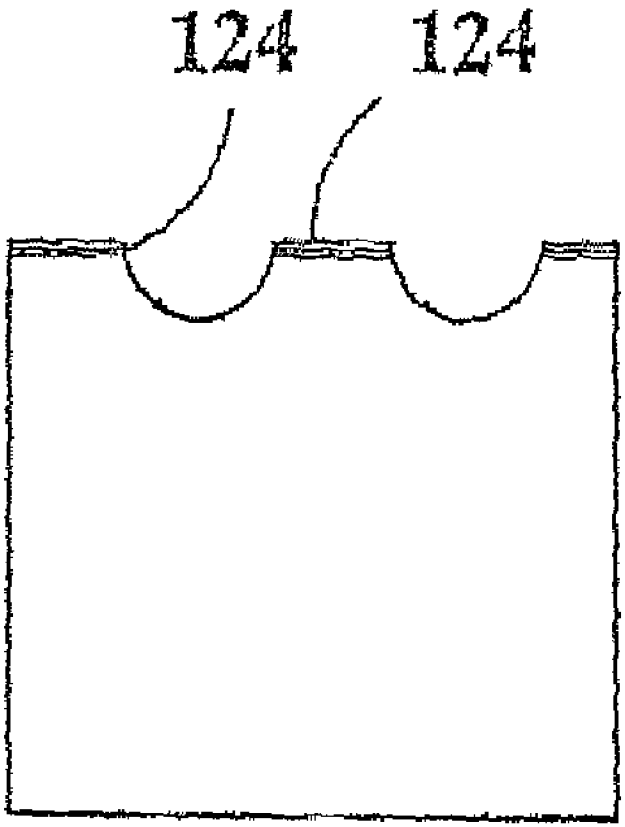
FIG. 7B is a cross-sectional schematic description of the surface of FIG. 7A, after undergoing the inventive lapping process.
Figure 7A:
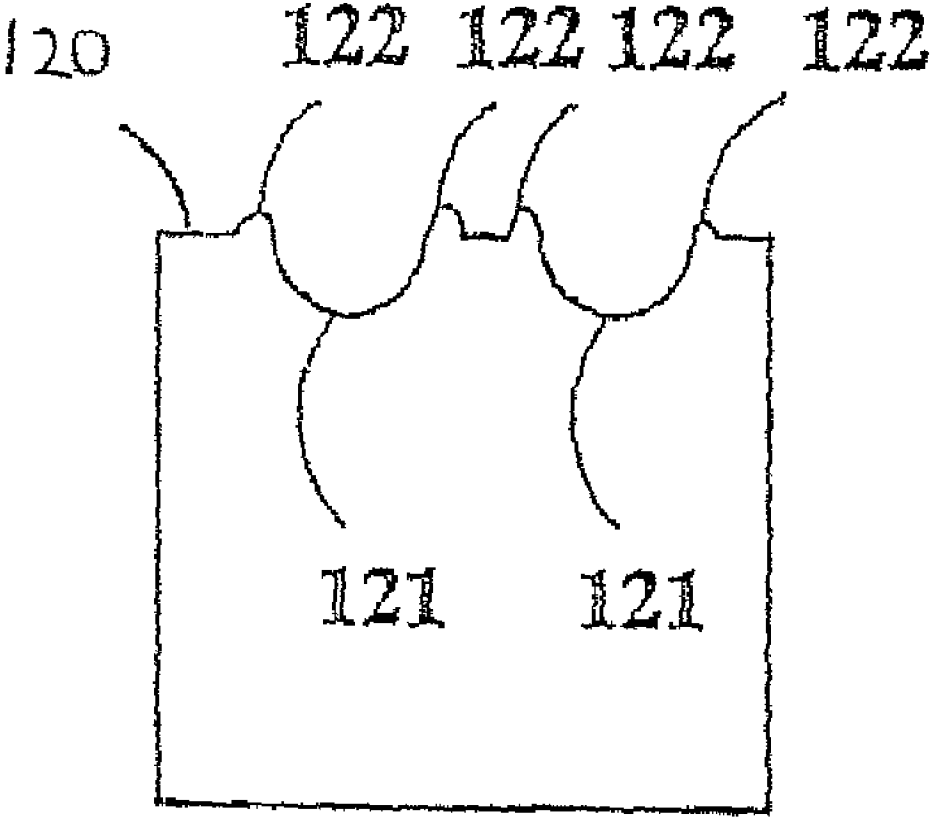
FIG. 7A is a cross-sectional schematic description of the working surface, after micro-grooving, the micro-grooves being surrounded by bulges.

The lapping step preferably succeeds the microgrooving step, because in forming the recessed microstructures on the surface, bulging of the surface around the microstructures is common. The bulges may appear even if the structural changes are effected by laser-cutting. This is illustrated schematically in FIGS. 7A-B, to which reference is now made. In FIG. 7A, recessed microstructures or microgrooves 121 have been formed in working surface 120. Around the edges of recessed microstructures 121 are disposed bulges 122, produced in the formation of microstructures 121. After the inventive lapping process, the bulges are leveled, and a plastically deformed region 124 is produced (see FIG. 7B) near the surface of working surface 120.

Lapping is the preferred mechanical finishing method for obtaining the characteristics of the working surface of the mechanical element in accordance with the present invention. The lapping may be performed using a lapping tool, the surface of which is softer than the working surface of the processed mechanical part, and a paste containing abrasive grit. The paste may be a conventional paste used in conventional lapping processes. In order to be effective, the abrasive grit is harder than the face of the lapping tool, and harder than the processed working surface. Aluminum oxide has been found to be a particularly suitable abrasive material for a variety of lapping surfaces and working surfaces, in accordance with the invention.

Figure 8A:
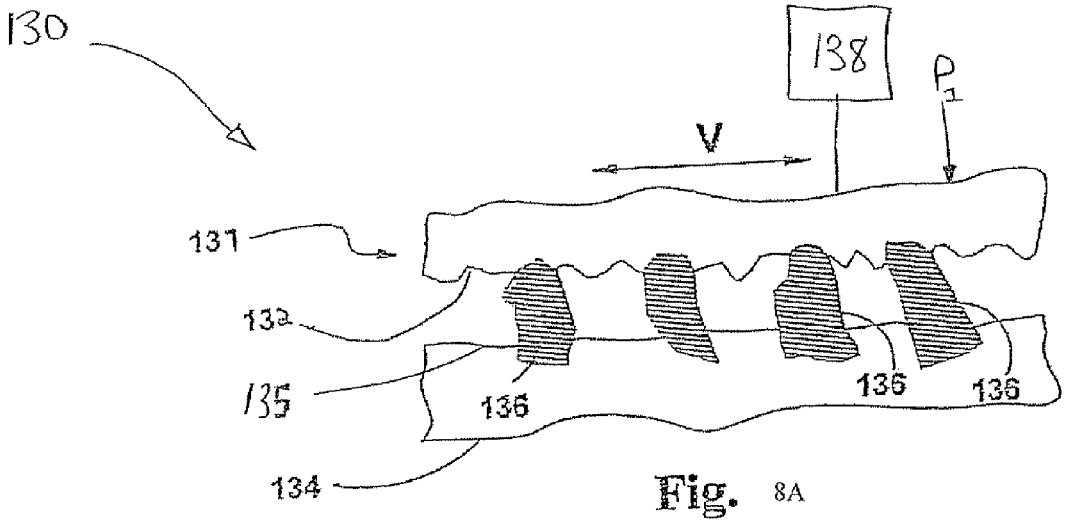
FIG. 8A is a cross-sectional schematic description of a lapping tool—working surface interface prior to lapping, in accordance with the invention.
Figure 8B:
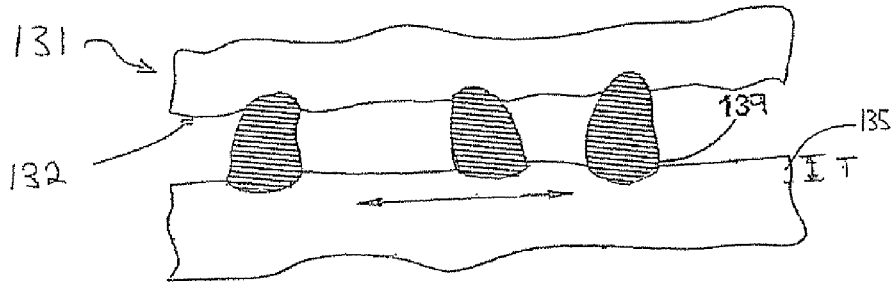
FIG. 8B is a cross-sectional schematic description of the lapping tool—working surface condition after lapping has progressed, in accordance with the invention.

FIGS. 8A-B schematically present progressive steps in the inventive lapping process, in which the conditioning of the working surface is promoted. The initial condition of one aspect of the inventive lapping system 130 is shown schematically in FIG. 8A. The irregular topography of a working surface 132 (disposed on a workpiece 131) faces a lapping tool 134 and is separated by an irregular distance therefrom. Abrasive particles 136 are partially embedded in contact surface 135 of lapping tool 134, and to a lesser extent, in working surface 132. Working surface 132 and contact surface 135 are made to move in a relative motion by mechanism 138. This motion has an instantaneous magnitude V. Mechanism 138 also exerts a load, or a pressure $P_1$, that is substantially normal to contact surface 135 and working surface 132.

Those skilled in the art will appreciate that mechanism 138 may be chosen from various known and commercially available mechanisms for use in conjunction with lapping systems.

In FIG. 8B, some lapping action has taken place, causing working surface 132 to become less irregular. As a result of the relative movement between the surfaces, the abrasive particles, such as abrasive particle 139, are now rounded to some extent, losing some of their sharp edges in the course of rubbing against the surfaces.

While initially, abrasive particles 136 penetrate into working surface 132 and gouge out material therefrom, as the process continues, and the abrasive particles become rounded, substantially no additional stock is removed from the processed part. Instead, the lapping movement effects a plastic deformation in working surface 132 of workpiece 131, so as to increase the micro-hardness of working surface 132.

FIGS. 8C (i)-(iii) are an additional schematic representation of a working surface being conditioned in a lapping process and system of the present invention. In FIG. 8C(i), a working surface 132 of a workpiece 131 faces a contact surface 135 of lapping tool 134. An abrasive paste containing abrasive particles, of which is illustrated a typical abrasive particle 136, is disposed between working surface 132 and contact surface 135. As in conventional lapping technologies, contact surface 135 of lapping tool 134 is made of a material having a greater wear-resistance and a lower hardness with respect to working surface 132. The composition and size distribution of the abrasive particles are selected so as to readily wear down working surface 132 according to plan, such as reducing surface roughness to a pre-determined roughness.

A load is exerted in a substantially normal direction to surfaces 132 and 135, causing abrasive particle 136 to penetrate working surface 132 and contact surface 135, and resulting in a pressure P being exerted on a section of abrasive particle 136 that is embedded in working surface 132. The penetration depth of abrasive particle 136 into working surface 132 is designated by $h_{a2}$; the penetration depth of abrasive particle 136 into contact surface 135 is designated by $h_{b2}$. Abrasive particle 136 penetrates into lapping tool 134 to a much greater extent than the penetration into workpiece 131, such that $h_{b2} \gg h_{a2}$. Significantly, because of the substantial elastic character of the deformation of inventive contact surface 135, the penetration depth of abrasive particle 136 into contact surface 135 is much larger than the penetration depths of identical abrasive particles into metal contact surfaces of typical conventional systems (under the same pressure P), i.e., $$h_{b2} > h_{b1},$$

where $h_{b1}$ is defined in FIG. 1C(i). Consequently, the penetration depth of abrasive particle 136 into working surface 132, $h_{a2}$, is much smaller than the corresponding penetration depth, $h_{a1}$, in such conventional systems, i.e., $$h_{a2} < h_{a1},$$

In FIG. 8C(ii), workpiece 131 and lapping tool 134 are made to move in a relative velocity V. The pressure P, and relative velocity V of workpiece 131 and lapping tool 134, are of a magnitude such that abrasive particle 136, acting like a cutting tool, gouges out a chip of surface material from workpiece 131. This chip is typically much smaller than the chips that are gouged out of the working surfaces conditioned by conventional lapping technologies using cast iron or aluminum contact surfaces.

In FIGS. 8C(ii)-(iii), relative velocity V is selected such that a corresponding shear force Q is large enough, with respect to pressure P, such that the direction of combined force vector F on abrasive particle 136 causes abrasive particle 136 to rotate. During this rotation, the elasticity of lapping tool 134 and contact surface 135 results in less internal strains within abrasive particle 136, with respect to the conventional lapping technologies, such that a typical particle, such as abrasive particle 136, does not shatter, rather, the edges of the surface become rounded. An idealization of this rounding phenomenon is provided schematically in FIG. 8C(iii).

Roughness Characterization and Characteristics of Working Surfaces

Surface roughness parameters may be characterized using a stylus, according to international standards like ISO4287; ISO4288; ASME B46.1; JIS B0601.

Figure 8D:
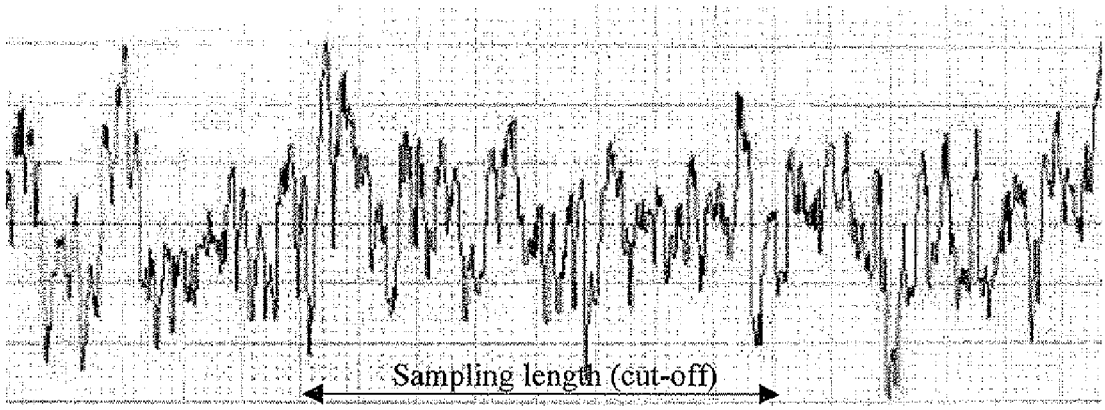
FIG. 8D is an exemplary plot of surface roughness as a function of the stylus position on a working surface, showing a typical sampling length, or "cut-off length"

Generally, a diamond tip stylus is dragged over the metallic surface at a known pace, and a sensitive pick-up mechanism measures the ordinate (Z) movement of the stylus. The stylus is dragged over the metallic surface for a specific unit length called the sampling length (see FIG. 8D). The surface roughness parameters are calculated for this sampling length.

The basic surface roughness parameter is Ra (average roughness), which is the arithmetic average of the absolute ordinate value calculated over a sampling length. Ra (as well as most other roughness parameters) is measured in microns (micrometers).

The sampling length, or cut-off, is defined based on the surface roughness: the higher the roughness, the longer the cut-off:

For Ra<0.02 microns, the cut-off length is 0.08 mm

For 0.02<Ra<0.1 microns, the cut-off length is 0.25 mm

For 0.1<Ra<2.0 microns, the cut-off length is 0.8 mm

For 2.0<Ra<10.0 microns, the cut-off length is 2.5 mm.

Figure 8E:
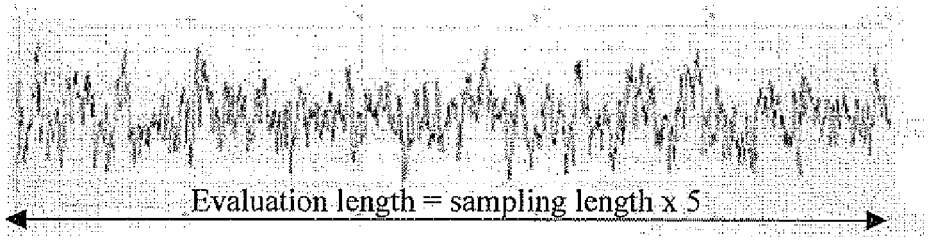
FIG. 8E is a longer section of the plot of FIG. 8D, showing the evaluation length of the working surface.

All surface roughness parameters are calculated independently for each sampling length. This process is repeated 5 consecutive times, over the evaluation length (shown in FIG. 8E). The reported surface roughness parameters are the average of the 5 results.

Figure 8F:
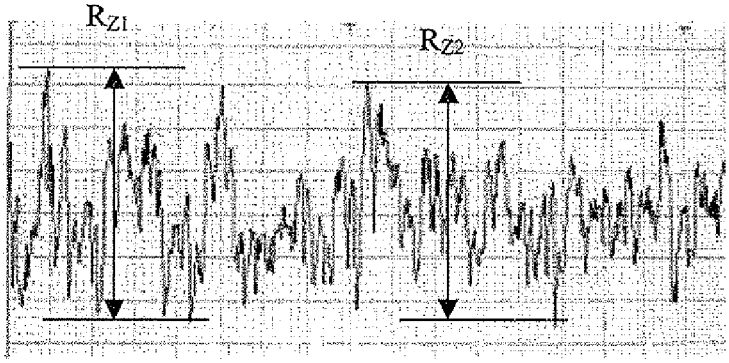
FIG. 8F shows how the roughness parameter Rz is defined over the course of two consecutive sampling lengths, in an exemplary plot of the ordinate movement of the stylus as a function of stylus position on the workpiece surface.

Another common surface roughness parameter is Rz, which is a measurement of the distance between the highest peak and the lowest valley within a sampling length. The reported Rz is the average of the 5 Rz over the entire evaluation length. FIG. 8F shows how Rz is defined over the course of two consecutive sampling lengths, for an exemplary plot of the ordinate movement of the stylus as a function of stylus position on the workpiece surface.

Table 2 shows typical average roughness values for workpiece surfaces of hard steel, cast iron, and aluminum, before and after the polymer lapping process according to the present invention. By way of example, workpiece surfaces of hard steel typically have an Ra of 0.05-0.2 microns before being conditioned using an exemplary embodiment of the inventive polymer lapping process. Single stage treatments are performed using a substantially neutral, (pH between 6 and 8) and substantially chemically inert alumina-based paste containing alumina particles having an average particle size of about 5-10 microns. The inventive workpiece surfaces produced have an Ra of 0.015-0.03 microns.

TABLE 2

| | Ra (μ) before polymer lapping | Ra (μ) after polymer lapping |
|---|---|---|
| Hard steel (55-65 HRc) | 0.05-0.2 | 0.015-0.03 (15-30 nm) |
| Cast iron (<25 HRc; <270 HB) | 0.2-0.6 | 0.15-0.3 (150-300 nm) |
| Aluminum | 0.2-0.4 | 0.03-0.06 (30-60 nm) |

Figure 8G:
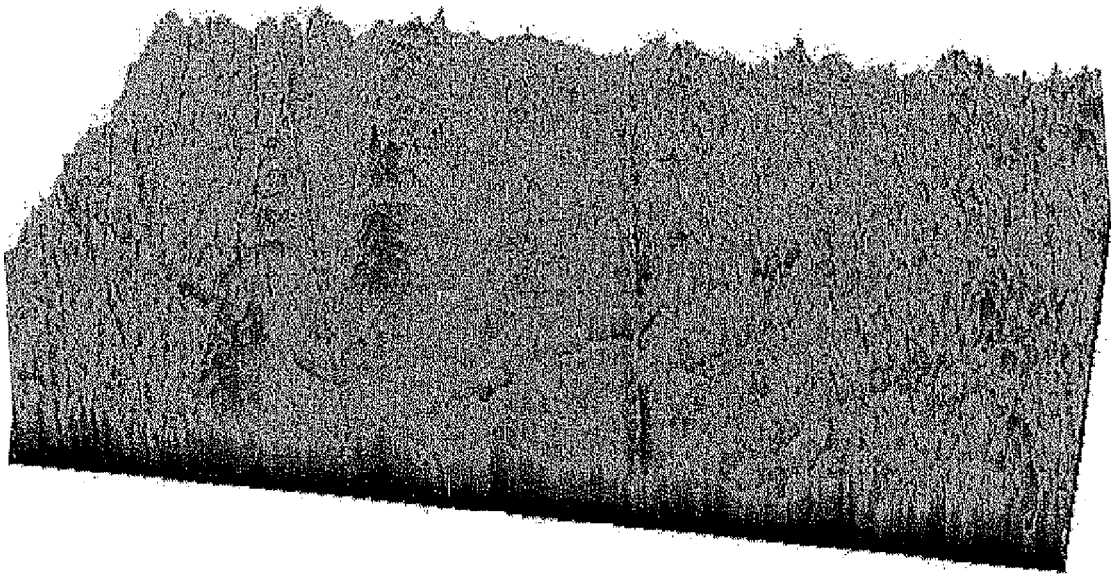
FIG. 8G is a white light interferometer image showing the surface topography of a steel sample after conventional grinding.

FIG. 8G is a white light interferometer image showing the surface topography of a steel sample after conventional grinding. The average roughness is 0.42 microns.

Figure 8H:
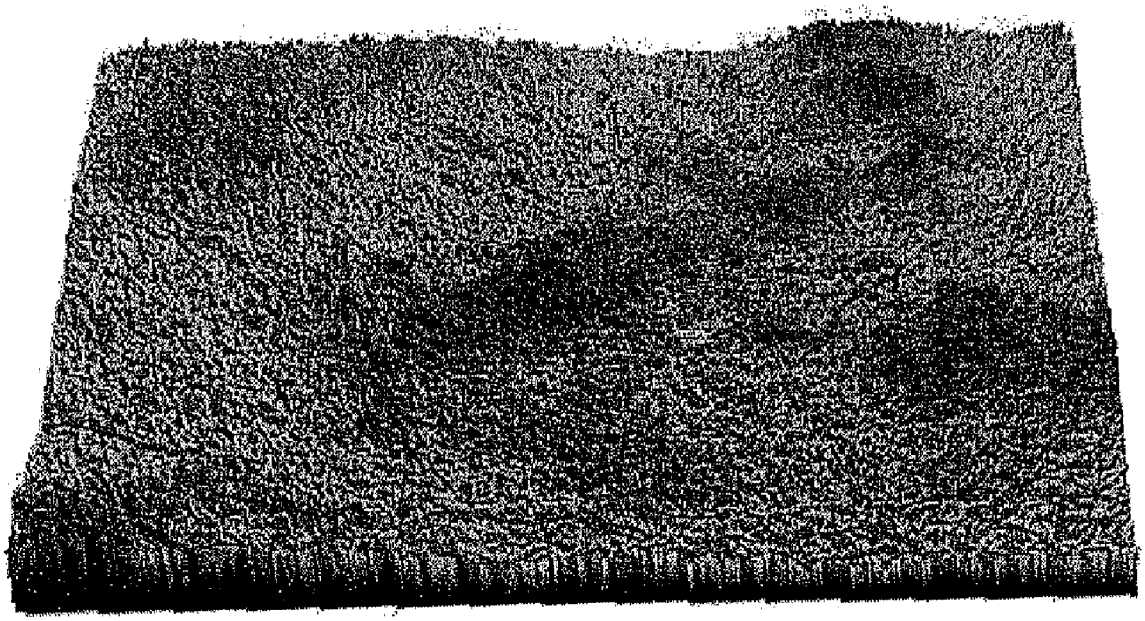
FIG. 8H is a white light interferometer image showing the surface topography of a steel sample after conventional superfinishing.

FIG. 8H is a white light interferometer image showing the surface topography of a steel sample after conventional superfinishing. The average roughness is reduced, relative to grinding, to 0.07 microns.

Figure 8I:
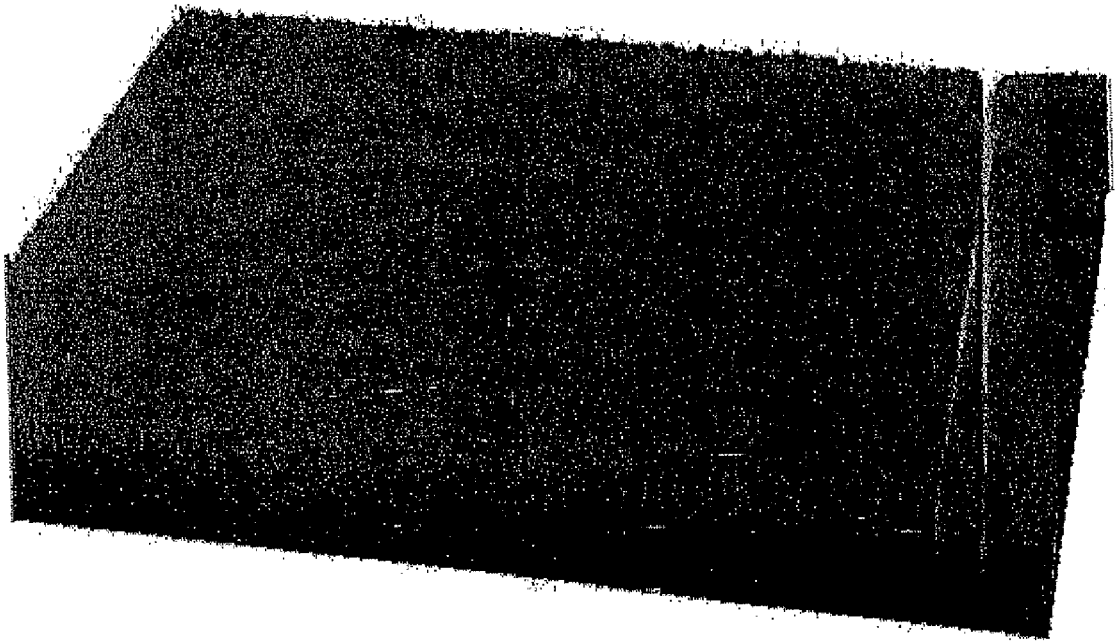
FIG. 8I is a white light interferometer image showing the surface topography of a steel sample after grinding followed by polymer lapping in accordance with the present invention.

FIG. 8I is a white light interferometer image showing the surface topography of a steel sample after grinding followed by polymer lapping in accordance with the present invention. The average roughness is reduced, relative to conventional grinding and conventional superfinishing processes, to about 0.02 microns.

The working surfaces of the present invention have an intrinsic microstructure that influences various macroscopic properties of the surface. Without wishing to be limited by theory, it is believed that the inventive lapping system effects a plastic deformation in the working surface, so as to improve the microstructure of the working surface. One manifestation of the modified microstructure is a greatly increased microhardness. Other manifestations of the modified microstructure will be developed hereinbelow.

The mechanical criteria with which the polymeric contact surface should preferably comply include:

1. wear resistance with respect to the abrasive paste used in the lapping process;
2. elastic deformation such that individual abrasive particles protrude into, and are held by, the polymeric surface; as the individual abrasive particles rotate during contact with the working surface, the elastic deformation should enable the particles to be absorbed into the polymeric surface in varying depths, according to the varying pressures exerted between the particles and the working surface. Consequently, the abrasive particles rotate against the working surface and become more rounded with time, instead of undergoing commination (being ground into a fine powder);
3. the hardness of the polymeric surface should be selected such that the elastic layer does not appreciably break or grind the abrasive powder.

Thus, contact surface 135 of lapping tool 134 (see FIGS. 8A-8B, and FIGS. 8C(i)-8C(iii)) is an organic, polymeric surface. If contact surface 135 is a layer that is mechanically supported (e.g., on a metal backing), surface 135 preferably has a thickness T1 (see FIGS. 8B, 9C) of at least 0.5 mm. Alternatively, organic, polymeric contact surface 135 has a thickness T1 of at least 5 mm and more preferably at least 8-10 mm, such that contact surface 135 is substantially self-supporting.

Figure 9A:
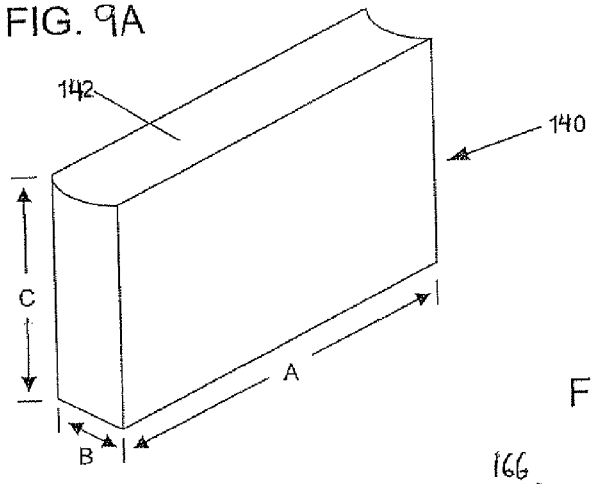
FIGS. 9A and 9C are a schematic perspective view of embodiments of a lapping tool used in conjunction with the present invention.

One aspect of the lapping tool used in conjunction with the present invention is provided in FIG. 9A. Lapping tool 140 is adapted for lapping an outside diameter of a component, such as a cylinder 180 shown in FIG. 9B. Lapping tool 140 is essentially a cube, a cubic rectangle or a box-shaped device, having a length A, a width B and a height C. Length A may be about twice the length of width B, and height C may be about half of width B. This is designated as a ratio of 2:1:0.5. Length A, width B and height C may also have other dimensions, such as ratios 1:2:1, 0.5:2:3, and others.

The top side of lapping tool 140 includes a working area 142, which may be symmetrically or asymmetrically concave. The radius of the concavity of the working area 142 may be approximately equal to the radius of a cylinder, such as cylinder 180, such that as the lapping treatment is being conducted, a substantial portion of working area 142 (up to the entire surface area of working area 142) may be in contact with an outside surface 182 of cylinder 180. Initially (i.e., prior to contact with outside surface 182), the concavity of working area 142 may have a radius smaller or larger than the radius of cylinder 180. Working area 142 may lack concavity altogether. As the treatment progresses, working area 142 may self-form (or self-align) to an approximate or exact radius of cylinder 180. Alternatively, working area 142 may retain essentially its original shape over the course of treatment of outside surface 182.

In the embodiment of lapping tool 140 described above and shown in FIG. 9A, lapping tool 140 is often made of a single piece of polymeric material.

Figure 9C:
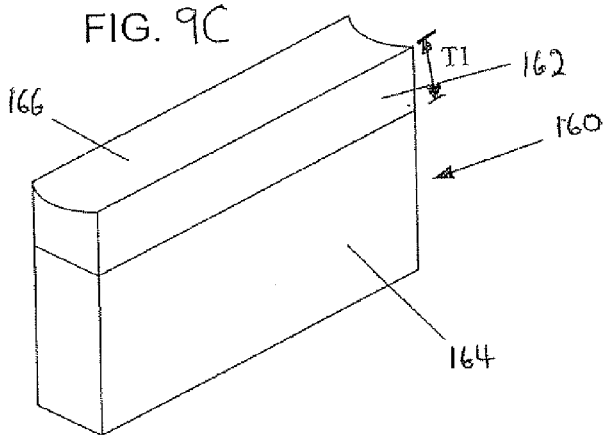
Figure 9B:
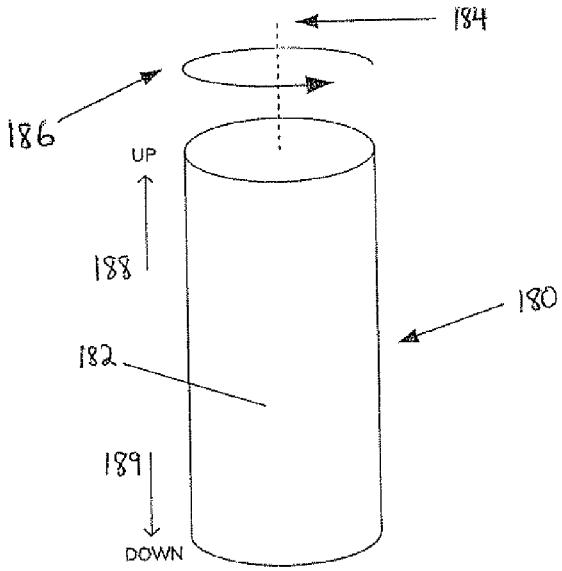
FIG. 9B is an exemplary, schematic perspective view of a cylinder having a working surface, for treating according to the present invention to obtain the inventive modified working surface.

In another embodiment, lapping tool 160, more fully shown in FIG. 9C, may have an external shape essentially similar or identical to that of the embodiment of lapping tool 140 described in relation to FIG. 9A, but lapping tool 160 may include two or more sub-sections. Each sub-section may be made of similar or different materials. For example, a surface treatment region, such as working area component 162 having a working area 166, may be made of a polymeric material; a supporting or structural component, such as base component 164 may be made of at least one structural or rigid material such as metal, polymer, ceramic, wood and the like. One advantage of forming lapping tool 160 with two or more sub-sections is the relative high cost of some polymeric materials that may be used to shape, form, or otherwise embody (hereinafter referred to as "form") base component 164, compared to the possible cost of other rigid materials that may form working area component 162 or other sub-sections of lapping tool 160. Another advantage may be the functional need to add rigidity and/or support to lapping tool 160; since the polymeric material that forms working area component 162 may be less mechanically-stable compared to other rigid materials, using such rigid materials to form base component 164 may add rigidity and support to the lapping tool, such as those shown at 140 and 160 in FIGS. 9A and 9C, respectively.

Figure 9F:
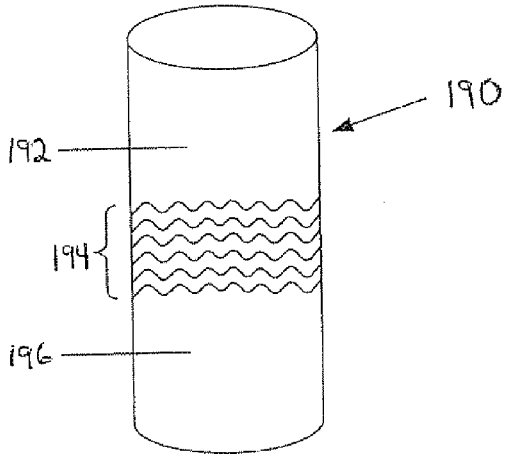
FIG. 9F is an exemplary, schematic perspective view of a cylinder having a working surface with different tribological zones, each zone for treating in a different manner to obtain a particular embodiment of the inventive modified working surface.
Figure 9D:
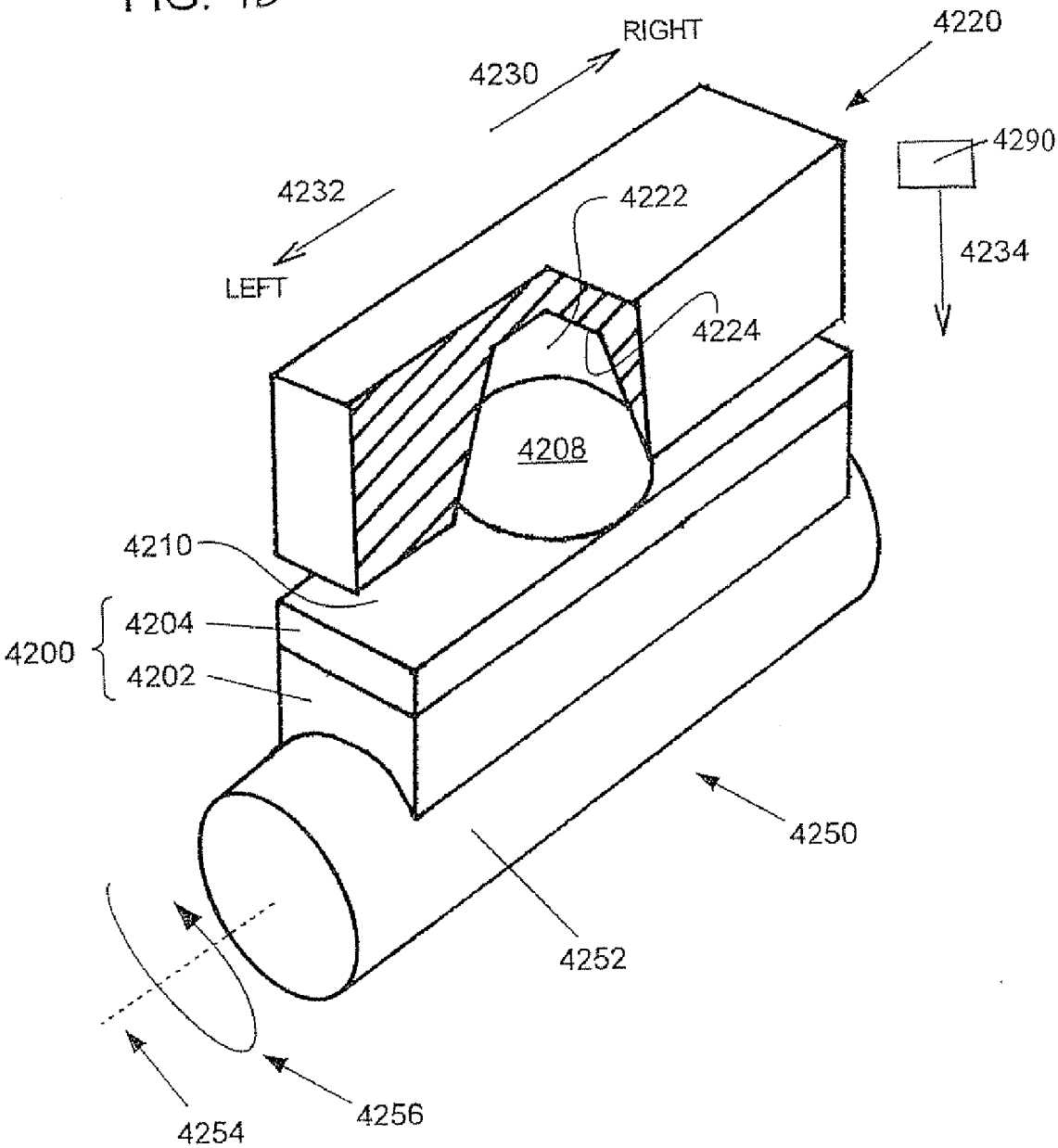
FIG. 9D is an exemplary, perspective view of an embodiment of a lapping tool having a leading device, according to the present invention.

In another embodiment shown in FIG. 9D, a lapping tool, such as lapping tool 4200 (that may include a base component, such as base component 4204, and a working area component, such as working area component 4202), may have an external shape essentially similar to that of lapping tool 200 shown in FIG. 9C, but with an alteration: lapping tool 4200 may have an essentially spherical protrusion, such as protrusion 4208, on top of its base component 4204. Exemplary protrusion 4208 has the shape of essentially a hemisphere, but other protrusions (not shown) may have other essentially oval or spherical shapes. Exemplary protrusion 4208 may be integrally formed with base component 4204 and located essentially at the center of the surface of base component 4204, but other protrusions (not shown) may be essentially functionally connected or attached to a base component (not shown), and/or positioned differently relative to a base component (not shown).

In addition to a cylinder with a homogenous radius along its entire length or along a desired portion of its length, a lapping tool (not shown) may also be suitable for treating a cylinder which has one or more ridges or one or more grooves (or a combination of one or more ridges and one or more grooves) on its outer surface (not shown). A lapping tool may have one or more grooves or ridges on its working area to functionally fit one or more ridges or grooves, respectively, on the outer surface of the cylinder. A lapping tool may also have a combination of one or more grooves and one or more ridges on its working area that may functionally fit respective grooves and ridges on the outer surface of a cylinder. The term "functionally fit" used above may represent identical or different sizes of the grooves or ridges on the working area of a lapping tool, and ridges and grooves, respectively, on a cylinder. Different sizes may be used, for example, by having a ridge on a working area of a lapping tool that is larger in size than the respective groove on a cylinder. During the treatment process, the ridge(s) on the working area(s) of the lapping tool may wear and fit (or align) itself to the size(s) and/or shape(s) of the groove.

In addition, a lapping tool, such as those shown at 140 and 160 in FIGS. 9A and 9C respectively, may also be suitable for treating devices of various shapes that have one or more portion(s) with an essentially cylindrical outline. The cylindrical outline, as well as cylinder 180, may be hollow, filled or have other attributes associated with the internal volume thereof.

One example of a cylinder that may be suitable for treatment by such lapping tools is a piston pin (or a wrist pin)—a component used extensively in the automotive and other industries. A piston pin may be used for connecting two parts inside an engine—the piston and the connecting rod. A piston pin may be made of steel and/or other rigid materials, and has the shape of essentially a cylinder. For a more detailed explanation of a piston pin, a piston, a connecting rod and other components that may be related, see Anthony B. Schwaller, *Total Automotive Technology* (4th ed. 2005).

During operation of the engine, the piston and the connecting rod move, and friction may occur between at least one of them and the piston pin. Treating the surface of the piston pin using a lapping tool such as lapping tool 140 or lapping tool 160 may reduce that friction.

Other examples of components that may exhibit improved tribological performance after the working surfaces of these components undergo treatment according to the lapping technologies of the present invention, include: poppet valves, hydraulic pistons, sliding bearings (sometimes referred to as "journal bearings" or "friction bearings"), and rollers of roller bearings (sometimes referred to as "non-friction bearings"). More detailed treatments of these mechanical components are available in the literature, including:

Andrew Parr, *Hydraulics and Pneumatics: A Technicians and Engineers Guide* (2nd ed. 1999);

Igor J. Karassik, Joseph P. Messina, Paul Cooper, Charles C. Heald, *Pump Handbook* (3rd ed. 2000);

Michael M. Khonsari, Earl Richard Booser, *Applied Tribology: Bearing Design and Lubrication* (1st ed. 2001);

Avraham Harnoy, *Bearing Design in Machinery* (2002);

Tedric A. Harris, Michael N. Kotzalas, *Rolling Bearing Analysis* (5th ed. 2006), as well as Schwaller (cited above), all of which are incorporated by reference for all purposes as if fully set forth herein.

Treatment of cylindrical components may be conducted by spinning or rotating a cylinder, such as cylinder 180, around a central axis 184 thereof (for example, in a direction of rotation 186), while essentially simultaneously functionally contacting the working area (such as working areas 142 and 166) with surface 182. The functional contact of the working area with surface 182 may include reciprocating (moving alternately in opposite directions such as up 188 and down 189 along the length of surface 182) the lapping tool along central axis 184 of cylinder 180.

Other treatments may be conducted by a lapping tool 4200 shown in FIG. 9D, in conjunction with a leading device, such as leading device 4220. Leading device 4220 may be a rectangular cube or a box-shaped device, having a recess, such as recess 4222, in a bottom surface thereof. In other embodiments, the leading device (not shown) may be otherwise shaped, given that it has a recess, such as recess 4222, shaped as explained below. Exemplary leading device 4220 is made of metal, but other embodiments may be made of other rigid materials, such as polymer, wood, or the like.

Recess 4222 may essentially have the shape of a cylinder, having a larger diameter at its opening (that appears next to a protrusion 4208 in FIG. 9D) and a relatively smaller diameter at its closed side, such as closed side 4224. The shape and size of recess 4222 may essentially correspond to the shape and side of protrusion 4208, such that when leading device 4220 is placed essentially adjacent to lapping tool 4200, protrusion 4208 may functionally contact the internal walls of recess 4222, so as to prevent the bottom surface (not shown) of leading device 4220 from contacting a top surface thereof, such as top surface 4210 of lapping tool 4200. Other embodiments may include a differently shaped recess, given that the recess corresponds to the shape and size of the relevant protrusion, as described above. Similarly, other embodiments may include a differently shaped protrusion, given that the protrusion corresponds to the shape and size of the relevant recess, as described above.

Treatment of cylinders, such as a cylinder 4250 shown in FIG. 9D, using lapping tool 4200 and leading device 4220, may be conducted by placing lapping tool 4200 with a working area thereof (not shown) essentially adjacent to an external surface, such as surface 4252 of cylinder 4250, and then placing leading device 4220 essentially adjacent to top surface 4210, so that protrusion 4208 essentially functionally fits within recess 4222. Pressure may be optionally applied on or by leading device towards lapping tool 4200, for example, in direction 4234 by any of various conventional load-applying mechanisms, such as load-applying mechanism 4290, which is represented schematically. Then, cylinder 4250 may be rotated around its central axis, such as central axis 4245 (for example, in direction of rotation 4256), while the working area (not shown) of lapping tool 4200 essentially functionally contacts surface 4252 of cylinder 4250.

Essentially due to recess 4224 and protrusion 4208, lapping tool 4200 may experience a certain degree of freedom of movement. Such freedom of movement may be advantageous, since it may allow lapping tool 4200 to dynamically alter its position during treatment, to better conform to surface 4252 of cylinder 4250.

Furthermore, leading device 4220 (and therefore also lapping tool 4200) may be optionally reciprocated along the length of cylinder 4250 during treatment, for example right 4230 and left 4232.

An abrasive paste or slurry (hereinafter referred to as "working agents") is often used as an intermediate between the working area (such as working area 142 in FIG. 9A) and a surface of a cylinder, such as surfaces 182 and 4252 of cylinders 180 and 4250, respectively.

Optionally, a lapping tool may be equipped with one or more tubing systems adapted to deliver one or more working agents to a space delimited between the lapping tool working area and the surface of a cylinder or other component. A tubing system (hereinafter referred to as an "internal tubing system") may include one or more tubes and/or bores that pass essentially through the lapping tool, and deliver the working agent to the lapping tool working area through one or more suitably disposed apertures. Alternatively, other tubing systems (hereinafter referred to as "external tubing systems") may include one or more tubes that run essentially externally to the lapping tool, and deliver the working agent to a space delimited between the lapping tool working area and the surface of a cylinder, as described hereinabove.

Optionally, a tubing system may include a combination of an internal tubing system and an external tubing system.

Figure 9E:
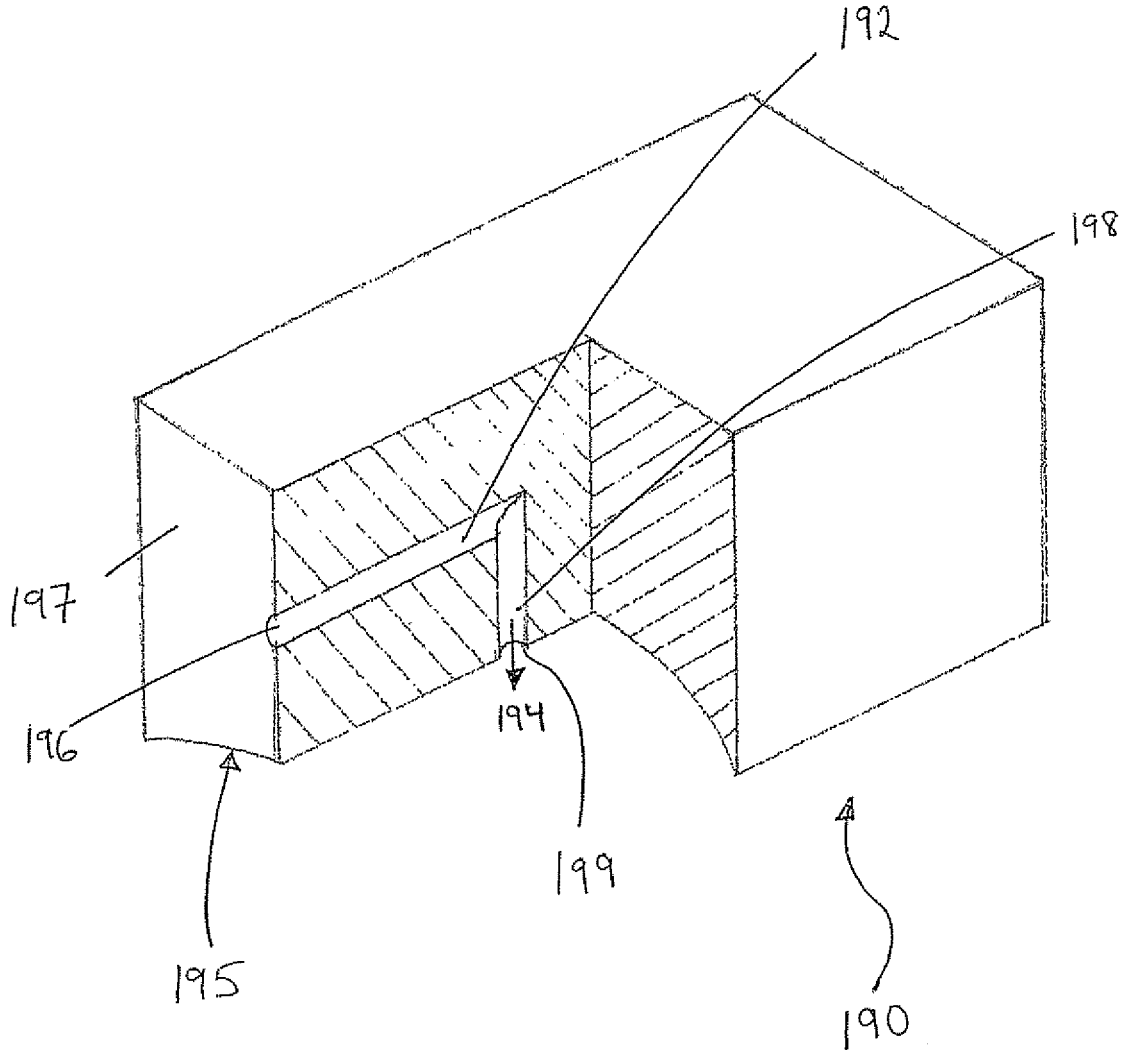
FIG. 9E is an exemplary, perspective, cut-open view of an embodiment of an inventive lapping tool having an internal tubing system for delivering an abrasive paste to the lapping tool working area.

FIG. 9E is an exemplary, perspective, cut-open view of an embodiment of a lapping tool 190 having an internal tubing system including internal tube 192 for delivering a working agent such as an abrasive paste to a lapping tool working space 194, i.e., the space between a contact surface 195 of lapping tool 190 and the working surface of the component (not shown), when the component is oriented so as to effect lapping of the working surface. In the embodiment provided in FIG. 9E, a distal end 196 of internal tube 192 is for receiving the abrasive paste from a source or reservoir, and passes through a side wall 197 of lapping tool 190. A proximal end 198 of internal tube 192 is for discharging the abrasive paste to lapping tool working space 194, via an opening or aperture 199 in contact surface 195.

The working agents may be fed to the tubing system in continuous fashion, at pre-determined intervals, or as otherwise desired. Feeding may be conducted using a pump and/or other means.

In addition to the treatment described above, treatments of different or similar natures may be performed on a surface of a cylinder, such as surfaces 182 and 4252 of cylinders 180 and 4250, respectively, for the purpose of conveying particular tribological properties thereto. Such treatments may be performed on essentially the same area of a surface of a cylinder, such as surfaces 182 and 4252 of cylinders 180 and 4250, respectively, or on essentially distinct areas of it. The treatments can be performed in either essentially simultaneously or essentially discrete fashion.

Some possible additional treatments may include changing the structure of a surface, such as surface 182 of cylinder 180. The structural change may include forming one or more recessed or elevated zones on surface 182 of the cylinder 180. Such recessed or elevated zones may have repeating or non-repeating patterns.

FIG. 9F is an exemplary, schematic perspective view of a cylinder 190 having a working surface with different tribological zones 192, 194 and 196, each zone for treating in a different manner to obtain a particular embodiment of the inventive modified working surface. A first treatment may be performed by a lapping tool (such as those shown at 140 and 160 in FIGS. 9A and 9C, respectively) on zones 192 and 196, and a second treatment, such as forming one or more recessed zones, or performing a different lapping treatment, may be applied to zone 194.

Figure 9G:
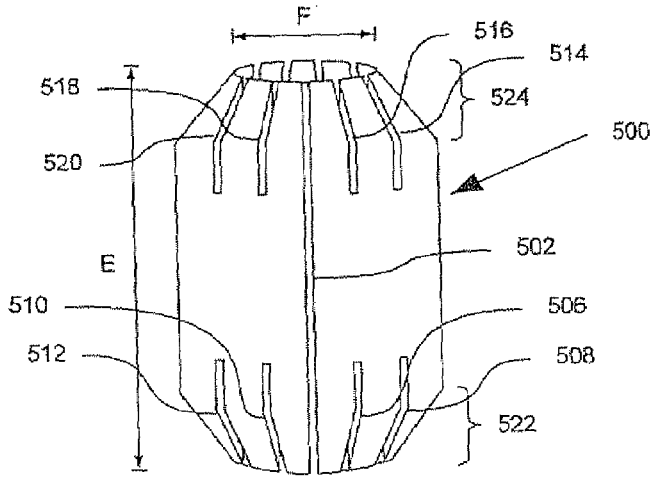
FIG. 9G is an exemplary, schematic perspective view of an embodiment of an inventive hollow cylindrical element having an inventive contact surface.

Another aspect of the inventive lapping tool and lapping process relates to the treatment of the outside of cylindrical surfaces using a double-sided flexible tool ("DOSIF"). An embodiment of a DOSIF 500 shown in FIG. 9G, is essentially a tubular or a hollow cylindrical device having a height E and an internal diameter F. A DOSIF, such as DOSIF 500, may have a homogenous internal diameter along its entire height E or desired portion(s) thereof, and a homogenous or a varying external diameter along its entire height E or desired portion(s) thereof. In an exemplary embodiment of DOSIF 500 shown in FIG. 9G, the external diameter of its uppermost 524 and lowermost 522 portions declines towards the uppermost and the lowermost edges, respectively, of DOSIF 500.

In the embodiment of DOSIF 500 described above and shown in FIG. 9G, DOSIF 500 is often made of a single piece of polymeric material. In another embodiment (not shown), DOSIF 500 may include two or more sub-sections or layers, each may be made of similar or different materials. One possible reason for forming a DOSIF with two or more sub-sections and/or layers is the relative high cost of some polymeric materials that may be used to form it, compared to the possible cost of other rigid materials that may be used. Another possible reason may be the functional need to add rigidity and/or support to the DOSIF; since some polymeric materials may be less mechanically-stable compared to other rigid materials, using such rigid materials to form sub-sections and/or layers of a DOSIF may add rigidity and support to it.

A DOSIF, such as DOSIF 500, may have one or more slots or openings 502 along the entire height E. These openings may penetrate through the entire shell (wall, side) of DOSIF 500. If there exists more than one opening, such as opening 502 (not shown), a connecting measure, element or arrangement (not shown) between shell parts on the two sides of an opening may be needed to prevent the DOSIF, such as DOSIF 500, from being separated into a plurality of parts (not shown). Opening 502 may cause DOSIF 500 to be essentially flexible or elastic, compared to a DOSIF without an opening (not shown). This flexibility or elasticity may enable the internal and/or external diameter of DOSIF 500 to expand or to be reduced in response to pressure applied on the shell (wall, side) of DOSIF 500 from an inner side or from an outer side thereof. Pressure may be applied from the outer side of DOSIF 500 by a squeezing device, for example. An exemplary squeezing device will be described in greater detail hereinbelow. Essentially due to the flexibility or elasticity, pressure applied on the outer side of DOSIF 500 may cause DOSIF 500 to better fit an external diameter of a treated cylindrical component (described below) inserted into DOSIF 500. In addition, the flexibility or elasticity may enable tightening or squeezing DOSIF 500 essentially during the treatment, thereby causing DOSIF 500 to better fit or adapt to an external diameter of a treated cylindrical component, even if, for example, the internal side of DOSIF 500 wears out during treatment such that the internal diameter is increased.

A DOSIF, such as DOSIF 500, may have one or more slots or openings (for example, openings 506, 508, 510, 512, 514, 516, 518, 520) along a desired portion of height E. The openings (for example, openings 506, 508, 510, 512, 514, 516, 518, 520) may penetrate through the entire shell (wall, side) of DOSIF 500. The openings, for example, openings 506, 508, 510, 512, 514, 516, 518, 520, may begin at the edge of DOSIF 500 and extend along a desired portion of height E of DOSIF 500. Openings, such as openings 506, 508, 510, 512, 514, 516, 518, 520, may cause parts of DOSIF 500 adjacent to the openings, such as openings 506, 508, 510, 512, 514, 516, 518, 520 to be essentially flexible or elastic, compared to a DOSIF without openings (not shown). Such flexibility or elasticity may enable DOSIF 500 to better fit, for example, into a squeezing device (described hereinbelow). Such flexibility or elasticity may also allow a squeezing device to squeeze DOSIF 500. Essentially due to the flexibility or elasticity, pressure imposed on the outer side of DOSIF 500 may cause DOSIF 500 to better fit an external diameter of a treated cylindrical component (provided in FIG. 9I and described hereinbelow) inserted into DOSIF 500.

Figure 9H:
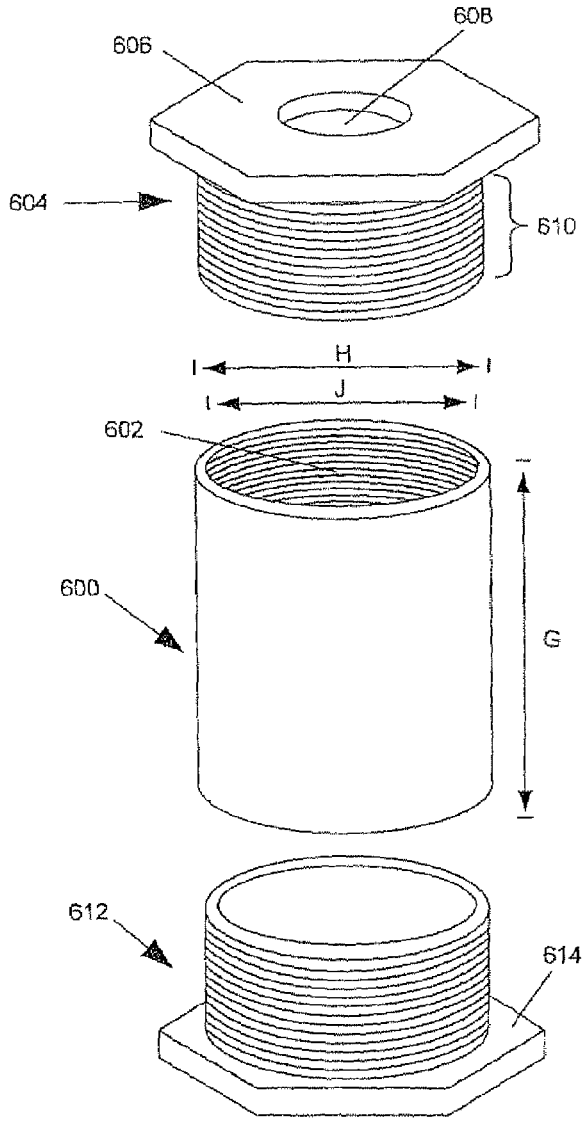
FIG. 9H is an exemplary, schematic perspective view of an inventive cylindrical assembly fitting over the hollow cylindrical element of FIG. 9G.

An embodiment of the squeezing device shown in FIG. 9H, may include three components: a central tube ("CET"), such as CET 600, a top cover ("TOC"), such as TOC 604 and a bottom cover ("BOC"), such as BOC 612.

CET 600 may essentially be a tubular or a hollow cylindrical device having a height, such as height G, an internal diameter, such as internal diameter J and an external diameter, such as external diameter H. CET 600 may have a homogenous internal diameter along its entire height G or desired portion(s) of it, and a homogenous or a varying external diameter along its entire height C or desired portion(s) of it. The internal diameter J of CET 600 may functionally fit an external diameter of a DOSIF, such as DOSIF 500, so that DOSIF 500 can be inserted (in a way to be described) into CET 600 with height E of DOSIF 500 parallel to height G of CET 600. CET 600 may have a thread 602 on the inner side of its shell. Thread 602 may be functionally adapted (in complementary fashion) to threads (for example, threads 610 and 616) on TOC 602 and BOC 612.

In the embodiment of CET 600 provided hereinabove, CET 600 is often made of a single piece of metal. In another embodiment of the CET (not shown), the CET may include two or more sub-sections or layers, each made of similar or different materials.

TOC 604 is essentially a tubular or a hollow cylindrical device that may have an external diameter, such as external diameter J, at its threaded area 610. TOC 604 may have a thread 610 on a portion of its outer surface. Thread 610 may be functionally adapted to a thread (for example, thread 602) on CET 600. TOC 604 may have a varying internal diameter, larger towards its lower part and smaller towards its upper part and the upper hole 608 (will be described). The optional varying internal diameter of TOC 604 may functionally fit uppermost portion 524 and/or lowermost portion 522 of DOSIF 500, when uppermost portion 524 or lowermost portion 522 of DOSIF 500 is inserted into TOC 604 with the narrower side towards the upper part and the upper hole 608 of TOC 604. "Functionally fit" may include such a varying internal diameter of TOC 604 that may essentially apply pressure on the uppermost portion 524 and/or the lowermost portion 522 of DOSIF 500, and essentially cause them to be squeezed or compressed, essentially due to the openings, such as openings 502, 506, 508, 510, 512, 514, 516, 518 and 520. TOC 604 may have a hex nut (hexagonal nut), such as hex nut 606 attached to it from the top. Hex nut 606 may be formed essentially as an integral part of TOC 604 or as essentially a separate part, functionally connected to TOC 604. Hex nut 608 may have a round or otherwise shaped hole ("upper hole"), such as upper hole 608 in its surface. In the exemplary embodiment shown in FIG. 9H, upper hole 608 has the shape of a circle, and is located at the center of the surface of hex nut 606. Upper hole 608 may facilitate the insertion of a treated cylindrical surface (will be described) through TOC 604.

BOC 612 may have the same or different shape and other characteristics of TOC 604 that were described above. For example, BOC 612 shown in FIG. 9H is identical TOC 604.

A surface of a cylinder, such as surface 702 of cylinder 700, may be suitable for treatment using a DOSIF, such as DOSIF 500. Cylinder 700 may be hollow, solid or have any other attributes to its internal area.

A DOSIF, such as DOSIF 500, may also be suitable for treating a cylinder having one or more grooves and/or depressions in its surface, for example depression 704. Due to the essentially tubular shape of DOSIF 500, when a cylinder, such as cylinder 700, is threaded through it, DOSIF 500 may be able to treat surface 702 of cylinder 700, which lies on the other side (not shown) of depression 704, without being essentially interfered or blocked by depression 704.

In addition, a DOSIF, such as DOSIF 500, may also be suitable for treating devices of various shapes that have an essentially cylindrical outline or shape to portion(s) of them.

One example of a cylinder that may be suitable for treatment by a DOSIF, such as DOSIF 500, is a rack-and-pinion steering gear—a component used in the automotive and other industries. A rack-and-pinion steering gear may be used, as part of a vehicle's steering system, for transferring power from a vehicle's steering wheel to the vehicle's wheels. For a more detailed explanation of rack-and-pinion steering gears, rack-and-pinion systems and other related components, see Schwaller, cited above, especially at pages 885-914. A rack-and-pinion steering gear may be made of steel and/or other rigid materials, and has the shape of essentially a cylinder with cogs or prongs on certain areas thereof. The cogs or prongs do not exceed the diameter of the cylinder. Essentially during the operation of a steering system, the rack-and-pinion steering gear may move and friction may occur between it and its housing or other components that come in contact with it. Treating the surface of the rack-and-pinion steering gear with a tool such as DOSIF 500 may reduce that friction.

Another example of a cylinder that may be suitable for treatment by a DOSIF, such as DOSIF 500, is a poppet valve—a component used in the automotive and other industries. Poppet valves are used to control fuel flow into an engine (such valves are often referred to as "intake valves") and/or control gas ejection from an engine (such valves are often referred to as "exhaust valves"). For a more detailed explanation of poppet valves and other components that may be related, see Schwaller, cited above, especially at pages 256-275. A poppet valve may be made of metal and/or other rigid materials, and may have the shape of essentially a cylinder (the "stem") having a wider round area (the "head") on one end, ending with a flat surface perpendicular to the stem. Essentially during the operation of an engine, the poppet valve may interchangeably move inside a bore in the engine block (often referred to as a "valve guide"), and friction may occur between the walls of the valve guide and the stem of the poppet valve and/or other related parts. Some engines may have an integral valve guide—a bore machined directly into the engine block, while other engines may have an insert valve guide—a hollow cylinder that is inserted into a bore in the engine block and serves as an intermediate between the bore and the poppet valve's stem. Treating the surface of the poppet valve's stem with a tool such as DOSIF 500 may reduce the friction between the poppet valve's stem and the walls of the valve guide (and/or other related parts).

Another example of a cylinder that may be suitable for treatment by a DOSIF, such as DOSIF 500, is a hydraulic piston—a component used in various variable displacement pumps (or axial piston pumps). Variable displacement pumps are devices that convert mechanical energy to hydraulic (fluid) energy. A hydraulic piston is essentially a cylinder made of metal or other rigid materials that may interchangeably slide within bores inside a drum of the variable displacement pump, for the purpose of essentially pushing or pulling fluids. For a more detailed explanation of variable displacement pumps, hydraulic pistons and other components that may be related, see Parr and Karassik, both of which have been referenced hereinabove. Essentially during the operation of a variable displacement pump, the hydraulic piston may interchangeably slide within a bore inside a drum of the variable displacement pump, and friction may occur between the hydraulic piston's outer surface and the inner surface of the drum's bore. Treating the surface of the hydraulic piston with a tool such as DOSIF 500 may reduce that friction.

Figure 9I:
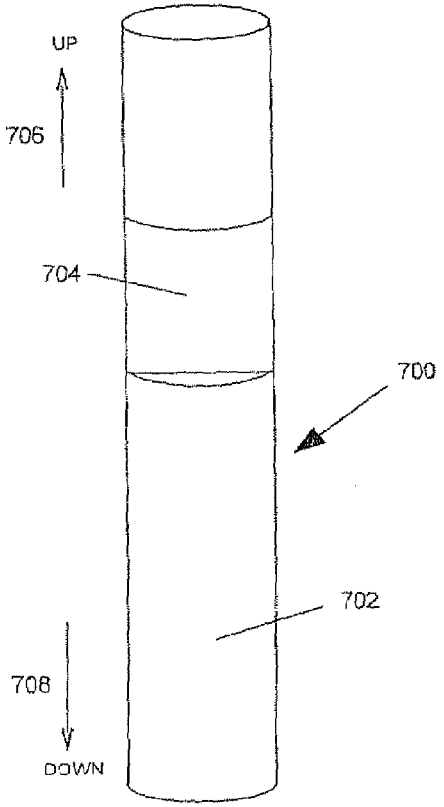
FIG. 9I is an exemplary, schematic perspective view of a generally cylindrical workpiece for treating with the cylindrical element and cylindrical assembly of FIGS. 9G-9H.

Treatment of cylindrical components, such as cylinder 700 shown in FIG. 9I using a DOSIF, such as DOSIF 500, may be conducted by fitting (in a way to be described) DOSIF 500 into a squeezing device (that may include 600, 604, 612) and threading the to-be-treated cylinder, such as cylinder 700, through DOSIF 500 and squeezing device (that may include 600, 604, 612). Then, DOSIF 500 and/or cylinder 700 may be spun or rotated around their central axis, so that the internal surface of DOSIF 500 may essentially functionally contact surface 702 of cylinder 700. The functional contact of DOSIF 500 with surface 702 of cylinder 700 may include reciprocating (moving interchangeably in two or more different directions) DOSIF 500 along the central axis of cylinder 700 (for example, reciprocating DOSIF 500 up 706 and down 708.) Reciprocating may also include moving cylinder 700 while DOSIF 500 remains in its place.

Fitting DOSIF 500 into squeezing device (that may include 600, 604, 612) may be performed, for example, by inserting DOSIF 500 into CET 600 with height E of DOSIF 500 parallel to height G of CET 600, and threading TOC 604 into the upper opening of CET 600, and BOC 612 into the lower opening of CET 600. The threading mentioned above may be performed by functionally using hex nut 606 and/or 614 for getting a better grip of TOC 604 and BOC 612, respectively, while performing the threading.

Various highly abrasive working agents (e.g., an organic paste containing fused alumina particles) may be used as an intermediate between the internal surface of DOSIF 500 and surface of a cylinder, such as surface 702 of cylinder 700.

Optionally, a DOSIF (not shown) may include one or more tubing systems adapted to deliver one or more working agents to a space delimited between an internal surface of a DOSIF and surface of a cylinder. An internal tubing system may include one or more tubes and/or bores that pass essentially through a DOSIF, and deliver the at least one working agent through one or more apertures in the internal surface of the DOSIF. Alternatively, an external tubing system may include one or more tubes running essentially externally to a DOSIF, to deliver the at least one working agent to a space between an internal surface of a DOSIF and the outer surface of a cylinder.

Optionally, a tubing system may include a combination of an internal tubing system and an external tubing system.

One or more working agents may be fed to a tubing system either continuously, at pre-determined intervals and/or otherwise when desired. Feeding may be conducted, for example, using a pump and/or other means.

The internal surface of DOSIF 500 may functionally contact surface 702 of cylinder 700.

In addition to the treatment described above, additional treatments of different or similar natures may be performed on surface 702 of cylinder 700, for the purpose of conveying particular frictional properties to it. Such one or more additional treatments may be performed on essentially the same area of surface 702 of cylinder 700 or on essentially distinct areas of it. Treatments can be performed either essentially simultaneously or at essentially separate instances.

Some possible additional treatments may include changing the structure of a surface, such as surface 702 of cylinder 700. Such change of structure may consist of forming one or more recessed or elevated zones on surface 702 of cylinder 300. Such recessed or elevated zones may have repeating or non-repeating patterns.

An example of a cylinder having two types of treatments applied to its surface is described hereinabove with respect to FIG. 9F.

Another aspect of the inventive lapping tool and lapping process relates to the treatment of the outside of cylindrical surfaces using a single-sided flexible tool ("SISIF"). One embodiment of the SISIF 800, shown in FIG. 9J, is essentially a tubular or a hollow cylindrical device having a height L and an internal diameter K. A SISIF 800 may have a homogenous internal diameter along the entire height L or along desired portion(s) thereof, and a homogenous or a varying external diameter along the entire height L or desired portion(s) thereof. In an exemplary embodiment of the SISIF, shown at 800 in FIG. 9J, the external diameter of uppermost portion 804 of SISIF 800 declines towards the uppermost edge of SISIF 800. An embodiment of SISIF, such as SISIF 800, may also have a surface, such as surface 806 with a declining external diameter. Surface 806 may extend from groove 802, where the diameter is relatively large, until the bottom edge of SISIF 800, where the diameter is relatively small.

An embodiment of the SISIF, such as SISIF 800, may have a groove on its external surface, such as groove 802. Groove 802 may extend from the bottom edge of uppermost portion 804 of SISIF 800 until a desired location on surface 806 below groove 802.

In the embodiment of the SISIF 800 described above and shown in FIG. 93, SISIF 800 is often made of a single piece of polymeric material. In another embodiment of the SISIF (not shown), it may include two or more sub-sections or layers, each may be made of similar or different materials.

SISIF 800 may have one or more slots, grooves or openings (for example, openings 808, 810, 812, 814) along a desired portion, up to the entire height L of SISIF 800. For example, openings 808, 810 and 814 may extend from the top rim of SISIF 800 until a desired location on surface 806 of SISIF 800, and opening 812 may extend from the top rim of SISIF 800 until its bottom rim. The openings (for example, openings 808, 810, 812, 814) may penetrate through the entire shell (wall, side) of SISIF 800. The openings (for example, openings 808, 810, 812, 814) may begin at the uppermost edge of SISIF 800 and extend along a desired portion of the height L of SISIF 800. Openings (for example, openings 808, 810, 812, 814) may cause parts of SISIF 800 adjacent to the openings (for example, openings 808, 810, 812, 814) to be essentially flexible or elastic, compared to a SISIF without openings (not shown). Such flexibility or elasticity may enable a SISIF, such as SISIF 800, to better fit, for example, into a squeezing device (an exemplary squeezing device will be discussed hereinbelow with respect to FIG. 9K) Such flexibility or elasticity may also allow a squeezing device to squeeze SISIF 800. Essentially due to the flexibility or elasticity, pressure imposed on the outer side of SISIF 800 may cause SISIF 800 to better fit an external diameter of a treated cylindrical component (provided in FIG. 9L and described hereinbelow) inserted into SISIF 800.

An embodiment of the squeezing device, shown in FIG. 9K, may include two components: a central tube ("CETU"), such as CETU 900, and a top cover ("TOCO"), such as TOCO 904.

CETU 900 may essentially be a tubular or a hollow cylindrical device that may be closed on its bottom end 916 and may have a height, such as AA. CETU 900 may have a varying or homogenous external diameter, and a varying internal diameter along the entire height AA or desired portion(s) thereof. For example, the internal diameter of CETU 900 may be homogenous along a threaded area, such as threaded area 902, until a first imaginary circumferential line, such as first imaginary circumferential line 912, and then gradually decrease (as shown schematically by lines 918, 920) until a second imaginary circumferential line, such as second imaginary circumferential line 914. This exemplary varying internal diameter of CETU 900 may functionally fit the external shape of surface 806 of SISIF 800, such that SISIF 800 can be inserted (in a way to be described) into CETU 900 with height L of SISIF' 800 parallel to height AA of CETU 900.

CETU 900 may have a thread, such as thread 902, on a desired portion of its shell's inner side. For example, thread 902 may extend from the top part of CETU 900 until first imaginary circumferential line 912. Thread 902 may be functionally adapted to a thread, such as thread 910, on TOCO 902.

In the embodiment of the CETU 900 described above and shown in FIG. 9K, CETU 900 is often made of a single piece of metal. In another embodiment of the CETU (not shown), it may include two or more sub-sections or layers, each may be made of similar or different materials, TOCO 904 may essentially be a tubular or a hollow cylindrical device. TOCO 904 may have a thread, such as thread 910, on a portion of its outer surface. Thread 910 may be functionally adapted to a thread, such as thread 902 on CETU 900. TOCO 904 may have a varying internal diameter, larger towards its lower part and smaller towards its upper part and upper hole 908 (will be described). The varying internal diameter of TOCO 904 may functionally fit uppermost portion 804 of SISIF 800, when uppermost portion 804 of SISIF 800 is inserted into TOCO 904 with its narrower side towards the upper part and upper hole 908 of CETU 904. "Functionally fit" may include such a varying internal diameter of TOCO 904 that may essentially apply pressure on uppermost portion 804 of SISIF 800, and essentially cause it to squeeze or compress, essentially due to the openings (such as openings 808, 810, 812 and 814).

TOCO 904 may have a hex nut (hexagonal nut), such as hex nut 906, attached to it from the top. Hex nut 906 may be formed essentially as an integral part of TOCO 904 or as an essentially separate part, functionally connected to TOCO 904. Hex nut 908 may have a round or otherwise shaped hole, such as upper hole 908 in its surface. In an embodiment shown in FIG. 9K, upper hole 908 has the shape of a circle, and is located at the center of the surface of hex nut 906. Upper hole 908 may be essentially functionally larger than the diameter of the top edge of uppermost portion 804 of SISIF 800, so that once SISIF 800 is inserted into the squeezing device, the top edge is essentially approximately aligned with the top surface of hex nut 906. Upper hole 908 may facilitate the insertion of a treated cylindrical surface (will be described) through TOCO 904.

A surface of a cylinder, such as surface 1002 of cylinder 1000, may be suitable for treatment using a SISIF, such as SISIF 800. Cylinder 1000 may be hollow, solid or have any other attributes to its internal area.

SISIF 800 may also be suitable for treatment of cylinders, such as cylinder 1000, that are essentially functionally attached or connected on one end to other devices, such as device 1008, that may be larger in diameter than the cylinder.

One example of a cylinder that may be suitable for treatment by a SISIF, such as SISIF 800 is a trunnion of a CV (Constant Velocity) joint—a component used in the automotive and other industries. CV joints or other joints (such as a Universal Joint) may be used as part of a vehicle's torque transfer system—a system that may essentially transfer torque from the vehicle's engine to some or all of its wheels. For a more detailed explanation of trunnions, CV joints, Universal Joints and other components that may be related, see Schwaller, cited above, especially at pages 767-788. A trunnion may be made of steel and/or other rigid materials, and has the shape of essentially a cylinder, essentially attached or connected on one of its ends to a device such as a CV joint. A CV joint may have a number of trunnions (for example: four trunnions) essentially attached to it. A cap, sometimes called a Bearing Cap, may be fitted on the trunnion. Essentially during the operation of a torque transfer system, the trunnion may move relative to the bearing cap, and friction may occur between them. Treating the surface of the trunnion with a tool such as SISIF 800 may reduce that friction.

Treatment of cylindrical components, such as cylinder 1000 shown in FIG. 9L, using a SISIF, such as SISIF 800, may be conducted by fitting (in a way to be described) SISIF 800 into a squeezing device (that may include 900, 904) and threading the to-be-treated cylinder (for example, cylinder 1000) essentially through a portion of SISIF 800 and the squeezing device (that may includes 900, 904). Then, the squeezing device (that may include 900, 904) that essentially contains SISIF 800 may be spun or rotated around its central axis, so that the internal surface of SISIF 800 essentially functionally contacts surface 1002 of cylinder 1000. The functional contact of SISIF 800 with surface 1002 of cylinder 1000 may include reciprocating (moving interchangeably in two or more different directions) SISIF 800 along the central axis of cylinder 1000 (for example, reciprocating SISIF 800 up 1004 and down 1006.) Reciprocating may also include moving cylinder 1000 while SISIF 800 remains in its place.

Fitting SISIF 800 into the squeezing device (that may include 900, 904) may be performed, for example, by inserting SISIF 800 into CETU 900 with height L of SISIF 900 parallel to height AA of CETU 900, and uppermost portion 804 of SISIF 900 towards the upper aperture of CETU 900, and then threading TOCO 904 using thread 910 into the upper aperture of CETU 900 using its thread 902. The threading mentioned above may be performed by using hex nut 906 to obtain a better grip of TOCO 904 while performing the threading.

Various abrasive working agents may be used as an intermediate between the internal surface of SISIF 800 and surface of a cylinder, such as surface 1002 of cylinder 1000.

Optionally, a SISIF may include one or more tubing systems adapted to deliver one or more working agents to a space delimited between an internal surface of a SISIF and surface of a cylinder. An internal tubing system may include one or more tubes and/or bores that pass essentially through a SISIF, and deliver the at least one working agent through one or more apertures in the internal surface of the SISIF. Alternatively, an external tubing system may include one or more tubes running essentially externally to a SISIF, to deliver the at least one working agent to a space between an internal surface of a SISIF and the outer surface of a cylinder.

Optionally, a tubing system may include a combination of an internal tubing system and an external tubing system.

One or more working agents may be fed to a tubing system either continuously, at pre-determined intervals and/or otherwise when desired. Feeding may be conducted, for example, using a pump and/or other means.

In addition to the treatment described above, additional treatments of different or similar natures may be performed on surface 1002 of cylinder 1000, for the purpose of conveying particular frictional properties to it. Such one or more additional treatments may be performed on essentially the same area of surface 1002 of cylinder 1000 or on essentially distinct areas of it. Treatments can be performed either essentially simultaneously or at essentially separate instances.

Some possible additional treatments may include changing the structure of a surface, such as surface 1002 of cylinder 1000. Such change of structure may consist of forming one or more recessed or elevated zones on surface 1002 of cylinder 1000. Such recessed or elevated zones may have repeating or non-repeating patterns.

An example of a cylinder with two types of treatments applied to its surface is provided hereinabove.

Another aspect of the inventive lapping tool and lapping process relates to the treatment of the outside of cylindrical surfaces using a disk, a separator and a pressure plate, hereinafter jointly referred to as a "DISEP". One embodiment of the disk, shown at 2400 in FIG. 9M, may essentially be a round plate or a disk-shaped device, having a body, such as body 2408, an essentially flat working area, such as working area 2402 which is essentially a surface of body 2408, and a base, such as base 2404 located on the opposite side of working area 2402.

In another embodiment of the disk (not shown), its working area may have one or more recessed or elevated zones on it. Such recessed or elevated zones may have repeating or non-repeating patterns.

Body 2408 of disk 2400 may have a homogeneous or varying thickness. In the embodiment of disk 2400 shown in FIG. 9M, body 2408 has a homogeneous thickness along its entire area.

In the embodiment of disk 2400 described above and shown in FIG. 9M, body 2408 is often made of a single piece of polymeric material, either solid, hollow, or with other internal characteristics. In another embodiment of the body (not shown), it may include two or more sub-sections or layers, each may be made of similar or different materials. For example, the body may have two layers, one (on which a working area will be present) made of a polymeric material, and one made of a rigid material.

Base 2404 may essentially be a cylindrical device solid, hollow or with other internal characteristics, having a central axis, such as central axis 2406, which essentially merges with central axis 2406 of body 2408. Base 2404 may either be integrally formed with body 2408 and made of the same polymeric material, or essentially functionally connected to body 2408. If base 2404 is essentially functionally connected to body 2408, it may be made of a polymeric material similar or identical to the polymeric material that may be used to form base 2404, or made of another rigid material such as metal. Forming base 2404 with other rigid materials may be advantageous due to the relatively high cost of some polymeric materials that may be used to form it, compared to the possible cost of other rigid materials that may be used. Another possible reason may be the functional need to add rigidity and/or support to disk 2400; since the polymeric material that may form it may be less mechanically-stable compared to other rigid materials, using such rigid materials to form base 2404 may essentially add rigidity and support to the entire disk 2400.

Base 2404 may function essentially as a functional intermediate between body 2408 and an external torque (or other movement) transfer device (not shown), that may essentially functionally connect to base 2404, spin or rotate it, and thus cause rotation of the entire disk 2400.

Figure 9M:
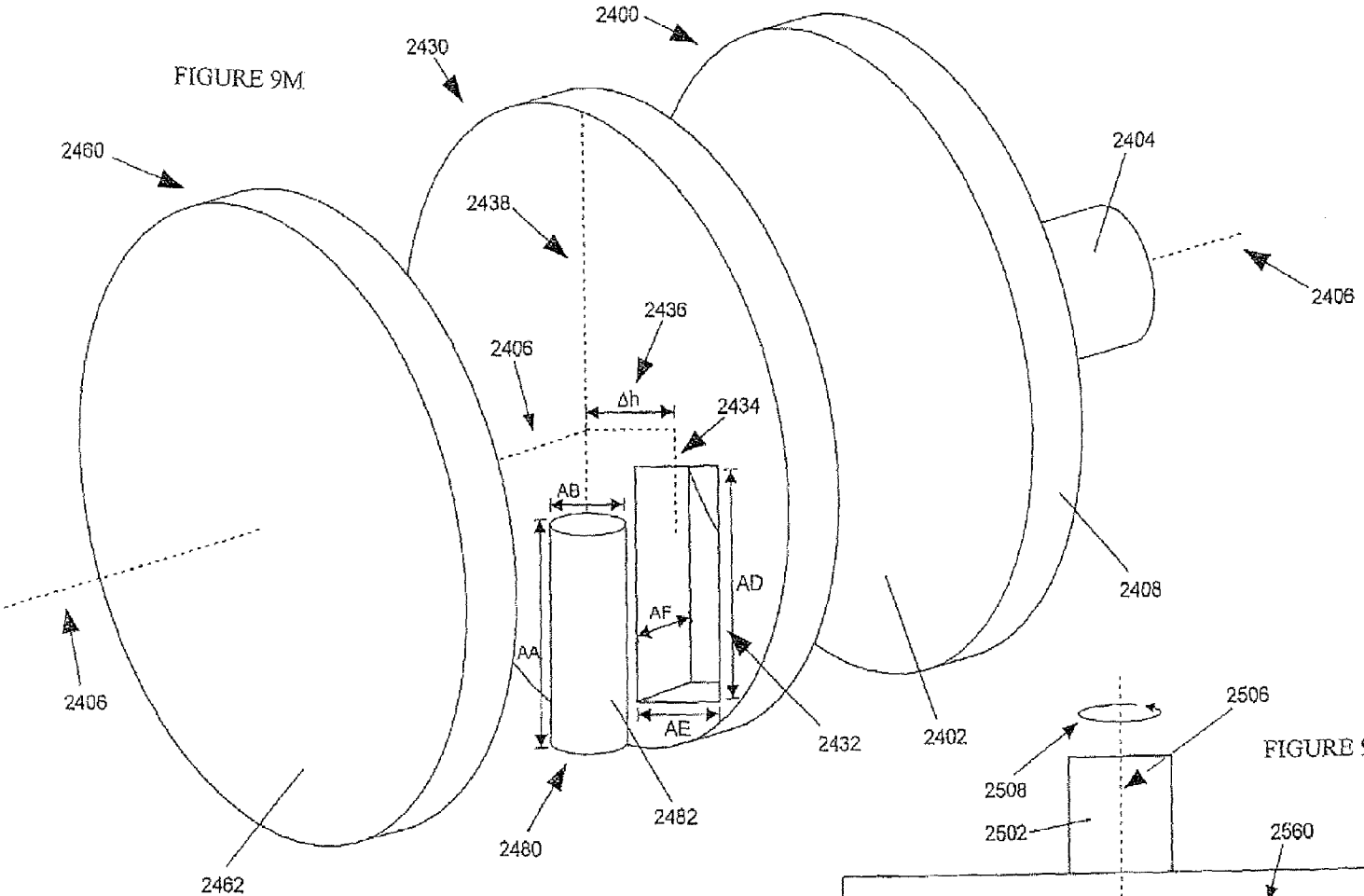
FIG. 9M is an exemplary, schematic perspective view of a lapping tool system according to another embodiment of the present invention.

An embodiment of separator 2430, shown in FIG. 9M, may essentially be a round plate or a disk-shaped device, equal or different in size than disk 2400, having one or more holes that penetrate through its entire thickness. In the exemplary embodiment of separator 2430 shown in FIG. 9M, separator 2430 has one hole, such as hole 2432 that penetrates through its entire thickness. Larger number of holes may essentially enable simultaneous treatment of more treated components, and thus may lower costs and save time.

Separator 2430 may be formed with hole(s) of desired sizes that may essentially correspond to sizes of treated cylinder(s), such as cylinder 2480, to facilitate the insertion of the treated cylinder(s), such as cylinder 2480, into the hole(s), such as hole 2432. For example, height AA of exemplary cylinder 2480 may be essentially slightly shorter than height AD hole 2432, and diameter AB of exemplary cylinder 2480 may be essentially slightly smaller than width AE of hole 2432. The essentially slightly larger measurements of hole 2432 may be required in order for cylinder 2480 to loosely fit therein.

Separator 2430 may have a thickness measuring less than the diameter of treated cylinder 2480. For example, thickness AB of separator 2430 may measure less than diameter AB of treated cylinder 2480. In this case, treated cylinder 2480, when inserted into hole 2432 in separator 2430, may protrude beyond the two opposing surfaces of separator 2430, and thus may essentially functionally contact working area 2402 of disk 2400 from one side, and pressure plate 2460 from the other side. Such functional contact, which may essentially constitute a part of or all of the treatment, is further explained hereinbelow.

A hole, such as hole 2432, may be positioned (as shown in FIG. 9M) with imaginary line 2434 (which may be parallel to height AD of hole 2432 and intersect with width AE of hole 2432 in its middle) essentially parallel to a diameter, such as diameter 2438 of separator 2430. In addition, distance $\Delta h$ 2436 between imaginary line 2434 and diameter 2438 may be different than zero (0). In the exemplary treatment shown in FIG. 9M, $\Delta h$ 2436 is larger than zero (0), and may have a value, for example, of 5 centimeters. The general mathematical expression of $\Delta h$ may be $|\Delta h|>0$ (in words: the absolute value of $\Delta h$ is larger than zero). As $|\Delta h|$ is larger, treatment may be more efficient and/or convey better frictional properties to the treated surface, as greater distance between imaginary line 2434 and diameter 2438 may result in a more complex pattern of functional contact between working area 2402 of disk 2400 and surface 2482 of treated cylinder, such as cylinder 2480. Different values of $|\Delta h|$ may also be reflected in different characteristics of frictional properties conveyed to the treated surface—characteristics that may not be necessarily defined in terms of "better" or "worse".

A separator, such as separator 2430, may essentially have functional connectors (not shown) adapted to secure separator 2430 to one or more other objects, for the purpose of stabilizing and/or securing separator 2430 in a desired position. Such stabilizing and/or securing may be needed due to torque (rotary movement) and/or other types of motion that may essentially be conveyed from disk 2400, treated cylindrical component 2480 and/or pressure plate, such as pressure plate 2460.

In the embodiment of separator 2430 described above and shown in FIG. 9M, separator 2430 is often made of a single piece of polymeric or other rigid materials, either solid, hollow, or with other internal characteristics. In another embodiment of the separator (not shown), it may include two or more sub-sections or layers, each may be made of similar or different materials. For example, the majority of the separator may be made of metal or other rigid materials, whereas a thin layer covering the four inner walls of the hole may be made of either polymeric material that may function as additional means of treating the cylinder, such as cylinder 2480, or of a function-neutral material that may prevent undesired contact between rigid portions of the separator and the treated cylinder, such as cylinder 2480. One other possible reason for forming a separator with two or more sub-sections and/or layers is the relative high cost of some polymeric materials that may be used to form it, compared to the possible cost of other rigid materials that may be used. Yet another possible reason may be the functional need to add rigidity and/or support to separator 2430; since the polymeric material that may form it may be less mechanically-stable compared to other rigid materials, using such rigid materials to form portions and/or layers of it may essentially add rigidity and support to it.

An embodiment of pressure plate 2460, shown in FIG. 9M, may essentially be a round plate or a disk-shaped device, equal or different in size compared to disk 2400 and/or separator 2460. The round surface area (not shown) located on the flip side of round surface area 2462, is the pressure plate working area, hereinafter referred to as "PP working area".

A pressure plate, such as pressure plate 2460, may essentially have functional connectors (not shown) adapted to secure it to other object(s), for the purpose of stabilizing and/or securing it in a desired position. Such stabilizing and/or securing may be needed due to torque (rotary movement) and/or other types of motion that may essentially be conveyed from disk 2400, treated cylindrical component 2480 and/or separator 2430.

In the embodiment of pressure plate 2460 described above and shown in FIG. 9M, pressure plate 2460 is often made of a single piece of polymeric material, either solid, hollow, or with other internal characteristics. In another embodiment of the pressure plate (not shown), it may include two or more sub-sections or layers, each may be made of similar or different materials. For example, the pressure plate may have two layers, one (on which a PP working area will be present) made of polymeric material, and one made of another rigid material. One other possible reason for forming a pressure plate with two or more sub-sections and/or layers is the relative high cost of some polymeric materials that may be used to form it, compared to the possible cost of other rigid materials that may be used. Yet another possible reason may be the functional need to add rigidity and/or support to pressure plate 2460; since the polymeric material that may form it may be less mechanically-stable compared to other rigid materials, using such rigid materials to form portions and/or layers of it may essentially add rigidity and support to it.

A surface of a cylinder, such as surface 2482 of cylinder 2480, may be suitable for treatment using a DISEF such as the DISEF shown in FIG. 9M. Cylinder 2480 may be hollow, solid or have any other attributes to its internal area.

One example of a cylinder that may be suitable for treatment by a DISEF, such as the DISEF shown in FIG. 9M, is a piston pin (or a wrist pin)—a component used in the automotive and other industries. A piston pin may be used for connecting two parts inside an engine—the piston and the connecting rod. For a more detailed explanation of a piston pin, a piston, a connecting rod and other components that may be related, see Schwaller, cited above, especially at pages 241-243. A piston pin may be made of steel and/or other rigid materials, and has the shape of essentially a cylinder. Essentially during the operation of the engine, the piston and the connecting rod move, and friction may occur between at least one of them and the piston pin. Treating the surface of the piston pin with a tool such as the DISEF shown in FIG. 9M may reduce that friction.

Another example of a cylinder that may be suitable for treatment by a DISEF, such as the DISEF shown in FIG. 9M, is a hydraulic piston. Essentially during the operation of a variable displacement pump, the hydraulic piston may interchangeably slide within a bore inside a drum of the variable displacement pump, and friction may occur between the hydraulic piston's outer surface and the inner surface of the drum's bore. Treating the surface of the hydraulic piston with a tool such as the DISEF shown in FIG. 9M may reduce that friction.

Another example of a cylinder that may be suitable for treatment by a DISEF, such as the DISEF shown in FIG. 9M, is a roller of a roller bearing (sometimes referred to as a "non-friction bearing")—a component used in the automotive and other industries, Roller bearings are bearings that may generally include two rings or hollow cylinders that may be made of metal or other rigid materials and may have different diameters. The ring having the smaller diameter may be mounted inside the ring having the larger diameter, with rollers (essentially cylinders) intermediating between the two rings. When one of the rings spins, it may cause spinning of the rollers, which may, in turn, functionally contact the other ring. Due two the rolling of the rollers, less friction is usually experienced with roller bearings than with sliding bearings, which lack rollers. For a more detailed explanation of roller bearings and other components that may be related, see Khonsari et al., Harnoy, and Harris, et al., all of which have been referenced hereinabove. For a more detailed explanation of the use of roller bearings in the automotive industry, see Schwaller, cited above, especially at pages 75-85. Essentially during the operation of a roller bearing, as described above, the rollers may roll or spin, causing friction between them and at least of the rings. Treating the outer surface of the rollers with a tool such as the DISEF shown in FIG. 9M may reduce that friction.

Figure 9N:
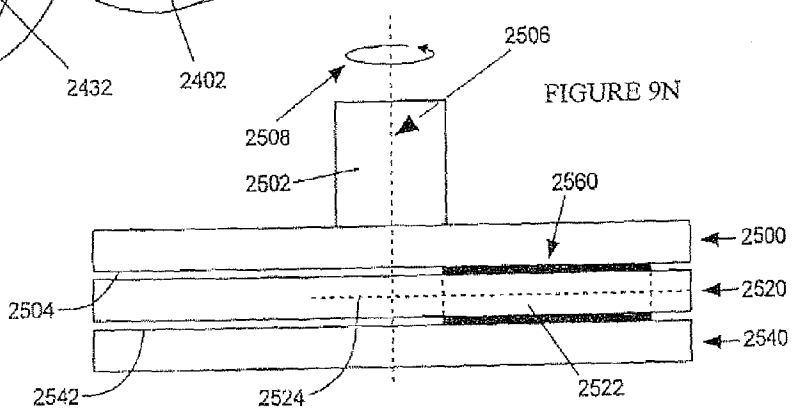
FIG. 9N is a schematic sectional view of the lapping tool system of FIG. 9M.

Essentially prior to the treatment of cylinder 2480 surface 2482 using a DISEF, such as the DISEF shown in FIG. 9M, separator 2430 may essentially be placed adjacent to working area 2402 of disk 2400, cylinder 2480 may essentially be placed inside hole 2432 of separator 2430, and pressure plate 2460 may essentially be placed adjacent to separator 2430. Referring now to FIG. 9N, an exemplary position of the disk (that may include 2500 and 2502), separator 2520, cylinder 2560 and pressure plate 2540 is shown in a two-dimensional side view. As shown in FIG. 9N, the disk, separator 2520, cylinder 2560 and pressure plate 2540 may be positioned in such a way that cylinder 2560 (that may essentially be contained within hole 2522 in separator 2520) essentially functionally contacts working area 2504 of the disk and/or PP working area 2542. Cylinder 2560 may essentially also functionally contact the internal walls of hole 2522 in which the cylinder may essentially be contained.

Essentially after the disk, separator 2520, cylinder 2560 and pressure plate 2540 have been positioned according to the exemplary description given above or in a different position, the disk may be spun or rotated (for example, in direction of rotation 2508) around its central axis 2506 while separator 2520 and pressure plate 2540 may be secured in place. Essentially due to the rotation of the disk and its functional contact with cylinder 2560, cylinder 2560 may rotate or spin around its central axis 2524 and acquire certain frictional properties essentially due to its functional contact with working area 2504, walls of hole 2522 and/or PP working area 2542.

Various abrasive working agents may be used as an intermediate between surface of a cylinder, such as surface 2482 of cylinder 2480, and working area 2402, internal walls of hole 2432 and/or PP working area.

Optionally, a disk of the DISEP may include one or more tubing systems adapted to deliver at least one working agent to a space delimited between a working area of a disk and surface of a cylinder. An internal tubing system may include one or more tubes and/or bores that pass essentially through a disk, and deliver the at least one working agent through one or more apertures in the working area of the disk. Alternatively, an external tubing system may include one or more tubes that run essentially externally to a disk, and deliver the at least one working agent to a space delimited between a working area of a disk and surface of a cylinder.

Optionally, a separator may include one or more tubing systems adapted to deliver at least one working agent to a space delimited between internal walls of a separator hole and the surface of a cylinder. An internal tubing system may include one or more tubes and/or bores that pass essentially through the body of a separator, and deliver the at least one working agent through one or more apertures in the internal walls of the separator hole. Alternatively, an external tubing system may include one or more tubes that run essentially externally to a separator, and deliver the at least one working agent to a space delimited between internal walls of a separator hole and surface of a cylinder.

Optionally, a pressure plate may include one or more tubing systems adapted to deliver at least one working agent to a space delimited between a PP working area and the surface of a cylinder. An internal tubing system may include one or more tubes and/or bores that pass essentially through the body of a pressure plate, and deliver the at least one working agent through one or more apertures in the PP working area. Alternatively, an external tubing system may include one or more tubes that run essentially externally to a pressure plate, and deliver the at least one working agent to a space delimited between a PP working area and surface of a cylinder.

Optionally, a tubing system may include a combination of an internal tubing system and an external tubing system.

One or more working agents may be fed to a tubing system either continuously, at pre-determined intervals and/or otherwise when desired. Feeding may be conducted, for example, using a pump and/or other means.

In addition to the treatment described above, additional treatments of different or similar natures may be performed on a treated surface (for example, surface 2482), for the purpose of conveying particular frictional properties to it. Such one or more additional treatments may be performed on essentially the same area of the treated surface (for example, surface 2482) or on essentially distinct areas of it. Treatments can be performed either essentially simultaneously or at essentially separate instances.

Some possible additional treatments may include changing the structure of a surface, such as surface 2482. Such change of structure may consist of forming one or more recessed or elevated zones on it. Such recessed or elevated zones may have repeating or non-repeating patterns.

Treatment of a cylinder, such as cylinder 2480, may be also conducted using only a disk, such as disk 2400, without a separator, such as separator 2430, and/or without a pressure plate, such as pressure plate 2460. Such treatment may require stabilizing and/or securing cylinder 2480 using means (not shown) other than separator 2430 and pressure plate 2460, and rotating or spinning cylinder 2480 using the same means (not shown) used for stabilizing and/or securing it, or other means (not shown), while essentially simultaneously functionally contacting surface 2482 of cylinder 2480 with working area 2402 of disk 2400. The functional contact of working area 2402 with surface 2482 of cylinder 2480 may include reciprocating (moving interchangeably in two or more different directions) cylinder 2480 along an imaginary line (not shown) parallel to height AA of cylinders 2480, or along another imaginary line (not shown) parallel to diameter AB of cylinder 2480.

Figure 9O:
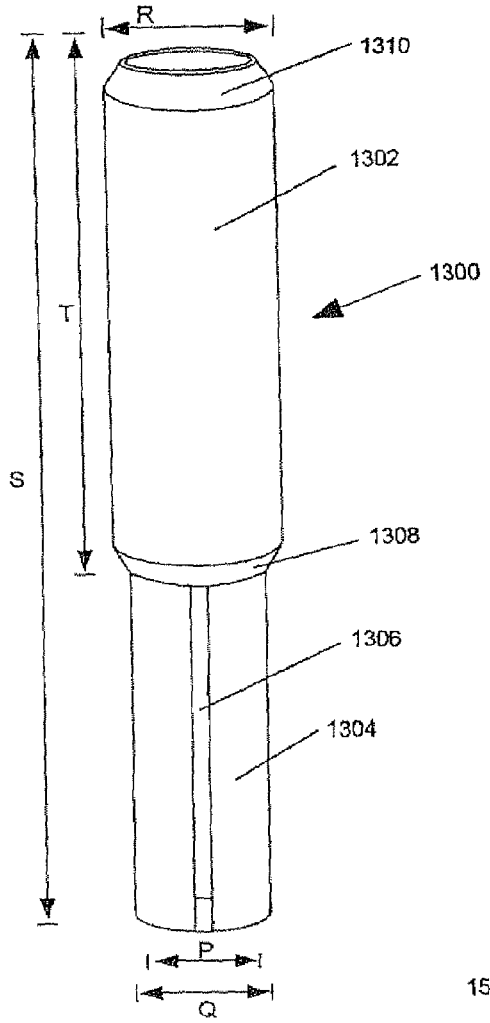
FIG. 9O is an exemplary, schematic perspective view of another inventive hollow, generally cylindrical element having a contact surface for treating a working surface on the inside diameter of a workpiece.

Another aspect of the inventive lapping tool and lapping process relates to the treatment of the inside of cylindrical surfaces using a sleeve tool ("sleeve"). One embodiment of the sleeve, such as sleeve 1300 shown in FIG. 9O, is essentially a tubular or a hollow cylindrical device that may include a base, such as base 1304, and a coating, such as coating 1302.

One embodiment of base 1304 may be essentially a tube or a hollow cylinder having a length, such as length S, an internal diameter such as internal diameter P and an external diameter such as external diameter Q. Internal diameter P may be homogenous or varying along its length S. External diameter Q may be homogenous or varying along its length S. Referring now to the essentially tubular form of exemplary base 1304, the base may be open on one end and closed on the other, or open on both ends.

Base 1304 may have one or more openings, slots or grooves, such as opening 1306, along its entire length S. Such openings may penetrate through the entire shell (wall, side) of base 1304. If there are one or more additional openings (not shown) such as opening 1306, a connecting element or measure (not shown) between shell parts on the two sides of an opening may be needed to prevent base 1304 from being separated into a plurality of parts (not shown). Opening 1306 may cause the base 1304 to be essentially flexible or elastic, compared to a base without an opening (not shown). This flexibility or elasticity may enable the internal and/or external diameter of base 1304 to expand or to be reduced in response to pressure applied essentially on the shell (wall, side) of base 1304 from its inner side or outer side. Pressure may be applied from the inner side of base 1304 by a wedge, for example. An exemplary wedge is provided in FIG. 9H and will be described hereinbelow. Essentially due to the flexibility or elasticity, pressure applied from the inner side of base 1304 may cause base 1304, and essentially the entire sleeve 1300, to better fit an internal diameter of a treated cylindrical component (described hereinbelow).

In the embodiment of sleeve 1300 described above and shown in FIG. 9O, base 1304 is often made of a single piece of metallic material. In another embodiment of the sleeve (not shown), the base may include two or more sub-sections or layers, each may be made of similar or different materials. One possible reason for forming a base with two or more sub-sections and/or layers is the relative high cost of some metallic materials that may be used to form it, compared to the possible cost of other rigid materials that may be used.

An embodiment of coating 1302 may be essentially a layer of polymeric or other material that is essentially wrapped around a portion of or the entirety of the external surface of base 1304. Coating 1302 may have a homogenous or a varying external diameter, such as diameter R, along its length, such as length T. In an exemplary embodiment of sleeve 1300 shown in FIG. 9O, the external diameter of its uppermost 1310 and lowermost 1308 portions is declining as it reaches the uppermost and the lowermost edges, respectively, of coating 1302. Coating 1302 may be welded, glued or otherwise essentially functionally connected to base 1304.

In the embodiment of sleeve 1300 described above and shown in FIG. 9O, coating 1302 is often made of a single piece of polymeric material. In another embodiment of the sleeve (not shown), the coating may include two or more sub-sections or layers, each may be made of similar or different materials. One possible reason for forming a base with two or more sub-sections and/or layers is the relative high cost of some polymeric materials that may be used to form the base, compared to the cost of various rigid materials that may be used.

An embodiment of the sleeve (not shown) may include only one component—a combination of a base and a coating. In this embodiment (not shown), the sleeve may be made of a single piece of polymeric material.

Figure 9P:
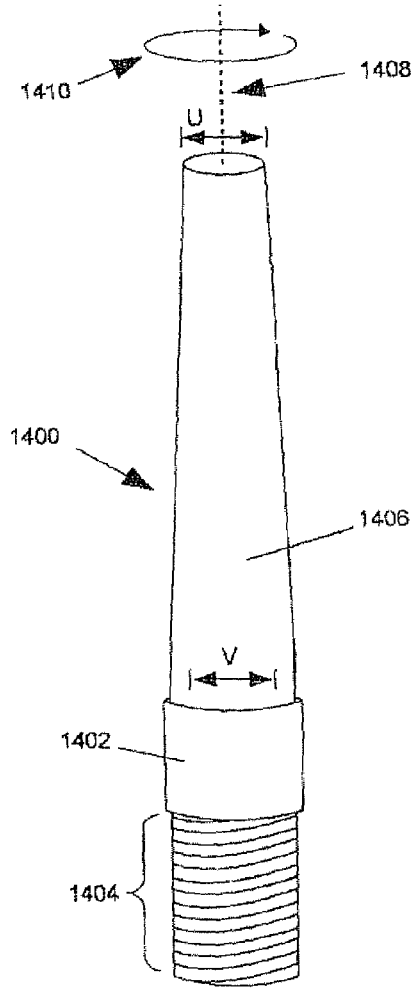
FIG. 9P is an exemplary, schematic perspective view of a wedge fitting into the hollow cylindrical element of FIG. 9O.

An embodiment of the wedge, such as wedge 1400 shown in FIG. 9P, is essentially a cylindrical device, having a diameter, such as diameter U, on the upper end of its shank, such as shank 1406, a diameter, such as diameter V on the lower side of its shank 1406, a cornice such as cornice 1402 and a thread such as thread 1404. Wedge 1400 may be hollow, solid or have any other attributes to its internal area.

The upper end of shank 1406 may have diameter U essentially smaller than diameter V on its lower side. The change in diameter of shank 1406 between the areas essentially near U and V may be constant or varying.

Cornice 1402 may be an area essentially elevated from the surface of shank 1406 and/or the essential surface of thread 1404. Cornice 1402 may be used to essentially stop a device (not shown) threaded onto thread 1404 from reaching an undesired area, such as shank 1406.

Thread 1404 may be an essentially cylindrical area having a thread over its outer surface. Referring now to FIG. 9H, an area such as area 1404 may be essentially fully threaded (such as in the exemplary embodiment provided in FIG. 9P) or may have a thread only on a desired portion or portions thereof. Thread 1404 may be used to essentially connect the wedge to other devices (not shown) that may deliver torque or other types of movement to thereto.

In the embodiment of wedge 1400 described above and shown in FIG. 9P, wedge 1400 is often made of a single piece of metallic material. In another embodiment of the sleeve (not shown), the wedge may include two or more sub-sections or layers, each may be made of similar or different materials. One possible reason for forming a base with two or more sub-sections and/or layers is the relative high cost of some metallic materials that may be used to form it, compared to the possible cost of other rigid materials that may be used.

An inner surface of a tube or a hollow cylinder, such as inner surface 1502 of cylinder 1500, may be suitable for treatment using a sleeve, such as sleeve 1300. Sleeve 1300 may also be suitable for treating an inner surface of a tube or a hollow cylinder having one or more grooves and/or depressions in its inner surface (not shown).

One example of a cylinder having an inner surface that may be suitable for treatment by a sleeve, such as sleeve 1300, is a rocker roller—a component used in the automotive industry and in various other industries. For example, a rocker roller may be part of the valve system of an internal combustion engine. Rocker rollers may be essentially hollow cylindrical devices that may essentially constitute a part of a rocker arm—an arm that opens and closes the valves following contact with a camshaft or a pushrod. The rocker arm may be functionally contacted by a camshaft or a pushrod that pushes on the rocker arm when a valve needs to be opened. The rocker roller is the part of the rocker arm that may come in contact with the camshaft or the pushrod. For a more detailed explanation of internal combustion engine valve systems and other components that may be related, see Schwaller (cited above) at pages 276-292.

A rocker roller may be made of metal and/or other rigid materials. It may be functionally connected to the rocker arm using a hinge that goes through the bore of the rocker roller. During the operation of an engine, the rocker roller may roll around the hinge, and friction may occur between the inner surface of the rocker roller and the hinge. Treating the inner surface of the rocker roller with a tool such as sleeve 1300 may reduce that friction.

Another example of a cylinder that may be suitable for treatment by a sleeve, such as sleeve 1300, is an outer ring of a sliding bearing (sometimes referred to as a "journal bearing" or a "friction bearing")—a component that may be used in the automotive and other industries. Sliding bearings are bearings that may generally include two rings or hollow cylinders that may be made of metal or other rigid materials and may have different diameters. The ring with the smaller diameter may be mounted inside the ring with the larger diameter, such that the outer surface of the inner ring may functionally contact the inner surface of the outer ring. A lubricant may sometimes serve as an intermediate between the two rings. For a more detailed explanation of sliding bearings and other components that may be related, see Khonsari et al, and Harnoy, both of which have been referenced hereinabove. For a more detailed explanation of the use of sliding bearings in the automotive industry, see Schwaller (referenced hereinabove), especially at pages 75-85 (in which sliding bearings may be referred to as "friction bearings"). During the operation of a sliding bearing, one ring may spin with respect to a second, associated ring, thus, friction may occur between the outer surface of the inner ring and the inner surface of the outer ring. Treating the inner surface of the outer ring with a tool such as sleeve 1300 may reduce that friction.

Figure 9Q:
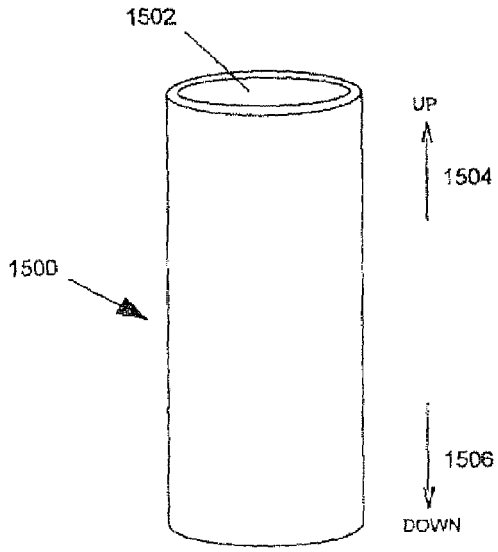
FIG. 9Q is an exemplary, schematic perspective view of a generally cylindrical workpiece having a working surface on the inside diameter thereof for treating with the cylindrical element and wedge unit of FIGS. 9O-9P.

Treatment of and internal surface of a tube or a hollow cylinder, such as internal surface 1502 of cylinder 1500, both shown in FIG. 9Q, using a sleeve such as sleeve 1300, may be conducted by inserting sleeve 1300 (wholly or partially) into cylinder 1500 and then inserting wedge 1400 into sleeve 1300, so that the uppermost end of the wedge (near U) is facing the uppermost end of the sleeve (near R). When inserting wedge 1400 into sleeve 1300, base 1304 and/or coating 1302 may expand in diameter due to the pressure applied thereto from the internal side of sleeve 1300 by wedge 1400. The expanding may bring the external diameter of coating 1302 to have approximately or exactly the same diameter as the internal diameter of cylinder 1500. The pressure applied on internal side of sleeve 1300 by wedge 1400 may secure together, fully or partially, wedge 1400 and sleeve 1300.

Essentially after wedge 1400 and sleeve 1300 have been secured together, fully or partially, wedge 1400 (along with the sleeve 1300) may be spun or around its central axis 1408 (for example, in a direction of rotation 1410), while essentially simultaneously functionally contacting coating 1302 with internal surface 1502 of cylinder 1500. The functional contact of coating 1302 with internal surface 1502 of cylinder 1500 may include reciprocating (moving interchangeably in two or more different directions) sleeve 1300 and/or wedge 1400 along the height of cylinder 1500 (for example, reciprocating sleeve 1300 and/or wedge 1400 up 1504 and down 1506.)

Various abrasive working agents may be used as an intermediate between an internal surface of a cylinder, such as internal surface 1502 of cylinder 1500, and a coating, such as coating 1302.

Optionally, a sleeve may include one or more tubing systems adapted to deliver at least one working agent to a space delimited between a coating of a sleeve and internal surface of a cylinder. An internal tubing system may include one or more tubes and/or bores that pass through a sleeve and deliver the at least one working agent through one or more apertures in a coating of the sleeve. Alternatively, an external tubing system may include one or more tubes running essentially externally to a sleeve, and deliver the at least one working agent to a space delimited between a coating of the sleeve and the internal surface of a cylinder.

Optionally, a tubing system may include a combination of an internal tubing system and an external tubing system.

One or more working agents may be fed to a tubing system either continuously, at pre-determined intervals and/or otherwise when desired. Feeding may be conducted, for example, using a pump and/or other means.

In addition to the treatment described above, additional treatments of different or similar natures may be performed on internal surface 1502 of cylinder 1500, for the purpose of conveying particular frictional properties thereto. Such one or more additional treatments may be performed on the same area of internal surface 1502 of cylinder 1500 or on distinct areas thereof.

Some possible additional treatments may include changing the structure of a surface, such as internal surface 1502 of cylinder 1500. Such change of structure may consist of forming one or more recessed or elevated zones on internal surface 1502 of cylinder 1500. Such recessed or elevated zones may have repeating or non-repeating patterns.

Another aspect of the inventive lapping tool and lapping process relates to the treatment of the inside of cylindrical surfaces using a spider tool ("spider"). An embodiment of the spider, such as spider 1100 shown in FIG. 9R, may include a hinge, such as hinge 1120, a shaft, such as shaft 1130, and one or more treatment components, such as treatment components 1102, 1104, 1106 and 1108 that may be essentially functionally attached to hinge 1120 and may essentially surround it.

Hinge 1120 may be cylindrical, cubic, or otherwise shaped. In the exemplary embodiment shown in FIG. 9R, hinge 1120 is essentially a cube, a cubic rectangle or a box-shaped device. Hinge 1120 may have cylindrical or otherwise shaped connectors (for example, connectors 1122, 1124) essentially threaded or passed through bores in its surface. Hinge 1120 may function as a central axis of spider 1100 when spider 1100 is spun or rotated to perform treatment (described below). Hinge 1120 may also function essentially as a supportive measure for the treatment components (for example, treatment components 1102, 1104, 1106, 1108) that may be essentially functionally attached to it.

Figure 9R:
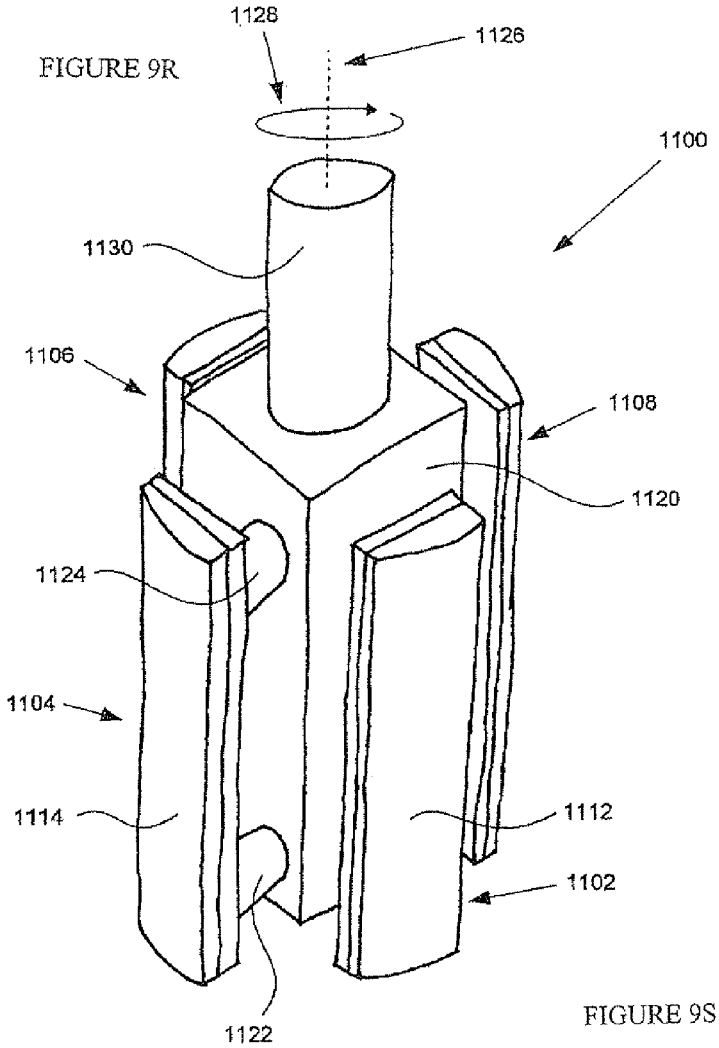
FIG. 9R is an exemplary, schematic perspective view of a spider-type lapping tool, according to the present invention.

In the embodiment of spider 1100 described herein and shown in FIG. 9R, hinge 1120 is often made of a single piece of metallic material. In another embodiment of the spider (not shown), the hinge may include two or more sub-sections or layers, each may be made of similar or different materials.

The shaft, such as shaft 1130, may be cylindrical, cubic, or otherwise shaped. In the exemplary embodiment shown in FIG. 9R, shaft 1130 is essentially a cylinder. Shaft 1130 may be essentially functionally attached to hinge 1120. In other embodiments, shaft 1130 and hinge 1120 may be integrally formed. Shaft 1130 may essentially function as an intermediate between spider 1100 and an external torque or rotation-transferring device (not shown) that may be used to spin or rotate the spider.

In the embodiment of spider 1100 described herein and shown in FIG. 9R, shaft 1130 is often made of a single piece of metallic material. In another embodiment of the spider (not shown), the shaft may include two or more sub-sections or layers, each may be made of similar or different materials.

The connectors, such as connectors 1122 and 1124, may be used to connect the treatment components, such as treatment components 1102, 1104, 1106 and 1108, to hinge 1120. The connectors, such as connectors 1122 and 1124, may be able to slide in and out through the bores in hinge 1120, to allow broadening and narrowing of the overall diameter of spider 1100. Narrowing the overall diameter of the spider may be needed in order to fit the spider into a to-be-treated cylindrical component (described below) essentially prior to the treatment (described below); broadening the overall diameter of spider 1100 may be needed after the spider is fitted into the to-be-treated cylindrical component (described below), in order to functionally press treatment components 1102, 1104, 1106 and 1108 against the inner surface of the to-be-treated cylindrical component.

In the embodiment of spider 1100 described herein and shown in FIG. 9R, the connectors, such as connectors 1122 and 1124, are often made of a single piece of metallic material. In another embodiment of the spider (not shown), the connectors may include two or more sub-sections or layers, each may be made of similar or different materials.

The treatment components, such as treatment components 1102, 1104, 1106 and 1108, may essentially be cubes, cubic rectangles or box-shaped devices. The side of a treatment component (for example, treatment components 1102, 1104, 1106, 1108) facing away from hinge 1120 is the working area (for example, working areas 1112, 1114), which may be symmetrically or asymmetrically concave. The radius of the concavity of working area (for example, working areas 1112, 1114) may be approximately equal to a radius of a to-be-treated cylindrical component (will be described), so that essentially a portion, up to the entire surface area of the working area (for example, working areas 1112, 1114), is in contact with the to-be-treated cylindrical component as the treatment (will be described) is being conducted. Prior to its contact with a to-be-treated cylindrical component, the concavity of the working area (for example, working areas 1112, 1114) may have a radius smaller or larger than the radius of a to-be-treated cylindrical component, and may lack concavity at all. As the treatment is being conducted, the working area (for example, working areas 1112, 1114) may self-form (or self-align) itself to the approximate or exact radius of the treated cylindrical component.

The treatment components (for example, treatment components 1102, 1104, 1106, 1108) may be essentially functionally connected to the hinge 1120 using one or more connectors (for example, connectors 1122, 1124). In an exemplary embodiment shown in FIG. 9R, each treatment component (for example, treatment components 1102, 1104, 1106, 1108) may be connected to hinge 1120 using two connectors (for example, treatment component 1104 may be connected to hinge 1120 using connectors 1122 and 1124).

In the embodiment of spider 1100 described herein and shown in FIG. 9R, the treatment components (for example, treatment components 1102, 1104, 1106, 1108) are often made of single pieces of polymeric material.

In another embodiment of the spider (not shown), the treatment components may have an external shape essentially similar or identical to that of treatment components 1102,

1104, 1106, 1108 shown in FIG. 9R, but may include two or more sub-sections. Each of the sub-sections may be made of similar or different materials. For example, a first sub-section may essentially be a layer of polymeric material on which a working area will be present, and a second sub-section may be a metallic base intermediating between the first sub-section and the connectors (such as connectors 1122 and 1124). Between these two sub-sections, one or more springs may be present, functionally adapted to allow flexible movement of the first sub-section relative to the second sub-section. Such flexible movement may allow better fitting of the spider inside a treated cylinder, and may essentially compensate for wear of the working area during treatment. Functional springs may be present also in other embodiments, in which the treatment components include only one section or more than two sections. Springs may be present in other locations, such as essentially inside or near the connectors (such as connectors 1122 and 1124).

An inner surface of a hollow cylinder or a tube, such as inner surface 1202 of hollow cylinder 1200, may be suitable for treatment using a spider, such as spider 1100.

Spider 1100 may also be suitable for treating an inner surface 1202 of a tube or a hollow cylinder 1200 having one or more grooves and/or depressions (not shown) in an inner surface thereof.

One example of a cylinder with an inner surface that may be suitable for treatment by a spider, such as spider 1100, is an engine cylinder—a component used in the automotive and other industries. An engine cylinder may be used to encompass the piston and provide space for the piston's movement. For a more detailed explanation of engine cylinders, pistons and related components, see Schwaller, cited above, especially at pages 225-255. An engine cylinder is essentially a bore or a hole inside an engine block. An engine block may be made of aluminum, cast steel, and/or other rigid materials.

Essentially during the operation of an engine, the piston may move inside the cylinder, and friction may occur between them and/or between other components that come in contact with them. Treating the inner surface of the cylinder with a tool such as spider 1100 may reduce that friction.

In another type of engine cylinders, a sleeve or a liner (usually referred to as "cylinder sleeve", not shown) is inserted and essentially secured inside the engine cylinder. Thus, when the piston reciprocates, it does not contact the internal surface of the cylinder, but rather the cylinder sleeve that lies inside the cylinder. A common purpose of using cylinder sleeves is that, if the cylinder is damaged, the cylinder sleeve can be removed and replaced rather easily. Engine blocks that do not have cylinder sleeves may have to be bored out to repair damage. Spider 1100 may be suitable to treat an internal surface of a cylinder sleeve.

Another example of a cylinder that may be suitable for treatment by a spider, such as spider 1100, is an outer ring of a sliding bearing (sometimes referred to as a "journal bearing" or a "friction bearing")—a component used in the automotive and other industries. Sliding bearings are bearings that may generally include two rings or hollow cylinders that may be made of metal or other rigid materials and may have different diameters. The ring with the smaller diameter may be mounted inside the ring with the larger diameter, so that the outer surface of the inner ring may essentially functionally contact the inner surface of the outer ring. A lubricant may sometimes serve as an intermediate between the two rings. For a more detailed explanation of sliding bearings and other components that may be related, see Khonsari et al, and Harnoy, both of which have been referenced hereinabove. For a more detailed explanation of the use of sliding bearings in the automotive industry, see Schwaller, cited above, especially at pages 75-85 (in which sliding bearings may be referred to as "friction bearings"). Essentially during the operation of a sliding bearing, one ring may spin while the other doesn't, and therefore friction may occur between the outer surface of the inner ring and the inner surface of the outer ring. Treating the inner surface of the outer ring with a tool such as spider 1100 may reduce that friction.

Figure 9S:
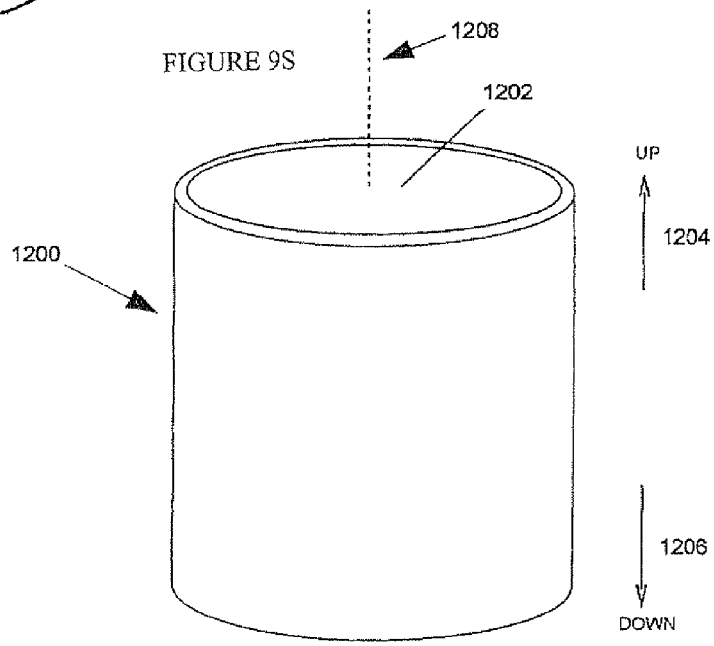
FIG. 9S is an exemplary, schematic perspective view of a generally cylindrical workpiece having a working surface on the inside diameter thereof, for treating with the lapping tool provided in FIG. 9R.

Treatment of internal surface 1202 of a tube or a hollow cylinder, such as cylinder 1200 shown in FIG. 9S, using spider 1100, may be conducted by inserting spider 1100 (wholly or partially) into cylinder 1200 and spinning or rotating spider 1100 around its central axis 1126 (for example, in a direction of rotation 1128), while essentially simultaneously functionally contacting the working area(s) (shown, for example, at 1112 and 1114) with internal surface 1202 of cylinder 1200. The functional contact of the working area(s) (shown, for example, at 1112 and 1114) with internal surface 1202 of cylinder 1200 may include reciprocating (moving interchangeably in two or more different directions) spider 1100 along central axis 1208 of cylinder 1200 (for example, reciprocating the spider 1100 up 1204 and down 1206.)

Various abrasive working agents may be used as an intermediate between an inner surface of a hollow cylinder, such as inner surface 1202 of hollow cylinder 1200, and a working area, such as working areas 1112 and 1114.

Optionally, a spider may include one or more tubing systems adapted to deliver at least one working agent to a space delimited between a coating of a spider and internal surface of a cylinder. An internal tubing system may include one or more tubes and/or bores that pass through a spider (such as through a hinge, a connector, and/or a treatment component) and deliver the at least one working agent through one or more apertures in a working area of the spider. Alternatively, an external tubing system may include one or more tubes running essentially externally to a spider, and deliver the at least one working agent to a space delimited between a working area of the spider and the internal surface of a hollow cylinder.

Optionally, a tubing system may include a combination of an internal tubing system and an external tubing system.

One or more working agents may be fed to a tubing system either continuously, at pre-determined intervals and/or otherwise when desired. Feeding may be conducted, for example, using a pump and/or other means.

In addition to the treatment described above, additional treatments of different or similar natures may be performed on internal surface 1202 of hollow cylinder 1200, for the purpose of conveying particular frictional properties to it. Such one or more additional treatments may be performed on essentially the same area of internal surface 1202 of hollow cylinder 1200 or on essentially distinct areas of it. Treatments can be performed either essentially simultaneously or at essentially separate instances.

Referring now to the example of an engine cylinder given above, an engine cylinder may be theoretically divided into three (or any other number of) areas having different frictional and heat characteristics: The top part of the cylinder, essentially in which the combustion occurs, may not be in functional contact with the piston essentially during the operation of the engine. Still, that top part of the cylinder may accumulate great heat due to the combustion. The middle part of the cylinder, essentially in which the piston moves, may be in functional contact with the piston and may accumulate a medium degree of heat caused by the friction between the piston and the cylinder. The bottom part of the cylinder may not be in functional contact with the piston essentially during the operation of the engine, and thus may accumulate only a minor amount of heat. The three theoretical areas of a cylinder mentioned above, may require different or similar types of treatments to handle the unique characteristics of them. For a more detailed explanation of the operation of pistons, cylinders and other parts of engines, see John Heywood, *Internal Combustion Engine Fundamentals* (1st ed. 1998), which is hereby incorporated by reference in its entirety.

Some possible additional treatments may include changing the structure of a surface, such as internal surface 1202 of hollow cylinder 1200. Such change of structure may consist of forming one or more recessed or elevated zones on internal surface 1202 of hollow cylinder 1200. Such recessed or elevated zones may have repeating or non-repeating patterns.

Figure 9T:
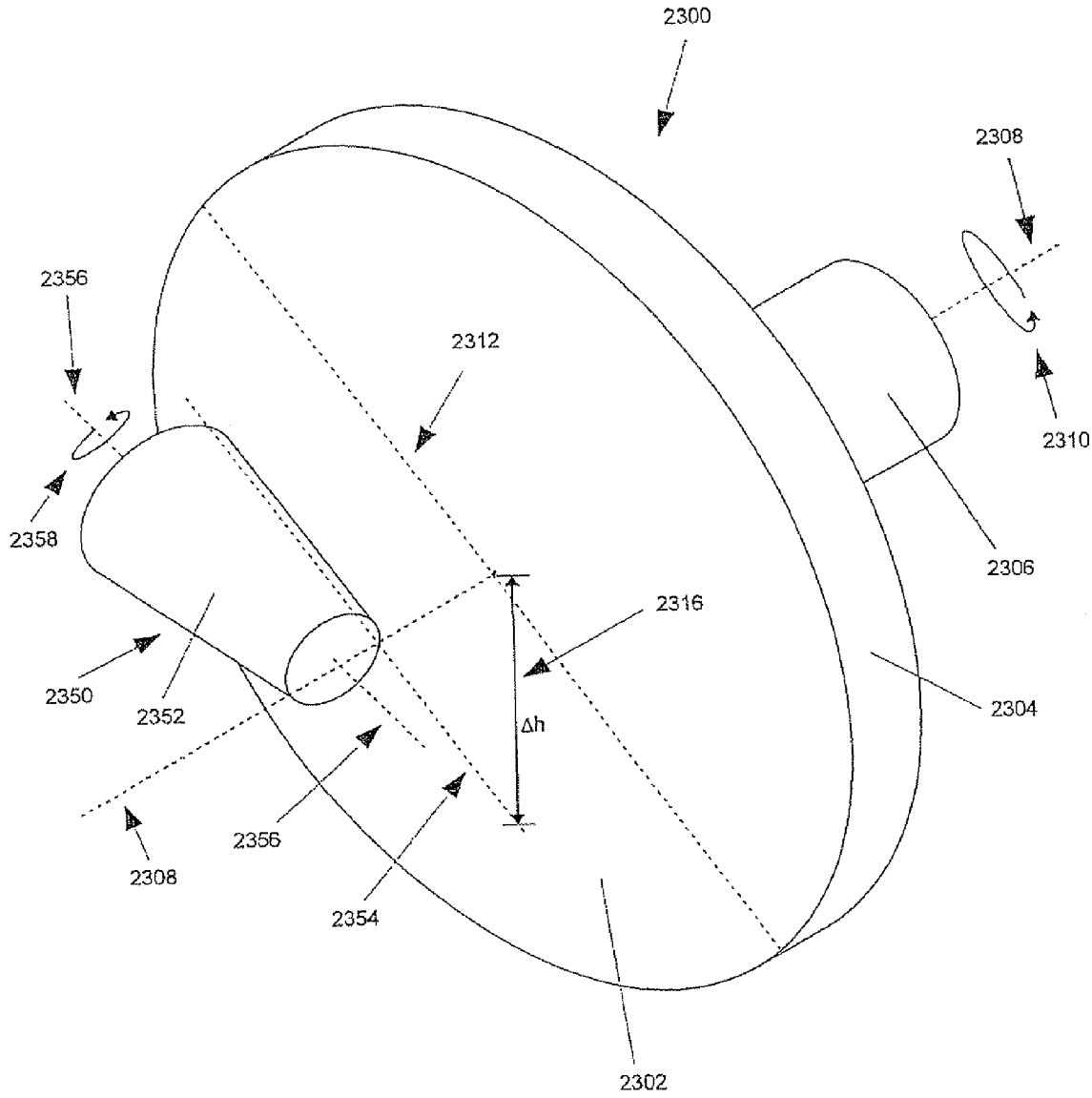
FIG. 9T is an exemplary, schematic perspective view of a disk-type lapping system for lapping conical segments, according to the present invention.

Another aspect of the inventive lapping tool and lapping process relates to the treatment of the outside of conical surfaces using a disk-type arrangement. An embodiment of a disk, such as disk 2300 shown in FIG. 9T, is essentially a round plate or a disk-shaped device, having a body, such as body 2304, an essentially flat working area, such as working area 2302, which is essentially a surface of body 2304, and a base, such as base 2306, located on the opposite side of working area 2302.

In another embodiment of the disk (not shown), the working area of the disk may have one or more recessed or elevated zones on it. Such recessed or elevated zones may have repeating or non-repeating patterns.

Body 2304 of disk 2300 may have a homogeneous or varying thickness. In the embodiment of disk 2300 shown in FIG. 9T, body 2304 has a homogeneous thickness along its entire area.

In the embodiment of disk 2300 described above and shown in FIG. 9T, body 2304 is often made of a single piece of polymeric material, either solid, hollow, or with other internal characteristics. In another embodiment of the body (not shown), the body may include two or more sub-sections or layers, each may be made of similar or different materials. For example, the body may have two layers, one (on which a working area will be present) made of a polymeric material, and one made of another rigid material.

Shaft or base 2306 may essentially be a cylindrical device—solid, hollow or with other internal characteristics, and may have a central axis, such as central axis 2308, common to body 2304 and to base 2306. Base 2306 may either be integrally formed with body 2304 and made of the same polymeric material, or essentially functionally connected to body 2304. If base 2306 is essentially functionally connected to body 2304, base 2306 may be made of a polymeric material similar or identical to the polymeric material that may be used to form base 2306, or made of another rigid material such as metal. Forming base 2306 with other rigid materials may be advantageous due to the relatively high cost of some polymeric materials that may be used to form it, compared to the possible cost of other rigid materials that may be used. Another possible reason may be the functional need to add rigidity and/or support to disk 2300; since the polymeric material that may form it may be less mechanically-stable compared to other rigid materials, using such rigid materials to form base 2306 may essentially add rigidity and support to the entire disk 2300.

Base 2306 may function essentially as a functional intermediate between body 2304 and an external torque (or other movement) transfer device (not shown), that may essentially functionally connect to base 2306, spin or rotate base 2306, and thus cause rotation of the entire disk 2300.

A surface of a conical device may be suitable for treatment using a disk, such as disk 2300. The exemplary treated component shown in 2350 is essentially a conical segment, i.e., a cone having a truncated vertex, wherein the treated surface may essentially be the circumferential surface, such as circumferential surface 2352, of a cone or a truncated cone such as conical element 2350.

As used herein in the specification and in the claims section that follows, the term "conical", "conical element" and the like, with respect to a workpiece or to a working surface, is meant to refer to a truncated cone as well as a cone.

One example of an essentially conical component that may be suitable for treatment by a disk, such as disk 2300, is a pulley of a VDP (Variable-Diameter Pulley) in a CVT (Continuously Variable Transmission)—a component that has found use in the automotive and other industries. VDP may be a subtype of CVT—a type of an automotive transmission system. For a more detailed explanation of CVTs, VDPs and related components, see Bruce D. Anderson and John R. Maten, *Continuously Variable Transmission* (2006), which is hereby incorporated by reference in its entirety. A pulley of a VDP CVT may include two metal, essentially conical devices positioned on the same imaginary central axis, with their vertexes facing one another. A metal or semi-metal chain may be present between the two conical devices and essentially around their imaginary central axis. Essentially during the operation of a VDP CVT, the abovementioned chain may be set in motion and essentially functionally contact the surface of one of or both conical devices, causing friction. Treating the surface of one of or both conical devices with a tool such as disk 2300 may reduce that friction.

Treatment of the outside of conical surfaces (for example, surface 2352 of cone 2350) using a disk, such as disk 2300, may be conducted by essentially spinning or rotating both disk 2300 and the treated conical device (for example, cone 2350) around their central axis (2308 and 2356 respectively, for example in direction of rotation 2310 and 2358, respectively) while essentially simultaneously functionally contacting working area 2302 with the treated surface, such as surface 2352 of cone 2350.

Essentially during the treatment, cone 2350 may be positioned (as shown in FIG. 9T) with an imaginary line, such as imaginary line 2354, representing the portion of surface 2352 facing (or essentially functionally contacting) working area 2302, essentially parallel to a diameter, such as diameter 2312, of working area 2302. In addition, a distance, such as distance $\Delta h$ 2316 between imaginary line 2354 and diameter 2312 may be different than zero (0). In the exemplary treatment shown in FIG. 9T, $\Delta h$ 2316 is larger than zero (0), and may have a value, for example, of 5 centimeters. The general mathematical expression of $\Delta h$ may be $|\Delta h|>0$ (in words: the absolute value of $\Delta h$ is larger than zero). As $|\Delta h|$ is larger, treatment may be more efficient and/or convey better frictional properties to the treated surface, as greater distance between imaginary line 2354 and diameter 2302 may result in a more complex pattern of functional contact between working area 2302 and surface 2353 of cone 2350. Different values of $|\Delta h|$ may also be reflected in different characteristics of frictional properties conveyed to the treated surface—characteristics that may not be necessarily defined in terms of "better" or "worse".

Various abrasive working agents may be used as an intermediate between a surface of a cone, such as surface 2352 of cone 2350, and a working area, such as working area 2302.

Optionally, a disk may include one or more tubing systems adapted to deliver at least one working agent to a space delimited between a working area of the disk and surface of a cone. An internal tubing system may include one or more tubes and/or bores that pass essentially through the disk and deliver the at least one working agent through one or more apertures in a working area of the disk. Alternatively, an external tubing system may include one or more tubes that run essentially externally to the disk, and deliver at least one working agent to a space delimited between a working area of the disk and the surface of the cone.

Optionally, a tubing system may include a combination of an internal tubing system and an external tubing system.

One or more working agents may be fed to a tubing system either continuously, at pre-determined intervals and/or otherwise when desired. Feeding may be conducted, for example, using a pump and/or other means.

In addition to the treatment described above, additional treatments of different or similar natures may be performed on a treated surface (for example, surface 2352), for the purpose of conveying particular frictional properties to it. Such one or more additional treatments may be performed on essentially the same area of the treated surface (for example, surface 2352) or on essentially distinct areas of it. Treatments can be performed either essentially simultaneously or at essentially separate instances.

Some possible additional treatments may include changing the structure of a surface, such as surface 2352. Such change of structure may consist of forming one or more recessed or elevated zones thereon. Such recessed or elevated zones may have repeating or non-repeating patterns.

Another aspect of the inventive lapping tool and lapping process relates to the treatment of concave spherical surfaces using an "Apollo-shaped" tool.

Figure 10A:
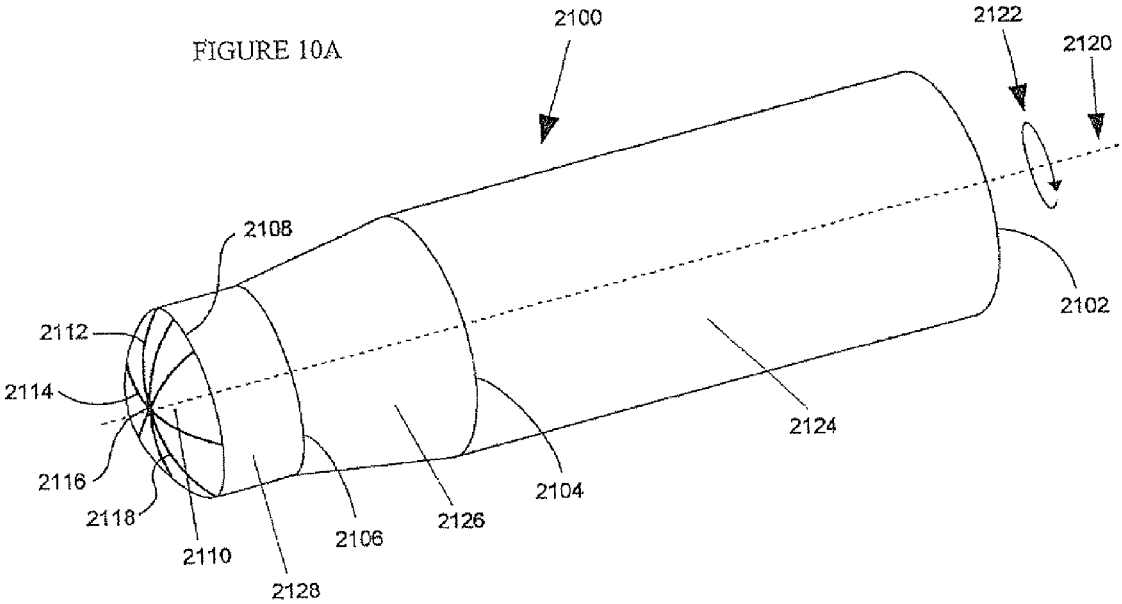
FIG. 10A is an exemplary, schematic perspective view of a lapping tool for lapping concave elements, according to the present invention.

An embodiment of the lapping tool, such as lapping tool 2100 shown in FIG. 10A, is essentially a cylindrical device that may have essentially different diameters along the length thereof. In the exemplary embodiment shown in FIG. 10A, Lapping tool 2100 may have a homogeneous diameter between its bottom end, such as bottom end 2102, until a first imaginary line, such as first imaginary line 2104. Starting at first imaginary line 2104, Lapping tool 2100 may gradually decline in radius until a second imaginary line, such as second imaginary line 2106, where it may continue at a constant diameter until a third imaginary line, such as third imaginary line 2108. Bordered on third imaginary line 2108 is a working area, such as working area 2110, which may be essentially an either symmetrical or asymmetrical convex area. In the exemplary embodiment shown in FIG. 10A, working area 2110 is symmetrically convex, having a vertex (or highest point), such as vertex 2116. Working area 2110 may have any number of grooves, such as grooves 2112-2118, and/or depressions (not shown) on its surface. In the exemplary embodiment shown in FIG. 10A, working area 2110 may have four grooves, such as grooves 2112-2118, on its surface, essentially intersecting at vertex 2116. A higher number of grooves and/or depressions may cause working area 2110 to be essentially functionally softer and/or more flexible—and therefore adaptable to perform a more delicate treatment (described below), whereas a lower number of grooves and/or depressions, or the absence thereof, may cause working area 2110 to be essentially functionally harder and/or less flexible, and therefore adaptable to perform a rougher treatment (described below).

In the embodiment described above and shown in FIG. 10A, lapping tool 2100 is often made of a single piece of polymeric material, either solid, hollow, or with other internal characteristics. In another embodiment, the lapping tool (not shown) may include two or more sub-sections or layers, each may be made of similar or different materials.

In another embodiment of the lapping tool (not shown), the lapping tool may essentially comprise a working area, such as working area 2110, essentially functionally connected or attached to another device (not shown) that may deliver torque (or rotational movement) to the working area (for example, working area 2110).

Figure 10B:
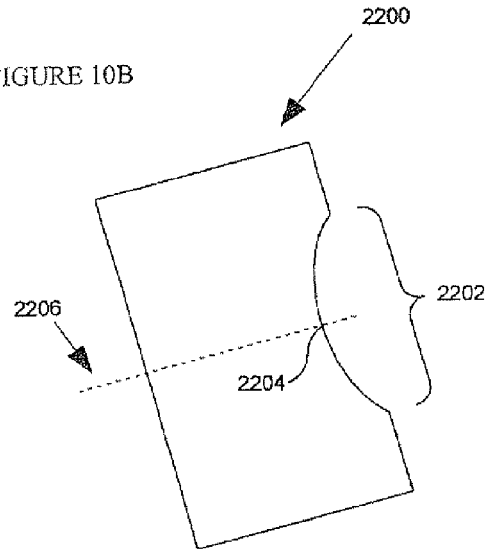
FIG. 10B is an exemplary, schematic perspective view of a workpiece having a concavity, for treating with the inventive lapping tool of FIG. 10A.

A concave spherical surface may be suitable for treatment using a lapping tool, such as lapping tool 2100. The exemplary treated component shown in FIG. 10B is essentially a cubic or a box-shaped device, such as cubic or a box-shaped device 2200, wherein the treated surface may essentially be a surface of a depression, such as depression 2202 in cubic or the box-shaped device 2200. Depression 2202 may be essentially symmetrically (having a nadir such as nadir 2204) or asymmetrically concave prior to the treatment (will be described), and may adapt to or form as a mirror of the essentially symmetrically or asymmetrically convex shape of working area 2110 essentially during the treatment (will be described).

One example of an essentially concave spherical surface that may be suitable for treatment by a lapping tool, such as lapping tool 2100, is a socket of an artificial ball-and-socket joint implant (often referred to as an enarthrosis or a spheroidal joint)—a device which may be used for medical and other purposes. Artificial ball-and-socket joint implants may be used to replace damaged natural ball-and-socket joints, such as, for example, hip joints and shoulder joints. For a more detailed explanation of ball-and-socket joints and related medical issues and procedures, see Mark Dutton, *Orthopaedic Examination, Evaluation & Intervention* (1st ed. 2004), which is hereby incorporated by reference in its entirety. Natural ball-and-socket joints may essentially include a "ball part"—a bone ending with a ball-like shape and a "socket part"—a bone having a concavity, capable of receiving or containing the end of the "ball part". During medical procedures for treatment of damaged ball-and-socket joints, the natural "ball part" (or a portion thereof) is sometimes replaced with an artificial "ball part", and an artificial concave socket is inserted into the natural "socket part". The artificial "ball part" and socket are often made of stainless steel. Essentially after the replacement of the natural ball-and-socket joint with an artificial one, and during the regular operation of the artificial ball-and-socket joint implant (for example, when the patient is moving the two organs on the two sides of that joint), the "ball part" of the artificial ball-and-socket joint implant may rub against the artificial concave socket, causing friction. Friction may cause wear of the "ball part" of the artificial ball-and-socket joint implant and/or the artificial concave socket, may produce debris, and thus cause medical problems such as osteolysis. Treatment of the artificial concave socket of an artificial ball-and-socket joint implant using a tool such as lapping tool 2100 may reduce the aforementioned friction.

Another example of an essentially concave spherical surface that may be suitable for treatment by a lapping tool, such as lapping tool 2100, is a socket of a rocker arm—a component that is used in the automotive and other industries. Rocker arms may be used to essentially push valves that control fuel flow into an engine (such valves are often referred to as "intake valves") and/or control gas ejection from an engine (such valves are often referred to as "exhaust valves".) For a more detailed explanation of rocker arms, valves, and other components that may be related, see Schwaller (cited above), especially at pages 276-292. A rocker arm may be made of metal and/or other rigid materials, and may have a concave spherical socket into which a stem of a valve may essentially fit. Essentially during the operation of a rocker arm, it may push the stem of a valve, the area of the rocker arm in contact with the stem being the socket of the rocker arm.

Such pushing and/or contact may cause friction. Treating the socket of the rocker arm with a tool such as lapping tool 2100 may reduce that friction.

Treatment of a concave spherical surface (for example, surface of depression 2202 shown in FIG. 10B) using a lapping tool, such as lapping tool 2100, may be conducted by essentially spinning or rotating lapping tool 2100 around its central axis, such as central axis 2120 (for example, in direction of rotation 2122), while essentially simultaneously functionally contacting working area 2110 with the treated surface, such as surface of depression 2202. A treated component (for example, cubic or box-shaped device 2200) may also be spun or rotated around its central axis 2206 essentially during the treatment.

Various abrasive working agents may be used as an intermediate between a surface of a depression, such as surface of depression 2202, and a working area, such as working area 2110.

Optionally, such a lapping tool may include one or more tubing systems adapted to deliver at least one working agent to a space delimited between a working area of the lapping tool and a surface of a depression. An internal tubing system may include one or more tubes and/or bores that pass essentially through the lapping tool and deliver the at least one working agent through one or more apertures in a working area of the lapping tool. Alternatively, an external tubing system may include one or more tubes that run essentially externally to the lapping tool, and deliver at least one working agent, similar to an internal tubing system, to a space delimited between a working area of the lapping tool and surface of a depression.

Optionally, a tubing system may include a combination of an internal tubing system and an external tubing system.

One or more working agents may be fed to a tubing system either continuously, at pre-determined intervals and/or otherwise when desired. Feeding may be conducted, for example, using a pump and/or other means.

In addition to the treatment described above, additional treatments of different or similar natures may be performed on a treated surface (for example, depression 2202), for the purpose of conveying particular frictional properties to it. Such one or more additional treatments may be performed on essentially the same area of the treated surface (for example, depression 2202) or on essentially distinct areas of it. Treatments can be performed either essentially simultaneously or at essentially separate instances.

Some possible additional treatments may include changing the structure of a surface, such as depression 2202. Such change of structure may consist of forming one or more recessed or elevated zones on it. Such recessed or elevated zones may have repeating or non-repeating patterns.

Figure 10C:
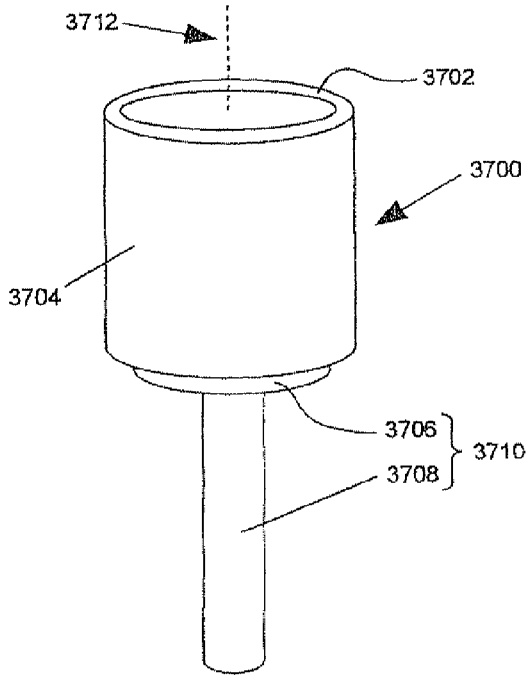
FIG. 10C is an exemplary, schematic perspective view of another embodiment of a lapping tool for lapping concave elements, according to the present invention.

Another aspect of the inventive lapping tool and lapping process relates to the treatment of concave spherical surfaces using a cup tool ("cup"). An embodiment of the cup, such as cup 3700 shown in FIG. 10C, is essentially a tubular or a hollow cylindrical device having a treatment component, such as treatment component 3704, and a base (that may include a plate, such as plate 3706, and a shank, such as shank 3708, hereinafter jointly referred to as base 3710).

An embodiment of the treatment component, such as treatment component 3704, may be essentially a tube or a hollow cylinder having one of its sides open (for example, the side near 3702) and one of its sides closed (for example, the side near base 3706). Another treatment component (not shown) may have both sides thereof open or both sides thereof closed. The top rim (the surface of the cut) of the treatment component is the working area, such as working area 3702. Working area 3702 may be a flat area perpendicular to the walls (or sides) of treatment component 3704. Working area 3702 may also lie at a different angle relative to treatment component 3704. A treatment component's internal and/or external diameter may be homogenous or varying along the height thereof.

In the embodiment of the cup, such as cup 3700 described above and shown in FIG. 10C, treatment component 3704 is often made of a single piece of polymeric material. In another embodiment of the cup (not shown), the treatment component may include two or more sub-sections or layers, each may be made of similar or different materials.

An embodiment of the base, such as base 3710, may be essentially a round or otherwise shaped plate, such as plate 3706 (in the exemplary embodiment shown is FIG. 10C, plate 3706 is round) that is essentially attached to a shank, such as shank 3708—a hollow or solid cylindrical component. Plate 3706 may function essentially as a measure of support to the connection between base 3710 and treatment component 3704, as plate 3706 provides a relatively large contact area between them. Shank 3708 may function essentially as means of functionally connecting cup 3700 to a spinning or rotating device (not shown) that may be used to spin or rotate cup 3700 for the purpose of essentially conducting a treatment.

In the exemplary embodiment shown in FIG. 10C, plate 3706 and shank 3708 may be essentially integrally formed. In another embodiment of the cup (not shown), the plate and the shank may be essentially separate pieces, functionally connected to each other. In yet another embodiment of the cup (not shown) the plate may not exist at all; in that case, shank 3708 may be essentially directly connected to treatment component 3704.

In the embodiment shown in FIG. 10C, base 3710 is often made of a single piece of metallic material. In another embodiment of the cup (not shown), the base may include two or more sub-sections or layers, each may be made of similar or different materials. One possible reason for forming a base with two or more sub-sections and/or layers is the relative high cost of some metallic materials that may be used to form it, compared to the possible cost of other rigid materials that may be used.

In an embodiment of the cup (not shown) mentioned before—in which the plate and the shank are essentially separate pieces, each of them may be made of similar or different materials. In addition, each of them may include two or more sub-sections or layers that may be made of similar or different materials.

Figure 10D:
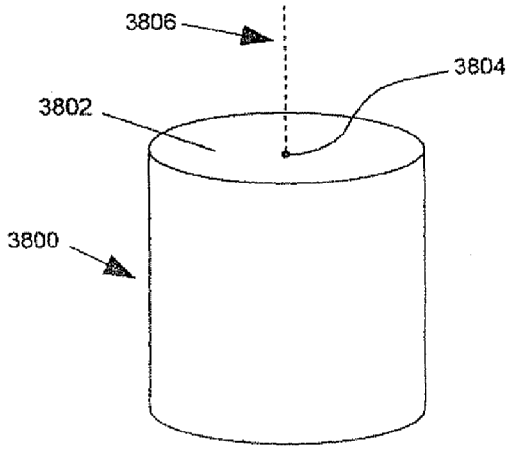
FIG. 10D is an exemplary, schematic perspective view of a workpiece having a concavity, for treating with the inventive lapping tool of FIG. 10C.

A concave spherical surface of a component may be suitable for treatment using a cup, such as cup 3700. The exemplary treated component shown in FIG. 10D is essentially a hollow or solid cylindrical device, such as cylinder 3800, wherein the treated surface may be the concave circular surface, such as surface 3802, of its top end, which may have a lowest point (or nadir), such as nadir 3804. The concavity may be yet more apparent from the side view provided in FIG. 10E.

One example of an essentially concave spherical surface that may be suitable for treatment by a cup, such as cup 3700, is a socket of an artificial ball-and-socket joint implant, which has been described in detail hereinabove. Treatment of the artificial concave socket of an artificial ball-and-socket joint implant using a tool such as cup 3700 may reduce friction between the ball and socket of the artificial joint.

Treatment of surfaces (for example, surface 3802 shown in FIG. 10D) using a cup, such as cup 3700, may be conducted by essentially spinning or rotating cup 3700 around its central axis 3712 while essentially simultaneously functionally contacting working area 3702 with treated surface 3802. A treated component (for example, treated component 3800) may also be spun or rotated (not shown) around its central axis 3806 essentially during the treatment.

Figure 10E:
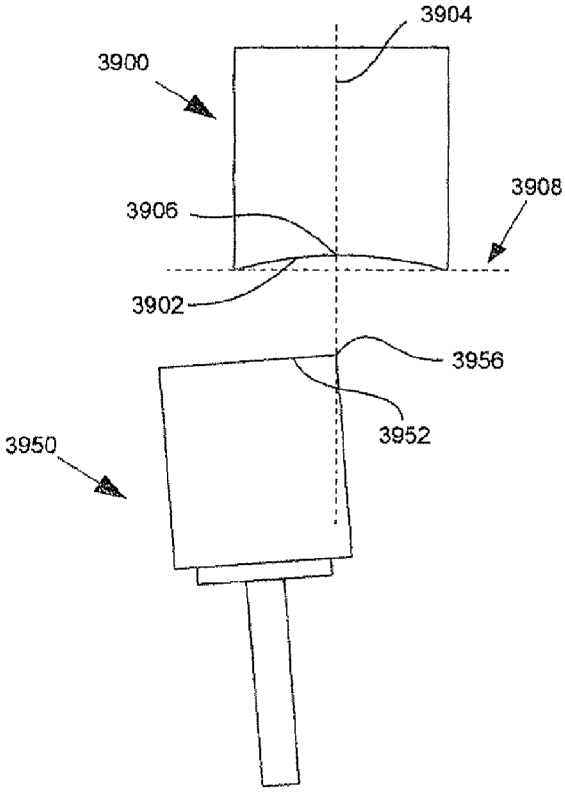
FIG. 10E is an exemplary, schematic perspective view showing an angle of incidence of the lapping tool of FIG. 10C, in treating the working surface of the workpiece provided in FIG. 10D.

Exemplary positioning of cup 3700 and treated component 3800 essentially during treatment may be better understood by referring to FIG. 10E, which shows a two-dimensional view of the cup of FIG. 10C (shown at 3950 in FIG. 10E) and the treated component of FIG. 10D, shown at 3900 in FIG. 10E, cup 3950 may be placed with its working area 3952 facing treated surface 3902 of treated cylindrical component 3900, so that an angle of between zero (0) and ninety (90) degrees (the angle may correspond to the concavity of surface 3902) is essentially formed between working area 3952 and an imaginary line, such as imaginary line 3908, which may essentially intersect with the rims of the concavity of surface 3902. In addition, cup 3950 may be positioned in a posture where an imaginary point, such as imaginary point 3956, on its working area 3952 is essentially intersecting with imaginary line 3904 continuing the central axis of treated component 3900 (point 3956 may essentially be the point of cup 3950 closest to treated cylindrical component 3900, should the angle between working area 3952 and treated surface 3902 be essentially larger than zero (0) degrees.)

Treatment may include spinning or rotating both cup 3950 and treated cylindrical component 3900. In this paragraph, the term "spinning or rotating" relates to the method of spinning or rotating explained hereinabove.

In addition to the treatments described above, other treatments (not shown) may include positioning a cup and a treated component in a way that may suit a treated surface having one or more patterns of different degrees of concavity and/or convexity.

Various abrasive working agents may be used as an intermediate between a surface of a cylinder, such as surface 3802 of cylinder 3800, and a working area, such as working area 3702.

Optionally, such a cup may include one or more tubing systems adapted to deliver at least one working agent to a space delimited between a working area of a cup and surface of a cylinder. An internal tubing system may include one or more tubes and/or bores that pass essentially through the cup and deliver the at least one working agent through one or more apertures in a working area of the cup. Alternatively, an external tubing system may include one or more tubes running essentially externally to the cup, and delivering the at least one working agent to a space delimited between a working area of the cup and the surface of a cylinder.

Optionally, a tubing system may include a combination of an internal tubing system and an external tubing system.

One or more working agents may be fed to a tubing system either continuously, at pre-determined intervals and/or otherwise when desired. Feeding may be conducted, for example, using a pump and/or other means.

In addition to the treatment described above, additional treatments of different or similar natures may be performed on a treated surface (shown, for example, at 3902), for the purpose of conveying particular frictional properties to it. Such one or more additional treatments may be performed on essentially the same area of the treated surface (shown, for example, at 3902) or on essentially distinct areas of it. Treatments can be performed either essentially simultaneously or at essentially separate instances.

Some possible additional treatments may include changing the structure of a surface, such as treated surface 3902. Such change of structure may consist of forming one or more recessed or elevated zones on thereon. Such recessed or elevated zones may have repeating or non-repeating patterns.

Figure 10F:
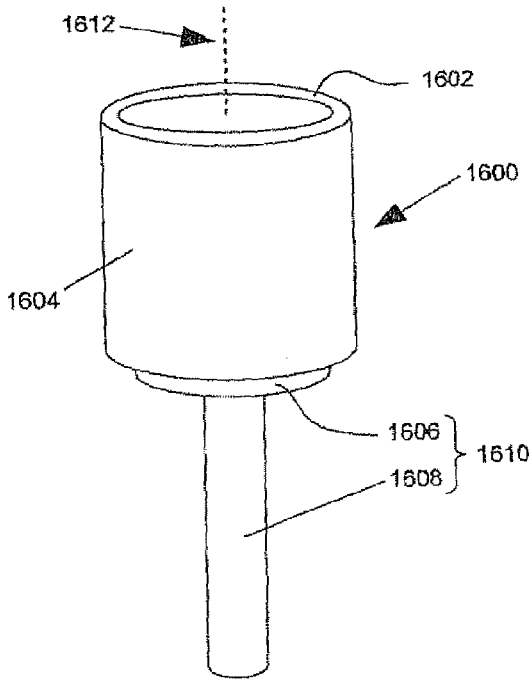
FIG. 10F is an exemplary, schematic perspective view of another embodiment of a lapping tool for lapping convex elements, according to the present invention.

Another aspect of the inventive lapping tool and lapping process relates to the treatment of mildly convex spherical surfaces using a cup-like tool ("Cup"). An embodiment of the cup, such as cup 1600 shown in FIG. 10F, is essentially a tubular or a hollow cylindrical device that may include a treatment component, such as treatment component 1604, and a base (that may include a plate, such as plate 1606, and a shank, such as shank 1608, hereinafter jointly referred to as base 1610).

An embodiment of the treatment component, such as treatment component 1604, may be essentially a tube or a hollow cylinder having one side or face open (for example, the side near 1602) and one side or face closed (for example, the side near base 1606). Another treatment component (not shown) may have both sides open or both sides closed. The top rim of cup 1600 is the working area, such as working area 1602. Working area 1602 may be a flat area perpendicular to the walls (or sides) of treatment component 1604. Working area 1602 may also lie at a different angle relative to treatment component 1604. A treatment component's internal and/or external diameter may be homogenous or varying along its height.

In the embodiment of the cup, such as cup 1600 described above and shown in FIG. 10F, treatment component 1604 is often made of a single piece of polymeric material. In another embodiment of the cup (not shown), the treatment component may include two or more sub-sections or layers, each may be made of similar or different materials.

An embodiment of the base, such as base 1610, may be essentially a round or otherwise shaped plate, such as plate 1606 (in the exemplary embodiment shown in FIG. 10F, plate 1606 is round) that is essentially attached to a shank, such as shank 1608, which is a hollow or solid cylindrical component. Plate 1606 may function essentially as measures of support to the connection between base 1610 and treatment component 1604, as it provides a relatively large contact area between them. Shank 1608 may function essentially as means of functionally connecting cup 1600 to a spinning or rotating device (not shown) that may be used to spin or rotate cup 1600 for the purpose of essentially conducting a treatment.

In the exemplary embodiment shown in FIG. 10F, plate 1606 and shank 1608 may be essentially integrally formed. In another embodiment of the cup (not shown), the plate and the shank may be essentially separate pieces, functionally connected to each other. In yet another embodiment of the cup (not shown) the plate may not exist at all; in that case, shank 1608 may be essentially directly connected to treatment component 1604.

In the embodiment shown in FIG. 10F, base 1610 is often made of a single piece of metallic material. In another embodiment of the cup (not shown), the base may include two or more sub-sections or layers, each may be made of similar or different materials. One possible reason for forming a base with two or more sub-sections and/or layers is the relative high cost of some metallic materials that may be used to form it, compared to the possible cost of other rigid materials that may be used.

In a previously mentioned embodiment of the cup (not shown), in which the plate and the shank are essentially separate pieces, each of them may be made of similar or different materials. In addition, each of them may include two or more sub-sections or layers that may be made of similar or different materials.

Figure 10G:
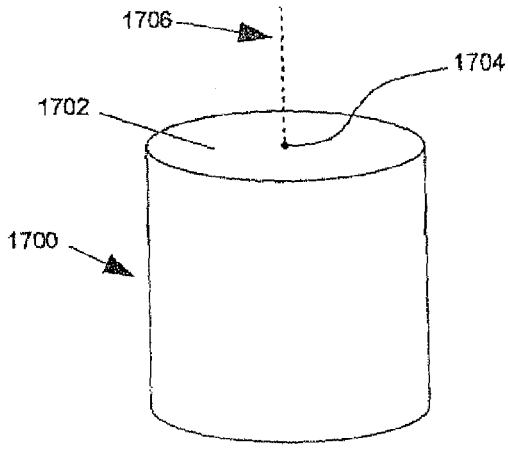
FIG. 10G is an exemplary, schematic perspective view of a workpiece for treating with the inventive lapping tool provided in FIG. 10F.

A mildly convex spherical surface of a component may be suitable for treatment using a cup, such as cup 1600. Various surfaces of other shapes (not shown) may be treated by a cup, such as cup 1600, in order to transform these surfaces into a mildly convex shape. The exemplary treated component shown in FIG. 10G is essentially a hollow or solid cylindrical device, such as cylinder 1700, wherein the treated surface is the circular surface of its top end, such as top end 1702. Prior to the treatment, top end 1702 may be conical, concave, convex, flat or have another shape. If top end 1702 is essentially approximately symmetrically convex, a point, such as vertex 1704, may be the highest point (or vertex) thereof.

One example of a component that may be suitable for treatment by a cup, such as cup 1600 is a tappet (or a valve lifter)—a component that may be used in the automotive and other industries. Tappets may be used as part of an engine's valve opening and closing mechanism. For a more detailed explanation of tappets and other components that may be related, see Schwaller (cited above) at pages 276-292. A tappet may have the shape of a tube or a hollow cylinder, closed on one end by a circular surface. Tappets may be made of steel or other metallic materials. Essentially during the operation of an engine, the tappet's circular surface may essentially ride on or follow the shape of a camshaft lobe, and friction may occur between them. Treating the circular surface of the tappet with a tool such as cup 1600 may reduce that friction. In addition, treatment of the circular surface of a tappet using a cup, such as cup 1600, may essentially form that circular surface in an essentially convex shape. The convexity may consist of a center of convexity (or a vertex) higher than its surrounding surface by only a fraction of a millimeter, and thus may be impossible or hard to notice with the naked eye.

Treatment of surfaces (for example, surface 1702 shown in FIG. 10G) using a cup, such as cup 1600, may be conducted by essentially spinning or rotating cup 1600 around its central axis, such as central axis 1612, while essentially simultaneously functionally contacting working area 1602 with surface 1702. A treated component (for example, treated component 1700) may also be spun or rotated (not shown) around its central axis 1706 essentially during the treatment.

Figure 10H:
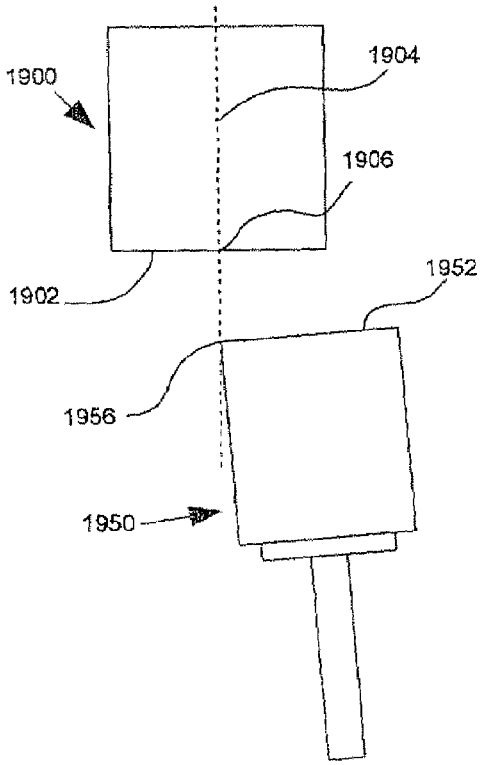
FIG. 10H is an exemplary, schematic perspective view showing an angle of incidence of the lapping tool of FIG. 10F, in treating the working surface of the workpiece of FIG. 10G.

Exemplary positioning of cup 1600 and treated component 1700 essentially during treatment may be better understood by referring to FIG. 10H, which shows a two-dimensional view of the cup of FIG. 10F, shown at 1950 in FIG. 10H, and the treated component of FIG. 10G, shown at 1900 in FIG. 10H, cup 1950 may be placed with its working area 1952 facing treated surface 1902 of cylinder 1900, so that an angle of between zero (0) and ninety (90) degrees (the angle may correspond to the existing or desired convexity of surface 1902) is essentially formed between working area 1952 and surface 1902. In addition, cup 1950 may be positioned in a posture where an imaginary point, such as imaginary point 1956, on its working area 1952 is essentially intersecting with an imaginary line, such as imaginary line 1904 continuing the central axis of treated component 1900 (point 1956 may essentially be the point of cup 1950 closest to cylinder 1900, should the angle between working area 1952 and treated surface 1902 be essentially larger than zero (0) degrees.) Essentially due to the relative position of cup 1950 and treated component 1900 explained above, when treating cylinder 1900 essentially using the method discussed hereinabove, treated surface 1902 may become essentially convex, having a center of convexity (or a vertex) such as vertex 1906.

Treatment may include spinning or rotating both cup 1950 and treated cylindrical component 1900. In this paragraph, the term "spinning or rotating" relates to the method of spinning or rotating explained hereinabove.

In addition to the treatments described above, other treatments (not shown) may include positioning a cup and a treated component in a way that may form a treated surface with one or more patterns of different degrees of concavity and/or convexity.

Various abrasive working agents may be used as an intermediate between a top end of a cylinder, such as top end 1702 of cylinder 1700, and a working area, such as working area 1602.

Optionally, such a cup may include one or more tubing systems adapted to deliver at least one working agent to a space delimited between a working area of a cup and a top end of a cylinder. An internal tubing system may include one or more tubes and/or bores that pass essentially through the cup and deliver the at least one working agent through one or more apertures in a working area of the cup. Alternatively, an external tubing system may include one or more tubes running essentially externally to the cup, and delivering the at least one working agent to a space delimited between a working area of the cup and the surface of a cylinder.

Optionally, a tubing system may include a combination of an internal tubing system and an external tubing system.

One or more working agents may be fed to a tubing system either continuously, at pre-determined intervals and/or otherwise when desired. Feeding may be conducted, for example, using a pump and/or other means.

In addition to the treatment described above, additional treatments of different or similar natures may be performed on a treated surface (shown, for example, at 1902), for the purpose of conveying particular frictional properties to it. Such one or more additional treatments may be performed on essentially the same area of the treated surface (shown, for example, at 1902) or on essentially distinct areas of it. Treatments can be performed either essentially simultaneously or at essentially separate instances.

Some possible additional treatments may include changing the structure of a surface, such as treated surface 1902. Such change of structure may consist of forming one or more recessed or elevated zones on it. Such recessed or elevated zones may have repeating or non-repeating patterns.

Another aspect of the inventive lapping tool and lapping process relates to the treatment of convex spherical surfaces using a cup-like tool ("Cup"). An embodiment of the cup, such as cup 2700 shown in FIG. 10I, is essentially a tubular or a hollow cylindrical device that may include a treatment component, such as treatment component 2704, and a base (that may include a plate, such as plate 2706, and a shank, such as shank 2708, hereinafter jointly referred to as base 2710).

An embodiment of the treatment component, such as treatment component 2704, may be essentially a tube or a hollow cylinder having one side open (for example, the side near 2702) and one side closed (for example, the side near base 2706). Another treatment component (not shown) may have both sides open or both sides closed. The top rim of the treatment component is the working area, such as working area 2702. Working area 2702 may be a flat area perpendicular to the walls (or sides) of treatment component 2704. Working area 2702 may also lie at a finite angle relative to treatment component 2704. The internal and/or external diameter of the treatment component may be constant or may vary.

In the embodiment of the cup, such as cup 2700 described above and shown in FIG. 10I, treatment component 2704 is often made of a single piece of polymeric material. In another embodiment of the cup (not shown), the treatment component may include two or more sub-sections or layers, each may be made of similar or different materials An embodiment of the base, such as base 2710, may be essentially a round or otherwise shaped plate, such as plate 2706 (in the exemplary embodiment shown is FIG. 10I, plate 2706 is round) that is essentially attached to a shank, such as shank 2708, which may be a hollow or solid cylindrical component. The plate may function essentially as measures of support to the connection between base 2710 and treatment component 2704, as it provides a relatively large contact area between them. Shank 2708 may function essentially as means of functionally connecting cup 2700 to a spinning or rotating device (not shown) that may be used to spin or rotate cup 2700 for the purpose of essentially conducting a treatment.

Figure 10I:
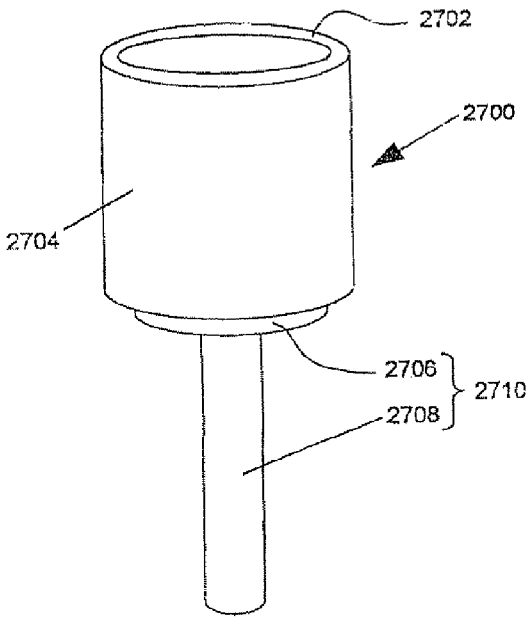
FIG. 10I is an exemplary, schematic perspective view of a lapping tool for lapping spherical elements, according to the present invention.

In the exemplary embodiment shown in FIG. 10I, plate 2706 and shank 2708 may be essentially integrally formed. In another embodiment of the cup (not shown), the plate and the shank may be essentially separate pieces, functionally connected to each other. In yet another embodiment of the cup (not shown) the plate may not exist at all; in that case, shank 2708 may be essentially directly connected to treatment component 2704.

In the embodiment shown in FIG. 10I, base 2710 is often made of a single piece of metallic material. In another embodiment of the cup (not shown), the base may include two or more sub-sections or layers, each may be made of similar or different materials. One possible reason for forming a base with two or more sub-sections and/or layers is the relative high cost of some metallic materials that may be used to form it, compared to the possible cost of other rigid materials that may be used.

Convex spherical surfaces, such as the outside surface of a ball or a sphere may be suitable for treatment using a cup, such as cup 2700. The exemplary treated component shown in FIG. 10J is essentially a hollow or a solid sphere (or ball), such as sphere 2850, wherein the treated surface may essentially be the outside surface of the sphere (or portion(s) of the outside surface), such as outside surface 2852 of sphere 2850.

One example of a component that may be suitable for treatment by a cup, such as cup 2700 is an artificial hip joint implant, which has been described briefly hereinabove. In greater detail now, an artificial hip joint implant is a device that may be used to replace damaged natural hip joints, and more specifically, the femoral head that is the ball-shaped part located at the uppermost part of the thighbone (or femur). The replacement is often conducted in a medical procedure called "hip replacement". Artificial hip joint implants are often made of stainless steel, and may have the shape of a ball to which a shaft is essentially attached. During a hip replacement procedure, the shaft may be secured into the patient's thighbone (or femur), and the ball, which may replace the damaged femoral head, may be inserted into the acetabulum of the pelvis (a socket in the hipbone). Prior to the insertion of the ball into the acetabulum, a fitting artificial concave liner may be placed inside the acetabulum, in order for the ball not to rub directly against the hipbone but rather against the liner. For a more detailed explanation of a hip joint, its related organs and parts and related medical issues and procedures, see Dutton, referenced hereinabove.

During the regular operation of the artificial hip joint (for example, when the patient is walking or running), the ball of the artificial hip joint may rub against the liner that lies inside the acetabulum, causing friction therebetween. Where a liner is not present friction may occur directly between the ball of the artificial hip joint and the acetabulum. Friction may cause wear of the ball of the artificial hip joint and/or the liner, may produce debris, and thus cause medical problems such as osteolysis. Treatment of the ball of an artificial hip joint using a tool such as cup 2700 may reduce the aforementioned friction.

Figure 10J:
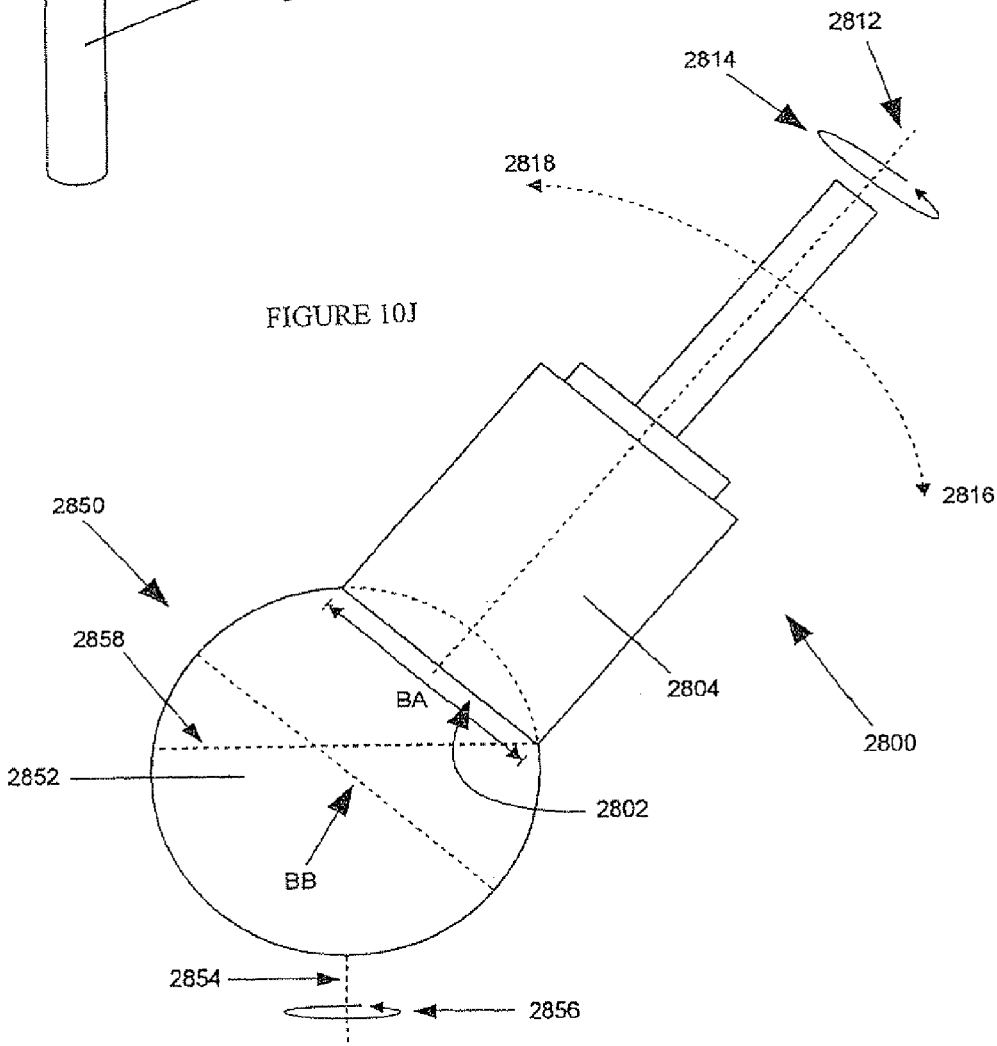
FIG. 10J is an exemplary, schematic perspective view showing the lapping of a sphere using the inventive lapping tool provided in FIG. 10I.

Reference is now made to FIG. 10J, which shows a two-dimensional view of a cup, such as sup 2800, which is the cup of FIG. 10I, and a sphere, such as sphere 2850. Treatment of convex spherical surfaces, such as surface 2852, using a cup, such as cup 2800 may be conducted by essentially spinning or rotating cup 2800 around its central axis 2812 (for example, in direction of rotation 2814) while essentially simultaneously functionally contacting working area 2802 with surface 2852 of sphere 2850. Sphere 2850 may also be spun or rotated essentially during the treatment (for example, spinning sphere 2850 around its central axis 2854 in direction 2856.) In the exemplary treatment shown in FIG. 10J, spinning sphere 2850 around its central axis 2854 may enable functional contact of working area 2802 with essentially the entire surface area of sphere 2850 located above an imaginary circumferential line, such imaginary circumferential line 2858. The functional contact of cup 2850 with surface 2852 of sphere 2850 may include reciprocating (moving interchangeably in two or more different directions) cup 2850 along surface 2852 of sphere 2850 (for example, reciprocating cup 2850 in directions 2816 and 2818.) Reciprocating may additionally or alternatively include moving cup 2850 in linear, circular or other patterns along surface 2852 of sphere 2850. Changing the position, the tilt and/or the pitch of sphere 2850 may complement or substitute reciprocating cup 2800. Essentially during the treatment, working area 2802 of cup 2800 may functionally contact all the desired areas of surface 2852 of sphere 2850.

Treatment component 2804 of cup 2800 may be formed with a diameter, such as diameter BA, corresponding to the diameter, such as diameter BB, of sphere 2850; the closer the measurement of diameter BA of cup 2800 to diameter BB of sphere 2850, the more efficient and/or more qualitative the treatment may be. "More efficient" may be reflected in lesser need of reciprocating cup 2800, essentially due to the better coverage of surface 2852 of sphere 2850 by a larger treatment component, such as treatment component 2804. "More qualitative" may be reflected in a more geometrically-homogeneous treatment along surface 2852 of sphere 2850, essentially due to the relative reduction in the reciprocating movement of cup 2800. Treatment component 2804 may be formed with a diameter, such as diameter BA, essentially not exceeding diameter BB of the sphere. The general mathematic expression of the correspondence between these two diameters may be $BA \leqq BB$. Should diameter BA be essentially larger than diameter BB, working area 2802 of cup 2800 may fail to functionally contact the surface 2852 of sphere 2850, and treatment may essentially fail.

Essentially prior to the treatment, the surface of working area 2802 may be flat, oblique, concave, convex or of any other shape. Essentially during the treatment, working area 2802 may self-align or self-fit its shape to the approximate or exact shape of sphere 2850. For example, working area 2802 may become concave, having the approximate or exact radius as that of sphere 2850.

Various abrasive working agents may be used as an intermediate between an outside surface of a sphere, such as outside surface 2852 of sphere 2850, and a working area, such as working area 2702.

Optionally, such a cup may include one or more tubing systems adapted to deliver at least one working agent to a space delimited between a working area of a cup and an outer surface of a sphere. An internal tubing system may include one or more tubes and/or bores that pass essentially through the cup and deliver the at least one working agent through one or more apertures in a working area of the cup. Alternatively, an external tubing system may include one or more tubes running essentially externally to the cup, and delivering the at least one working agent to a space delimited between a working area of the cup and an outer surface of a sphere.

Optionally, a tubing system may include a combination of an internal tubing system and an external tubing system.

One or more working agents may be fed to a tubing system either continuously, at pre-determined intervals and/or otherwise when desired. Feeding may be conducted, for example, using a pump and/or other means.

In addition to the treatment described above, additional treatments of different or similar natures may be performed on a treated surface (shown, for example, at 2852), for the purpose of conveying particular frictional properties to thereto. Such one or more additional treatments may be performed on essentially the same area of the treated surface (shown, for example, at 2852) or on essentially distinct areas of it. Treatments can be performed either essentially simultaneously or at essentially separate instances.

Some possible additional treatments may include changing the structure of a surface, such as treated surface 2852. Such change of structure may consist of forming one or more recessed or elevated zones on it. Such recessed or elevated zones may have repeating or non-repeating patterns.

Figure 10K:
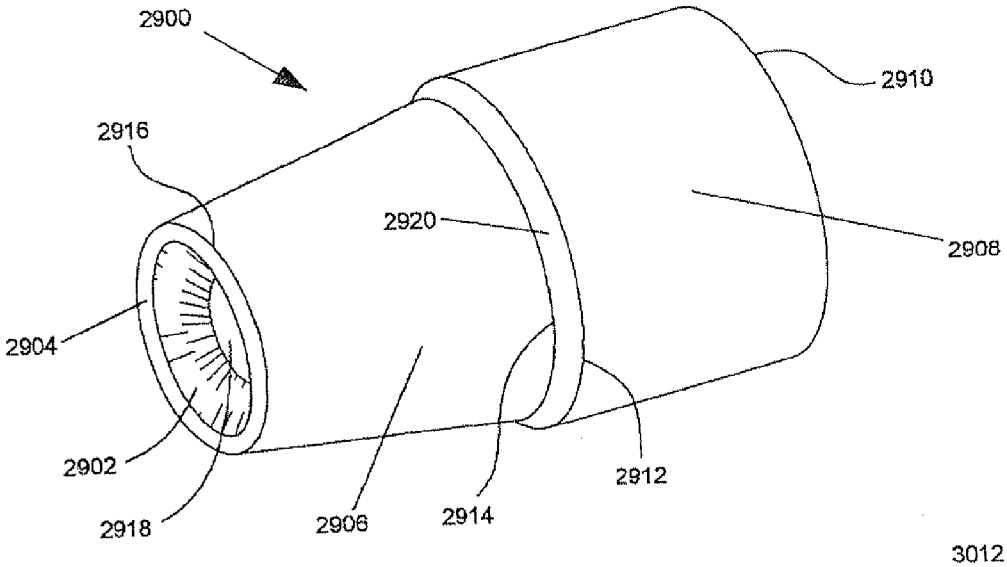
FIG. 10K is an exemplary, schematic perspective view of another embodiment of a lapping tool for lapping spherical elements, according to the present invention.

Another aspect of the inventive lapping tool and lapping process relates to the treatment of convex spherical surfaces using a basin tool ("Basin"). An embodiment of the basin, such as basin 2900 shown in FIG. 10K, is essentially a hollow or solid cylindrical device that may have essentially different diameters along various areas thereof. In the exemplary embodiment shown in FIG. 10K, basin 2900 may have a homogeneous diameter between its bottom end, such as bottom end 2910, until an imaginary line, such as first imaginary line 2912, along an area such as area 2908. Starting at first imaginary line 2912, basin 2900 may gradually decline in radius until another imaginary line, such as second imaginary line 2914, along an area such as area 2920. Starting at second imaginary line 2914, basin 2900 may continue at a gradually declining diameter until another imaginary line, such as third imaginary line 2916, along an area such as area 2906. Bordered on third imaginary line 2916 is the rim, such as rim 2904—an essentially flat area whose surface may be essentially perpendicular to area 2908. Bordered on rim 2904 from its other side is a working area, such as working area 2902—an essentially concave surface that may essentially be lowered from the surface of rim 2904 towards bottom end 2910 of basin 2900. Working area 2902 may have an essentially round aperture, such as aperture 2918, in the center of its surface. In other embodiments (not shown), the working area may essentially lack an aperture in its surface. The absence of an aperture (such as aperture 2918) and the existence of a full, concave working area (not shown) may essentially cause, during treatment (described hereinbelow), functional contact between a central round area of the working area (not shown) and a treated sphere (described hereinbelow). Due to the rotation of basin 2900 essentially during treatment (described hereinbelow), such functional contact may have an angular velocity lower than the angular velocity of the functional contact between more external areas of the working area and the treated sphere (described hereinbelow). In the most extreme case, functional contact between the central point of the working area and the sphere may lack angular velocity at all. Therefore, having an aperture (such as aperture 2918) essentially in the center of the working area may prevent essentially less efficient treatment.

In the embodiment shown in FIG. 10K, basin 2900 is often made of a single piece of polymeric material. In another embodiment of the basin (not shown), it may include two or more sub-sections or layers, each may be made of similar or different materials. For example, the working area and optionally its immediate surroundings may be made of polymeric material, whereas other portions of the basin may be made of other rigid materials.

In the exemplary embodiment shown in FIG. 10K, areas 2908, 2906, rim 2904 and working area 2902 may be essentially integrally formed. In another embodiment of the basin (not shown), some or all of these parts may essentially be separate pieces, functionally connected to each other. In yet another embodiment of the basin (not shown) some parts of it may not exist at all, and it may essentially include only a working area and optionally other functional parts, the combination of which is functionally adapted to perform a desired treatment or treatments.

Figure 10L:
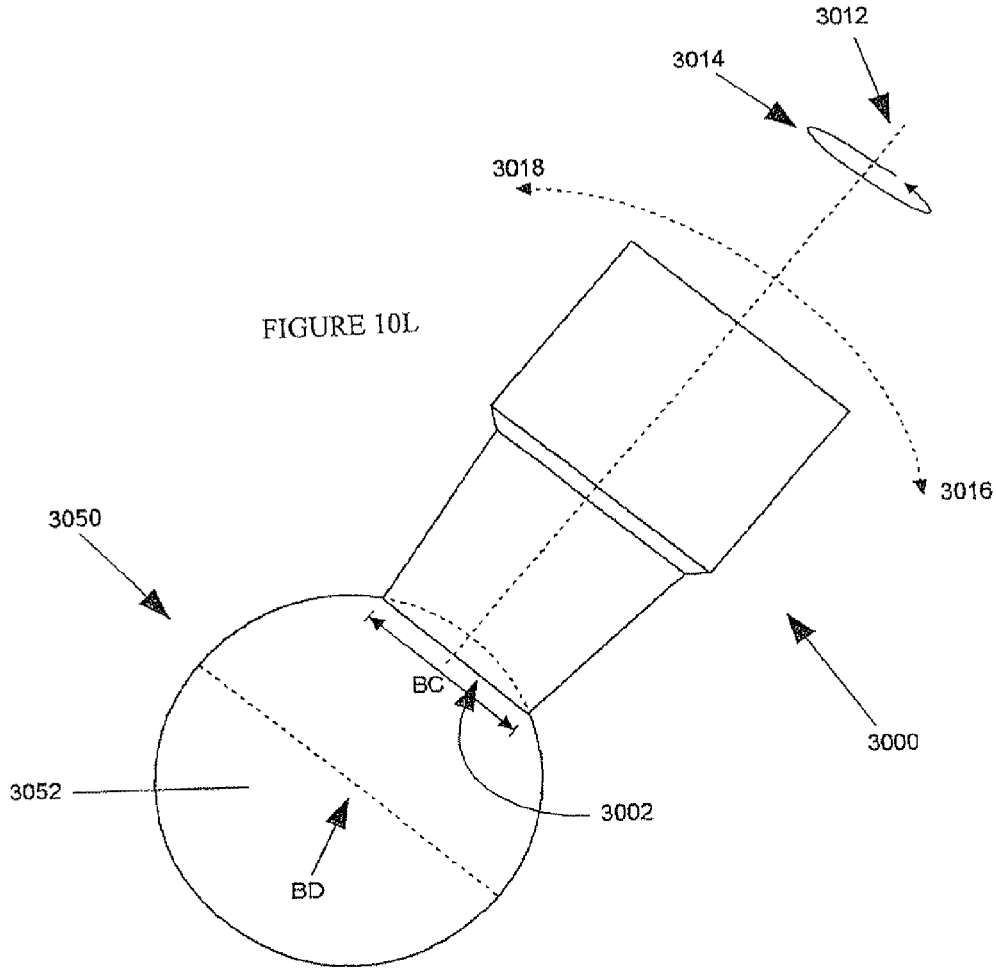
FIG. 10L is an exemplary, schematic perspective view showing the lapping of a sphere using the inventive lapping tool provided in FIG. 10K.

Convex spherical surfaces, such as the outside surface of a ball or a sphere may be suitable for treatment using a basin, such as basin 2900. The exemplary treated component shown in FIG. 10L is essentially a hollow or a solid sphere (or ball), such as sphere 3050, wherein the treated surface may essentially be its outside surface, such as outside surface 3052, or portion(s) thereof.

One example of a component that may be suitable for treatment by a basin, such as basin 2900, is an artificial hip joint implant, which has been described in detail hereinabove. Treatment of the ball of an artificial hip joint using a tool such as basin 2900 may reduce the aforementioned friction.

Reference is again made to FIG. 10L, which shows a two-dimensional view of a basin, such as basin 3000, which may be the basin of FIG. 10K, and a sphere 3050. Treatment of convex spherical surfaces (for example, surface 3052) using a basin, such as basin 3000, may be conducted by essentially spinning or rotating basin 3000 around its central axis 3012 (for example, in direction of rotation 3014) while essentially simultaneously functionally contacting working area 3002 with surface 3052 of sphere 3050. Sphere 3050 may also be spun or rotated essentially during the treatment. The functional contact of basin 3000 with surface 3052 of sphere 3050 may include reciprocating (moving interchangeably in two or more different directions) basin 3000 along surface 3052 of sphere 3050 (for example, reciprocating basin 3000 in directions 3016 and 3018.) Reciprocating may additionally or alternatively include moving basin 3000 in linear, circular or other patterns along surface 3052 of sphere 3050. Changing the position, the tilt and/or the pitch of sphere 3050 may complement or substitute reciprocating basin 3000. Essentially during the treatment, working area 2902 of basin 3000 may functionally contact all the desired areas of surface 3052 of sphere 3050.

Working area 3002 of basin 3000 may be formed with an external diameter, such as external diameter BC, corresponding to the diameter, such as diameter BD, of the sphere 3050; the closer the measurement of diameter BC of working area 3002 to diameter BD of sphere 3050, the more efficient and/or more qualitative the treatment may be. "More efficient" may be reflected in lesser need of reciprocating basin 3000, essentially due to the better coverage of surface 3052 of sphere 3050 by a larger working area, such as working area 2804. "More qualitative" may be reflected in a more geometrically-homogeneous treatment along surface 3052 of sphere 3050, essentially due to the relative reduction in the reciprocating movement of basin 3000. Working area 3002 may be formed with an external diameter, such as external diameter BC, essentially not exceeding diameter BD of sphere 3050. The general mathematic expression of the correspondence between these two diameters may be BC≦BD. Shall diameter BC be essentially larger than diameter BD, some portions of working area 3002 may fail to functionally contact surface 3052 of sphere 3050, and efficiency may essentially be lower than its full potential; shall the diameter of aperture (not shown in FIG. 10L, but shown at 2918 in FIG. 10K) be essentially larger than diameter BD, working area 3002 may completely fail to functionally contact surface 3052 of sphere 3050, and treatment may fail.

Essentially prior to the treatment, the surface of working area 3002 may be flat, oblique, concave, convex or may be of other shape. Essentially during the treatment, working area 3002 may self-align or self-fit its shape to the approximate or exact shape of sphere 3050. For example, working area 3002 may become concave, having the approximate or exact radius as that of sphere 3050.

Various abrasive working agents may be used as an intermediate between an outside surface of a sphere, such as outside surface 3052 of sphere 3050, and a working area, such as working area 2902.

Optionally, such a basin may include one or more tubing systems adapted to deliver at least one working agent to a space delimited between a working area of the basin and an outer surface of a sphere. An internal tubing system may include one or more tubes and/or bores that pass essentially through the basin and deliver the at least one working agent through one or more apertures in a working area of the basin. Alternatively, an external tubing system may include one or more tubes running essentially externally to the basin, and delivering the at least one working agent to a space delimited between a working area of the basin and an outer surface of the sphere.

Optionally, a tubing system may include a combination of an internal tubing system and an external tubing system.

One or more working agents may be fed to a tubing system either continuously, at pre-determined intervals and/or otherwise when desired. Feeding may be conducted, for example, using a pump and/or other means.

In addition to the treatment described above, additional treatments of different or similar natures may be performed on a treated surface (shown, for example, at 3052), for the purpose of conveying particular frictional properties to it. Such one or more additional treatments may be performed on essentially the same area of the treated surface (shown, for example, at 3052) or on essentially distinct areas of it. Treatments can be performed either essentially simultaneously or at essentially separate instances.

Some possible additional treatments may include changing the structure of a surface, such as treated surface 3052. Such change of structure may consist of forming one or more recessed or elevated zones on it. Such recessed or elevated zones may have repeating or non-repeating patterns.

Figure 10M:
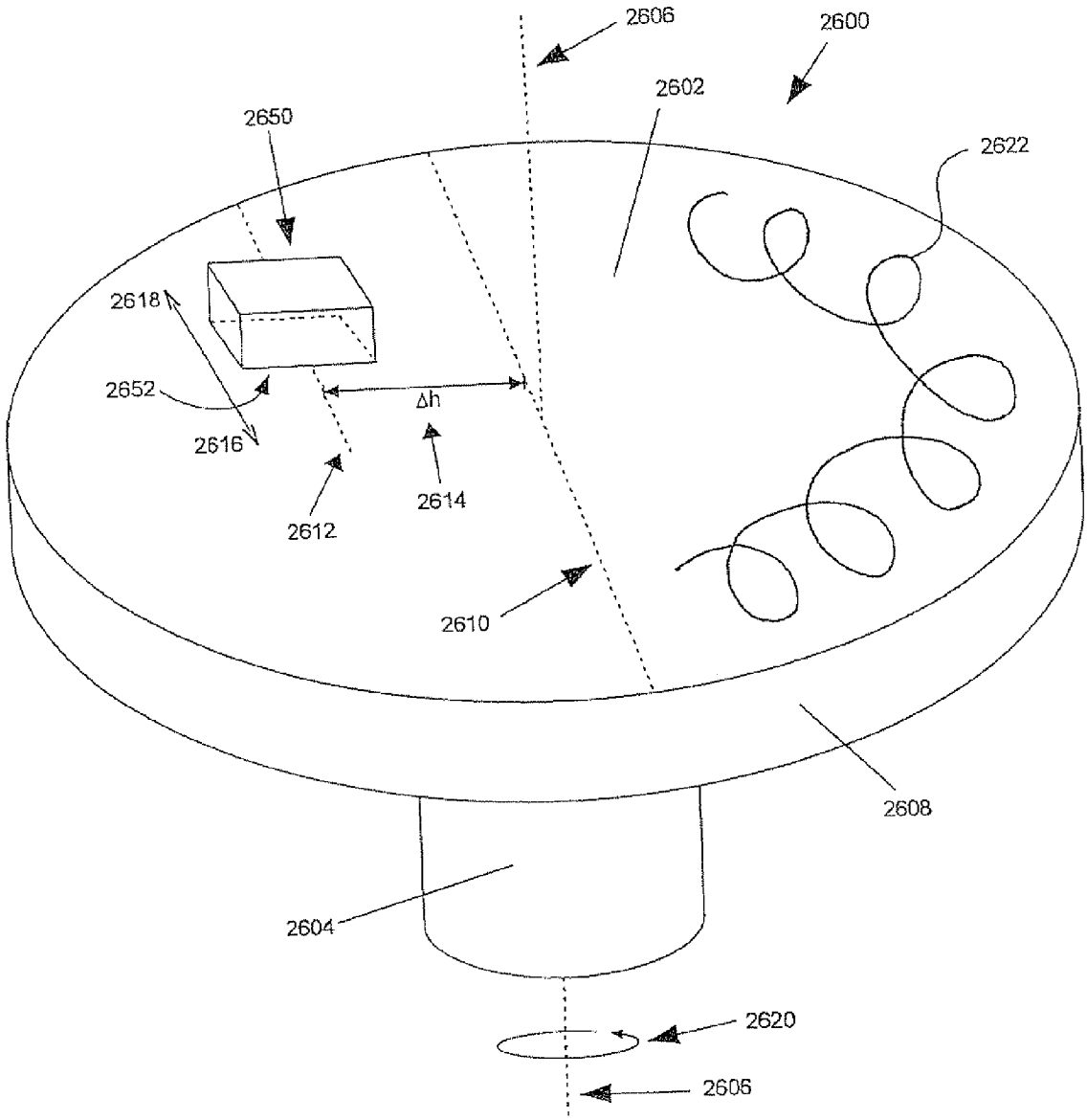
FIG. 10M is an exemplary, schematic perspective view of a disk-type lapping system, according to the present invention.

Another aspect of the inventive lapping tool and lapping process relates to the treatment of flat surfaces using a disk-like arrangement ("disk"). An embodiment of the disk, such as disk 2600 shown in FIG. 10M, is essentially a round plate or a disk-shaped device, having a body, such as body 2608, an essentially flat working area, such as working area 2602, which is essentially a surface of body 2608, and a base, such as base 2604, located on the opposite side of working area 2602.

In another embodiment of the disk (not shown), its working area may have one or more recessed or elevated zones on it. Such recessed or elevated zones may have repeating or non-repeating patterns.

Body 2608 of disk 2600 may have a homogeneous or varying thickness. In the embodiment shown in FIG. 10M, body 2608 has a homogeneous thickness along its entire area.

In the embodiment of disk 2600 described above and shown in FIG. 10M, body 2608 is often made of a single piece of polymeric material, either solid, hollow, or with other internal characteristics. In another embodiment of the body (not shown), it may include two or more sub-sections or layers, each may be made of similar or different materials. For example, the body may have two layers, one (on which a working area will be present) made of a polymeric material, and one made of another rigid material.

Base 2604 may essentially be a cylindrical device—solid, hollow or with other internal characteristics, having a central axis, such as central axis 2606, which essentially merges with central axis 2606 of body 2608. Base 2604 may either be integrally formed with body 2608 and made of the same polymeric material, or essentially functionally connected to body 2608. If base 2604 is essentially functionally connected to body 2608, it may be made of a polymeric material similar or identical to the polymeric material that may be used to form base 2604, or made of another rigid material such as metal. Forming base 2604 with other rigid materials may be advantageous due to the relatively high cost of some polymeric materials that may be used to form it, compared to the possible cost of other rigid materials that may be used. Another possible reason may be the functional need to add rigidity and/or support to disk 2600; since the polymeric material that may form it may be less mechanically-stable compared to other rigid materials, using such rigid materials to form base 2604 may essentially add rigidity and support to the entire disk 2600.

Base 2604 may function essentially as a functional intermediate between body 2608 and an external torque (or other movement) transfer device (not shown), that may essentially functionally connect to base 2604, spin or rotate it, and thus cause rotation of the entire disk 2600.

A flat surface may be suitable for treatment using a disk, such as disk 2600. The exemplary treated component shown in 2650 is essentially a rectangular cube or a box-shaped device, such as rectangular cube 2650, wherein the treated surface may essentially be a facet, such as facet 2652, or any other facet or side. In the exemplary rectangular cube 2650, the treated surface is facet 2652.

One example of a flat surface that may be suitable for treatment by a disk, such as disk 2600, is a clutch plate (or a clutch disk)—a component used in the automotive and other industries. A clutch plate may be used, as part of a clutch system, to functionally transfer torsion from an automotive engine to its wheels. For a more detailed explanation of clutch systems and other components that may be related, see Schwaller (cited above), especially at pages 683-698. A clutch plate may be made of metal and may essentially have the shape of a round, flat, disk or plate with a round hole in the center of its area. Essentially during the operation of an automotive clutch pedal, the clutch plate may contact the flywheel, another disk-shaped component. Prior to their contact, the clutch plate and the flywheel may rotate around their central axis at different speeds, and therefore, the contact (or at least the essentially initial contact) between them may produce friction resulting from that speed difference. Treating the surface of the clutch plate with a tool such as disk 2600 may reduce that friction.

Another example of a flat surface that may be suitable for treatment by a disk, such as disk 2600, is a swashplate—a component that may be used in variable displacement pumps (or axial piston pumps). Variable displacement pumps are devices that convert mechanical energy to hydraulic (fluid) energy. A swashplate is essentially a flat disk or plate-shaped device made of metal or other rigid materials that may be positioned in various angles relative to a variable displacement pump's drum for the purpose of adjusting the pump's output or power. For a more detailed explanation of variable displacement pumps, swashplates and other components that may be related, see Parr and Karassik et al., both of which have been referenced hereinabove. Essentially during the operation of a variable displacement pump, the swashplate may functionally contact tips of hydraulic pistons spinning inside the drum, and friction may occur between the surface of the swashplate and the tips of the hydraulic pistons. Treating the surface of the swashplate with a tool such as disk 2600 may reduce that friction.

Another example of a flat surface that may be suitable for treatment by a disk, such as disk 2600, is a plate of a thrust roller bearing. Thrust roller bearings are bearings that may transfer torque between two elements essentially pressed one towards the other. Thrust roller bearings may comprise of two round plates essentially separated by an array of cylinders (or rollers) assembled inside a cage. For a more detailed explanation of thrust roller bearings, their components and other components that may be related, see Johannes Brändlein, Paul Eschmann, Ludwig Hasbargen & Karl Weigand, *Ball and Roller Bearings: Theory, Design and Application* (3rd ed. 1999), which is hereby incorporated by reference in its entirety. Essentially during the operation of a thrust roller bearing, one or both plates may spin and essentially roll over the rollers, and friction may occur between the surface of the plates and the outer surface of the rollers. Treating the surface of the plates with a tool such as disk 2600 may reduce that friction.

Treatment of flat surfaces, such as facet 2652 of rectangular cube 2650, using a disk, such as disk 2600, may be conducted by essentially spinning or rotating disk 2600 around its central axis, such as central axis 2606 (for example, in direction of rotation 2620) or rotating both disk 2600 and rectangular cube 2650, while essentially simultaneously functionally contacting working area 2602 with facet 2652 of rectangular cube 2650. The functional contact of disk 2600 with facet 2652 of rectangular cube 2650 may include reciprocating (moving interchangeably in two or more different directions) rectangular cube 2650 in a path parallel to a diameter (for example, diameter 2610) of disk 2600 (for example, reciprocating rectangular cube 2650 in directions 2616 and 2618.) The functional contact of disk 2600 with facet 2652 of rectangular cube 2650 may also include moving rectangular cube 2650 in an essentially circular path, so that when disk 2600 spins or rotates while essentially simultaneously rectangular cube 2650 is moved in an essentially circular path, an essentially spiral movement pattern, such as spiral pattern 2622 is formed between disk 2600 and rectangular cube 2650.

Essentially during the treatment, rectangular cube 2650 may be positioned (as shown in FIG. 10M) with the imaginary line, such as imaginary line 2612, which may divide the area of facet 2652 into two essentially equal areas, essentially parallel to a diameter, such as diameter 2610, of working area 2602. In addition, a distance, such as distance Δh 2614 between imaginary line 2612 and diameter 2610 may be different than zero (0). In the exemplary treatment shown in FIG. 10M, Δh 2614 is larger than zero (0), and may have a value, for example, of 5 centimeters. The general mathematical expression of Δh may be $|\Delta h|>0$ (in words: the absolute value of Δh is larger than zero). As $|\Delta h|$ is larger, treatment may be more efficient and/or convey better frictional properties to the treated surface, as greater distance between imaginary line 2612 and diameter 2610 may result in a more complex pattern of functional contact between working area 2602 and facet 2652. Different values of $|\Delta h|$ may also be reflected in different characteristics of frictional properties conveyed to the treated surface—characteristics that may not be necessarily defined in terms of "better" or "worse".

Various abrasive working agents may be used as an intermediate between a facet of a device, such as facet 2652 of rectangular cube 2650, and a working area, such as working area 2602.

Optionally, such a disk may include one or more tubing systems adapted to deliver at least one working agent to a space delimited between a working area of the disk and a facet of the device. An internal tubing system may include one or more tubes and/or bores that pass essentially through the disk and deliver the at least one working agent through one or more apertures in a working area of the disk. Alternatively, an external tubing system may include one or more tubes running essentially externally to the disk, and delivering the at least one working agent to a space delimited between a working area of the disk and a facet of the device.

Optionally, a tubing system may include a combination of an internal tubing system and an external tubing system.

One or more working agents may be fed to a tubing system either continuously, at pre-determined intervals and/or otherwise when desired. Feeding may be conducted, for example, using a pump and/or other means.

In addition to the treatment described above, additional treatments of different or similar natures may be performed on a treated surface (for example, facet 2652), for the purpose of conveying particular frictional properties to it. Such one or more additional treatments may be performed on essentially the same area of the treated surface (for example, facet 2652) or on essentially distinct areas of it. Treatments can be performed either essentially simultaneously or at essentially separate instances.

Some possible additional treatments may include changing the structure of a surface, such as facet 2652. Such change of structure may consist of forming one or more recessed or elevated zones on it. Such recessed or elevated zones may have repeating or non-repeating patterns.

Figure 10N:
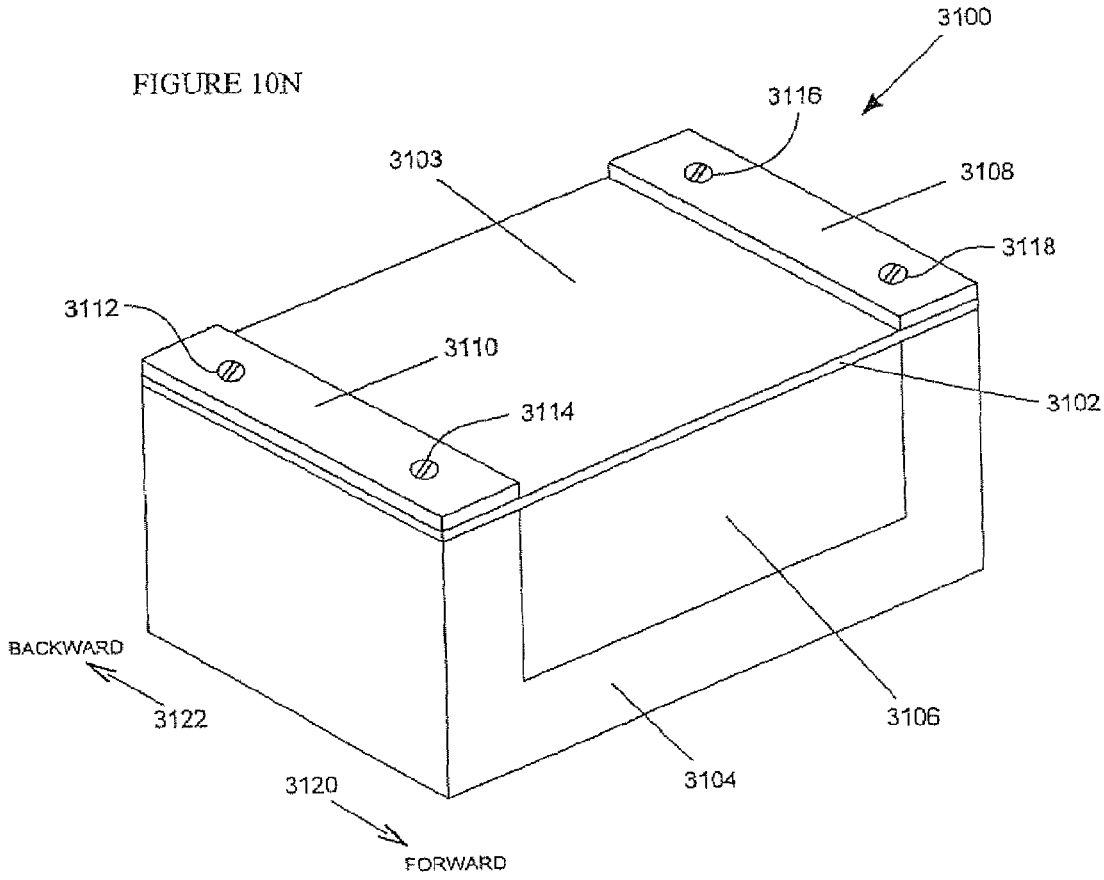

Another aspect of the inventive lapping tool and lapping process relates to the treatment of complex surfaces using an adaptable tool ("ADAT"). An embodiment of the ADAT, such as ADAT 3100 shown in FIG. 10N, is essentially a rectangular cube or a box-shaped device, having a base, such as base 3104, a filling, such as filling 3106, and an essentially flat plate, such as plate 3102, functionally secured to base 3104, essentially using holders, such as holders 3108, 3110.

Base 3104 may be an essentially U-shaped device, having an essentially rectangular bottom plane with two perpendicular walls emerging from two of the plane's sides.

Other embodiments of the base (not shown) may have other shapes, essentially functionally adaptable to contain filling, such as filling 3106, and to connect to a plate, such as plate 3102.

In the embodiment of ADAT 3100 described above and shown in FIG. 10N, base 3104 is often made of a single piece of metallic material, either solid, hollow, or with other internal characteristics. In another embodiment of the base (not shown), it may include two or more sub-sections or layers, each may be made of similar or different materials. One possible reason for forming a base with two or more sub-sections and/or layers is the relative high cost of some metallic materials that may be used to form it, compared to the possible cost of other rigid materials that may be used.

Plate 3102 may be an essentially flat, rectangular plate, made of polymer. The top surface of plate 3102 is the working area, such as working area 3103, which may be essentially flat. Plate 3102 may rest on the two walls of base 3104, so that essentially two distinct areas of plate 3102 rest, each one, on a wall. Plate 3102 may be essentially functionally secured to base 3104 using holders (such as holders 3108, 3110)—essentially rectangular tablets that may be placed one on each side of plate 3102, above each of the walls of base 3104. Holders 3108, 3110 may secure plate 3102 to base 3104 essentially using four (or a different number of) screws that may be threaded through holes (not shown) in holders 3108, 3110, then through holes (not shown) in plate 3102 and then through bores (not shown) in the walls of base 3104. Other embodiments (not shown) may lack holders, such as holders 3108, 3110.

In other embodiments of the plate (not shown), it may include two or more sub-sections or layers, each may be made of similar or different materials. For example, the plate may have two layers, one (on which a working area will be present) made of a polymeric material, and one made of another rigid or flexible material.

The space between base 3104 and plate 3102 may be essentially filled with filling 3106. Filling 3106 may made of an essentially flexible material, such as polyurethane foam, polyethylene foam, rubber foam, polystyrene foam and the like. Filling 3106 may also be made of a combination of flexible materials, either in a mixture or in layers. In another embodiment of the filling (not shown), it may include an essentially flexible container filled with an essentially pressurized gas or a liquid.

Filling 3106 may function as a supportive measure to plate 3102. It may enable the plate to form an essentially concave shape during treatment, without becoming too much concave. "Too much" may refer to an undesired degree of concavity. Different materials used for filling 3106 may essentially influence the amount of support filling 3106 may provide for plate 3102, and the degree of concavity plate 3102 may form to during treatment.

Many types of surfaces may be suitable for treatment using an ADAT, such as ADAT 3100. An ADAT, such as ADAT 3100, may be used, for example, to treat surfaces with complex characteristics, such as surfaces that have grooves and/or ridges with repeating or non-repeating patterns, or other surfaces that are relatively hard to treat using other means.

Figure 10P:
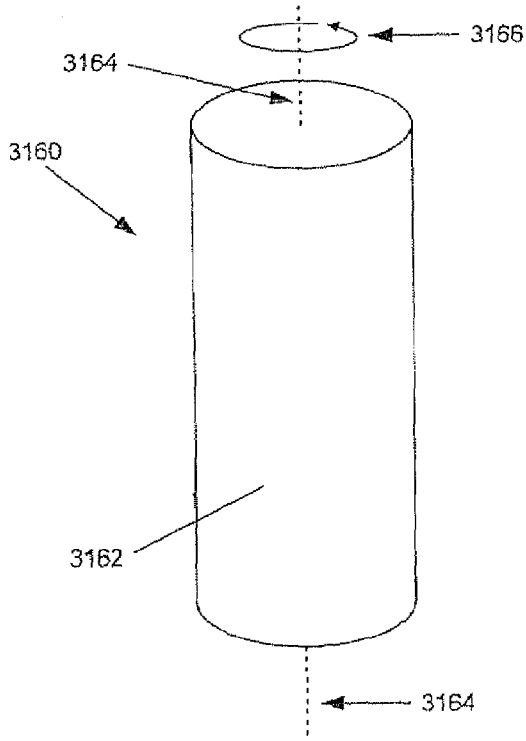
Figure 10O:
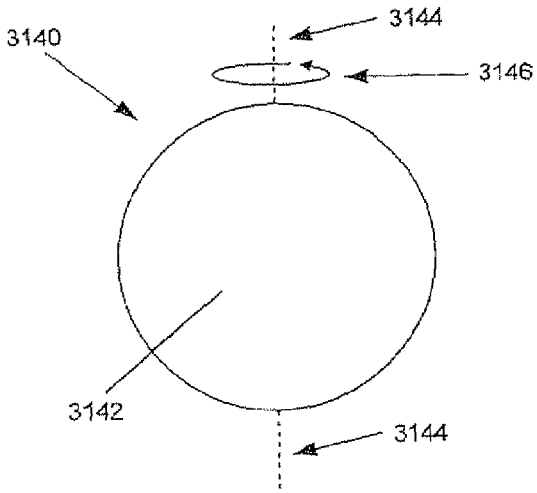
Figure 10A:
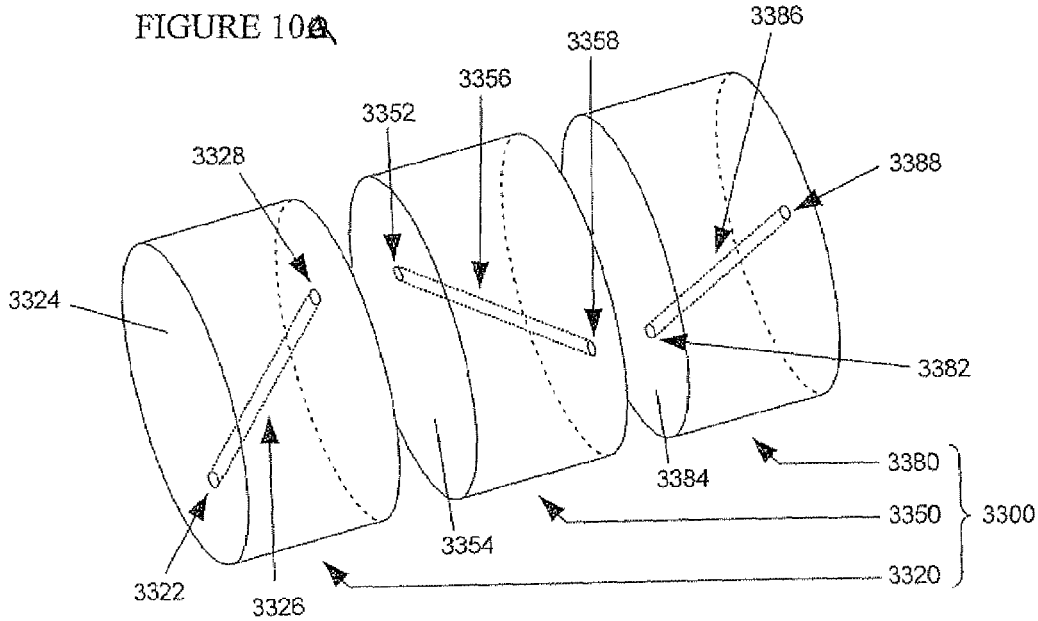

In addition, an ADAT, such as ADAT 3100, may be used to treat surfaces such as a convex spherical surface (for example, convex spherical surface of sphere 3140 shown in FIG. 10O) or a cylindrical surface (for example, cylindrical surface of cylinder 3160 shown in FIG. 10P).

One example of a convex spherical surface that may be suitable for treatment by an ADAT, such as ADAT 3100, is the surface of an artificial hip joint implant—a device which may be used for medical and other purposes. Artificial hip joint implants may be used to replace damaged natural hip joints, and more specifically the femoral head which is the ball-shaped part located at the uppermost part of the thighbone (or femur). The replacement is often conducted in a medical procedure called "hip replacement". Artificial hip joint implants are often made of stainless steel, and may have the shape of a ball to which a shaft is essentially attached. Essentially during a hip replacement procedure, the shaft may be secured into the patient's thighbone (or femur), and the ball, which may replace the damaged femoral head, may be inserted into the acetabulum of the pelvis (a socket in the hipbone). Essentially prior to the insertion of the ball into the acetabulum, a fitting artificial concave liner may be placed inside the acetabulum, in order for the ball not to rub directly against the hipbone but rather against the liner. For a more detailed explanation of a hip joint, its related organs and parts and related medical issues and procedures, see Dutton, referenced hereinabove.

Essentially during the regular operation of the artificial hip joint (for example, when the patient is walking or running), the ball of the artificial hip joint may rub against the liner lying inside the acetabulum, and friction may occur between them. Where a liner is not present, friction may occur directly between the ball of the artificial hip joint and the acetabulum. Friction may cause wear of the ball of the artificial hip joint and/or the liner, may produce debris, and thus cause medical problems such as Osteolysis. Treatment of the ball of an artificial hip joint using a tool such as ADAT 3100 may reduce the aforementioned friction.

One example of a cylinder that may be suitable for treatment by an ADAT, such as ADAT 3100, is a piston pin (or a wrist pin)—a component which may be used in the automotive and other industries A piston pin may be used for connecting two parts inside an engine—the piston and the connecting rod. For a more detailed explanation of a piston pin, a piston, a connecting rod and other components that may be related, see Schwaller (cited above), especially at pages 241-243. A piston pin may be made of steel and/or other rigid materials, and has the shape of essentially a cylinder. Essentially during the operation of the engine, the piston and the connecting rod move, and friction may occur between at least one of them and the piston pin. Treating the surface of the piston pin with a tool such as ADAT 3100 may reduce that friction.

Another example of a cylinder that may be suitable for treatment by an ADAT, such as ADAT 3100, is a hydraulic piston—a component used in variable displacement pumps (or axial piston pumps). Variable displacement pumps are devices that convert mechanical energy to hydraulic (fluid) energy. A hydraulic piston is essentially a cylinder made of metal or other rigid materials that may interchangeably slide within bores inside a drum of the variable displacement pump, for the purpose of essentially pushing or pulling fluids. For a more detailed explanation of variable displacement pumps, hydraulic pistons and other components that may be related, see Parr and Karassik et al., both of which have been referenced hereinabove. Essentially during the operation of a variable displacement pump, the hydraulic piston may interchangeably slide within a bore inside a drum of the variable displacement pump, and friction may occur between the hydraulic piston's outer surface and the inner surface of the drum's bore. Treating the surface of the hydraulic piston with a tool such as ADAT 3100 may reduce that friction.

Treatment of convex spherical surfaces, such as surface 3142 of sphere 3140 using an ADAT, such as ADAT 3100 may be conducted by essentially spinning or rotating the sphere 3140 around its central axis 3144 (for example, in direction of rotation 3146) while essentially simultaneously functionally contacting working area 3102 with surface 3142 of sphere 3140. The functional contact of working area 3102 with surface 3142 of sphere 3140 may include reciprocating (moving interchangeably in two or more different directions) ADAT 3100 along surface 3142 of sphere 3140 (for example, reciprocating ADAT 3100 forward 3120 and backward 3122.) Essentially during the treatment, sphere 3140 may be positioned at different angles relative to working area 3103, so that working area 3103 may essentially functionally contact all the desired areas of surface 3142 of sphere 3140.

In addition to the treatment described above, additional treatments of different or similar natures may be performed on a surface of a sphere, such as surface 3142 of sphere 3140, for the purpose of conveying particular frictional properties to it. Such one or more additional treatments may be performed on essentially the same area of surface 3142 of sphere 3140 or on essentially distinct areas of it. Treatments can be performed either essentially simultaneously or at essentially separate instances.

Some possible additional treatments may include changing the structure of a surface, such as surface 3142 of sphere 3140. Such change of structure may consist of forming one or more recessed or elevated zones on surface 3142 of sphere 3140. Such recessed or elevated zones may have repeating or non-repeating patterns.

Treatment of cylindrical components, such as cylinder 3160 shown in FIG. 10P, using an ADAT, such as ADAT 3100 may be conducted by spinning or rotating cylinder 3160 around its central axis 3164 (for example, in a direction of rotation 3166), with central axis 3164 being parallel to working area 3103, while essentially simultaneously functionally contacting working area 3103 with surface 3162 of cylinder 3160. The functional contact of working area 3103 with surface 3162 of cylinder 3160 may include reciprocating (moving interchangeably in two or more different directions) ADAT 3100 along central axis 3164 of cylinder 3160 (for example, reciprocating ADAT 3100 forward 3120 and backward 3122.) The functional contact of working area 3103 with surface 3162 of cylinder 3160 may also include applying pressure essentially with cylinder 3160 to working area 3103, so that working area 3103 becomes essentially concave. Such pressure may contribute to the quality of the treatment, as well as cause a larger area of surface 3162 of cylinder 3160 to come in functional contact with working area 3103.

In addition to the treatment described above, additional treatments of different or similar natures may be performed on surface 3162 of cylinder 3160, for the purpose of conveying particular frictional properties to it. Such one or more additional treatments may be performed on essentially the same area of surface 3162 of cylinder 3160 or on essentially distinct areas of it. Treatments can be performed either essentially simultaneously or at essentially separate instances.

Some possible additional treatments may include changing the structure of a surface, such as surface 3162 of cylinder 3160. Such change of structure may consist of forming one or more recessed or elevated zones on surface 3162 of cylinder 3160. Such recessed or elevated zones may have repeating or non-repeating patterns.

Various abrasive working agents may be used as an intermediate between a working area, such as working area 2602, and a surface of a sphere or a cylinder, such as surfaces 3142 or 1362 of sphere 3140 or cylinder 3160, respectively.

Optionally, an ADAT (not shown) may include one or more tubing systems adapted to deliver one or more working agents to space delimited between a working area of an ADAT and surface of a sphere or a cylinder. A tubing system (hereinafter referred to as an "internal tubing system") may include one or more tubes and/or bores that pass essentially through an ADAT and deliver the one or more working agents through one or more apertures in a working area of an ADAT. Alternatively, other tubing systems (hereinafter referred to as "external tubing systems") may include one or more tubes that run essentially externally to an ADAT, and deliver working agent(s), similar to an internal tubing system, to space delimited between a working area of an ADAT and surface of a sphere or a cylinder.

Optionally, such an ADAT may include one or more tubing systems adapted to deliver at least one working agent to a space delimited between a working area of the ADAT and a surface of a sphere or a cylinder. An internal tubing system may include one or more tubes and/or bores that pass essentially through the ADAT and deliver the at least one working agent through one or more apertures in a working area of the ADAT. Alternatively, an external tubing system may include one or more tubes running essentially externally to the ADAT, and delivering the at least one working agent to a space delimited between a working area of the ADAT and the surface of the sphere or cylinder.

Optionally, a tubing system may include a combination of an internal tubing system and an external tubing system.

One or more working agents may be fed to a tubing system either continuously, at pre-determined intervals and/or otherwise when desired. Feeding may be conducted, for example, using a pump and/or other means.

Another aspect of the inventive lapping tool and lapping process relates to the treatment of wires using a chain-link tool ("CHALT"). An embodiment of the CHALT (that may include 3320, 3350 and 3380, hereby jointly referred to as CHALT 3300) shown in FIG. 10Q, may essentially include one or more cylindrical parts, hereby referred to as "chain-links". In the exemplary embodiment shown in FIG. 10Q, CHALT 3300 includes three chain-links, such as chain-link A 3320, chain-link B 3350 and chain-link C 3380.

Chain-links A 3320, B 2250 and C 3380 may essentially be identical or different solid cylindrical parts.

Figure 10R:
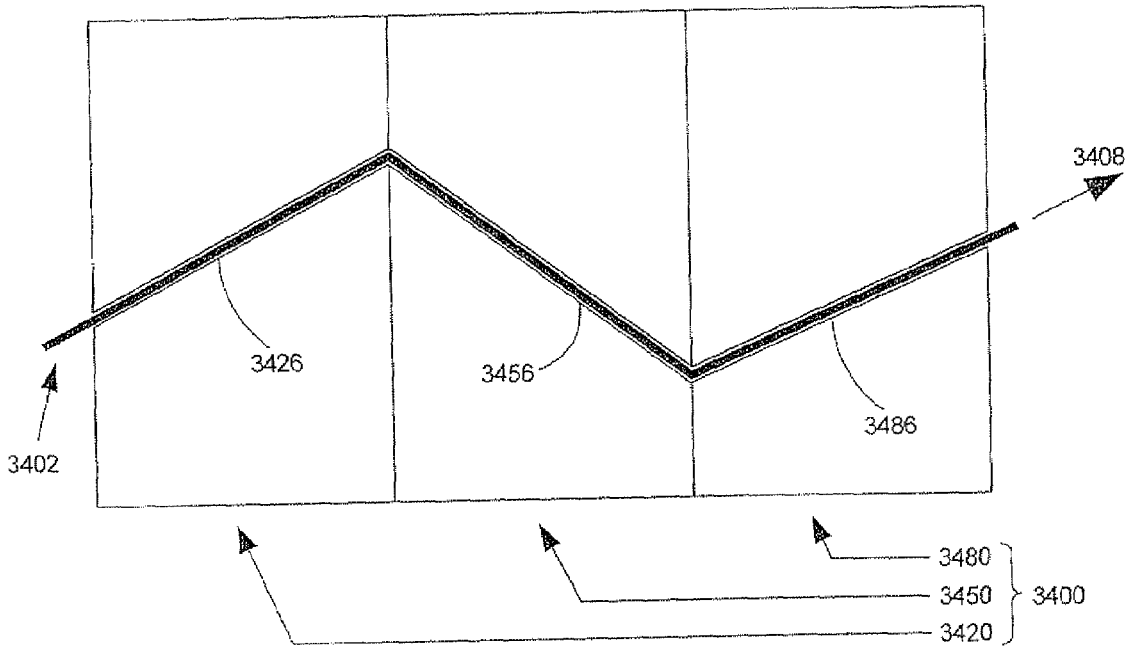
FIG. 10R is an exemplary cross-sectional view of an exemplary embodiment of an chain-link tool, in accordance with the present invention.

Chain-link A 3320 may have a bore, such as bore 3326, that may extend from an aperture, such as aperture 3322 on the left flat circular surface, such as left flat circular surface 3324 of chain-link A 3320, until an aperture, such as aperture 3328 on the right flat circular surface (not shown) of chain-link A 3320. Bore 3326 and/or apertures 3322 and 3328 may be round or otherwise shaped. In the exemplary embodiment shown in FIG. 10Q, bore 3326 and apertures 3322 and 3328 are round. Bore 3326 and/or apertures 3322 and 3328 may have a diameter essentially identical or similar to a diameter of a treated wire (will be described). Referring now to FIG. 10R which shows a cross-sectional view of an exemplary embodiment of a CHALT 3400, which may be the CHALT of FIG. 10Q, bore 3426 may have a diameter slightly larger than the diameter of the treated wire, such as treated wire 3402 (described hereinbelow).

Chain-link B 3350 may have a bore, such as bore 3356 that may extend from an aperture, such as aperture 3352 on the left flat circular surface, such as left flat circular surface 3354 of chain-link B 3350, until an aperture, such as aperture 3358 on the right flat circular surface (not shown) of chain-link B 3350. Aperture 3352 may be located in such a position so that when chain-link B 3350 is placed essentially adjacent to chain-link A 3320, aperture 3352 is located in front of aperture 3328. Bore 3356 and/or apertures 3352 and 3358 may be round or otherwise shaped. In the exemplary embodiment shown in FIG. 10Q, bore 3356 and apertures 3352 and 3358 are round. Bore 3356 and/or apertures 3352 and 3358 may have a diameter essentially identical or similar to a diameter of a treated wire (will be described). Referring now to FIG. 10R, which shows a cross-sectional view of an exemplary embodiment of CHALT 3400, bore 3456 may have a diameter slightly larger than the diameter of treated wire 3402 (will be described).

Chain-link C 3380 may have a bore, such as bore 3386, that may extend from an aperture, such as aperture 3382 on the left flat circular surface, such as left flat circular surface 3384 of chain-link B 3380, until an aperture, such as aperture 3388 on the right flat circular surface (not shown) of chain-link B 3380. Aperture 3382 may be located in such a position so that when chain-link C 3380 is placed essentially adjacent to chain-link B 3350, aperture 3382 is located in front of aperture 3358. Bore 3386 and/or apertures 3382 and 3388 may be round or otherwise shaped. In the exemplary embodiment shown in FIG. 10Q, bore 3386 and apertures 3382 and 3388 are round. Bore 3386 and/or apertures 3358 and 3388 may have a diameter essentially identical or similar to a diameter of a treated wire (will be described). Referring now to FIG. 10R which shows a cross-sectional view of an exemplary embodiment of CHALT 3400, bore 3486 may have a diameter slightly larger than the diameter of treated wire 3402 (will be described).

In the embodiment of CHALT 3300 described above and shown in FIG. 10Q, each chain-link (such as chain-link A 3320, chain-link B 3350 and chain-link C 3380) is often made of a single solid piece of polymeric material. In another embodiment of the CHALT (not shown), some or all of the chain-links may include two or more sub-sections or layers, each may be made of similar or different materials.

Wires of various shapes (such as round, flat and/or rectangular wires) and materials may be suitable for treatment using a CHALT, such as CHALT 3300. Referring now to FIG. 10R, the exemplary wire shown at 3402 is an essentially round metal wire.

One example of wires that may be suitable for treatment by a CHALT, such as CHALT 3300, is the metal wires often incorporated within automotive and other tires. Metal wires may be incorporated within tires essentially for reinforcement purposes, since tires are commonly made of less mechanically-stable materials such as rubber.

Essentially during the operation of a tire, it may be exposed to vibration, heat, physical pressure and/or other types of mechanical stress. Such vibration, heat, pressure and/or stress may cause friction between the tire and the metal wires essentially enclosed within it, and therefore cause wear and/or damage to the tire. Treating metal wires with a tool such as CHALT 3300 may reduce that friction.

Reference is now made to FIG. 10R, which shows a two-dimensional view of CHALT 3400, which may be the CHALT of FIG. 10Q, and a metal wire 3402. Treatment of metal wires (for example, metal wire 3402) using a CHALT (that may include chain-link A 3420, chain-link B 3450 and chain-link C 3480, hereby jointly referred to as CHALT 3400) may essentially be conducted by threading metal wire 3402 through bores 3426, 3456, 3486 in CHALT 3400 and then pulling metal wire 3402 from one side so that it slides through the bores 3426, 3456, 3486. Essentially during the pulling, metal wire 3402 may essentially functionally contact the internal side of bores 3426, 3456, 3486. The different location and/or angle of each of bores 3426, 3456, 3486 of chain-links A 3420, B 3450 and C 3480, respectively, may facilitate functional contact of the walls of bores 3426, 3456, 3486 with essentially major portions, up to the entirety of the external surface of metal wire 3402.

In the exemplary treatment shown in FIG. 10R, metal wire 3402 may be first threaded from the left to the right through bore 3426 of chain-link A 3420, then through bore 3456 of chain-link B 3450 and then through bore 3486 or chain-link C 3480. Threading may require functionally distancing chain-links A 3420, B 3450 and C 3480 from one another essentially for the duration of the threading; had chain-links A 3420, B 3450 and C 3480 been distanced from one another essentially during threading, they may need to be brought closer or adjacent to one another essentially after the threading. Essentially after metal wire 3402 had been threaded through CHALT 3400, it may be pulled through CHALT 3400 essentially from one side (for example, from the right side of chain-link C 3480) in direction 3408.

In other embodiments (not shown), the metal wire may be threaded through the CHALT in an essentially opposite direction to what is shown in FIG. 10R (for example, metal wire 3402 may be first threaded from the right to the left through bore 3486 of chain-link C 3480, then through bore 3456 of chain-link B 3450, and then through bore 3426 of chain-link A 3420), and/or may be pulled from the opposite side of what is shown in FIG. 10R (for example, pulled from the left side of chain-link A 3420 and towards the left.).

Various abrasive working agents may be used as an intermediate between a metal wire, such as metal wire 3402, and internal side of bores, such internal side of bores 3426, 3456 and 3486.

Optionally, such a CHALT may include one or more tubing systems adapted to deliver at least one working agent to a space delimited between a working area of the CHALT and a metal wire. An internal tubing system may include one or more tubes and/or bores that pass essentially through the CHALT and deliver the at least one working agent through one or more apertures in internal side of bores of the CHALT. Alternatively, an external tubing system may include one or more tubes running essentially externally to the CHALT, and delivering the at least one working agent to a space delimited between the internal side of bores of a CHALT and the metal wire.

Optionally, a tubing system may include a combination of an internal tubing system and an external tubing system.

One or more working agents may be fed to a tubing system either continuously, at pre-determined intervals and/or otherwise when desired. Feeding may be conducted, for example, using a pump and/or other means.

In addition to the treatment described above, additional treatments of different or similar natures may be performed on a metal wire (for example, metal wire 3402), for the purpose of conveying particular frictional properties to it. Such one or more additional treatments may be performed on essentially the same area of the metal wire (for example, metal wire 3402) or on essentially distinct areas of it. Treatments can be performed either essentially simultaneously or at essentially separate instances.

Figure 10S:
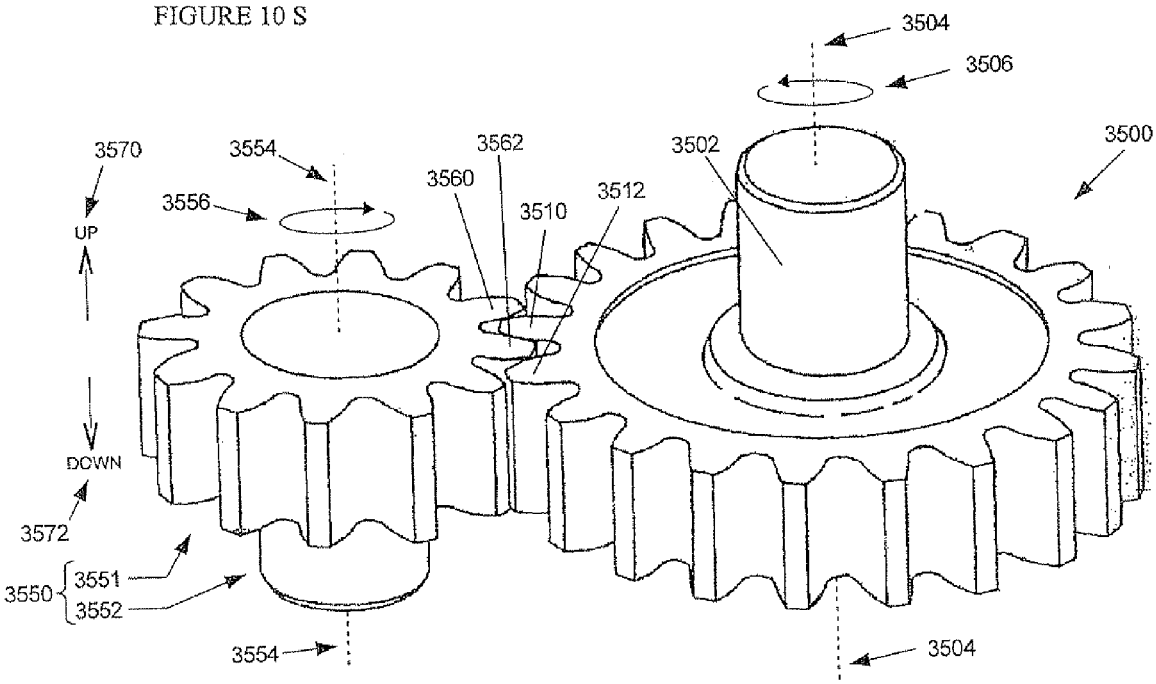
FIG. 10S is an exemplary, schematic perspective view of a gear-like tool for treatment of gear surfaces, in the process of treating a gear.

Another aspect of the inventive lapping tool and lapping process relates to the treatment of gears using a gear-like tool ("GEAT"). An embodiment of the GEAT, such as GEAT 3550 shown in FIG. 10S, is essentially a gear, such as gear 3551, which may have cogs or teeth (such as, for example, cogs 3560 and 3562) and a shank, such as shank 3552, a solid or hollow cylindrical device that is essentially functionally attached to, connected to or integrally formed with gear 3552. Gear 3551 and shank 3552 may have the same central axis, such as central axis 3554. Gear 3551 may be made of polymeric material, while shank 3552, if not integrally formed with gear 3551, may be made of metal, other rigid materials, or a combination thereof.

Figure 10T:
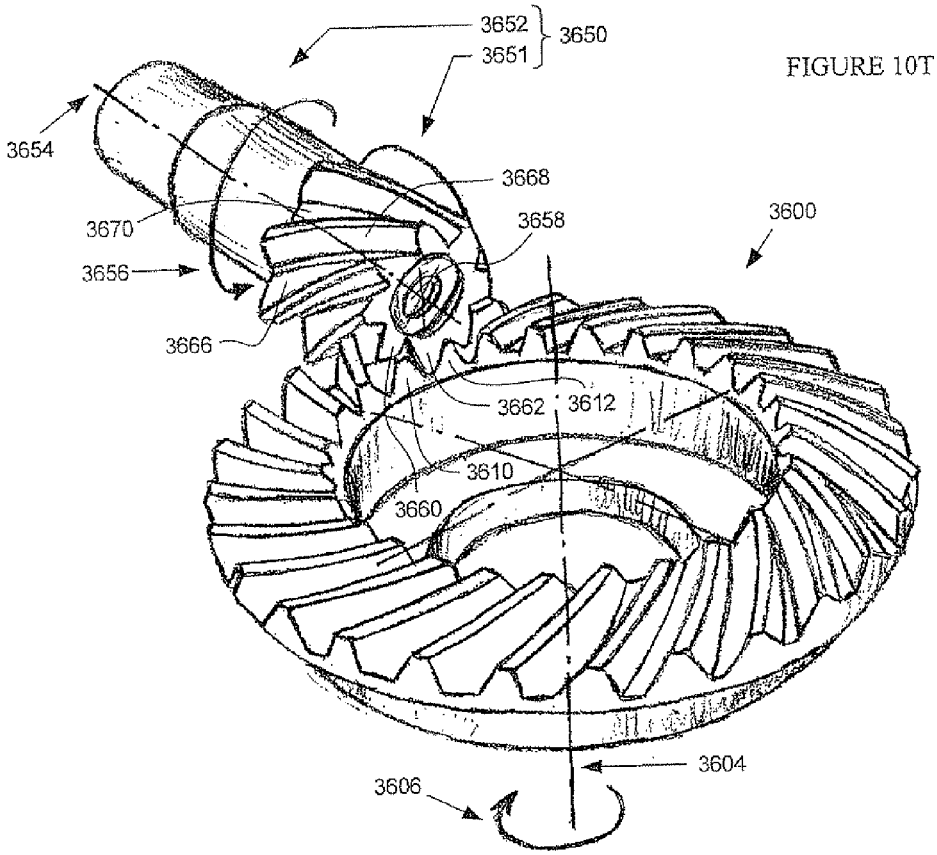
FIG. 10T is an exemplary, schematic perspective view of another embodiment of the inventive gear-like tool, in the process of treating another type of gear'

In the embodiment of GEAT 3550 described above and shown in FIG. 10S, gear 3551 is essentially a spur gear—a type of gear that may have cogs (such as, for example, cogs 3560 and 3562) radially arranged around the gear's central axis (such as, for example, central axis 3554) and essentially parallel thereto. For more information about spur gears, see Ivan Law, *Gears & Gear Cutting* (*Workshop Practice Series*) (1987), Earle Buckingham, Eliot K. Buckingham, *Manual of Gear Design* (Rev. ed. 1999) and Darle W. Dudley, *Handbook of Practical Gear Design* (1994), all hereby incorporated by reference in their entirety. In other embodiments (one of which is shown in FIG. 10T and is described below), the gear may be of other types, such as hypoid gear (shown at 3651 in FIG. 10T and described below), bevel gear, helical gear, worm gear, sector gear, rack-and-pinion gear, epicyclic or planetary gear, derailleur or sprocket gear and other gear types. For more information about these gear types and other gear types, see Law, Buckingham, and Dudley, all of which have been cited above, as well as http://en.wikipedia.org/wiki/Gears, the contents of which are hereby incorporated by reference. Gear systems usually work in groups of two or more corresponding gears, with power being transferred from one gear to another. Corresponding spur gears that are part of the same gear system are often positioned with their central axes parallel, to enable efficient and precise operation of the gear system.

Gear 3551 may be used to perform treatment of gears (such treatment and other treatments will be described below), while shank 3552 may be used to functionally connect GEAT 3550 to an external torque-transfer device for the purpose of essentially spinning or rotating GEAT 3550 (this will be further explained below, in the description of the treatment.) In other embodiments, the GEAT (not shown) may essentially lack a shank; in this case, the gear (such as, for example, gear 3551) may be essentially functionally directly connected to an external torque-transfer device (or to a functional intermediary device placed between the gear and the external torque-transfer device) for the purpose of essentially spinning or rotating gear 3551.

Referring again to FIG. 10T, another embodiment of the GEAT is shown at 3650. GEAT 3650 of FIG. 10T is essentially a gear, such as gear 3651, which may have cogs or teeth (such as, for example, cogs 3660, 3662, 3666 and 3668) and a shank, such as shank 3652—a solid or hollow cylindrical device essentially functionally attached to, connected to or integrally formed with gear 3652 (for example, shank 3652 may be essentially functionally connected to gear 3651 using screw 3658.) Gear 3651 and shank 3652 may have the same central axis 3654. Gear 3651 may be made of polymeric material, while shank 3652, if not integrally formed with gear 3651, may be made of metal, other rigid materials, or a combination thereof.

In the embodiment of GEAT 3650 described in the previous paragraph and shown in FIG. 10T, gear 3651 is essentially a hypoid gear—a type of gear which may have cogs (such as, for example, cogs 3660, 3662, 3666 and 3668) angularly arrayed around the gear's central axis (such as, for example, central axis 3554.), forming an angle of between zero (0) and ninety (90) degrees with the central axis (such as, for example, central axis 3554)—although commonly the angle formed is between thirty (30) and sixty (60) degrees. In the exemplary embodiment of GEAT 3650 shown in FIG. 10T, the cogs (such as, for example, cogs 3660, 3662, 3666 and 3668) form an angle of approximately forty-five (45) degrees with central axis 3654. The array of the cogs (such as, for example, cogs 3660, 3662, 3666 and 3668) may essentially lie on and protrude from a conical surface (a portion of which can be noticed at 3670), expanding in diameter starting at the front end (near 3658) of gear 3651 towards its back end (in the general direction of the shank 3652). The cogs (such as, for example, cogs 3660, 3662, 3666 and 3668) themselves may essentially be prolonged trapezoid box-shaped parts, essentially attached to the conical surface (a portion of which can be noticed at 3670) from their wider base. The cogs (such as, for example, cogs 3660, 3662, 3666 and 3668) may be concave in their length dimension. For more information about hypoid gears, see Law, Buckingham, and Dudley, all of which have been cited above. Gear systems usually work in groups of two or more corresponding gears, with power being transferred from one gear to another. Corresponding hypoid gears that are part of the same gear system are often positioned with their central axes perpendicular to one another and non-intersecting, to enable efficient and precise operation of the gear system.

Gears of various types (such as bevel gears, helical gears, worm gears, sector gears, rack-and-pinion gears, epicyclic or planetary gears, derailleur or sprocket gears or the like) may essentially be suitable for treatment using a GEAT (either GEAT 3550 of FIG. 10S, GEAT 3650 of FIG. 10T or other embodiments of the GEAT not shown). The treated surface in these gears may essentially be the outer surface of their cogs (for example, cogs 3510 and 3512 in FIG. 10S or cogs 3610 and 3612 in FIG. 10T). During the regular operation of gears, cogs of two engaging gears may essentially functionally contact each other, causing friction. Treatment of gears using a GEAT (either GEAT 3550 of FIG. 10S, GEAT 3650 of FIG. 10T or other embodiments of the GEAT not shown) may reduce that friction.

The general principle of matching a gear with a suitable GEAT (either GEAT 3550 of FIG. 10S, GEAT 3650 of FIG. 10T or other embodiments of the GEAT not shown) is that the GEAT (either GEAT 3550 of FIG. 10S, GEAT 3650 of FIG. 10T or other embodiments of the GEAT not shown) should essentially correspond to the to-be-treated gear. "Correspond" may refer to the way gears usually correspond to and essentially match one another—the gears should usually be of the same type (for example, two helical gears, two bevel gears and so on) and their cogs should be shaped in a way that enables cogs of one gear to engage, mesh or fit between the cogs of the other gear when the two gears are positioned adjacently, in their working position.

The following examples will demonstrate how two types of treated gears, spur gears and hypoid gears, are matched with their corresponding GEAT (either GEAT 3550 of FIG. 10S, GEAT 3650 of FIG. 10T or other embodiments of the GEAT not shown):

Referring now to FIG. 10S, a GEAT, such as GEAT 3550, and its matching or corresponding treated gear, such as treated gear 3500, are shown. Treated gear 3500 may essentially be a spur gear—larger, smaller or equal in diameter than GEAT 3550 (exemplary treated gear 3500 is larger in diameter than GEAT 3550), having cogs (for example, cogs 3510 and 3512) shaped in a way that enables the cogs (for example, cogs 3560 and 3562) of GEAT 3550 to engage, mesh or fit between them, when GEAT 3550 and treated gear 3500 are positioned adjacently, in their working position—as essentially shown in FIG. 10S.

Treated gear 3500 is often made of metal, and may have a shank, such as shank 3502—an essentially solid or hollow cylindrical part—attached to, functionally connected to, or integrally formed with treated gear 3500. Shank 3502, if not integrally formed with treated gear 3500, may be made of metal, other rigid materials, or a combination thereof. Treated gear 3500 and shank 3502 may have the same central axis, such as central axis 3504. In other embodiments, treated gear 3500 may lack a shank at all, or may be fitted onto an essentially functional shank, rod, shaft, hinge, pivot and the like (all are not shown) for the purpose of performing treatment (treatment will be described below).

Referring now to FIG. 10T, another GEAT, such as GEAT 3650, and its matching or corresponding treated gear, such as treated gear 3600, are shown. Treated gear 3600 may essentially be a hypoid gear—larger, smaller or equal in diameter than SEAT 3650 (exemplary treated gear 3600 is larger in diameter than GEAT 3650), having cogs (for example, cogs 3610 and 3612) shaped in a way that enables the cogs (for example, cogs 3660 and 3662) of GEAT 3650 to engage, mesh or fit between them, when GEAT 3650 and treated gear 3600 are positioned adjacently, in their working position—as essentially shown in FIG. 10T.

Treated gear 3600 is often made of metal, and may have a shank (not shown)—an essentially solid or hollow cylindrical part—attached to, functionally connected to, or integrally formed with treated gear 3600. The shank (not shown), if not integrally formed with treated gear 3600, may be made of metal, other rigid materials, or a combination thereof. Treated gear 3600 and shank (not shown) may have the same central axis, such as central axis 3604. In the embodiment shown in FIG. 10T, treated gear 3600 lacks a shank at all, but may be fitted onto an essentially functional shank, rod, shaft, hinge, pivot and the like (all are not shown) for the purpose of performing treatment (treatment will be described below).

Treatment of gears (for example, treated gear 3500 of FIG. 10S or treated gear 3600 of FIG. 10T) may be performed by essentially spinning or rotating (for example, in direction 3556 in FIG. 10S or direction 3656 in FIG. 10T) the GEAT (for example, GEAT 3550 of FIG. 10S or GEAT 3650 of FIG. 10T) around it central axis (for example, central axis 3554 in FIG. 10S or central axis 3654 in FIG. 10T) while at an adjacent working position with the treated gear (for example, treated gear 3500 of FIG. 10S or treated gear 3600 of FIG. 10T).

Essentially as a result of spinning or rotating the GEAT (for example, GEAT 3550 of FIG. 10S or GEAT 3650 of FIG. 10T) while at an adjacent working position with the treated gear (for example, treated gear 3500 of FIG. 10S or treated gear 3600 of FIG. 10T), some cogs (for example, cogs 3560 and 3562 in FIG. 10S or cogs 3660 and 3662 in FIG. 10T) of the GEAT (for example, GEAT 3550 of FIG. 10S or GEAT 3650 of FIG. 10T) may engage some cogs (for example, cogs 3510 and 3512 in FIG. 10S or cogs 3610 and 3612 in FIG. 10T) of the treated gear (for example, treated gear 3500 of FIG. 10S or treated gear 3600 of FIG. 10T), causing the treated gear (for example, treated gear 3500 of FIG. 10S or treated gear 3600 of FIG. 10T) to also spin or rotate (for example, in direction 3506 in FIG. 10S or direction 3606 in FIG. 10T) around its central axis (for example, central axis 3504 in FIG. 10S or central axis 3604 in FIG. 10T).

The spin or rotation described herein may continue for a desired period of time or for a desired amount of rounds, essentially until the treated gear (for example, treated gear 3500 of FIG. 10S or treated gear 3600 of FIG. 10T) has reached a satisfactory condition.

Other treatments may include spinning or rotating the treated gear (for example, treated gear 3500 of FIG. 10S or treated gear 3600 of FIG. 10T) instead of the GEAT (for example, GEAT 3550 of FIG. 10S or GEAT 3650 of FIG. 10T), or spinning or rotating either one of them while applying breaking torque onto the other one, for the purpose of enlarging the engagement pressure applied from the spun or rotated gear onto the other gear.

Referring again to FIG. 10S, in addition to the treatment described above, other treatments may include reciprocating (moving interchangeably between two positions) the GEAT 3550 (or other GEATs, not shown, that may be suitable for reciprocation—for example bevel gears, helical gears, worm gears, sector gears, rack-and-pinion gears, epicyclic or planetary gears, derailleur or sprocket gears) up 3570 and down 3572 in an essentially straight pattern, for the purpose of essentially enhancing the functional contact between the cogs (for example, cogs 3560 and 3562) of GEAT 3550 and the cogs (for example, cogs 3510 and 3512) of treated gear 3500 caused by the engagement of these cogs together. Other treatments (not shown), may include reciprocating the treated gear instead of GEAT 3550, or may include essentially simultaneously reciprocating both the treated gear and GEAT 3550 in essentially opposite directions.

Referring now to FIG. 10T, straight-pattern reciprocating, as described in the previous paragraph, is usually not possible with hypoid gears (such as GEAT 3650 and treated gear 3600), essentially due to the concave shape of these gears' cogs (such as cogs 3610, 3612, 3660, 3662, 3666 and 3668). However, other methods for enhancement (in the meaning of "enhancement" described in the previous paragraph) may exist, for example, vibration of either GEAT 3650, treated gear 3600 or both. Nevertheless, other methods for enhancement may often not be necessary, since during regular operation of hypoid gears, cogs of the two engaging hypoid gears may essentially rub against each other in a sliding motion—a motion often absent from some other types of gears (for example, spur gears). The sliding motion itself may be considered as a relatively efficient catalyst of treatment.

Various abrasive working agents may be used as an intermediate between cogs of a GEAT, such as cogs 3560 and 3562, or cogs 3660 and 3662 of GEAT 3550 or 3650, respectively, and cogs of a treated gear, such as cogs 3510 and 3512, or cogs 3610 and 3612 of treated gear 3500 or 3600, respectively.

Optionally, such a GEAT may include one or more tubing systems adapted to deliver at least one working agent to a space delimited between a working area of the GEAT and cogs of a treated gear. An internal tubing system may include one or more tubes and/or bores that pass essentially through the GEAT and deliver the at least one working agent through one or more apertures in cogs of the GEAT. Alternatively, an external tubing system may include one or more tubes running essentially externally to the GEAT, and delivering the at least one working agent to a space delimited between a working area of the GEAT and cogs of a treated gear.

Optionally, a tubing system may include a combination of an internal tubing system and an external tubing system.

One or more working agents may be fed to a tubing system either continuously, at pre-determined intervals and/or otherwise when desired. Feeding may be conducted, for example, using a pump and/or other means.

With regard to the composition of the contact surface of the lapping tool, the inventors have found that a mixture of epoxy cement and polyurethane in a ratio of about 25:75 to 90:10, by weight, is suitable for forming the elastic, organic, polymeric contact surface of the lapping tool. In the epoxy cement/polyurethane mixture, the epoxy provides the hardness, whereas the polyurethane provides the requisite elasticity and wear-resistance. It is believed that the polyurethane also contributes more significantly to the deposition of an organic, possibly polymeric nanolayer on at least a portion of the working surface, as will be developed in further detail hereinbelow. It will be appreciated by one skilled in the art that the production of the epoxy cement/polyurethane mixture can be achieved using known synthesis and production techniques.

More preferably, the weight ratio of epoxy cement to polyurethane ranges from about 1:2 to about 2:1, and even more preferably, from about 3:5 to about 7:5.

In terms of absolute composition, by weight, the lapping tool surface typically contains at least 10% polyurethane, preferably, between 20% and 75% polyurethane, more preferably, between 40% and 75% polyurethane, and most preferably, between 40% (inclusive) and 65% (inclusive).

The inventive contact surface of the lapping tool should preferably contain, by weight, at least 10% epoxy, more preferably, at least 35% epoxy, yet more preferably, at least 40% epoxy, and most preferably, between 40% (inclusive) and 70% (inclusive). In some applications, however, the elastic layer should preferably contain, by weight, at least 60% epoxy, and in some cases, at least 80% epoxy.

Preferably, the contact surface (lapping surface) should have the following combination of physical and mechanical properties:

Shore D hardness within a range of 40-90, preferably 60-90, more preferably 65-82, and most preferably, 70-80;

impact resistance (with notch) within a range of 3-20 $kJ/m^2$, preferably 3-12 $kJ/m^2$, more preferably 4-9 $kJ/m^2$, and most preferably, 5-8 $kJ/m^2$, according to ASTM STANDARD D 256-97;

It should be appreciated that a variety of materials or combinations of materials could be developed, by one skilled in the art, that would satisfy these physical and mechanical property requirements.

An exemplary lapping tool surface for use in accordance with the present invention is synthesized as follows: an epoxy resin, a polyol and a di-isocyanate are reacted at a temperature exceeding room temperature and less than about 150° C. Subsequently, a hardener is mixed in. As will be evident to one skilled in the art, the requisite curing conditions depend largely upon the particular qualities and ratios of the above-mentioned ingredients. It will be further evident to one skilled in the art that the polymer can be produced as a bulk polymer or as a molded polymer.

While advantageous ratios of the epoxy and polyurethane materials have provided hereinabove and in the claims section hereinbelow, it should be appreciated that other polymers or combinations of polymers having the requisite mechanical and physical properties for use in conjunction with the inventive device and method could be developed by one skilled in the art.

Figure 11A:
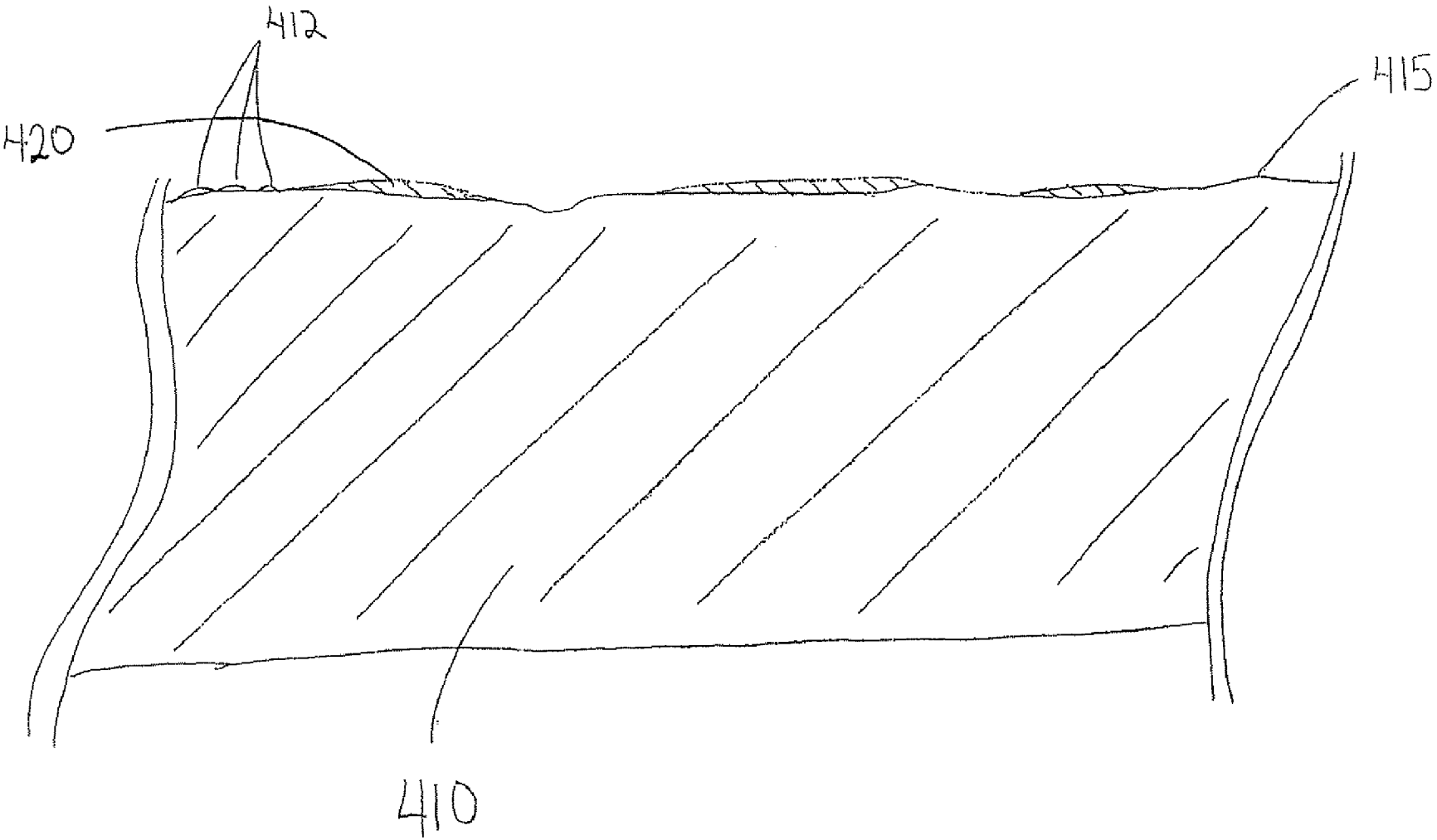
FIG. 11A is a schematic, cross-sectional diagram showing nanometric, organic particles and layers, deposited on, and intimately bonded to, the working surface, according to the present invention.

FIG. 11A is a schematic cross-section of a working surface according to one embodiment of the present invention. Using the inventive lapping technology, it has surprisingly been discovered that a nanometric organic layer 420 is disposed on a working surface 415 of workpiece 410. Typically, a substantial (though not necessarily exclusive) source of the organic material is the organic, polymeric surface of the inventive lapping tool.

Alternatively or additionally, the source of the organic material can be organic particles and materials (e.g., oligomeric or polymeric materials) added to the abrasive paste used in the lapping process.

Generally, nanometric organic layer 420 does not cover the entire area of working surface 415. There exist bare areas devoid of organic layer 420. Also, a large plurality of nanometric organic particles 412 is distributed on, and eventually become incorporated into, working surface 415. As used herein, organic particles 412 can be considered to be small patches of nanometric organic layer 420.

Without wishing to be bound by theory, the inventors believe that as the rounded abrasive particles produced by the inventive lapping process and system (see FIG. 8B and 8C(iii) and the associated description) rotate along the working surface, a large plurality of nanometric organic particles disposed on working surface 415 are flattened against the contour of surface 415 by this rotating action under the load of the lapping system.

In areas of working surface 415 in which the population density of the nanometric organic particles is high, the lapping process forms a relatively large nanometric organic layer, such as nanometric organic layer 420. In areas of working surface 415 in which the population density of the nanometric organic particles is lower, the lapping process flattens the particles against the contour of surface 415 to form flattened nanometric particles such as organic particles 412.

The intimate bonding of the solid nanometric organic layer 420 (including nanometric organic particles 412) to working surface 415 is greatly enhanced by aging of workpiece 410, as will be described in further detail hereinbelow.

After the aging of workpiece 410, organic layer 420 is more strongly bonded to working surface 415. Organic layer 420 is nanometric, typically having an average thickness of up to 30 nm, and more typically, 1-20 nm. Excellent experimental results have been obtained for working surfaces having nanometric layers within this range of thickness.

It must be emphasized that the inventive working surface of FIG. 11A, and the inventive method for producing the surface, differ from known coated working surfaces and methods in various fundamental ways. These include:

a the inventive layer has a thickness of up to 30 nm. By sharp contrast, known coatings have a thickness exceeding several microns.

the deposition of the nanometric layer is advantageously performed by the inventive lapping method itself;

the material source of the organic material in the nanometric layer is the inventive contact surface of the lapping tool, or materials disposed in the paste;

a the material source of the inorganic material in the nanometric inorganic layer (or disposed in the organic nanometric layer) is materials disposed in the paste;

the nanometric organic and inorganic layers are intimately bonded to the working surface and follow the nanometric contours of the working surface;

the nanometric organic and inorganic layers strongly adhere to the working surface. Consequently, these layers are not subject to the phenomena of peeling, flaking, crumbling, etc., characteristic of various coatings of the prior art;

the microstructuring is performed prior to deposition of the organic layer.

Figure 11B:
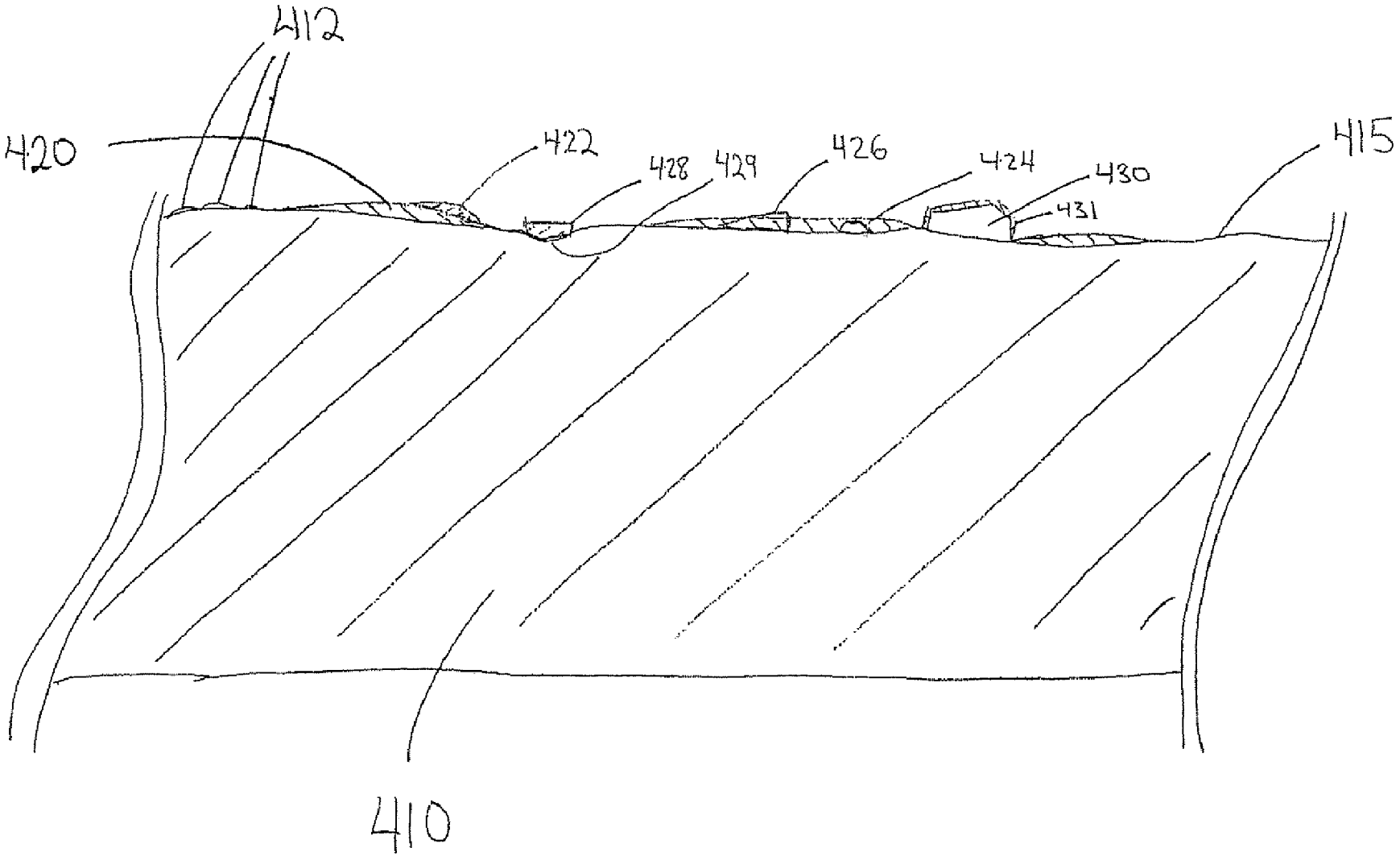
FIG. 11B is the schematic, cross-sectional diagram of FIG. 11A, in which are shown inorganic nanoparticles incorporated in the working surface, according to another aspect of the present invention.

FIG. 11B is the schematic, cross-sectional diagram of FIG. 11A, in which are shown inorganic abrasive particles 422, 424, 426, 428, 430 incorporated in working surface 415 of workpiece 410, according to another aspect of the present invention. Particle 422 is disposed on, and attached to, organic nanolayer 420. Particle 424 is disposed completely within organic nanolayer 420. Particle 426 is disposed within organic nanolayer 420, but has an exposed face protruding out of organic layer 420. Particle 428 is disposed on, and attached directly to, working surface 415. In this particular example, particle 428 is mechanically wedged in to a recess 429 of working surface 415. Without wishing to be limited by theory, it is believed that as the rounded abrasive particles produced by the inventive lapping process and system (see FIG. 8B and 8C(iii) and the associated description) roll along the working surface under the load of the lapping system, solid particles such as solid particle 428 are embedded and subsequently packed into the working surface. Similarly, it appears that particles 422 and 426 are similarly embedded in organic nanolayer 420, where the softness relative to the rest of working surface 415, along with the adhesive properties of nanolayer 420, result in the particles being firmly attached to nanolayer 420, and consequently, become an integral part of working surface 415.

Although not drawn to scale, abrasive particle 430 schematically represents a large particle (e.g., having a diameter of several microns) covered by a thin organic nanolayer 431.

The inventors have further discovered that the properties of the working surface are modified by the inventive incorporation of hard solid particles therein.

Figure 11C:
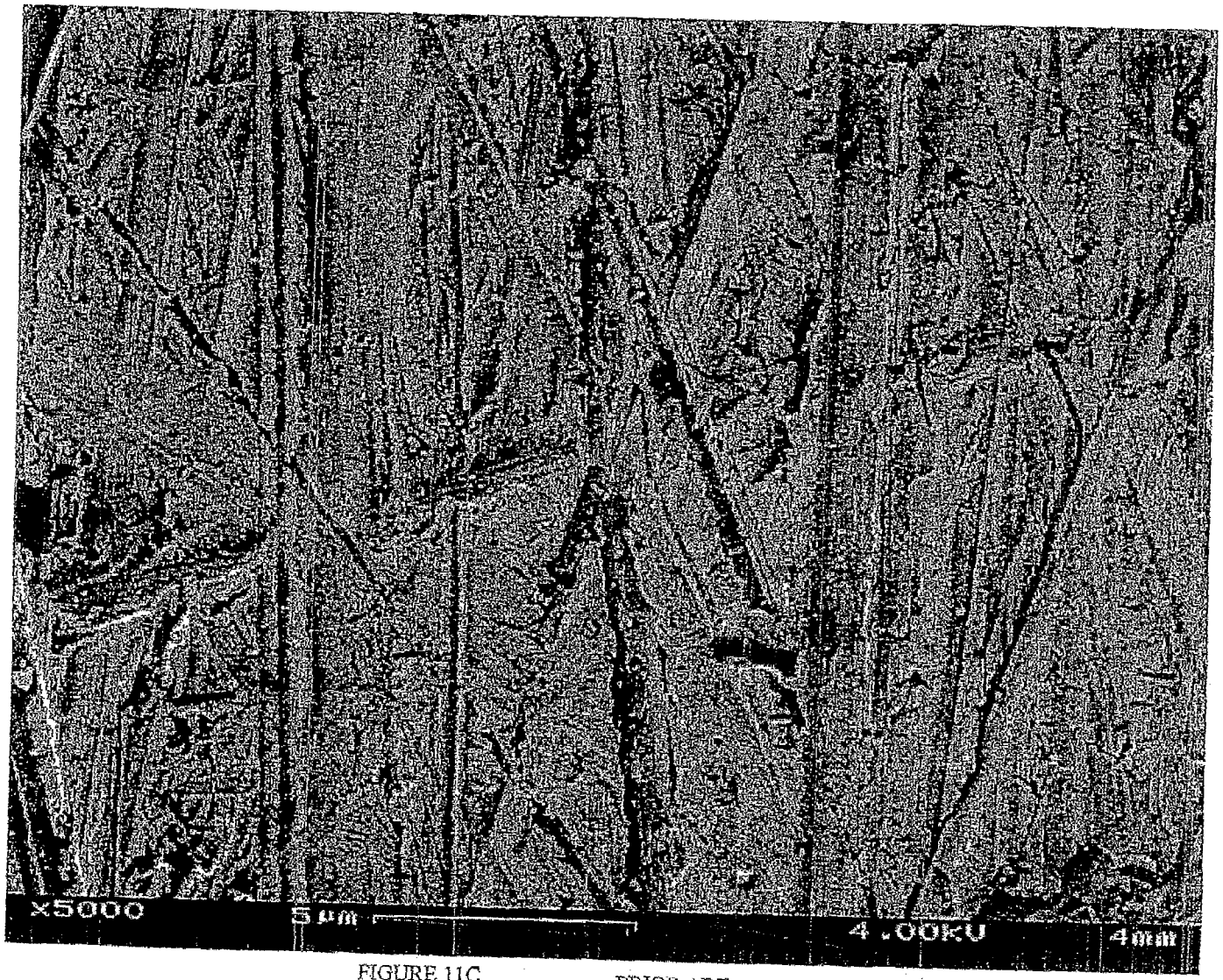
FIGURE 11C PRIOR ART
FIGS. 11C and 11D are scanning electron microscope (SEM) images of cleaned working surfaces produced using conventional (cast iron and aluminum, respectively) lapping tool surfaces.
Figure 11D:
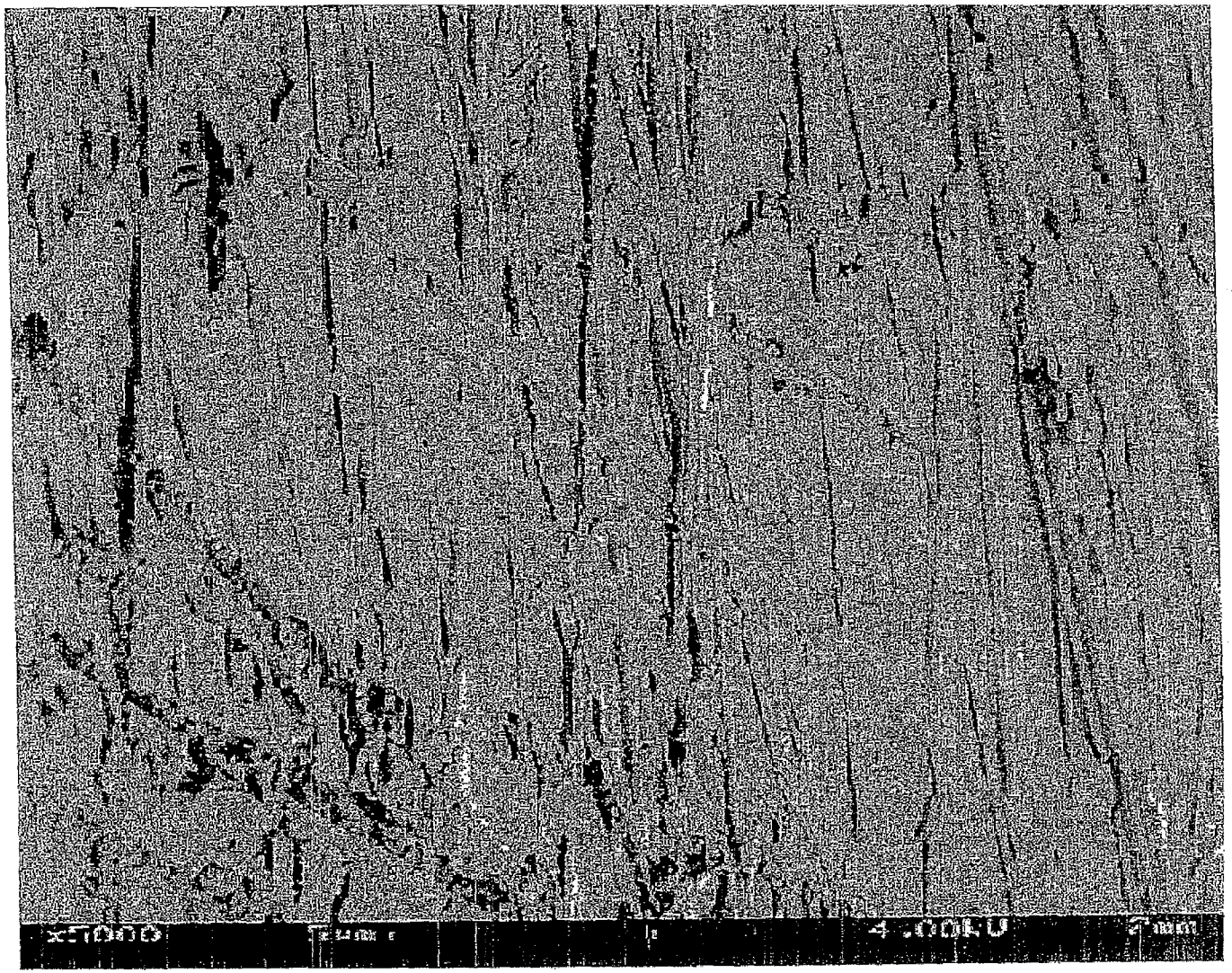
FIGURE 11D PRIOR ART

FIGS. 11C and 11D are scanning electron microscope (SEM) images of cleaned working surfaces produced using conventional lapping tool surfaces. FIG. 11C is a SEM image of a steel working surface lapped with a cast iron lapping tool surface; FIG. 11D is a SEM image of a substantially identical steel surface lapped with an aluminum lapping tool surface. Each image represents, approximately, a 22 micron by 17 micron portion of the respective steel working surface.

Figure 12A:
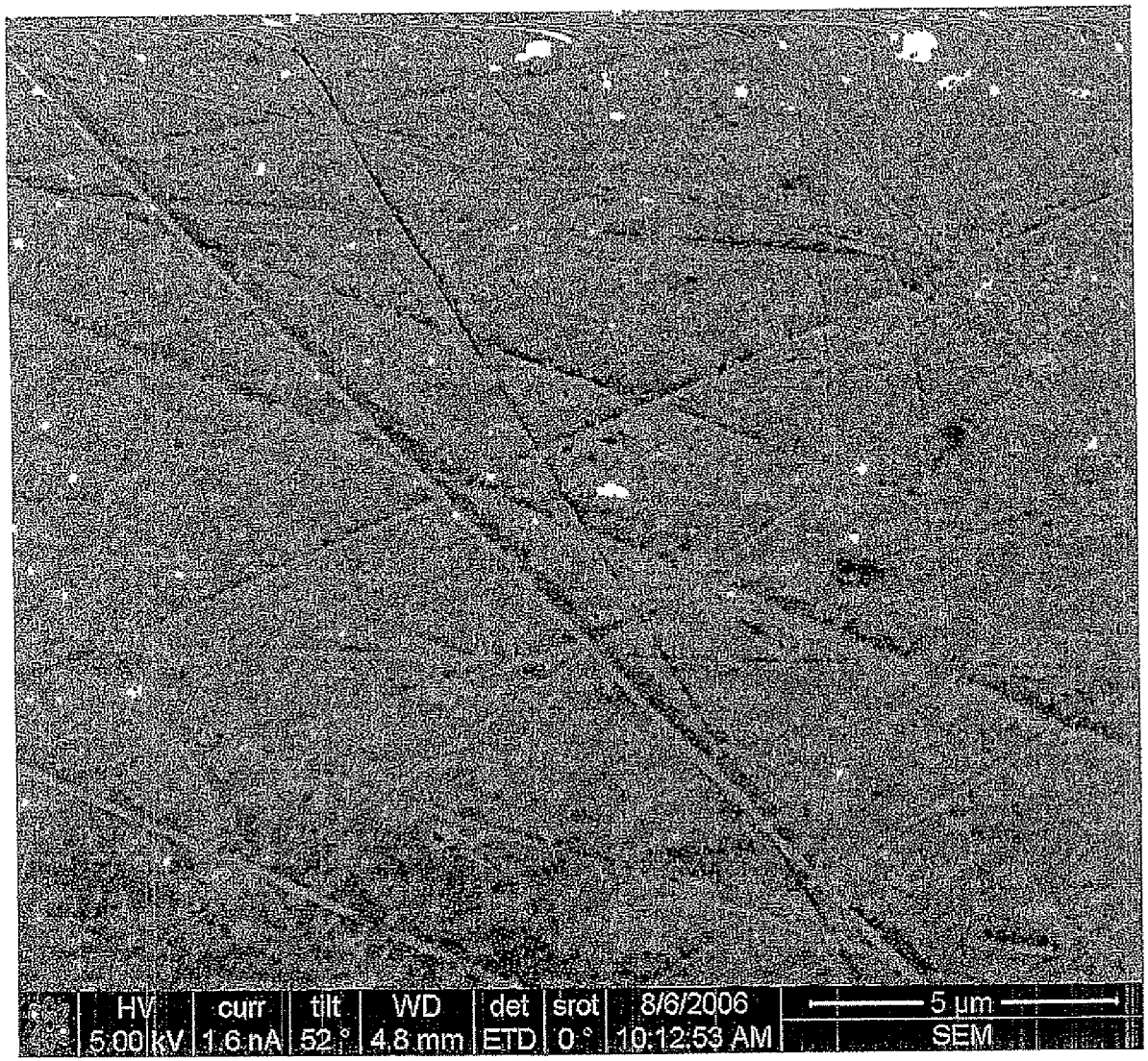
FIG. 12A is a SEM image of a cleaned steel working surface lapped with a polymeric lapping tool surface and subjected to an aging process in an ambient environment, according to the present invention.

FIG. 12A is a SEM image of a cleaned steel working surface lapped with a polymeric lapping tool surface of the present invention, and aged in an ambient environment for over 1 week. The steel sample used is substantially identical to the steel samples used with the conventional lapping tool surfaces described above. The magnification is also substantially identical to the magnification of FIGS. 11C and 11D.

It is manifestly evident that the steel working surface lapped with the inventive polymeric lapping tool surface is characterized by a much lower average surface roughness. In addition, the characteristic amplitude of the surface topography ($R_Z$) is much lower, and the characteristic slope ($R_{\Delta Q}$) is much more gradual.

Figure 12B:
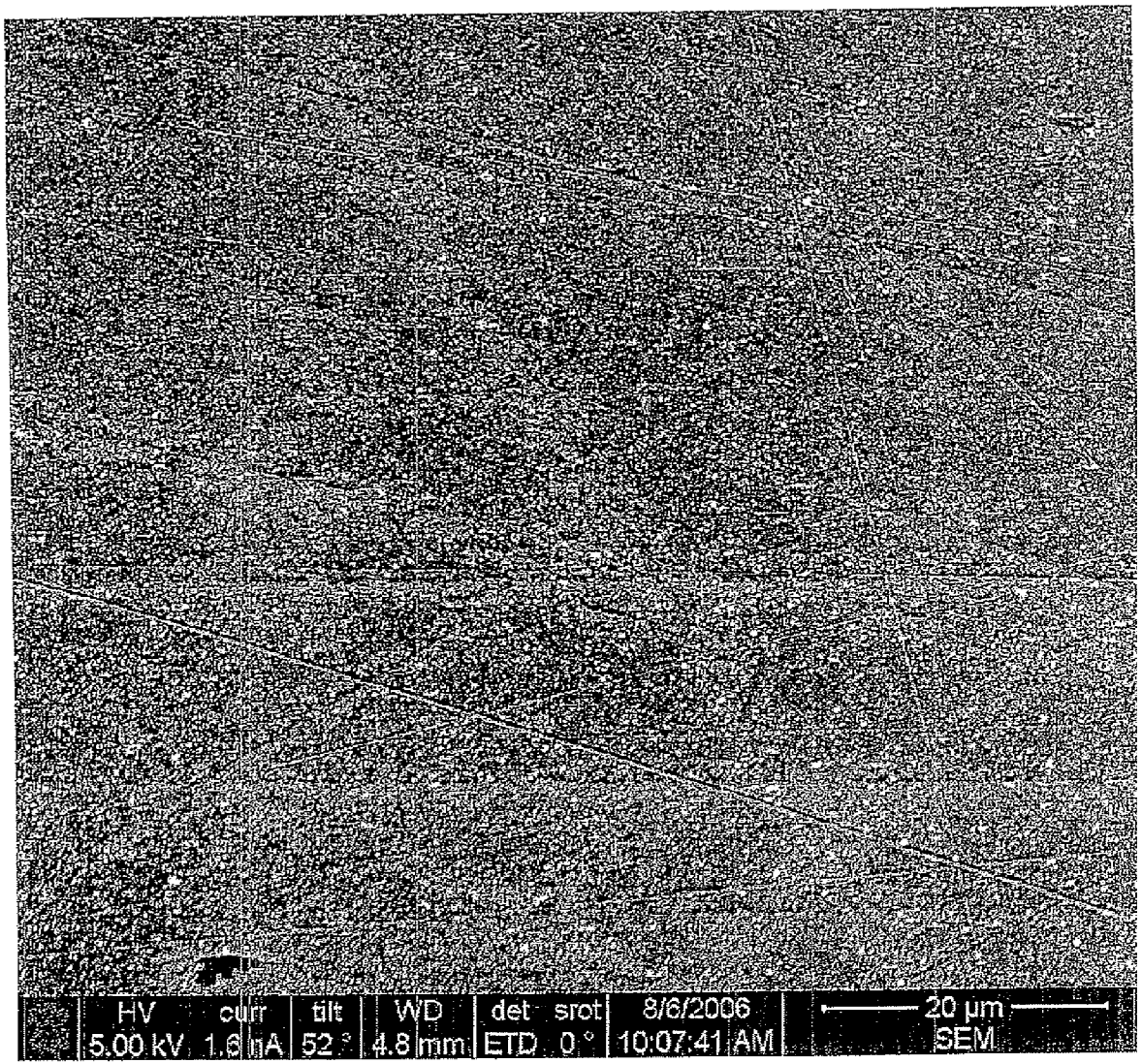
FIG. 12B is the SEM image of FIG. 12A, shown at a lower magnification.

More surprisingly, a large plurality of light-colored spots is disposed on the inventive working surface shown in FIG. 12A. This large plurality of spots is even more pronounced in the same inventive working surface, shown at lower magnification in FIG. 12B. No such spots are observed on the working surfaces of the prior art (FIGS. 11C and 11D).

Figure 11E:
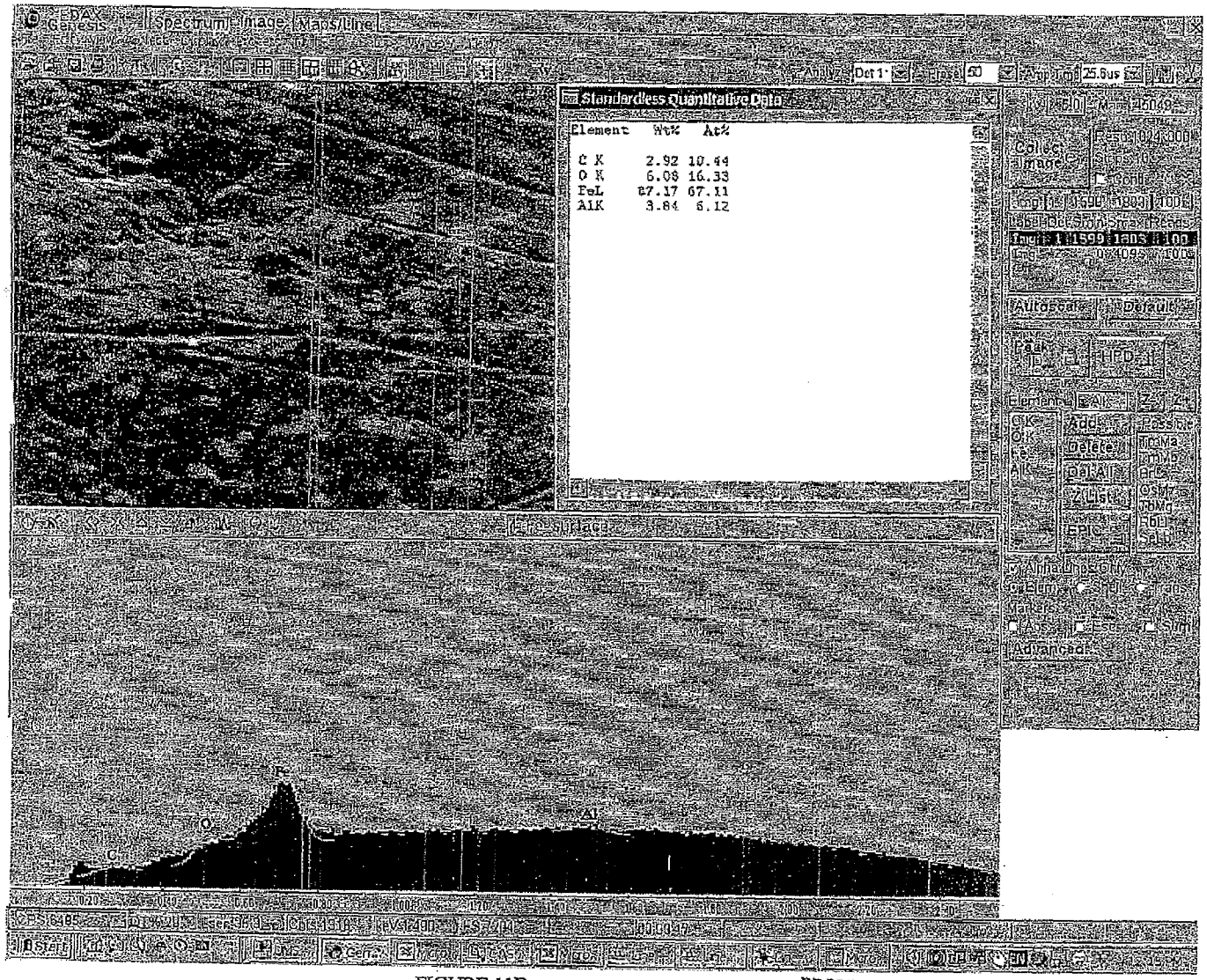
FIGURE 11E PRIOR ART
FIG. 11E is a SEM image and an energy dispersion spectrography (EDS) spectrograph of the a cleaned working surface produced using a conventional aluminum lapping tool surface.
Figure 12C:
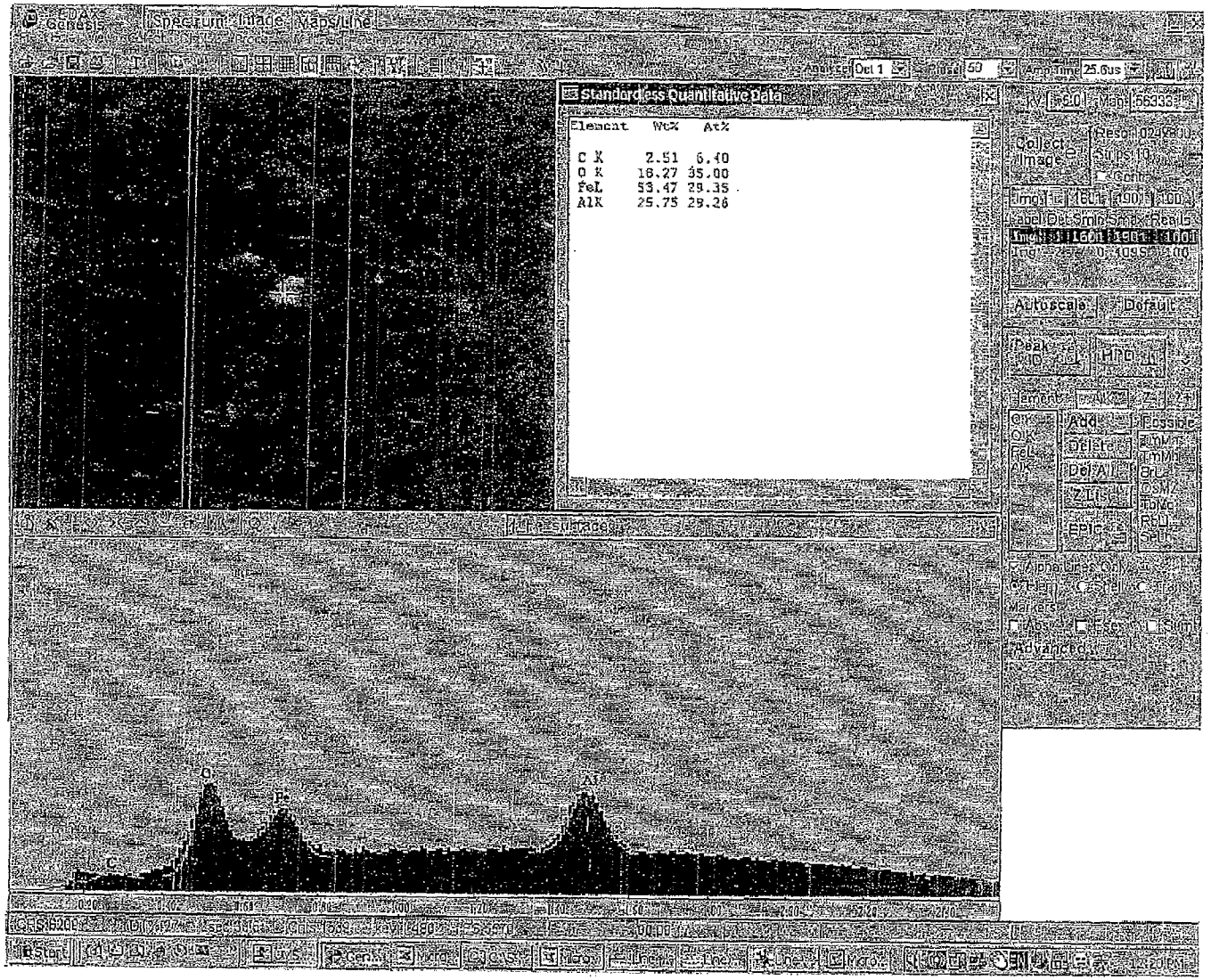
FIG. 12C is a SEM image and an energy dispersion spectrography (EDS) spectrograph of the inventive working surface.

The light-colored spots on the working surface contain a high concentration of alumina, as is evident from the energy dispersion spectrography (EDS) spectrograph provided in FIG. 12C. Upon focusing on such a light-colored spot, the EDS spectrograph shows both a distinct aluminum peak and a distinct oxygen peak. By sharp contrast, no such peaks were observed anywhere on the working surfaces produced using conventional lapping tool surfaces and a conventional abrasive paste containing alumina particles. An exemplary EDS spectrograph of such a conventional working surface (produced using an aluminum lapping tool surface) is provided in FIG. 11E. No aluminum peak was detected.

It must be emphasized that the alumina particles of the inventive working surface are incorporated and firmly embedded in the surface. After lapping, the working surfaces are subjected to a rigorous cleaning process to remove loose particulate matter and organic debris.

As used herein in the specification and in the claims section that follows, the term "cleaning", "cleaned", or "cleaning process", with respect to a working surface, refers to the following procedure:

(step 1) immersion of the working surface in a bath filled with isopropanol or ethanol, and subjecting the immersed working surface to ultrasonic treatment for at least one minute;

(step 2) washing in ethanol followed by wiping the surface with a cloth soaked in ethanol, and (step 3) subjection to a vacuum of $10^{-7}$ torr (preferably up to $10^{-10}$ torr) for at least 5 minutes, wherein the specific parameters of the ultrasonic treatment, the washing in ethanol, and the wiping are performed so as to remove loose particulate matter and organic debris, according to techniques that are known to one skilled in the art.

It must be emphasized that over the course of extensive testing of lapped and cleaned working surfaces using conventional lapping tool surfaces (cast iron, aluminum, etc.), no alumina particles were detected in any of the working surfaces.

By sharp contrast, lapped and cleaned working surfaces produced using the inventive polymeric lapping tool surface and a conventional abrasive paste containing alumina particles were surprisingly discovered to have a population density of at least 2,000 alumina particles per square millimeter, typically, at least 10,000 alumina particles per square millimeter, more typically, at least 50,000 alumina particles per square millimeter, yet more typically, at least 100,000 alumina particles per square millimeter, and most typically, 300,000-600,000 particles per square millimeter.

In terms of coverage area, the coverage area of the incorporated alumina particles is at least 0.1% of the nominal surface area of the working surface, typically, at least 0.5%, and more typically, at least 2%. Various working surfaces of the present invention were found to have coverage areas in the range of 3% to 6%.

As is evident from the SEM image provided in FIG. 12A, the alumina particles (i.e., the spots identified as alumina by EDS) are extremely small. In SEM images of higher magnification, the size of each alumina particle is more easily quantifiable. In any event, extensive testing shows that at least 90% of the particles have a diameter of less than 1 micron (1000 nanometers). In many cases, at least 90% of the abrasive particles have a diameter of less than 300 nanometers. In some cases, at least 50% of the abrasive particles have a diameter of less than 100 nanometers. The smallest particles measured to date have a diameter of no more than 10 nanometers.

Perhaps most surprisingly, working surfaces having alumina particles incorporated therein have consistently demonstrated superior tribological performance relative to working surfaces of the same composition and having similar, or better, average roughness. The presence of abrasive particles in a tribological system such as a bearing or seal is known to seriously compromise the tribological performance. Thus, the discovery of the inventors that the incorporation of abrasive particles into a working surface can actually enhance the tribological performance of the surface is indeed surprising.

Without wishing to be bound by theory, there may be some increased hardness associated with the incorporation of hard inorganic particles in the surface layer of the working surface. However, the minute size of the incorporated abrasive particles, possibly coupled with the rounded nature of these tiny particles, appears to be an appreciably contributing factor. In the polymer lapping methods of the present invention there are reduced internal stresses within the relatively large (e.g., 3-20 micron) abrasive particles, with respect to various conventional lapping technologies, there is considerably less shattering of those particles, yielding extremely fine particles having somewhat rounded edges. Moreover, these particles are too small to cause appreciable damage to the countersurface.

Typically, the alumina used in the abrasive pastes used in the inventive lapping process is fused alumina. However, as used herein in the specification and in the claims section that follows, the term "alumina" refers to all forms of alumina, including fused alumina, unfused alumina, alpha alumina, gamma alumina, and natural alumina or alumina-containing materials such as corundum and emery.

More generally, other pastes containing inorganic abrasives can be used in conjunction with the inventive lapping process and inventive contact surface to produce the inventive working surface. Although experimentation is ongoing, one common denominator of the incorporated inorganic abrasive particles is hardness: the hardness should be at least 8 on the Mohs scale. The presently preferred hardness is 8 to 9.5, inclusive. Thus, in addition to different forms of alumina, garnet, corundum, silicon carbide, and boron carbide are suitable, or appear to be suitable for incorporation into working surfaces, to produce the working surface of the present invention. Also, the above-delineated characterizations of population density, coverage area, and particle size with respect to alumina incorporated on the working surface, may be broadly applicable to other such inorganic abrasives.

The inorganic abrasive particles disposed in the working agents such as the (unspent) abrasive pastes used in conjunction with the present invention typically have a well-defined particle size distribution (PSD). The average particle size (APS) of the inorganic abrasive particles, and more particularly, alumina, is typically 4-15 microns, and more typically, 4-11 microns. Abrasive pastes having an APS of as little as 3 microns and up to 20 microns have been used successfully in some applications. Below an APS of 2 microns, the abrasive particles tend to be small with respect to the peaks of the working piece surface, such that the lapping process is greatly compromised, and is impractical. Below an APS of 1-2 microns for the abrasive particles, the lapping is substantially ineffectual.

Moreover, the incorporation of the free, hard abrasive particles is particularly enhanced when the inorganic abrasive particles in the abrasive paste, and more particularly, alumina particles in the abrasive paste, have an APS of at least 3 microns, typically 4-15 microns, and often, 4-11 microns.

The abrasive pastes used in conjunction with the present invention are typically oil-based pastes, and are generally commercially available. Typical suppliers and products are provided below:

1. Kemet (UK): green silicon carbide paste, black silicon carbide paste, white aluminum oxide paste. (http://www-.flatlap.co.uk/consumables.asp)
2. US Products (USA): white aluminum oxide, Borazon CBN lapping compound, diamond lapping compound. (http://www.us-products.com/sitehtml/products/compslur.php)
3. St. Gobain (USA): diamond abrasive compounds. (http://www.amplexabrasives.com/Data/Element/Node/Category/category_edit.asp?ele_ch_id=C0000000000000002217)

Referring back to FIG. 11A, and without wishing to be limited by theory, some of the characteristics of the inventive tribological surface can be understood in relation to conventional metal surface structures. A typical metal surface is a multi-layer "sandwich" composed of 4 basic layers, as illustrated in FIG. 13. An oxide layer II, which covers the bulk metal I, is about 2-5 nm deep. An oxide layer formed within seconds after exposure of the metal to air, as well as during machining operations such as grinding or lapping. The oxide layer is tightly bonded to the base metal by strong ionic forces, as explained in Table 3 below, and in fact becomes an integral part of the metal surface.

The surface of the oxide layer is covered by polar hydroxyl OH groups that are responsible for the adsorption of organic compounds, polar and non-polar, on the metal surfaces. In the case of polar organic molecules with carbon-oxygen polar groups such as COOH, strong polar-covalent bonds (see Table 3 below) are formed between the polar groups in the organic molecules and the surface of the oxide. This strong chemical bond forms an organic monolayer (designated III in FIG. 13) approximately 2-3 nm deep, with its polar groups facing towards the metal surface ("chemical adsorption").

The oriented organic monolayer (III) can, in turn, assemble several loosely formed layers of non-polar organic compounds such as fingerprint oil and dust, as well as other carbon-based debris. This organic, non-oriented overlayer (IV) is bonded to the surface by weak dispersive electrostatic forces (Van der Waals forces) that are easily cleansed by solvents and/or are readily removed in vacuum ("physical adsorption").

TABLE 3

Bonding Strength Between Layers on the Working Surface

Figure 1B:
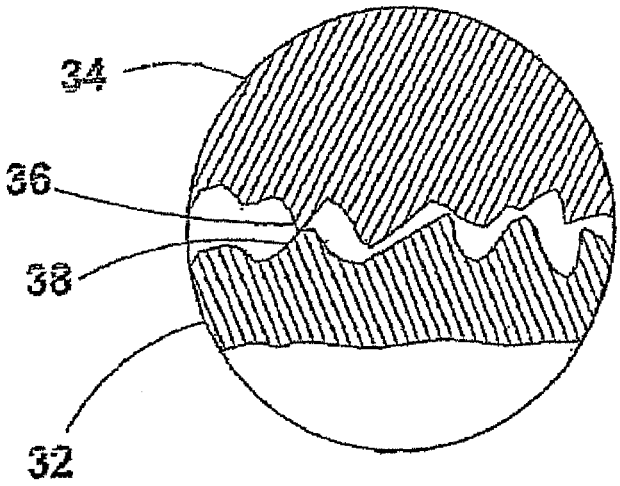
Fig. 1B PRIOR ART
FIG. 1B is a schematic description of mechanically interacting surfaces having interacting asperities.

| Interface between layers | FIG. 1 designation | Type of bond | Bonding strength (KJ/mol) | Comments |
|---|---|---|---|---|
| Metal - oxide | I-II | Ionic bonds | ~1,000 - Very strong | |
| Oxide - oriented organic layer | II-III | (Polar) Covalent bonds | ~700 - Strong | Polar - in the case of polar organic groups |
| oriented organic layer - non-oriented organic layer | III-IV | Van der Waals | ~10 - Weak | |

Several steel samples were lapped either by using standard a lapping method with a cast iron lapping tool, or by using the polymer-surfaced lapping tool of the present invention. All samples were machined with the same, commercially-available aluminum oxide abrasive paste. After lapping, the samples were carefully cleaned (to remove overlayer IV) and were analyzed by X-ray Photoelectron Spectroscopy (XPS), which is used to evaluate atomic and chemical composition of the near-surface layers.

Figure 14A:
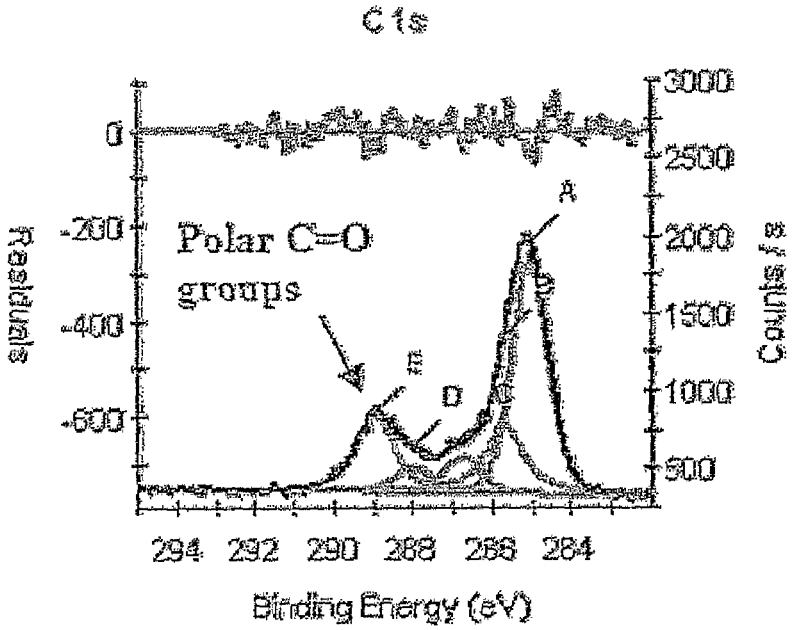
FIGS. 14A and 14B are X-ray Photoelectron Spectroscopy (XPS) spectra (carbon C1s) of the inventive polymer-lapped surface and of the conventionally lapped steel surface, respectfully.
Figure 14B:
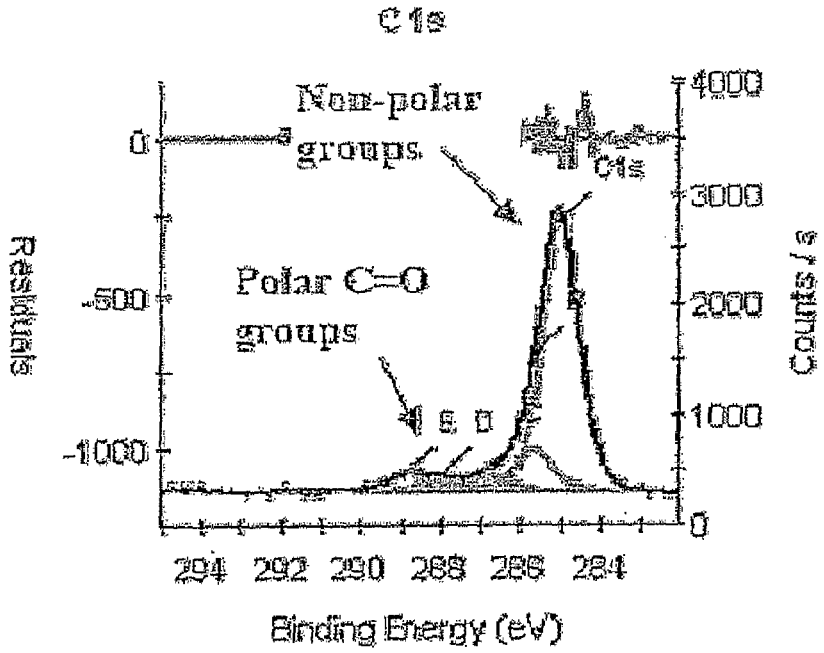
PRIOR ART FIGURE 14B

One goal of the XPS study was to analyze the organic-metal interface, i.e., layers II and III. The main information about the organic monolayer (III) was obtained from carbon C1s spectra as shown in FIGS. 14A and 14B. The C1s signal of the polymer-lapped sample (FIG. 14A) reveals a significant increase of polar C=O/COOH groups content in the near-surface layers when compared with C1s signal of the conventionally lapped steel sample (FIG. 14B). It is well known that such C═O or COO—/COOH polar groups in organic molecules interact with Fe/FeO/FeOH reactive sites in the metal surface by forming strong polar-covalent or even ionic chemical bonds (like in metal salts RCOOFe); thus leading to the strong interaction between the organic monolayer and the oxide surface.

The inventive polymer lapping surface is, by its chemical nature, very rich in various polar organic groups. During the lapping process, the abrasive particles scratch/tear out small fragments from the polymeric lapping tool. These organic or polymeric fragments, which appear to have substantially the same composition as the polymer-surfaced lapping tool, contain reactive polar groups. As a result of the lapping process, these reactive fragments reach the metal surface. Simultaneously, the abrasive particles (e.g., alumina) also abrade the oxide layer and the base metal, thus activating the metal surface and stimulating the chemical interaction with the reactive fragments.

As a result of this mechano-chemical process, strongly bonded organic fragments cover at least a portion of the metal surface and form a unique organic/metal interface.

Commercial engine oils contain organic acid additives, which are surface-active compounds having polar groups that improve the oil adhesion to the metal surface. These organic acid additives are bonded to the polar metal surface by covalent bonds, which form a boundary monolayer (similar to layer III) with polar groups oriented towards the metal surface and the non-polar groups oriented away from the surface.

The non-polar "upper" side of the monolayer orients non-polar oil molecules thereby forming a structured multi-layered lubricating film that is required for good lubrication (similar to layer IV).

During lapping using the inventive lapping tool, the organic monolayer (III) is bonded much more strongly to the metal surface than any boundary layer created with organic acid additives in oil because, inter alia, a much larger concentration of active polar groups becomes bonded to the surface. XPS spectral data (C1s) of such organic acid additives are provided in FIG. 15. It can be observed that the surface, following treatment using the inventive polymer-surfaced lapping tool, contains a much higher ratio of polar to non-polar groups (FIG. 14A) than those found with acid additives (FIG. 15).

Figure 16:
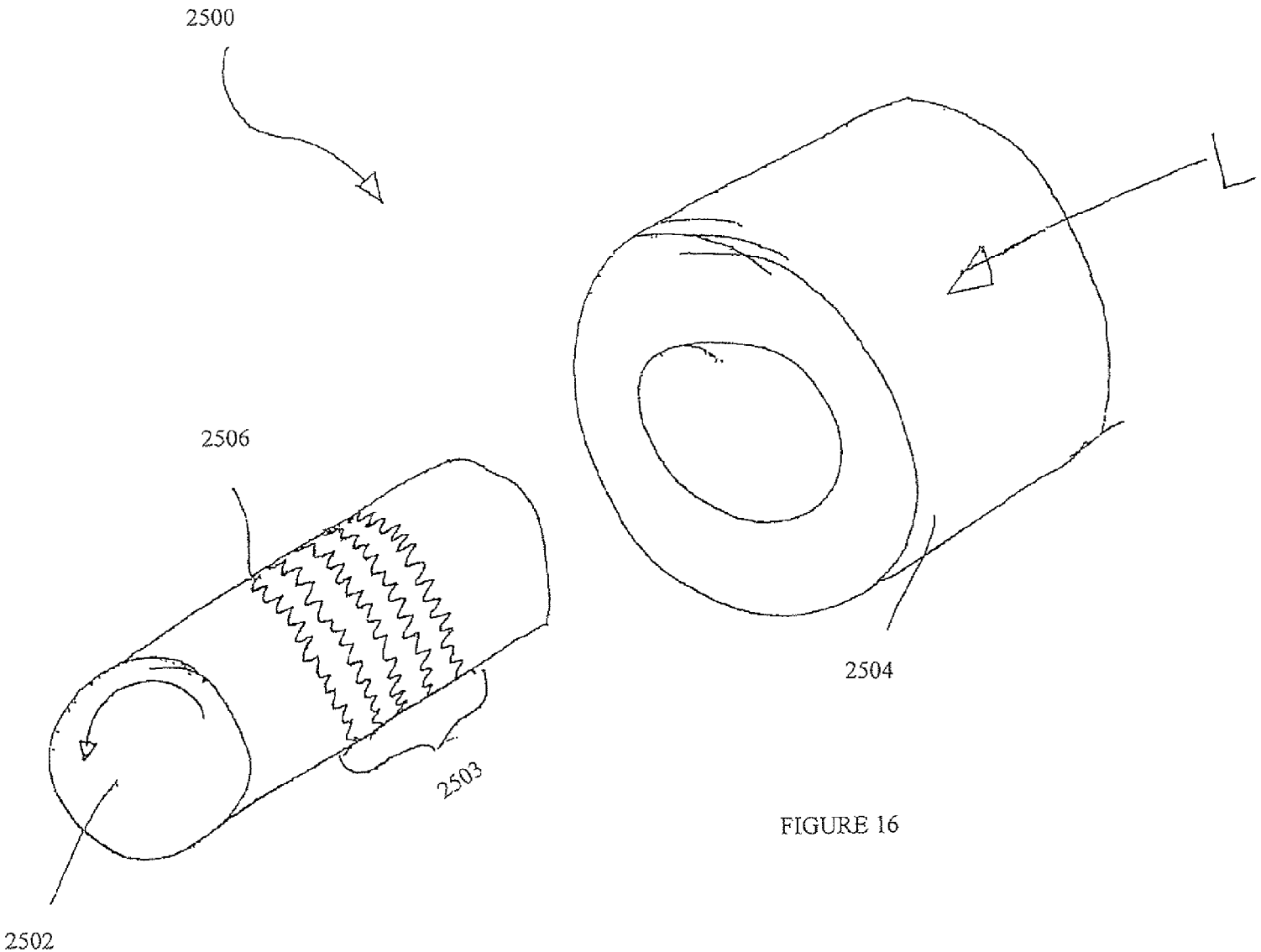
FIG. 16 is a schematic drawing of an exemplary tribological system according to one aspect of the present invention.

FIG. 16 is a schematic drawing of an exemplary tribological system 2500 according to one aspect of the present invention. Tribological system 2500 includes a rotating working piece 2502 (mechanism of rotation, not shown, is standard), having a working surface (contact area) 2503 bearing a load L, a counter surface disposed within stationary element (bushing) 2504, and a lubricant (not shown) disposed between working surface 2502 and counter surface 2504. Working surface 2503 is an inventive working surface of the present invention, as described hereinabove. Optional recessed zones (grooves 2506) serve, inter alia, as a reservoir for the lubricant and as a trap for debris.

In most tribological applications, the magnitude of load L on the working surface such as working surface 2503 of a workpiece such as workpiece 2502, is at least 0.01 mega Pascal (MPa), more typically, at least 0.03 MPa, and yet more typically, at least 0.08 MPa. In various sliding surface applications, the magnitude of the load is typically 0.03 to 2 MPa, and more typically, 0.05 to 1 MPa.

Most structurally important metals have allowable stresses that are orders of magnitude larger than these typical loads of sliding friction applications, allowing such metals to easily withstand these externals loads solely by means of their internal resilience (strength).

It must be emphasized that, as demonstrated experimentally, the inventive working surface achieves a surprisingly-high performance with respect to working surfaces produced by various conventional lapping technologies.

In another embodiment of the present invention, the inventive work surface and inventive lapping method and device are utilized in the production of artificial joints, e.g., hip joints. Conventional hip joints suffer from a number of disadvantages, which tend to reduce their effectiveness during use, and also shorten their life span. First, since the synovial fluid produced by the body after a joint replacement operation is considerably more diluted and thus 80% less viscous than the synovial fluid originally present, the artificial joint components are never completely separated from each other by a fluid film. The materials used for artificial joints, as well as the sliding-regime parameters, allow only two types of lubrication: (i) mixed lubrication, and (ii) boundary lubrication, such that the load is carried by the metal femoral head surface sliding on the plastic or metal acetabular socket surface. This results in accelerated wear of the components, increasing the frictional forces, and contributes to the loosening of the joint components and, ultimately, to the malfunction of the joint.

The high wear rate of the ultra-high-weight polyethylene (UHWPE) cup results in increased penetration of the metal head into the cup, leading to abnormal biomechanics, which can cause loosening of the cup. Furthermore, polyethylene debris, which is generated during the wearing of the cup, produces adverse tissue reaction, which can induce the loosening of both prosthetic components, as well as cause other complications. Increased wear also produces metal wear particles, which penetrate tissues in the vicinity of the prosthesis. In addition, fibrous capsules, formed mainly of collagen, frequently surround the metallic and plastic wear particles. Wear of the metal components also produces metal ions, which are transported, with other particles, from the implanted prosthesis to various internal organs of the patient. These phenomena adversely affect the use of the prosthesis.

In addition, bone and bone cement particles, which remain in the cup during surgery, or which enter the contact zone between the hip and the cup during articulation, tend to become embedded in the cup surface. These embedded bone particles can cause damage to the head, which can, in turn, bring about greatly increased wear of the cup.

The treatment of the head friction surface using microstructuring technology, so as to reduce the wear of the friction surfaces, has been suggested in the literature (see Levitin, M., and Shamshidov, B., "A Laboratory Study of Friction in Hip Implants", Tribotest Journal 5-4, June 1999, the contents of which are incorporated by reference for all purposes as if fully set forth herein). The microstructuring technology improves lubrication and friction characteristics, and facilitates the removal of wear debris, bone fractions, and bone cement particles from the friction zone between the male and female components of the joint.

Figure 17:
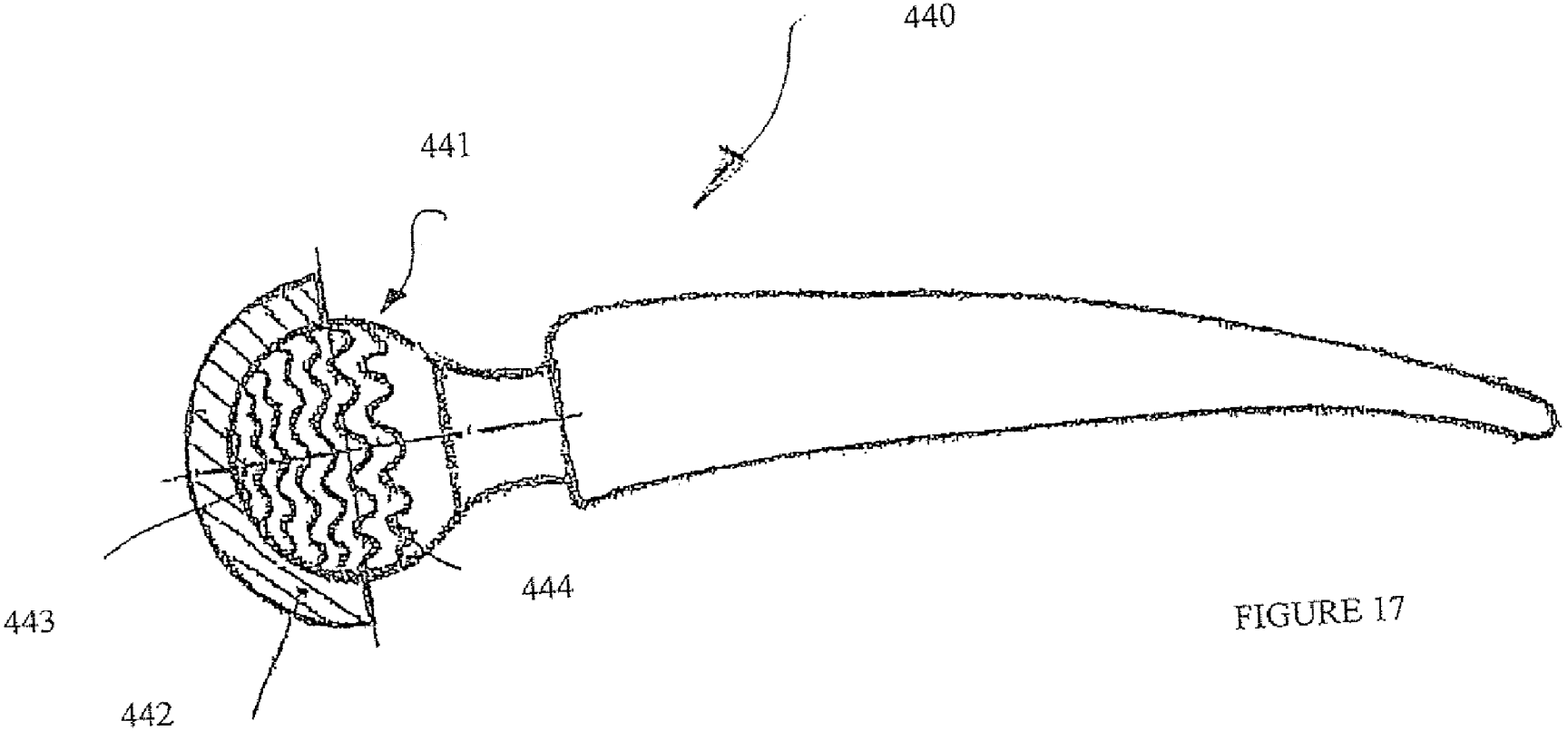
FIG. 17 is a cross-sectional schematic illustration of an artificial joint for implanting in a living body.

There is, however, a well recognized need for further improvement in reducing friction and wear in artificial joints. In another embodiment of the present invention, shown in FIG. 17, a tribological system 440 has a metal joint head 441 is engaged within a metal cup 442. Optionally, metal joint head 441 has grooves 444 (recesses, pores, etc.) according to microstructuring technologies known in the art. Metal joint head 441 has been subjected to the lapping methods of the present invention, so as to produce the inventive working surface. Preferably, a working surface 443 of metal joint head 441 is at least partially covered with a nanometric organic layer, as described hereinabove with reference to FIG. 11A. It is also preferable to have hard, inorganic nanometric particles incorporated into working surface 443, as described hereinabove with reference to FIG. 11B.

As used herein in the specification and in the claims section that follows, the term "impact resistance" refers to the impact resistance, with notch, in units of $kJ/m^2$, as determined by ASTM STANDARD D 256-97.

As used herein in the specification and in the claims section that follows, the term "Shore D hardness", and the like, refers to a measure of the resistance of material to indentation, according to the standard ASTM test (D 2240-97).

The hardness testing of plastics and hard rubbers is most commonly measured by the Shore D test, with higher numbers signifying greater hardness.

As used herein in the specification and in the claims section that follows, the term "freely disposed", regarding abrasive particles, relates to the free-flowing state of abrasive particles as in typical lapping methods of the prior art.

As used herein in the specification and in the claims section that follows, the term "intimately bonded", with respect to a layer and a working surface, refers to a nanometric layer having a contour that substantially complements the micro-contour of the working surface, such that the layer is firmly attached to the working surface along the entire contour thereof.

As used herein in the specification and in the claims section that follows, the term "metal surface layer" is meant to include a metal oxide layer bonded to the base metal layer, as described with respect to FIG. 13.

As used herein in the specification and in the claims section that follows, the term "aging" and the like refers to a process of at least 24 hours in which the working surface is allowed to mature, and in which various chemical interactions transpire.

As used herein in the specification and in the claims section that follows, the term "oxygen-rich environment" and the like refers to an environment containing at least 2% oxygen gas, by volume.

As used herein in the specification and in the claims section that follows, the term "incorporated", "incorporation", and the like, with respect to a particle or nanolayer and with respect to a single-phase working surface, refers to a particle or nanolayer that is so strongly attached to the working surface, that the particle or nanolayer remain attached thereto even after the working surface has been subjected to a cleaning process, as defined hereinabove.

As used herein in the specification and in the claims section that follows, the term "incorporated", "incorporation", and the like, with respect to a particle or nanolayer and with respect to a multiple-phase working surface, refers to a particle or nanolayer that is so strongly attached to a phase of the working surface having a Mohs hardness exceeding 2, or to organic material attached to this phase, that the particle or nanolayer remain attached thereto even after the multiple-phase working surface has been subjected to a cleaning process, as defined hereinabove.

As used herein in the specification and in the claims section that follows, the term "multiple-phase", with respect to a working surface, refers to a working surface having at least two distinct inorganic phases, wherein the harder phase of these at least two distinct inorganic phases has a Mohs hardness of at least 2.0, more typically, at least 2.5, yet more typically, at least 3.5, and most typically, at least 4.0. Examples of multiple-phase working surfaces include cast iron and Nikasil™.

As used herein in the specification and in the claims section that follows, the term "predominant phase" and the like, with respect to a working surface, refers to a phase that is present on the working surface in a higher proportion than any of the other phases, but does not necessarily represent a majority.

As used herein in the specification and in the claims section that follows, the term "single-phase", with respect to a working surface, refers to a working surface having substantially a single distinct metallic phase. Examples of a single-phase working surface include iron, steels, stainless steels, aluminum, and brass.

As used herein in the specification and in the claims section that follows, the term "metal", "metallic", and the like, is used to refer to materials classified as metals according to the classification of the periodic table, as well as to alloys containing such metals.

As used herein in the specification and in the claims section that follows, the term "coverage area", with respect to particles or at least one nanolayer disposed on, or incorporated in, a working surface, refers to the relative area, expressed as a percentage, defined by the area of the working surface on which these particles or one or more nanolayers are disposed, divided by the nominal surface area of the working surface. When the term "coverage area" is used with respect to a multiple-phase working surface, the coverage area refers to the relative area, expressed as a percentage, defined by the area of the working surface consisting of all phases having a Mohs hardness exceeding 2.0, and typically exceeding 2.5, on which these particles or one or more nanolayers are disposed, divided by the nominal surface area of the working surface.

As used herein in the specification and in the claims section that follows, the term "nanometric", with respect to an abrasive particle, refers to a particle having a diameter of up to 5,000 nanometers, typically 10-5,000 nanometers, more typically, 50-2,000 nanometers, and in some cases, up to 1,000 nanometers.

As used herein in the specification and in the claims section that follows, the term "nanometric", with respect to an organic particle, refers to a particle having a diameter of up to 5,000 nanometers, typically 1-5,000 nanometers, more typically, 50-2,000 nanometers, and in some cases, up to 1,000 nanometers. The term "organic particle" is also meant to include an abrasive particle that is covered by an organic layer (e.g., abrasive particle 430 covered by thin organic nanolayer 431 as shown schematically in FIG. 11B).

As used herein in the specification and in the claims section that follows, the term "nanometric", with respect to a layer, refers to a layer having a thickness of 1-30 nanometers, more typically, 1-20 nanometers, and most typically, 2-10 nanometers.

EXAMPLES

Reference is now made to the following examples, which together with the above description, illustrate the invention in a non-limiting fashion.

Example 1

Comparative Surface Analysis Using X-Ray Photoelectron Spectroscopy (XPS)

Surface Analyses of lapped samples were performed using XPS. The apparatus and analysis conditions were as follows:

| | |
|---|---|
| Instrument: | VG Scientific Sigma Probe |
| X-ray source: | Monochromatic Al Kα, 1486.6eV |
| X-ray beam size: | 400 μm |
| Charge neutralization: | 6eV electrons (used for the polymer sample) |
| Argon Ion Beam: | 4.0 keV |
| Sputtering Rate: | calibrated with a 20 nm thick $SiO_2$ standard |
| Software Analysis: | Sigma Probe Avantage |

For surface analysis, the samples were irradiated with monochromatic X-rays. Survey spectra were recorded with a pass energy of 100 eV, from which the surface chemical composition was determined. Depending on the element, the depth of analysis is up to ~10 nm, with ~63% of the information originating from the top layer having a thickness of 3 nm. The survey scans are presented as plots of the number of electrons measured as a function of the binding energy.

For identification of the chemical state, high-energy resolution measurements were performed with a pass energy of 20 eV. The core level binding energies of the different peaks were normalized by setting the binding energy for the C1s at 285.0 eV.

For lapped steel samples, a depth profile of relevant elements was acquired in the alternate sputtering mode using a beam of argon ions. Sputtering depths are reported as the silicon oxide equivalent.

Steel Samples Lapped by Cast Iron (Prior Art)

A first sample, lapped by cast iron according to conventional methodology, was evaluated on the day of preparation (after lapping with cast iron, according to conventional lapping methodology). A second sample was evaluated after 3 weeks of storage (after lapping) in a clean closed box.

Figure 18:
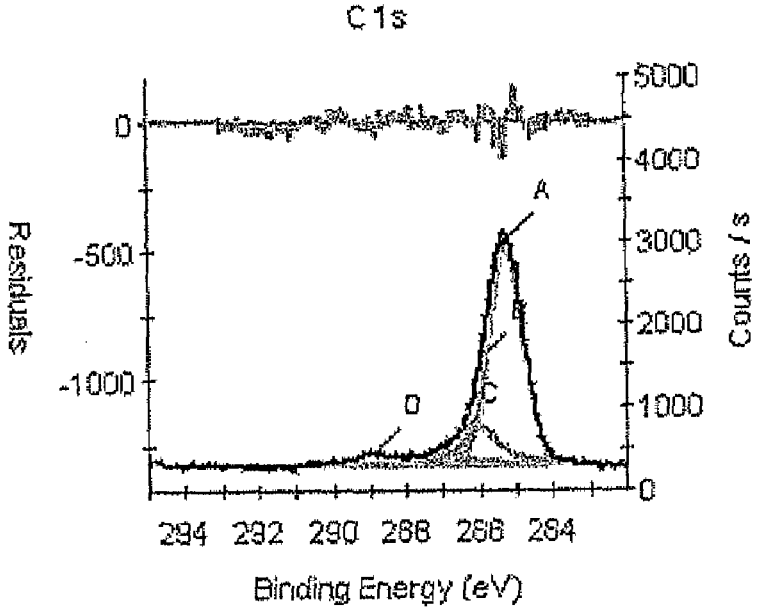
FIGS. 18 and 19 show typical high resolution spectra of C1s measured from the conventionally-lapped steel sample on the day of preparation and 3 weeks after preparation, respectively.
Figure 19:
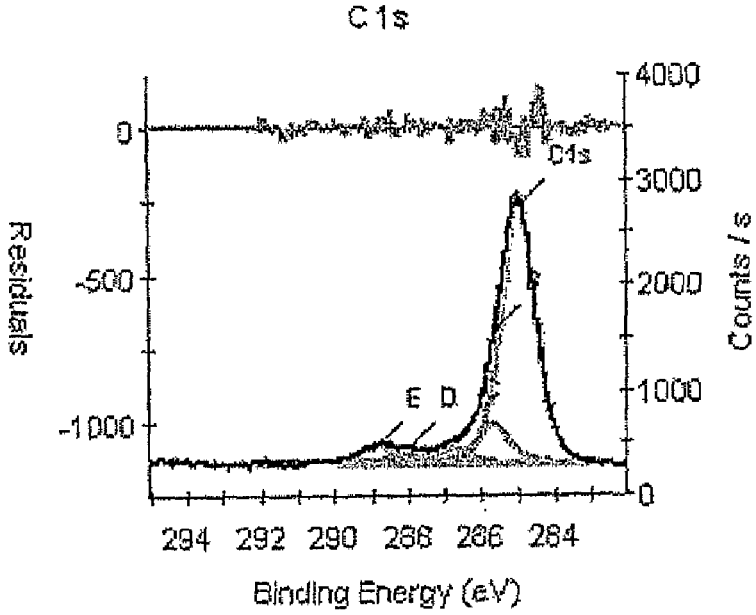

FIGS. 18 and 19 show typical high-resolution spectra of C1s measured from the conventionally-lapped steel sample on the day of preparation and 3 weeks after preparation, respectively.

For the sample measured on the day of preparation, a carbon concentration of 70% was found at the surface. Most of the carbon bonds were identified as C—H. After storage of the sample, no significant change in the concentration of carbon and in the distribution of carbon-oxygen bonds was observed.

Also, no significant reduction in the amount of oxidized Fe was observed between the stored sample and the initial sample. This indicates that no chemical reaction occurred between the steel substrate and the carbon-based material.

ration. The spectrum demonstrates the presence of C, O, Fe, Si and small amounts of Ni.

Figure 22A:
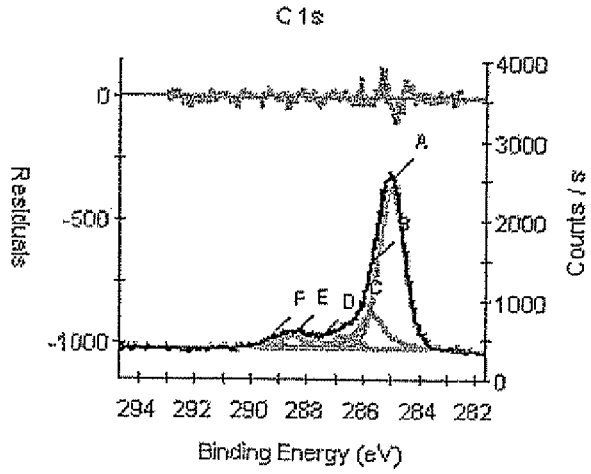
FIGS. 22*a*-22*c* show typical high-resolution spectra of C1s measured from samples measured on the day of preparation (Sample 1); after 1 day of aging (Sample 2); and after 2 weeks of aging (Sample 3), respectively.
Figure 22B:
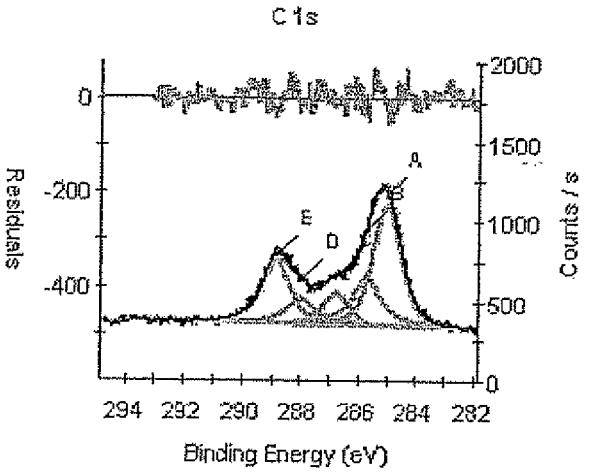
Figure 22C:
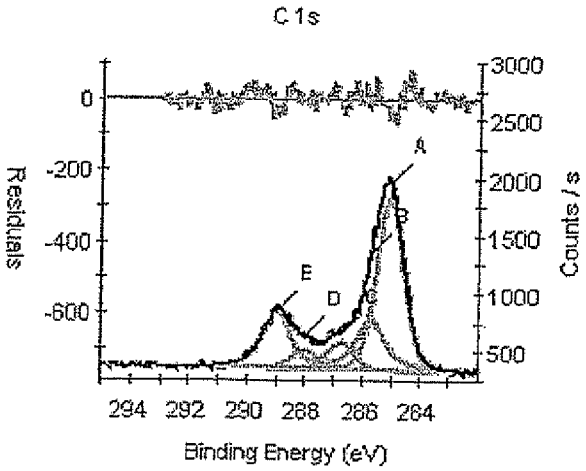

FIGS. 22*a*-22*c* show typical high-resolution spectra of C1s measured from Samples 1-3, respectively.

Figure 23A:
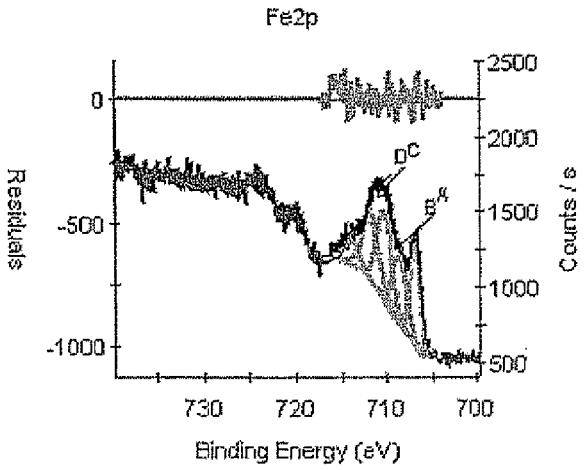
FIGS. 23*a*-23*c* show typical high-resolution spectra of Fe2p measured from Samples 1-3, respectively.
Figure 23B:
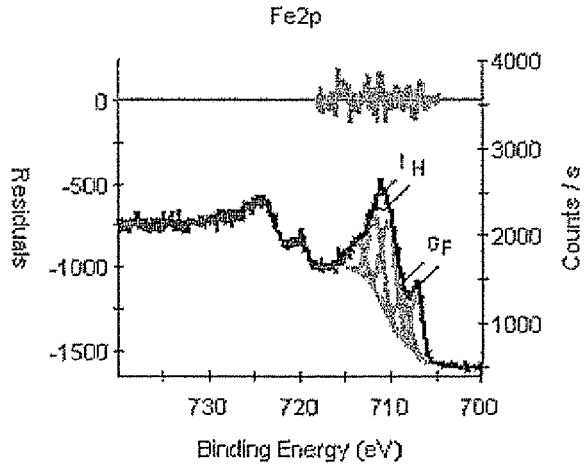
Figure 23C:
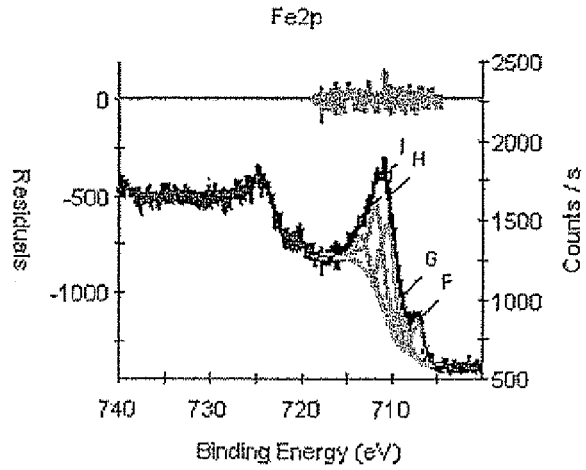

Similarly, FIGS. 23*a*-23*c* show typical high-resolution spectra of Fe2p measured from Samples 1-3, respectively.

The C1s spectrum of Sample 1, measured on the day of preparation, was curve-fitted with 6 components. In the case of Samples 2-3, the C1s spectrum was curve-fitted with 5 components. The binding energies (BE) and atomic concentrations (AC) of the various carbon species are quantified for Samples 1-3 in Table 4 hereinbelow.

TABLE 4

| | F | | E | | D | | C | | B | | A | |
|---|---|---|---|---|---|---|---|---|---|---|---|---|
| | AC (%) | BE (eV) | AC (%) | BE (eV) | AC (%) | BE (eV) | AC (%) | BE (eV) | AC (%) | BE (eV) | AC (%) | BE (eV) |
| SAMPLE 1 | 2.3 | 289.39 | 3.4 | 288.52 | 2.3 | 287.59 | 3.6 | 286.61 | 8.7 | 285.67 | 41.7 | 285.02 |
| SAMPLE 2 | — | — | 8.5 | 288.82 | 3.5 | 287.97 | 4.3 | 286.77 | 4.8 | 285.68 | 19.1 | 284.97 |
| SAMPLE 3 | — | — | 10.4 | 288.96 | 2.9 | 287.99 | 4.1 | 286.74 | 10.1 | 285.71 | 25.9 | 285.06 |

Sample of the Polymeric Contact Surface

Figure 20A:
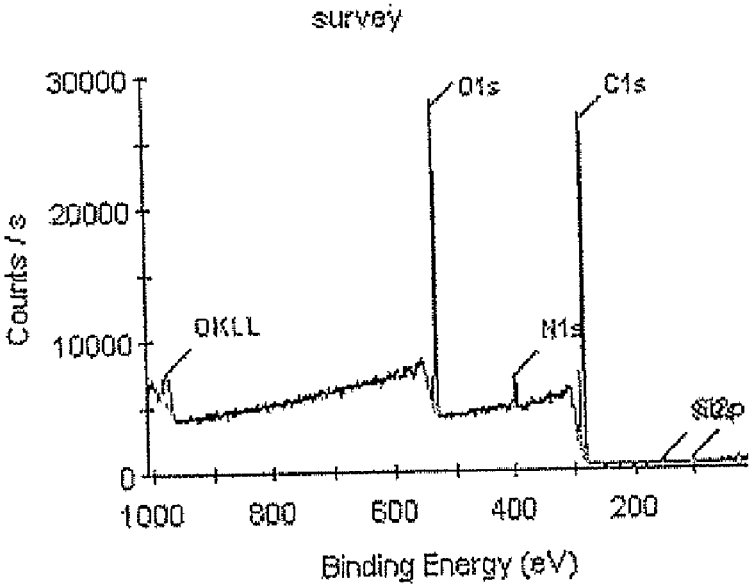
FIG. 20*a* presents a typical XPS survey spectrum measured from the fractured polymer surface.

A clean polymer sample surface was prepared by fracturing the polymer in air and immediately transferring the material into the UHV chamber of the XPS instrument. FIG. 20*a* presents a typical XPS survey spectrum measured from the fractured polymer surface. The spectrum demonstrates the presence of C, O, N and small amounts of Si.

Figure 20B:
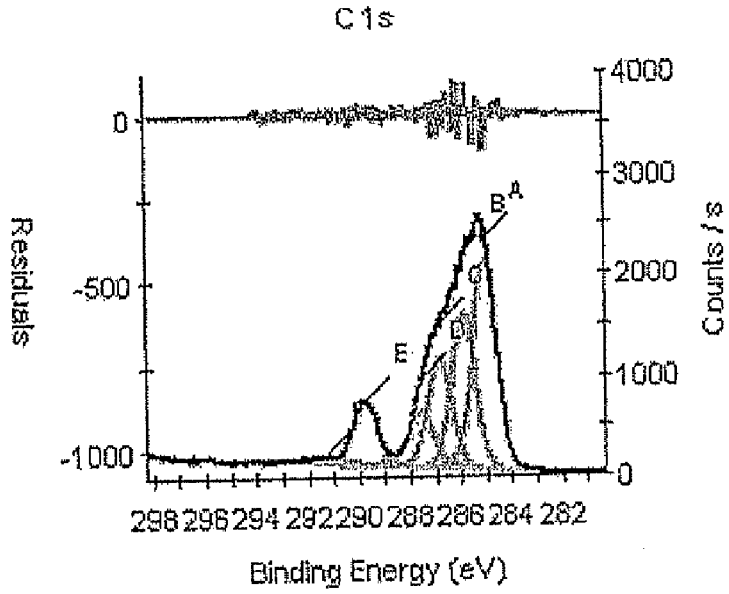
FIGS. 20*b*-20*d* show high-resolution spectra of C1s, O1s and N1s, respectively, measured from the fractured polymer surface of FIG. 20*a;*
Figure 20C:
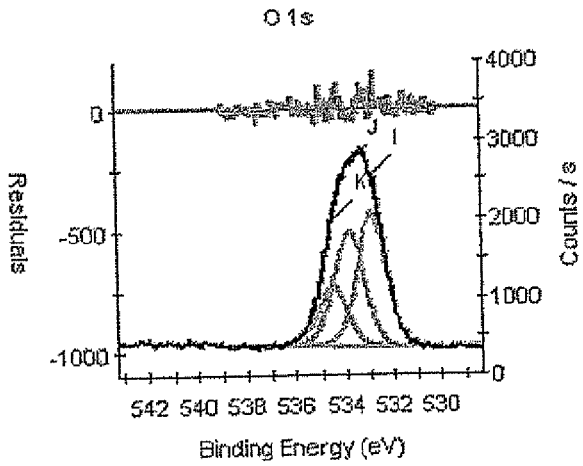
Figure 20D:
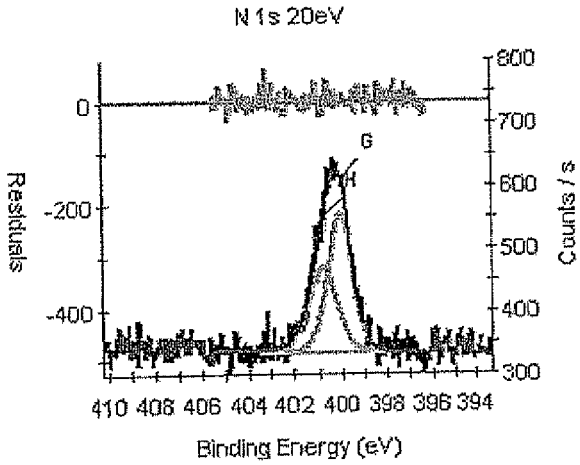

FIGS. 20*b*-20*d* show high-resolution spectra of C1s, O1s and N1s, respectively, measured from the same fractured polymer surface.

The C1s spectrum was curve-fitted with 6 components as summarized in Table 3.

TABLE 3

Binding energies (BE) and atomic concentrations (AC) of different C species measured for the polymer sample

| Functional groups | AC (%) | BE (eV) | Cls components |
|---|---|---|---|
| C—H | 25.7 | 284.99 | A |
| O—C═O | 20.3 | 285.66 | B |
| C, C—OH—O—C | 14.1 | 286.85 | C |
| C—O—C═O | 5.4 | 287.54 | D |
| O═C—O—C═O | 9.1 | 289.70 | E |
| aromatic | — | 291.86 | F |

While binding energy line or peak A (284.99 eV) can be related to carbon bounded to hydrogen (irrespective of hybridization), the higher binding energy lines B, C, D and E can be assigned to different types of carbon-oxygen bonds. The F component is a characteristic shake-up line for carbon in aromatic compounds. The O1s and N1s spectra were curve fitted with three and two components, respectively.

The XPS analysis of the bulk polymer sample identified the presence of ~3% of nitrogen and a number of different carbon—oxygen chemical bonds characteristic to the inventive polymeric lapping surface.

Steel Sample Lapped by a Lapping Tool Having the Polymer Surface

Samples 1-3 were measured on the day of preparation, after 1 day of aging, and after 2 weeks of aging. The aging process was performed in a clean, closed box.

Figure 21:
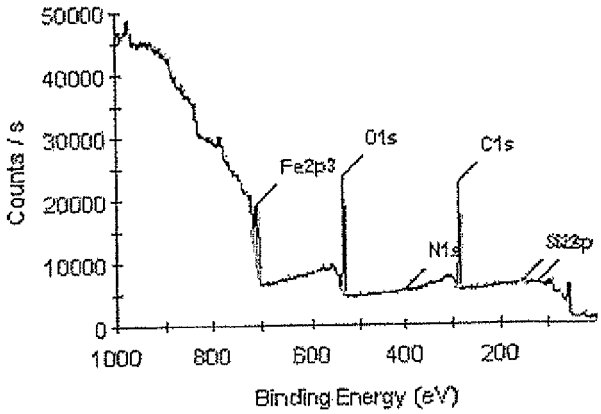
FIG. 21 presents a typical XPS survey spectrum measured from the (polymer) lapped steel sample on the day of preparation (Sample 1)

FIG. 21 presents a typical XPS survey spectrum measured from the (polymer) lapped steel sample on the day of prepa- Binding energy line A, at 285.00 eV, is associated with carbon bound to hydrogen (irrespective of hybridization). Higher binding energy lines B, C, D, F and F are assigned to different types of carbon—oxygen bonds.

The O1s and N1s spectra were curve-fitted with three and two components, respectively.

The Fe 2p3/2 line was curve-fitted with five components. While binding energy line A, at 706.81 eV, can be related to metallic Fe originating from steel substrate, the higher binding energy lines can be assigned to Fe in different oxidation states. The presence of a metallic Fe line is due to the fact that the steel surface oxide and the carbon-rich overlayer are thin enough to allow the photoelectrons from the metal to escape through the oxide layer.

Figure 24A:
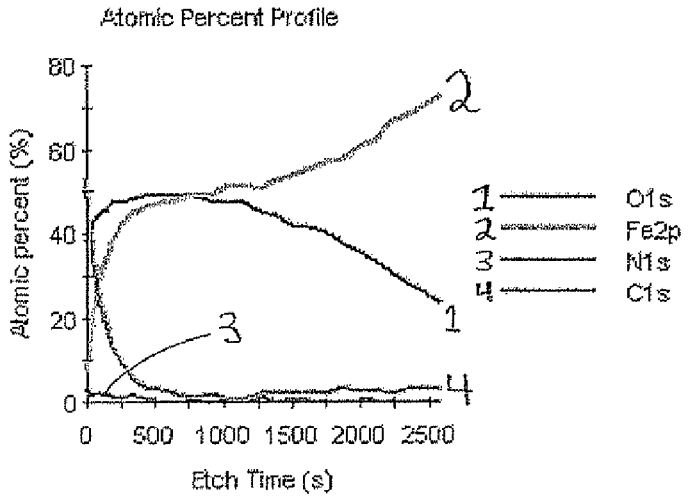
FIG. 24*a* is an XPS depth profile for an inventive (polymer) lapped steel sample, performed 10 weeks after preparation.
Figure 24B:
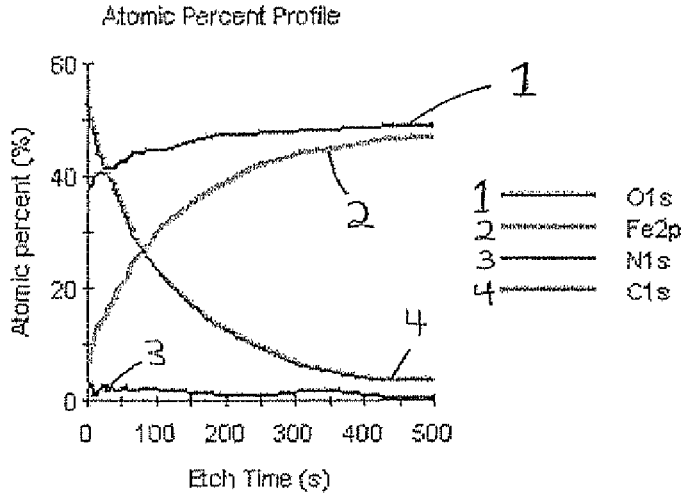
FIG. 24*b* is the same depth profile showing the first 500 seconds of the profiling.
Figure 25:
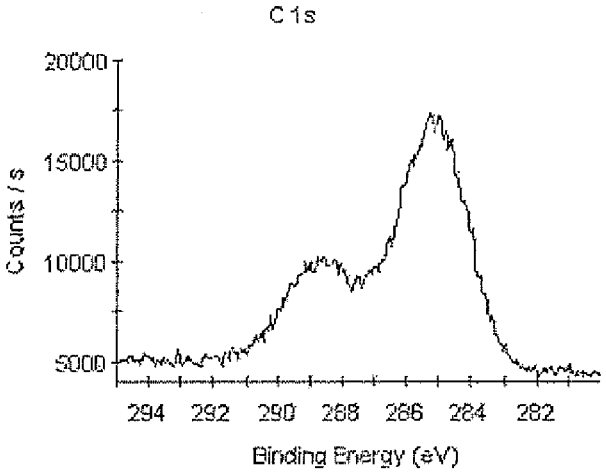
FIG. 25 is a plot showing the C1s line shape obtained during the depth profiling.

FIG. 24*a* is an XPS depth profile for an inventive (polymer) lapped steel sample, performed 10 weeks after preparation. The units of the profile are atomic concentration versus sputtering time. FIG. 24*b* is the same depth profile showing the first 500 seconds of the profiling. The XPS depth profile demonstrates the presence of a carbon-rich layer having a thickness of several nanometers, which covers, or at least partially covers, the oxidized steel surface. The C1s line shape (FIG. 25) obtained (with a pass energy of 100 eV) during the depth profiling is characterized by the presence of C—O bonds similar to some of those found for the polymeric contact surface.

Results and Conclusions of the Comparative Surface Analysis

- The steel sample lapped using the inventive polymeric lapping surface was analyzed on the day of preparation and after storage in a clean box for different periods of time: in all the samples, ~0.5% of nitrogen was found to be present at the sample surface.
- In the sample measured on the day of preparation, ~62% of carbon was found at the surface. Most of the carbon bonds were identified as C—H.
- After a day of storage in air, there was a decrease in the total amount of carbon identified on the sample surface. This phenomenon is accompanied by a decrease in the amount of the carbon-hydrogen bonds and a significant increase in the number of carbon-oxygen bonds characterized by a binding energy of ~288.8 eV.

After additional storage of the samples, no significant change in the distribution of carbon-oxygen bonds was identified.

Along with the change in the concentration of carbon and in the bonding states of carbon, a reduction in the amount of unoxidized iron was found, accompanied by an increase in the amount of oxidized iron. This signifies an increase in the thickness of the iron oxide layer attached to the metal underlayer.

There is evidence from the XPS analysis results that during the storage, a chemical reaction occurred between the inventive polymeric lapping surface and the steel substrate, leading to the formation of a thicker interfacial metal oxide.

For the sample stored for about 10 weeks, the thickness of the iron oxide was estimated to be approximately 6 nm, based on the XPS depth profiling results.

Based on the XPS analysis, an organic-based material having an average thickness of several nanometers was found to be present on the surface of the polymer-lapped steel working surface of the present invention.

The chemical composition of this organic material stabilizes after about one day (and sometimes several days or more) of storage in an oxygen-rich environment such as ambient air, and is characterized by the presence of a number of carbon-oxygen based fragments that are similar to, or substantially identical to, some of those found in the inventive polymeric lapping surface. Thus, aging the working surface prior to use advantageously changes the chemical and mechanical properties of the working surface.

Although the invention has been described in conjunction with specific embodiments thereof it is evident that many alternatives, modifications and variations will be apparent to those skilled in the art. All publications mentioned in this specification are herein incorporated in their entirety by reference into the specification, to the same extent as if each individual publication was specifically and individually indicated to be incorporated herein by reference.

What is claimed is:

1. A mechanical system for lapping a workpiece, the system comprising:

(a) a workpiece having a metal working surface with non-planar geometry;

(b) a lapping tool having a non-planar contact surface shaped to complement at least part of said non-planar geometry of said working surface when said contact surface is disposed generally opposite the working surface, said contact surface including an organic, polymeric material;

(c) a plurality of particles, including abrasive particles, said abrasive particles disposed in a paste between said contact surface and said working surface, and (d) a drive, associated with at least one of the working surface and said contact surface, adapted to generate relative motion between said contact surface and said metal working surface, and to exert a load on said contact surface and said working surface, said contact surface for providing an at least partially elastic interaction with said plurality of abrasive particles, and wherein said contact surface and said drive are adapted, and said plurality of particles is selected, such that upon activation of said drive, said relative motion under said load effects:

(i) lapping of said metal working surface, and (ii) incorporation of particles into said metal working surface.

2. The mechanical system of claim 1, wherein a pH of said paste is between 4 and 10.

3. The mechanical system of claim 1, wherein a pH of said paste is between 6 and 8.

4. The mechanical system of claim 1, wherein an average roughness (Ra) of the metal working surface produced from said lapping and said incorporation is at least 0.015 microns.

5. The mechanical system of claim 1, wherein said workpiece has a substantially cylindrical form, and wherein the working surface is disposed along an outside diameter of said substantially cylindrical form.

6. The mechanical system of claim 5, wherein said contact surface of said lapping tool has a concavity that at least partially conforms to said substantially cylindrical form.

7. The mechanical system of claim 5, wherein said workpiece includes a tribological element selected from the group of tribological elements consisting of piston pins, poppet valves, hydraulic pistons, sliding bearings, and rollers of roller bearings.

8. The mechanical system of claim 1, said system further comprising:

(e) a tubing system including a tube deployed at least partially within said lapping tool and adapted to deliver said paste to a lapping tool working space disposed between said contact surface of said lapping tool and said metal working surface.

9. The mechanical system of claim 5, wherein said contact surface envelops more than half of a circumference of said substantially cylindrical form.

10. The mechanical system of claim 9, wherein said lapping tool has at least one slot running in a generally longitudinal fashion, said at least one slot adapted to impart flexibility to said lapping tool.

11. The mechanical system of claim 10, wherein at least a portion of said drive has a substantially cylindrical form, said drive further adapted to envelop said lapping tool and to exert said load on the metal working surface, via a wall of said lapping tool.

12. The mechanical system of claim 11, wherein said workpiece includes a tribological element selected from the group of tribological elements consisting of piston pins, poppet valves, hydraulic pistons, sliding bearings, and rollers of roller bearings.

13. The mechanical system of claim 1, wherein said metal working surface bounds a substantially cylindrical hollow volume within said workpiece.

14. The mechanical system of claim 13, wherein said lapping tool has at least one slot running in a generally longitudinal fashion, said at least one slot adapted to impart flexibility to said lapping tool.

15. The mechanical system of claim 13, wherein at least a portion of said drive has a substantially cylindrical form, said drive further adapted to envelop an outer surface of said workpiece and to exert said load on the metal working surface and said contact surface, via said outer surface of said workpiece.

16. The mechanical system of claim 13, further comprising:

(e) a wedge element, disposed within said lapping tool, said wedge element adapted to exert a load on the metal working surface, via an inside wall of said lapping tool.

17. The mechanical system of claim 13, wherein said workpiece includes a tribological element selected from the group of tribological elements consisting of a rocker roller and an outer ring of a sliding bearing.

18. The mechanical system of claim 13, wherein said lapping tool is a spider tool having a shaft and at least two outwardly-disposed pads, each having said contact surface, and wherein said drive is adapted to act upon said shaft to achieve said relative motion between said contact surface and the metal working surface.

19. The mechanical system of claim 18, wherein said pads are adapted to at least partially retract towards said shaft.

20. The mechanical system, of claim 18, wherein said workpiece includes a tribological element selected from the group of tribological elements consisting of a cylinder, a cylinder sleeve, and an outer ring of a sliding bearing.

21. The mechanical system of claim 1, wherein said workpiece has a substantially conical section, and wherein at least a portion of the working surface is disposed along an outside diameter of said conical section.

22. The mechanical system of claim 21, wherein said drive and said workpiece are adapted wherein said conical section rotates about a longitudinal axis thereof.

23. The mechanical system of claim 1, wherein said metal working surface has a concavity.

24. The mechanical system of claim 1, wherein at least a portion of a body of said lapping tool defining said shape of said non-planar contact surface is formed from said organic polymeric material.

25. The mechanical system of claim 1, wherein said organic polymeric material is a primary structural component of at least a portion of a body of said lapping tool adjacent to said non-planar contact surface.

* * * * *